US008726594B2

(12) United States Patent
Salazar et al.

(10) Patent No.: US 8,726,594 B2
(45) Date of Patent: May 20, 2014

(54) COMPOSITE PRE-FORMED BUILDING PANELS

(75) Inventors: Lorenzo L. Salazar, Gibsonia, PA (US); Jay J. Bowman, Florence, KY (US); Gregory S. Ralph, Wexford, PA (US)

(73) Assignee: Syntheon Inc., Moon Township, PA (US)

( * ) Notice: Subject to any disclaimer, the term of this patent is extended or adjusted under 35 U.S.C. 154(b) by 1941 days.

(21) Appl. No.: 11/361,715

(22) Filed: Feb. 24, 2006

(65) Prior Publication Data

US 2006/0191232 A1 Aug. 31, 2006

Related U.S. Application Data

(60) Provisional application No. 60/656,596, filed on Feb. 25, 2005, provisional application No. 60/664,120, filed on Mar. 22, 2005.

(51) Int. Cl.
*E04C 1/00* (2006.01)

(52) U.S. Cl.
USPC ..... 52/309.16; 52/309.1; 52/309.2; 52/309.3; 52/309.4; 52/309.7; 52/309.13

(58) Field of Classification Search
USPC ..... 52/309.1–309.4, 309.7, 309.16, 309.13
See application file for complete search history.

(56) References Cited

U.S. PATENT DOCUMENTS

| | | | | |
|---|---|---|---|---|
| 2,983,692 | A | 5/1961 | D'Alelio | |
| 3,021,291 | A | 2/1962 | Thiessen | |
| 3,023,175 | A | 2/1962 | Rodman, Jr. | |
| 3,214,393 | A | 10/1965 | Sefton | |
| 3,257,338 | A | 6/1966 | Sefton | |
| 3,272,765 | A | 9/1966 | Sefton | |
| 3,611,653 | A | 10/1971 | Zinn | |
| 3,972,167 | A | 8/1976 | Vogeli | |
| 4,001,993 | A * | 1/1977 | Daniels | 52/376 |

(Continued)

FOREIGN PATENT DOCUMENTS

| | | |
|---|---|---|
| DE | 203 16 376 U1 | 2/2004 |
| EP | 0 459 924 A1 | 12/1991 |

(Continued)

OTHER PUBLICATIONS

Dietrich Metal Framing, "The Metal Framing & Finishing Catalog", pp. 22, 23, 36 and 86, Sep. 2005.

(Continued)

*Primary Examiner* — Brian Glessner
*Assistant Examiner* — Omar Hijaz
(74) *Attorney, Agent, or Firm* — The Webb Law Firm

(57) ABSTRACT

A composite building panel including a central body, substantially parallelepipedic in shape, comprised of an expanded polymer matrix, having opposite faces, a first surface and an opposing second surface; and one or more reinforcing members longitudinally extending across the central body between said opposite faces, having a first side portion embedded in the expanded polymer matrix, and a second side portion extending away from the first surface of the central body and one or more expansion holes located in the reinforcing member between the first side portion of the reinforcing member and the first surface of the central body. The central body includes a polymer matrix that expands through the expansion holes; and a space defined by the first surface of the central body and the second side portion of the reinforcing members is adapted for accommodating utilities through the space.

25 Claims, 70 Drawing Sheets

(56) References Cited

U.S. PATENT DOCUMENTS 4,018,020 A 4/1977 Sauer et al.
4,094,110 A 6/1978 Dickens et al.
4,152,878 A * 5/1979 Balinski ..... 52/481.1
4,157,640 A 6/1979 Joannes
4,241,555 A 12/1980 Dickens et al.
4,250,674 A 2/1981 Feist
4,267,135 A 5/1981 Stroud et al.
4,268,236 A 5/1981 Peille
4,282,447 A 8/1981 Summers et al.
4,303,756 A 12/1981 Kajimura et al.
4,303,757 A 12/1981 Kajimura et al.
4,332,754 A 6/1982 Meunier et al.
4,348,164 A 9/1982 Fujii et al.
4,354,810 A 10/1982 Stidham
4,376,741 A 3/1983 Stenzel
4,379,107 A 4/1983 Berner
4,382,759 A 5/1983 Vassalli
4,399,086 A 8/1983 Walter
4,412,961 A 11/1983 DiBiasi et al.
4,435,345 A 3/1984 Colombo
4,447,382 A 5/1984 Spurlock et al.
4,485,059 A 11/1984 Krutchen et al.
4,486,369 A 12/1984 Schafler et al.
4,487,731 A 12/1984 Kobayashi
4,489,023 A 12/1984 Proksa
4,492,664 A 1/1985 Bruno
4,498,660 A 2/1985 Brema et al.
4,504,429 A 3/1985 Griffiths
4,507,255 A 3/1985 Shizawa
4,518,550 A 5/1985 Miettinen et al.
4,530,806 A 7/1985 Melchior
4,551,958 A 11/1985 Reneault et al.
4,559,003 A 12/1985 Poncet
4,564,487 A 1/1986 Bennett
4,567,008 A 1/1986 Griffiths
4,572,865 A 2/1986 Gluck et al.
4,581,186 A 4/1986 Larson
4,585,603 A 4/1986 Furuta et al.
4,607,061 A 8/1986 Schmidt
4,641,468 A 2/1987 Slater
4,653,718 A 3/1987 Dickens
4,666,393 A 5/1987 Kumasaka et al.
4,685,872 A 8/1987 Erlenbach
4,756,860 A 7/1988 Hooper et al.
4,761,256 A 8/1988 Hardenbrook et al.
4,783,287 A 11/1988 Eichberger et al.
4,813,193 A * 3/1989 Altizer ..... 52/210
4,832,885 A 5/1989 Gross
4,862,660 A 9/1989 Raymond
4,911,628 A 3/1990 Heilmayr et al.
4,953,334 A 9/1990 Dickens
4,956,133 A 9/1990 Payne
4,981,003 A 1/1991 McCarthy
4,981,427 A 1/1991 Prignitz
5,067,298 A 11/1991 Petersen
D323,222 S 1/1992 Roland
5,087,185 A 2/1992 Yada et al.
5,127,760 A 7/1992 Brady
5,187,905 A 2/1993 Pourtau et al.
5,229,138 A 7/1993 Carotti
5,245,809 A 9/1993 Harrington
5,265,389 A 11/1993 Mazzone et al.
5,279,089 A 1/1994 Gulur
5,333,429 A 8/1994 Cretti
5,375,988 A 12/1994 Klahre
5,388,975 A 2/1995 Proksa et al.
5,411,389 A 5/1995 Kellerhof et al.
5,414,972 A 5/1995 Ruiz et al.
D360,700 S 7/1995 Myers et al.
5,474,722 A 12/1995 Woodhams
5,505,599 A 4/1996 Kemerer et al.
5,512,222 A 4/1996 Sabol et al.
5,524,400 A 6/1996 Schmechel
D373,836 S 9/1996 Bado et al.
5,580,378 A 12/1996 Shulman
5,582,840 A 12/1996 Pauw et al.
5,587,182 A 12/1996 Sulzbach et al.
5,620,710 A 4/1997 Fiorentini et al.
5,622,556 A 4/1997 Shulman
5,629,027 A 5/1997 Fiorentini et al.
5,639,483 A 6/1997 Fiorentini et al.
5,665,286 A 9/1997 Sulzbach et al.
5,665,287 A 9/1997 Fiorentini et al.
5,689,990 A 11/1997 Deeley
5,722,198 A 3/1998 Bader
5,725,652 A 3/1998 Shulman
5,749,960 A 5/1998 Belyayev
5,784,850 A 7/1998 Elderson
5,787,665 A 8/1998 Carlin et al.
5,792,481 A 8/1998 Cretti
5,798,064 A 8/1998 Peterson
D399,010 S 9/1998 Current
5,804,113 A 9/1998 Blackwell et al.
5,809,725 A 9/1998 Cretti
5,822,940 A 10/1998 Carlin et al.
D401,361 S 11/1998 Mitchell
5,842,276 A 12/1998 Asher et al.
5,842,314 A 12/1998 Porter
5,844,015 A 12/1998 Steilen et al.
D406,360 S 3/1999 Finkell, Jr.
D411,628 S 6/1999 Dyer
5,943,775 A 8/1999 Lanahan et al.
5,945,048 A 8/1999 Ensinger
D414,275 S 9/1999 Azar
5,966,885 A 10/1999 Chatelain
D418,926 S 1/2000 Owens et al.
D419,697 S 1/2000 Kroesbergen
6,021,618 A 2/2000 Elderson
D422,094 S 3/2000 Wolfrum
6,036,898 A 3/2000 Sulzbach et al.
RE36,674 E 4/2000 Gluck et al.
6,044,603 A 4/2000 Bader
6,045,350 A 4/2000 Cretti
6,098,367 A * 8/2000 Fridman et al. ..... 52/656.1
6,119,418 A 9/2000 Johnson
6,127,439 A 10/2000 Berghmans et al.
6,147,133 A 11/2000 Sulzbach et al.
6,160,027 A 12/2000 Crevecoeur et al.
RE37,012 E 1/2001 Fiorentini et al.
6,167,624 B1 * 1/2001 Lanahan et al. ..... 29/897.32
RE37,075 E 2/2001 Fiorentini et al.
D437,644 S 2/2001 Russo
6,183,879 B1 2/2001 Deeley
RE37,115 E 3/2001 Fiorentini et al.
6,202,375 B1 3/2001 Kleinschmidt
6,206,669 B1 3/2001 Lewit et al.
D440,327 S 4/2001 Keating et al.
6,226,943 B1 5/2001 Grinshpun et al.
6,233,892 B1 * 5/2001 Tylman ..... 52/309.12
6,235,367 B1 5/2001 Holmes et al.
6,242,540 B1 6/2001 Crevecoeur et al.
6,264,734 B1 7/2001 Dickens
6,272,749 B1 8/2001 Boeshart et al.
6,276,104 B1 * 8/2001 Long et al. ..... 52/309.4
D449,392 S 10/2001 Kulik
6,298,622 B1 10/2001 Cretti
6,301,854 B1 10/2001 Daudet et al.
6,322,651 B1 11/2001 Phelps
6,350,308 B1 2/2002 Dickens
D455,843 S 4/2002 Albany et al.
6,385,942 B1 5/2002 Grossman et al.
6,412,243 B1 7/2002 Sutelan
6,418,687 B1 7/2002 Cox
6,444,073 B1 9/2002 Reeves et al.
6,494,012 B2 12/2002 Seng
D469,885 S 2/2003 Zen
D470,602 S 2/2003 Pate
6,531,077 B1 3/2003 Flarup-Knudsen
6,537,054 B2 3/2003 Kitahama et al.
6,655,944 B2 12/2003 Massarotto et al.
6,662,503 B2 12/2003 Cowell et al.
D487,317 S 3/2004 Guertin
6,701,684 B2 3/2004 Stadter
6,708,460 B1 3/2004 Elderson

(56) References Cited

U.S. PATENT DOCUMENTS

| | | | | |
|---|---|---|---|---|
| D493,545 | S | 7/2004 | Lancia et al. | |
| D494,284 | S | 8/2004 | Wenrick et al. | |
| 6,796,093 | B2 * | 9/2004 | Brandes | 52/309.8 |
| 6,833,095 | B2 | 12/2004 | Sulzbach et al. | |
| 6,851,235 | B2 | 2/2005 | Baldwin | |
| 6,854,230 | B2 | 2/2005 | Starke | |
| 2001/0009683 | A1 | 7/2001 | Kitahama et al. | |
| 2002/0026760 | A1 | 3/2002 | Moore, Jr. | |
| 2002/0117769 | A1 | 8/2002 | Arch et al. | |
| 2002/0139066 | A1 | 10/2002 | Szymanski et al. | |
| 2002/0184846 | A1 | 12/2002 | Crowder | |
| 2003/0079438 | A1 | 5/2003 | Stephens et al. | |
| 2003/0085483 | A1 | 5/2003 | Kroeger | |
| 2003/0172607 | A1 | 9/2003 | Brandes | |
| 2004/0017652 | A1 | 1/2004 | Billington et al. | |
| 2004/0065034 | A1 | 4/2004 | Messenger et al. | |
| 2004/0065973 | A1 | 4/2004 | Ehbing et al. | |
| 2004/0096642 | A1 | 5/2004 | Maruyama et al. | |
| 2004/0152795 | A1 | 8/2004 | Arch et al. | |
| 2004/0202742 | A1 | 10/2004 | Winter | |
| 2005/0034401 | A1 | 2/2005 | Sutelan et al. | |
| 2005/0086906 | A1 | 4/2005 | Bathon et al. | |
| 2006/0201090 | A1 * | 9/2006 | Guevara et al. | 52/309.12 |

FOREIGN PATENT DOCUMENTS

| | | | |
|---|---|---|---|
| EP | 0 464 008 | B1 | 2/1995 |
| EP | 0 693 597 | B1 | 1/1996 |
| GB | A-2 365 456 | | 2/2002 |
| JP | 9071449 | | 3/1997 |
| WO | 9802397 | A1 | 1/1998 |
| WO | 0061519 | A1 | 10/2000 |
| WO | 0166485 | A2 | 9/2001 |
| WO | WO 02/20916 | A1 | 3/2002 |
| WO | WO 02/35020 | A2 | 5/2002 |
| WO | WO 2004/009929 | A1 | 1/2004 |
| WO | WO 2004/101905 | A | 11/2004 |
| WO | WO 2004/101905 | A1 | 11/2004 |
| WO | WO 2006/040623 | A | 4/2006 |
| WO | WO 2006/040624 | A | 4/2006 |

OTHER PUBLICATIONS

ThermaSteel Corporation, "Standard Panel Catalog", Rev. 13, Sep. 13, 2000.

ELFI Wall System, http://elfiwallsystem.com/index.htm, 2003.

Stoam Industries, Product Brochure, at least earlier than Feb. 24, 2006.

Elhajj, Nader R., "Development of Cost-Effective, Energy-Efficient Steel Framing", AISI/DOE Technology Roadmap Program, Jan. 6, 2003.

Boral, "EurekaWALL", Product Brochure, Sep. 2002 (2 sheets).

Plastbau Technology—Insul-Deck, "Lightweight Forming System for Concrete Floors and Roofs", Product Brochure, Cat. No. 5M02, 2002.

Sicilferro, "Tecnova—Tecnologie Costruttive", Product Catalog, at least earlier than Feb. 24, 2006.

* cited by examiner

COMPOSITE PRE-FORMED BUILDING PANELS

CROSS REFERENCE TO RELATED APPLICATIONS

This application claims the benefit of priority of U.S. Provisional Application Ser. Nos. 60/656,596 filed Feb. 25, 2005 and 60/664,120 filed Mar. 22, 2005, both entitled "Composite Pre-Formed Building Panels," which are both herein incorporated by reference in their entirety.

BACKGROUND OF THE INVENTION

1. Field of the Invention

The present invention is directed to pre-formed building panels that include one or more reinforcing structural elements embedded in a foamed thermoplastic matrix.

2. Description of Related Art

It is known to use construction elements made of expanded plastics, for example expanded polystyrene, in forms of boards or section members of suitable shape and size. These members provide thermal and sound insulation functions and have long been accepted by the building industry.

It is also known that, in order to confer adequate self-supporting properties to such construction elements, one or more reinforcing section bars of a suitable shape must be incorporated into the mass of expanded plastics.

U.S. Pat. Nos. 5,787,665 and 5,822,940 disclose molded composite wall panels for building construction that include a regular tetragonal body of polymer foam and at least one light metal gauge hollow stud in the body. The edges of the studs are even with a surface of the polymer foam so drywall can be attached thereto.

U.S. Pat. No. 6,098,367 discloses a constructive system applied to buildings to form walls by means of modular foldable frames that allow for the placement of blocks or plates. The frames with the resistant channels, rods, blocks or plates, better resist strong winds and seismic movements.

U.S. Pat. No. 6,167,624 discloses a method for producing a polymeric foamed material panel including the steps of providing a polymeric foamed material, cutting the polymeric foamed material until reaching a preconfiguration cut point, cutting subsequently from the preconfiguration cut point a brace-receiving configuration in the polymeric foamed material, and sliding a brace member into the brace-receiving configuration to produce a polymeric foamed material panel.

U.S. Pat. No. 6,235,367 discloses a molded construction product, having one or more walls and an inner core section, including a composition matrix having a resin system, a catalytic agent, and filler compounds for forming the walls; a foam core system for forming the inner core section, a curing agent and a drying agent. A structural reinforcement support system is provided for reinforcing the structural integrity of the composition. A locking system is provided for joining one or more of the molded products.

EP 0 459 924 discloses a self-supporting construction element made of expanded plastics material, specifically a floor element, which includes a substantially parallelepipedic central body in which a reinforcing section bar, made of a thin metal sheet shaped as an I-beam, is integrated during the molding step.

U.S. Pat. No. 5,333,429 discloses a composite panel with a structural load-bearing wooden framework formed by a substantially parallelepiped body of expanded synthetic material. The panels have a plurality of longitudinal channels extending for the whole height of the panel. A series of channels uniformly spaced and staggered are open on the adjacent face of the panel and have a T-shaped cross section. In these open channels fit T-shaped cross section wooden posts, the stem portion of which emerges out of the open channels and project from the surface of the panel.

WO 2002/035020 discloses a composite construction element that includes a body made of expanded plastics material and a slab-shaped coating element associated to the body. The slab-shaped coating element includes a plurality of substantially adjoining and substantially U-shaped adjacent sections provided with respective means for mechanically clinching the slab-shaped element to the expanded plastics material.

While the construction elements described above have on the one hand light weight, comparative ease of installation and low cost, on the other hand their application in the art and flexibility of use have been restrained heretofore by their poor fire-resisting properties and/or the propensity for mold to grow on finished surfaces attached thereto.

This inadequate resistance to fire is essentially related to the fact that construction elements made of expanded plastics show an insufficient capability to securely hold outer covering layers, such as the plaster layers used for the outer surface finish or contain the expanded polymer body, in flammable molten or liquid form, that occurs from the heat generated from a fire.

When exposed to fire, in fact, the expanded plastic materials soon shrink into a shapeless mass of reduced volume, which can flow and burn, and in some cases with the ensuing separation of the outer covering layers and rapid collapse of the whole structure.

In addition, an undesirable separation of the outer covering layers may be caused in some instances by a premature "aging" of the plastics surface to which these coverings adhere, a separation which may be further fostered by exposure to heat sources, dusts, fumes, vapors, or chemical substances coming from a source close to the construction elements.

U.S. Pat. No. 6,298,622 and WO 2004/101905 disclose an approach to overcoming the above-described problem by using a self-supporting construction element of expanded plastics for use as floor elements and walls of buildings. The construction elements include a central body, substantially parallelepipedic in shape and having two opposite faces; at least one reinforcing section bar transversally extending across the central body between the faces thereof and embedded in the expanded plastics; a lath for supporting at least one layer of a suitable covering material, associated to a fin of the reinforcing section bar lying flush with and substantially parallel to at least one of the faces of the construction element. However, moisture buildup between the lath and construction element can lead to mold and mildew growth and the ability to easily run electrical lines without cutting into the construction elements have limited the desirability of this approach.

Thus there is a need in the art for composite pre-formed building panels that overcome the above-described problems.

SUMMARY OF THE INVENTION

The present invention provides a composite building panel comprising:

- a central body, substantially parallelepipedic in shape, comprising an expanded polymer matrix, having opposite faces, a first surface and an opposing second surface; and
- one or more reinforcing members longitudinally extending across the central body between said opposite faces, having a first side portion embedded in the expanded polymer matrix, and a second side portion extending away from the first surface of the central body and one or more expansion holes located in the reinforcing member between the first side portion of the reinforcing member and the first surface of the central body;

wherein the central body includes a polymer matrix that expands through the expansion holes; and a space defined by the first surface of the central body and the second side portion of the reinforcing members may accommodate utilities therethrough.

Another feature of various embodiments of the present invention further provides a framing stud comprising:

a body having a length, a width and a thickness, the body comprising:

a first side portion; and an opposed second side portion, the first side portion and second side portion being positioned along a longitudinal axis of the width of the body, wherein the first side portion comprises a plurality of holes spaced along the length of the body and the second side portion comprises at least one utility hole along the length of the body.

Various embodiments of the present invention also provide wall units, floor units, ceiling units, and roofing units comprising one or more of the various reinforcing members described herein (and their equivalents) and/or various composite building panels as described herein (and their equivalents) in combination form.

Still other embodiments of the present invention also provide a method of constructing a building that comprises:

providing a foundation;

positioning and securing the above-described composite building panels, adapted for use as a floor unit, to the foundation;

positioning and securing two or more of the above described composite building panels, adapted for use as a wall unit, to at least a part of a top surface of the floor unit; and positioning and securing the above-described composite building panels, adapted for use as a roof and/or ceiling unit, to the wall units.

Various embodiments of the present invention also provide a building constructed according to the various method and/or buildings as described herein (and their equivalents) that include one or more of the composite building panels described herein (and their equivalents).

Various embodiments of the present invention also further provide methods of doing business between a composite building panel manufacturer and a customer for creating custom composite building panels for use in building or renovating buildings. One method arrangement includes the steps of: providing an automated building panel design program to the customer; creating a custom composite building panel utilizing the automated building panel design program, where the customer performs a design procedure to create the custom composite building panel, the design procedure including the steps of: selecting an architectural design for a building; specifying at least one custom composite building panel design; and saving the custom composite building panel design to a custom design file; and the manufacturer making the custom composite building panel corresponding to the custom composite building panel design.

BRIEF DESCRIPTION OF THE DRAWINGS

FIG. 118 is a cross-sectional view of a concrete composite pre-formed tilt-up insulated panel according to various embodiments of the present invention;

FIG. 119 is a cross-sectional view of a reinforced body for use in making the concrete composite pre-formed tilt-up insulated panel in FIG. 118;

FIG. 120 is a perspective view of an embedded metal member for use in making the reinforced body in FIG. 119 and the concrete composite pre-formed tilt-up insulated panels in FIGS. 118 and 121;

FIG. 121 is a cross-sectional view of a concrete composite pre-formed tilt-up insulated panel according to various embodiments of the present invention;

FIG. 122 is a cross-sectional view of a concrete composite pre-formed tilt-up insulated panel according to various embodiments of the present invention;

FIG. 123 is a cross-sectional view of a reinforced body for use in making the concrete composite pre-formed tilt-up insulated panel in FIG. 122;

FIG. 124 is a perspective view of an embedded metal member for use in making the reinforced body in FIG. 123 and the concrete composite pre-formed tilt-up insulated panels in FIGS. 122 and 125;

FIG. 125 is a cross-sectional view of a concrete composite pre-formed tilt-up insulated panel according to various embodiments of the present invention;

FIG. 126A is a perspective view of a floor system according to various embodiments of the present invention;

FIG. 126B is a perspective view of a floor system according to various embodiments of the present invention;

FIG. 127 is a cross-sectional view of metal members that can be used in the pre-formed building panels according to various embodiments of the present invention;

FIG. 128 is a cross-sectional view of metal members that can be used in the pre-formed building panels according to various embodiments of the present invention;

Figure 129:
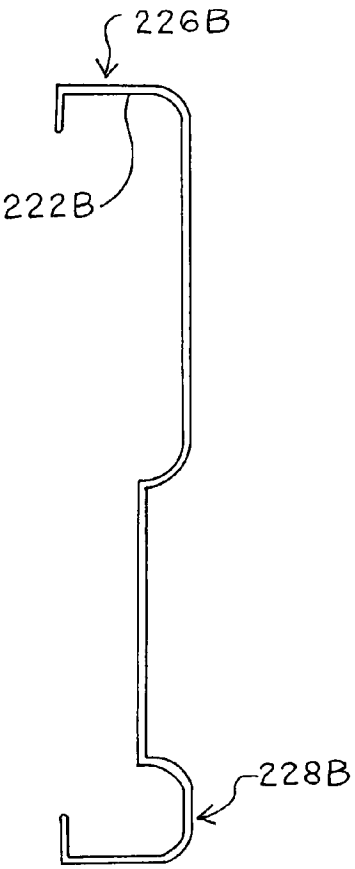
Figure 130:
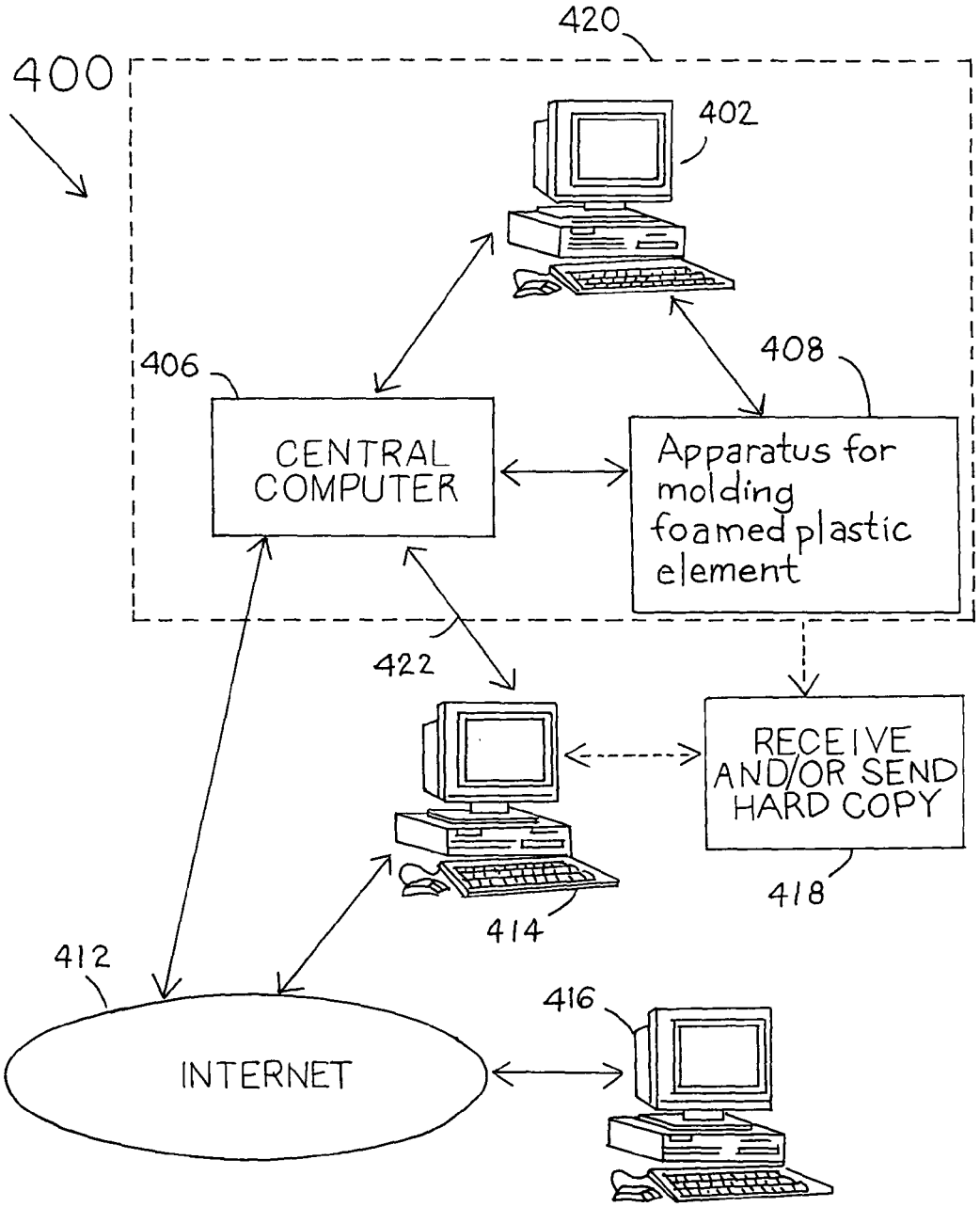
Figure 131:
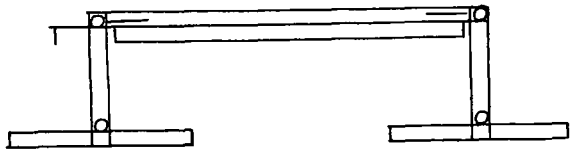
Figure 132:
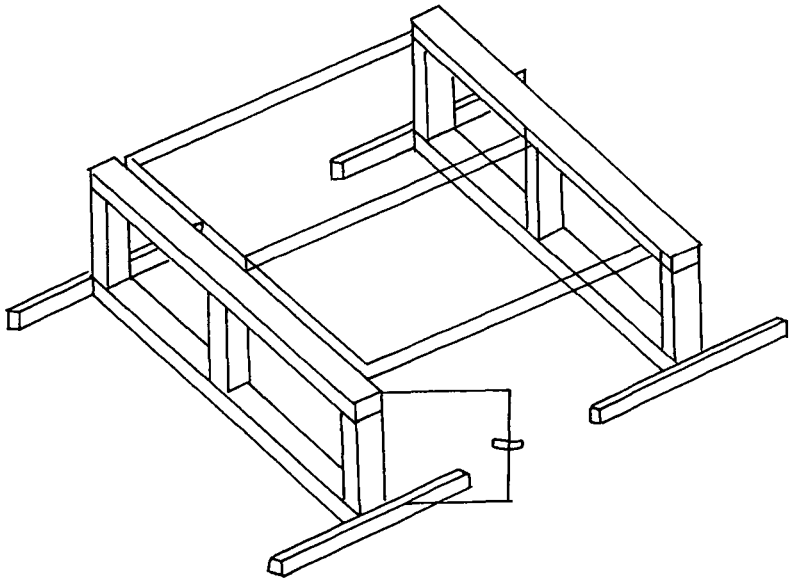
Figure 133:
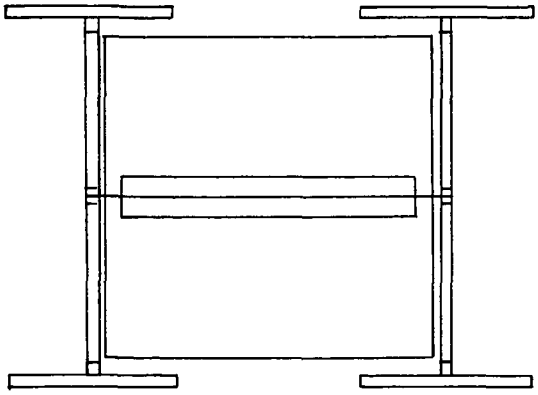
Figure 134:
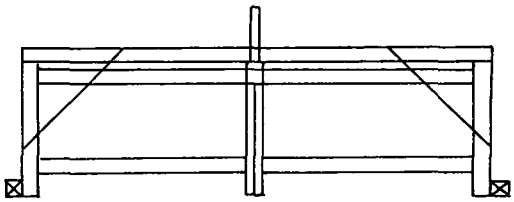
Figure 135:
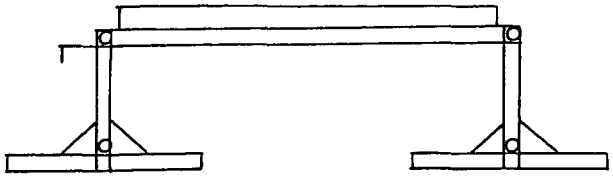
Figure 136:
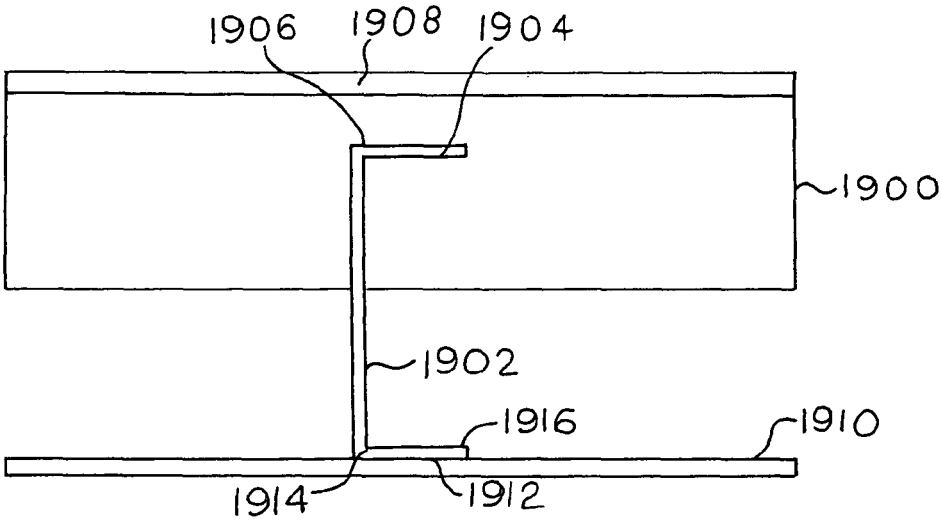
Figure 137:
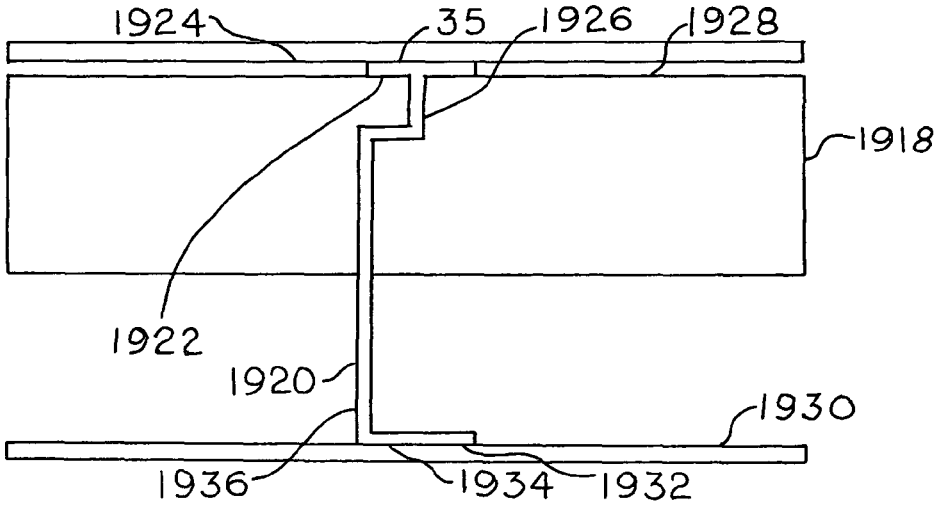
Figure 139:
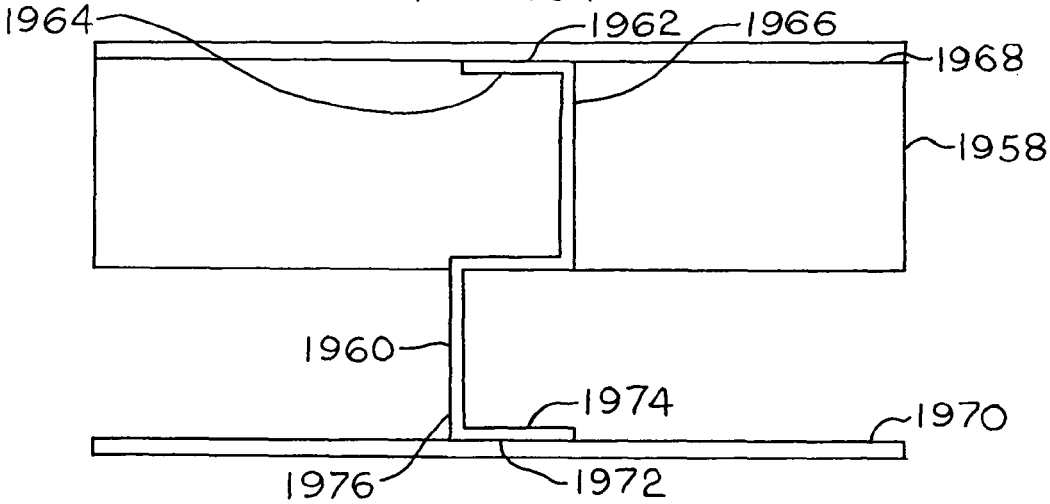
Figure 140:
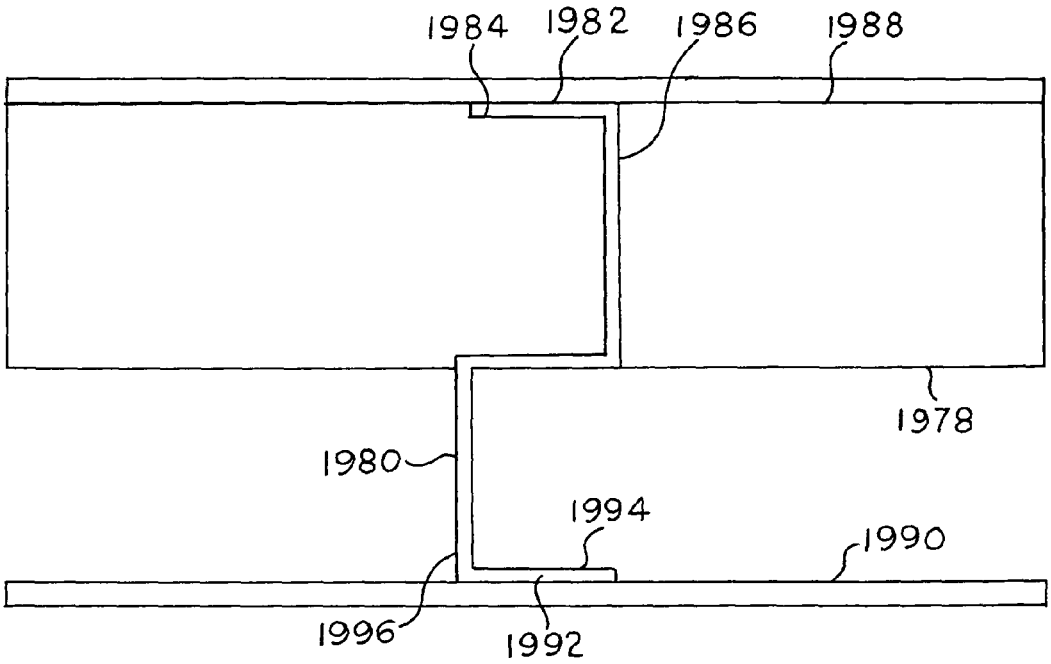
Figure 138:
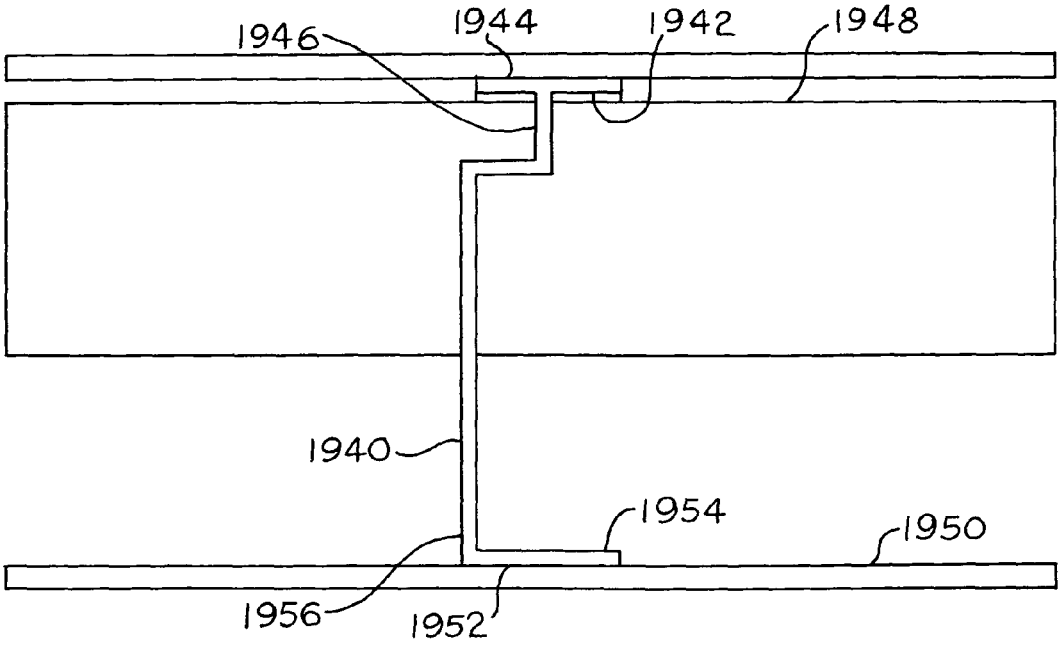

FIG. 129 is a cross-sectional view of metal members that can be used in the pre-formed building panels according to various embodiments of the present invention; and FIG. 130 illustrates a manufacturer/customer method of designing custom composite building panels according to various embodiments of the present invention;

FIG. 131 is a cross-sectional view of a wind load resistance test apparatus for testing panels according to various embodiments of the present invention;

FIG. 132 is a perspective view of the wind load resistance test apparatus for testing panels according to various embodiments of the present invention;

FIG. 133 is a top plan view of the test apparatus of FIG. 132;

FIG. 134 is a side elevational view of the test apparatus of FIG. 132;

FIG. 135 is a cross-sectional view of the test apparatus of FIG. 132 for scenario #2;

FIG. 136 is a top plan view of a simulated building panel assembly according to various embodiments of the present invention;

FIG. 137 is a top plan view of a simulated building panel assembly according to various embodiments the present invention;

FIG. 138 is a top plan view of a simulated building panel assembly according to various embodiments of the present invention;

FIG. 139 is a top plan view of a simulated building panel assembly according to various embodiments of the present invention; and FIG. 140 is a top plan view of a simulated building panel assembly according to various embodiments of the present invention.

DETAILED DESCRIPTION OF THE INVENTION

For the purpose of the description hereinafter, the terms "upper," "lower," "inner", "outer", "right," "left," "vertical," "horizontal," "top," "bottom," and derivatives thereof, shall relate to the invention as oriented in the drawing Figures. However, it is to be understood that the invention may assume alternate variations and step sequences except where expressly specified to the contrary. It is also to be understood that the specific devices and processes, illustrated in the attached drawings and described in the following specification, is an exemplary embodiment of the present invention. Hence, specific dimensions and other physical characteristics related to the embodiment disclosed herein are not to be considered as limiting the invention. In describing the embodiments of the present invention, reference will be made herein to the drawings in which like numerals refer to like features of the invention.

Other than where otherwise indicated, all numbers or expressions referring to quantities, distances, or measurements, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective measurement methods.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

Various embodiments of the present invention provide preformed building panels that comprise one or more reinforcing structural elements or members running longitudinally, which may be partially exposed, with the remainder of the reinforcing structural element(s) partially encapsulated in an expanded polymer matrix, which acts as a thermal break. The reinforcing structural elements can be flanged lengthwise on either side to provide attachment points for external objects to the panel. Perforations in the reinforcing structural elements which are encapsulated in the expanded polymer matrix allow for fusion perpendicularly. Perforations in the exposed portion of the reinforcing structural element provide attachment points for lateral bracing and utility installation. In some embodiments, a tongue and groove connection point design provides for panel abutment, weep holes provide for the draining of moisture or the venting of vapors and attachment points for external objects. In some embodiments, recessed areas on opposing panel ends provide an area of member to member connection with "C" channels running along the top and bottom of the structural member. In some embodiments, longitudinal holes can be provided through the expanded polymer matrix to provide areas or channels for the placement of utilities and/or the venting of gasses. Such construction also serves to reduce the overall weight of the panels. The longitudinal holes can be variable in diameter and location. Panel manufacture can be accomplished through the use of a semi-continuous or continuous molding process allowing for variable panel lengths.

The composite building panels of the present invention will now be discussed in terms of embodiments providing wall units and wall systems. However, one skilled in the art would understand that the composite building panels of the present invention can be used for a variety of uses, for example flooring units, ceiling units, etc., such as will be discussed in detail below. Therefore, the following discussion regarding wall units and wall systems is not intended to limit the scope of the present invention.

Figure 1:
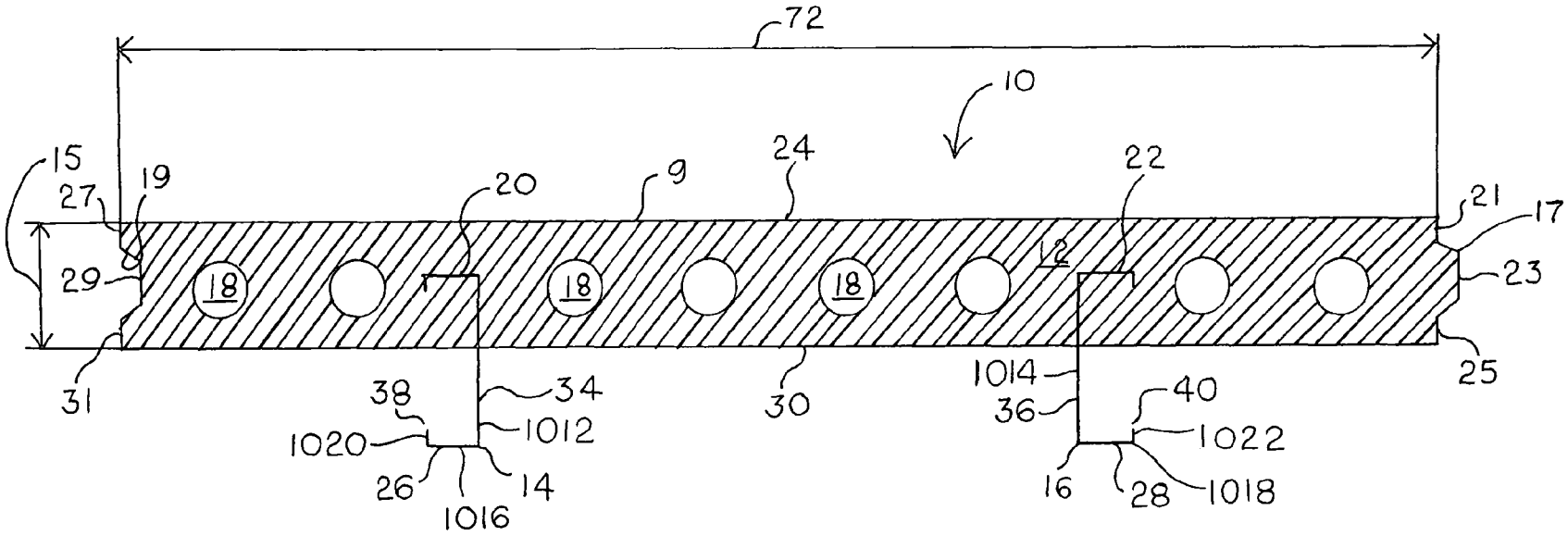
FIG. 1 is a cross-sectional view of a pre-formed building panel according to various embodiments of the present invention.
Figure 2:
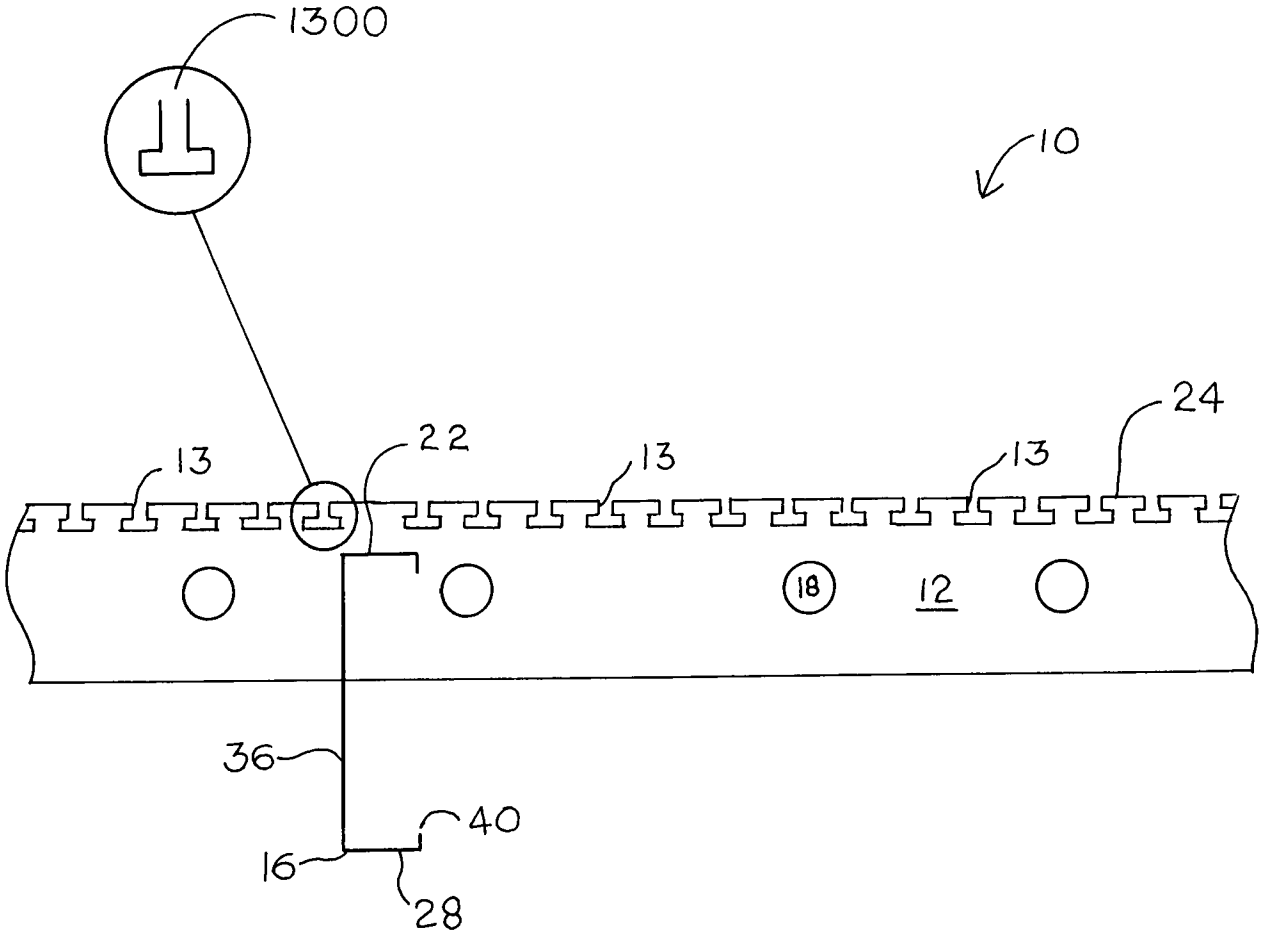
FIG. 2 is a cross-sectional view of a pre-formed building panel adapted for use with stucco according to various embodiments of the present invention.

As shown in FIG. 1, composite building panel or wall unit 10 according to the present invention comprises a central body 9 comprised of an expanded polymer matrix (expanded polymer body 12).

As used herein, the term "expandable polymer matrix" refers to a polymeric material in particulate or bead form that can be impregnated with a blowing agent such that when the particulates and/or beads are placed in a mold and heat is applied thereto, evaporation of the blowing agent (as described below) effects the formation of a cellular structure and/or an expanding cellular structure in the particulates and/or beads and the outer surfaces of the particulates and/or beads fuse together to form a continuous mass of polymeric material conforming to the shape of the mold.

As used herein, the term "polymer" is meant to encompass, without limitation, homopolymers, copolymers and graft copolymers.

The expanded polymer matrix makes up the expanded polymer body, panels and/or forms described herein below. The expanded polymer matrix is typically molded from expandable thermoplastic particles. These expandable thermoplastic particles are made from any suitable thermoplastic homopolymer or copolymer. Particularly suitable for use are homopolymers derived from vinyl aromatic monomers including styrene, isopropylstyrene, alpha-methylstyrene, nuclear methylstyrenes, chlorostyrene, tert-butylstyrene, and the like, as well as copolymers prepared by the copolymerization of at least one vinyl aromatic monomer as described above with one or more other monomers, non-limiting examples being divinylbenzene, conjugated dienes (non-limiting examples being butadiene, isoprene, 1,3- and 2,4-hexadiene), alkyl methacrylates, alkyl acrylates, acrylonitrile, and maleic anhydride, wherein the vinyl aromatic monomer is present in at least 50% by weight of the copolymer. In an embodiment of the invention, styrenic polymers are used, particularly polystyrene. However, other suitable polymers can be used, such as polyolefins (e.g. polyethylene, polypropylene), polycarbonates, polyphenylene oxides, and mixtures thereof.

As used herein, the terms "(meth)acrylic" and "(meth) acrylate" are meant to include both acrylic and methacrylic acid derivatives, such as the corresponding alkyl esters often referred to as acrylates and (meth)acrylates, which the term "(meth)acrylate" is meant to encompass.

In various embodiments of the invention, the expandable thermoplastic particles are expandable polystyrene (EPS) particles. These particles can be in the form of beads, granules, or other particles convenient for the expansion and molding operations. Particles polymerized in an aqueous suspension process are essentially spherical and are useful for molding the expanded polymer body, panels and/or forms described herein below. These particles can be screened so that their size ranges from about 0.008 to about 0.15 inch (0.20 mm to about 3.81 mm) prior to expansion.

The expandable thermoplastic particles can be impregnated using any conventional method with a suitable blowing agent. As a non-limiting example, the impregnation can be achieved by adding the blowing agent to the aqueous suspension during the polymerization of the polymer, or alternatively by re-suspending the polymer particles in an aqueous medium and then incorporating the blowing agent as taught in U.S. Pat. No. 2,983,692. Any gaseous material or material which will produce gases on heating can be used as the blowing agent. Conventional blowing agents include aliphatic hydrocarbons containing 4 to 6 carbon atoms in the molecule, such as butanes, pentanes, hexanes, and the halogenated hydrocarbons, e.g. CFC's and HCFC's, which boil at a temperature below the softening point of the polymer chosen. Mixtures of these aliphatic hydrocarbon blowing agents can also be used.

Alternatively, water can be blended with these aliphatic hydrocarbons blowing agents or water can be used as the sole blowing agent as taught in U.S. Pat. Nos. 6,127,439; 6,160,027; and 6,242,540 in these patents, water-retaining agents are used. The weight percentage of water for use as the blowing agent can range from 1 to 20%. The texts of U.S. Pat. Nos. 6,127,439; 6,160,027; and 6,242,540 are incorporated herein by reference.

The impregnated thermoplastic particles are generally pre-expanded to a density of at least 0.1 lb/ft$^3$, in some cases at least 0.25 lb/ft$^3$, in other cases at least 0.5 lb/ft$^3$, in some situations at least 0.75 lb/ft$^3$, in other situations at least 1 lb/ft$^3$, and in some instances at least about 2 lb/ft$^3$. Also, the density of the impregnated pre-expanded particles can be up to 12 lb/ft$^3$, in some cases up to 10 lb/ft$^3$, and in other cases up to 5 lb/ft$^3$. The density of the impregnated pre-expanded particles can be any value or range between any of the values recited above. The pre-expansion step is conventionally carried out by heating the impregnated beads via any conventional heating medium, such as steam, hot air, hot water, or radiant heat. One generally accepted method for accomplishing the pre-expansion of impregnated thermoplastic particles is taught in U.S. Pat. No. 3,023,175.

The impregnated thermoplastic particles can be foamed cellular polymer particles as taught in U.S. Patent Publication No. 2002/0117769, the teachings of which are incorporated herein by reference. The foamed cellular particles can be polystyrene that are pre-expanded and contain a volatile blowing agent at a level of less than 6.0 weight percent, in some cases ranging from about 2.0 wt % to about 5.0 wt %, and in other cases ranging from about 2.5 wt % to about 3.5 wt % based on the weight of the polymer.

An interpolymer of a polyolefin and in situ polymerized vinyl aromatic monomers that can be included in the expandable thermoplastic resin according to various embodiments of the present invention is disclosed in U.S. Pat. Nos. 4,303,756 and 4,303,757 and U.S. Application Publication No. 2004/0152795, the relevant portions of which are herein incorporated by reference. Non-limiting examples of interpolymers that can be used in the present invention include those available under the trade name ARCEL®, available from NOVA Chemicals Inc., Pittsburgh, Pa. and PIOCELAN®, available from Sekisui Plastics Co., Ltd., Tokyo, Japan.

The expanded polymer matrix can include customary ingredients and additives, such as pigments, dyes, colorants, plasticizers, mold release agents, stabilizers, ultraviolet light absorbers, mold prevention agents, antioxidants, and so on. Typical pigments include, without limitation, inorganic pigments such as carbon black, graphite, expandable graphite, zinc oxide, titanium dioxide, and iron oxide, as well as organic pigments such as quinacridone reds and violets and copper phthalocyanine blues and greens.

In one embodiment of the invention the pigment is carbon black, a non-limiting example of such a material is EPS SILVER® pigment, available from NOVA Chemicals Inc.

In another embodiment of the invention the pigment is graphite, a non-limiting example of such a material is NEOPOR® pigment, available from BASF Aktiengesellschaft Corp., Ludwigshafen am Rhein, Germany.

When materials such as carbon black and/or graphite are included in the polymer particles, improved insulating properties, as exemplified by higher R values for materials containing carbon black or graphite (as determined using ASTM-C578), are provided. As such, the R value of the expanded polymer particles containing carbon black and/or graphite or materials made from such polymer particles are at least 5% higher than observed for particles or resulting articles that do not contain carbon black and/or graphite.

The pre-expanded particles or "pre-puff" are heated in a closed mold in the semi-continuous or continuous molding process described below to form the pre-formed building panels according to various embodiments of the present invention.

In some embodiments, portions of the central body 9 can further comprise materials in addition to the expanded polymer matrix, as nonlimiting examples ultraviolet (UV) stabilizers, heat stabilizers, flame retardants, structural enhancements, biocides, and combinations thereof.

Generally, the central body 9 is substantially parallelepipedic in shape, i.e., a polyhedron having six parallelogram faces that are parallel to the opposite face. As shown in FIG. 1, the central body 9 comprises opposite faces, including a first surface or inner surface 30 and an opposing second surface or outer surface 24, a first end 17 and a second end 19, discussed in detail below.

In some embodiments of the invention, outer surface 24 of expanded polymer body 12 can have any desirable type of surface. In some instances, outer surface 24 will be smooth, in other instances grooves can be cut into or molded into outer surface 24 to facilitate the application of finishing surfaces and surface finishing materials such as stucco and the like. In order to facilitate the application of stucco to outer surface 24, T-slots 1300 can be cut into or molded into outer surface 24. Any suitable type of stucco can be used, such as natural material stucco or polymer based stucco. Thus, by including T-slots 1300 in outer surface 24, a stucco ready wall panel surface is provided. More particularly, T-slots 13 provide a mechanical connection for stucco adhesion and no secondary mesh is required. In a particular embodiment of the invention, T-slots 1300 allow for the use of natural material stucco as this type of stucco is able to breathe and not trap water. When stucco is not applied to outer surface 24, T-slots 1300 can be used as water condensation channels for other finishing techniques.

Referring now to FIG. 1, expanded polymer body 12 has a width 32. The expanded polymer body 12 can be manufactured in a variety of different sizes that would facilitate its safe handling and minimal damage during shipping and installation thereof. The width 32 of expanded polymer body 12 may be at least 3.28 feet (1 m), in some cases at least 4.92 feet (1.5 m), and in other cases at least 6.56 feet (2 m) and can be up to 82.02 feet (25 m), in some cases up to 65.62 feet (20 m), in other cases up to 49.21 feet (15 m), in some instances up to 32.81 feet (10 m) and in other instances up to 16.40 feet (5 m). The width 32 of expanded polymer body 12 can be any value or can range between any of the values recited above.

The height 33 of expanded polymer body 12 can be any height that allows for the safe handling and minimal damage to expanded polymer body 12 during shipping and installation. See FIG. 3. In various embodiments, the height 33 of expanded polymer body 12 is generally determined by the length of embedded metal studs 14 and 16. See also FIG. 1. In various embodiments, the height 33 of expanded polymer body 12 can be at least 3.28 feet (1 m) and in some cases at least 4.92 feet (1.5 m) and can be up to 9.84 feet (3 m) and in some cases up to 8.20 feet (2.5 m). The height 33 of expanded polymer body 12 can be any value or can range between any of the values recited above.

Referring now to FIG. 1, expanded polymer body 12 can have a thickness 15, measured as the distance from inner surface 30 to outer surface 24, of at least 0.79 inches (2 cm), in some cases at least one inch (2.5 cm), and in other cases at least 1.18 inches (3 cm) and can be up to 3.94 inches (10 cm), in some cases up to 3.15 inches (8 cm), and in other cases up to 2.36 inches (6 cm) from inner surface 30 of expanded polymer body 12. One skilled in the art will appreciate that the polymer body 12 could be provided in other thicknesses without departing from the spirit and scope of the present invention.

In some embodiments, expanded polymer body 12 can comprise one or more openings 18 that traverse all or part of the length and/or width of expanded polymer body 12, for example holes, conduits or chases can be molded into and extend along the length of the expanded polymer body 12. It is conceivable, however, that the expanded polymer body 12 may also be provided without any such openings therethrough. In some embodiments of the present invention, the holes, conduits or chases may be used as access ways for accommodating utilities, such as wiring, plumbing and exhaust vents within the walls, ceilings, floors and roofs constructed according to various embodiments of the present invention.

Openings 18 can have various cross-sectional shapes, non-limiting examples being round, oval, elliptical, square, rectangular, triangular, hexagonal or octagonal. The cross-sectional size or area of openings 18 can be uniform or they can vary independently of each other with regard to size and location relative to inner surface 30 and outer surface 24. The spacing between each opening 18 can be at least 1.97 inches (5 cm) and in some cases at least 3.94 inches (10 cm) and can be up to 3.61 feet (110 cm), in some cases up to 3.28 ft (100 cm), in other cases up to 2.46 ft (75 cm), and in some instances up to 1.97 ft (60 cm) measured from a midpoint of one opening 18 to a midpoint of an adjacent opening 18. The spacing between openings 18 can independently be any distance or range between any of the distances recited above.

The cross-sectional area of openings 18 can also vary independently one from another or they can be uniform. The cross-sectional area of openings 18 is limited by the dimensions of expanded polymer body 12, as openings 18 will fit within the dimensions of expanded polymer body 18. The cross-sectional area of openings 18 can independently be at least 0.155 $in^2$ (1 $cm^2$), in some cases at least 0.775 $in^2$ (5 $cm^2$), and in other cases at least 1.395 $in^2$ (9 $cm^2$) and can be up to 20.15 $in^2$ (130 cm2), in some cases up to 15.50 $in^2$ (100 $cm^2$), in other cases up to 11.625 in2 (75 $cm^2$). The cross-sectional area of openings 18 can independently be any value or range between any of the values recited above.

Figure 4:
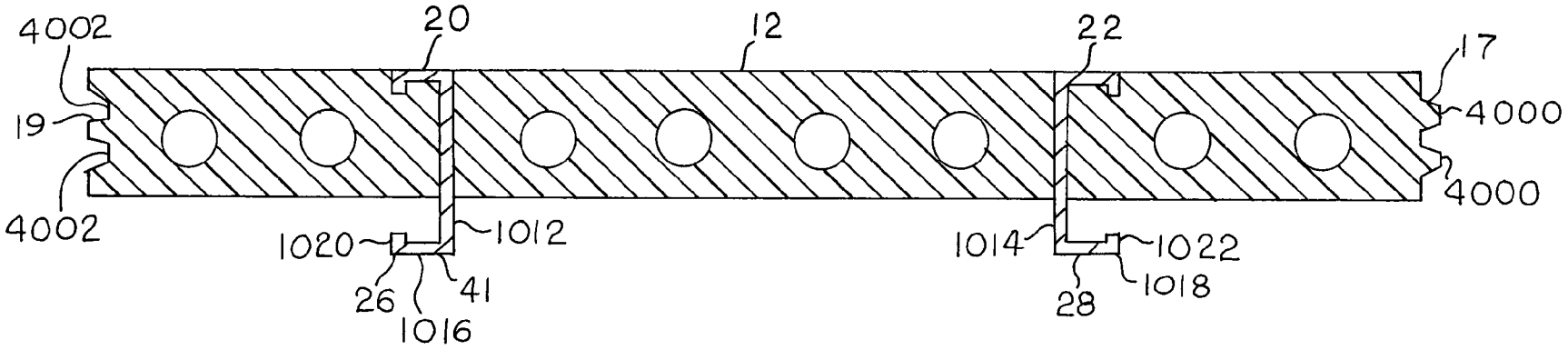
FIG. 4 is a cross-sectional view of a pre-formed building panel according to various embodiments of the present invention.

Referring now to FIG. 4, in other embodiments of the invention, the wall units, floor units and expanded polymer panels or central body have a first end 17, such as a male "tongue" end or edge, and a second end 19, such as for example a female "groove" end or edge, that facilitates a "tongue and groove" union of two matching wall units, floor units and expanded polymer panels. The tongue and groove union can be non-linear and can provide for a weep hole and/or larger opening to accommodate plumbing lines. Typically the tongue and groove union provides a flat surface at the union to allow for easy application of sealing tape to seal the union or joint if desired.

Figure 3:
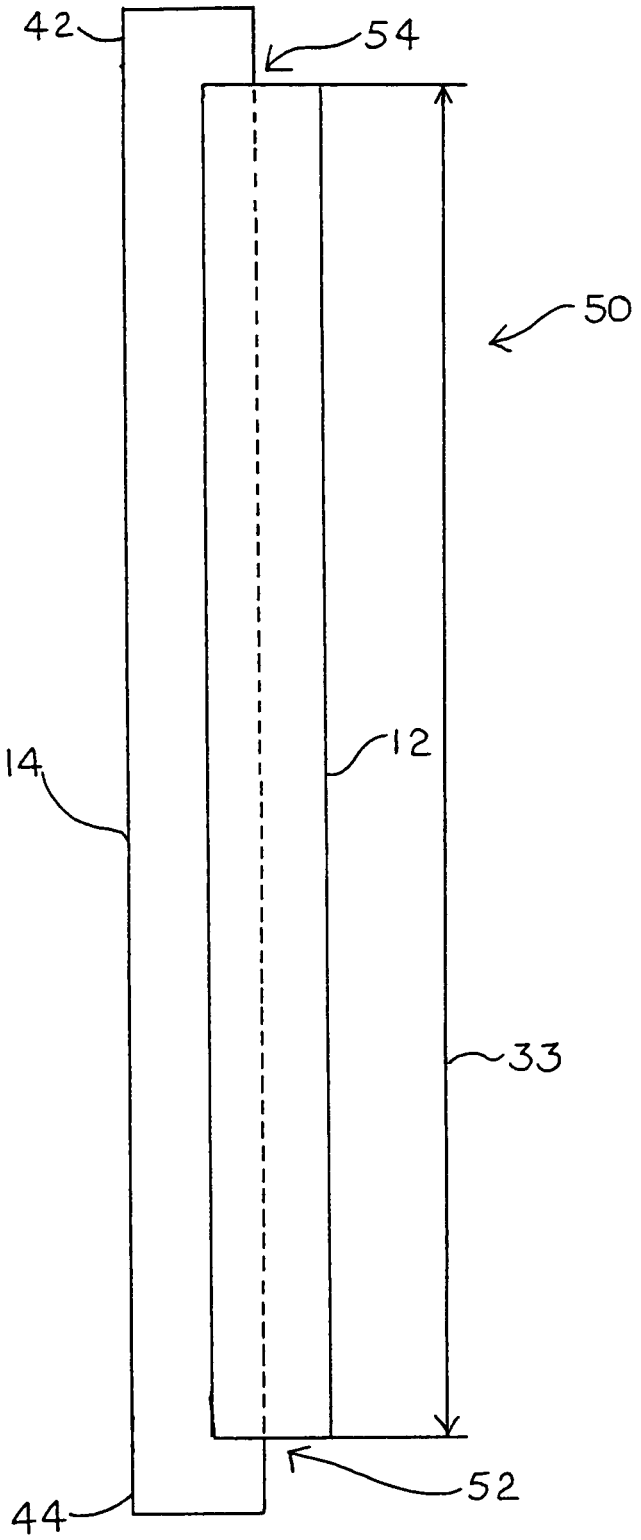
FIG. 3 is a side elevational view of a pre-formed building panel according to various embodiments of the present invention.

Various embodiments of the present invention further include reinforcing members to provide strength and rigidity to the panel and to generally enhance the panel's structural integrity to thereby enable the panel to withstand the anticipated loads and stresses that it will likely encounter when installed. The reinforcing members employed in various embodiments of the present invention may comprise a variety of different structural members, bars, joists, studs and other structural profiles without departing from the spirit and scope of the present invention. FIG. 1 illustrates the use of reinforcing members in the form of conventional metal studs 14 and 16. As can be seen in that Figure, the metal studs 14 and 16 are spaced from each other across the width 32 of the central body 9 and extend longitudinally therein as illustrated in FIG. 3. As shown in FIG. 1, in one embodiment wall unit 10 comprises a left facing embedded metal stud 14, and right facing embedded metal stud 16. One skilled in the art would understand that in alternative embodiments a single reinforcing member or more than two reinforcing members can be used as desired.

The reinforcing members used in various embodiments of the invention can be made of any suitable material. Suitable materials are those that add strength, stability and structural integrity to the pre-formed building panels. Such materials provide embedded framing studs meeting the requirements of applicable test methods known in the art, as non-limiting examples ASTM A 36/A 36M-05, ASTM A 1011/A 1011M-05a, ASTM A 1008/A 1008M-05b, and ASTM A 1003/A 1003M-05 for various types of steel.

Suitable materials include, but are not limited to metals, construction grade plastics, composite materials, ceramics, combinations thereof, and the like. Suitable metals include, but are not limited to, aluminum, steel, stainless steel, tungsten, molybdenum, iron and alloys and combinations of such metals. In various particular embodiments of the invention, the reinforcing members are made of a light gauge metal.

Suitable construction grade plastics include, but are not limited to reinforced thermoplastics, thermoset resins, and reinforced thermoset resins. Thermoplastics include polymers and polymer foams made up of materials that can be repeatedly softened by heating and hardened again on cooling. Suitable thermoplastic polymers include, but are not limited to homopolymers and copolymers of styrene, homopolymers and copolymers of $C_2$ to $C_{20}$ olefins, $C_4$ to $C_{20}$ dienes, polyesters, polyamides, homopolymers and copolymers of $C_2$ to $C_{20}$ (meth)acrylate esters, polyetherimides, polycarbonates, polyphenylethers, polyvinylchlorides, polyurethanes, and combinations thereof.

Suitable thermoset resins are resins that when heated to their cure point, undergo a chemical cross-linking reaction causing them to solidify and hold their shape rigidly, even at elevated temperatures. Suitable thermoset resins include, but are not limited to alkyd resins, epoxy resins, diallyl phthalate resins, melamine resins, phenolic resins, polyester resins, urethane resins, and urea, which can be crosslinked by reaction, as non-limiting examples, with diols, triols, polyols, and/or formaldehyde.

Reinforcing materials that can be incorporated into the thermoplastics and/or thermoset resins include, but are not limited to carbon fibers, aramid fibers, glass fibers, metal fibers, fiberglass, carbon black, graphite, clays, calcium carbonate, titanium dioxide, woven fabric or structures of the above-referenced fibers, and combinations thereof.

A non-limiting example of construction grade plastics are thermosetting polyester or vinyl ester resin systems reinforced with fiberglass that meet the requirements of required test methods known in the art, non-limiting examples being ASTM D790, ASTM D695, ASTM D3039 and ASTM D638.

The thermoplastics and thermoset resins can optionally include other additives, as a non-limiting example ultraviolet (UV) stabilizers, heat stabilizers, flame retardants, structural enhancements, biocides, and combinations thereof.

In an embodiment of the invention, one or more surfaces of the reinforcing members used herein can have a texturized surface. As used herein, "texturized surface" refers to a non-smooth surface that includes surface alterations, non-limiting examples of such include dimples and corrugation. Methods for texturizing such surfaces are disclosed, for example in U.S. Pat. Nos. 6,183,879 and 5,689,990, the disclosures of which are herein incorporated by reference in their entirety. Texturized surfaces can provide improved strength in the reinforcing members and/or improved adherence between the reinforcing members and the expanded polymer matrix and other materials, non-limiting examples of which include concrete, stucco, cement and mortar.

The reinforcing members can have a variety of different thicknesses depending upon the intended use and desired physical properties of the panel. For example, in various embodiments, the reinforcing members may have a thickness 41 of at least 0.016 in (0.4 mm) to up to 0.394 in (10 mm), in some instances at least 0.039 in (1 mm) and in other instances at least up to 0.314 in (8 mm). As indicated above, the reinforcing members that may be employed in various embodiments of the present invention and may have a variety of different cross-sectional shapes. For example, such reinforcing members may comprise studs referred to as C-type studs, CT-type studs, and CC-type studs. It is also conceivable that reinforcing members with other cross-sectional shapes and thicknesses could be employed. In the embodiments depicted in FIGS. 1, 4, and 6, C-type studs are employed.

Referring now to FIG. 1, there is shown a cross-sectional view of a preformed building panel 10 that has an expanded polymer body 12 that includes reinforcing members in the form of metal studs 14 and 16 that are partially embedded therein. The embedded metal studs 14 and 16 have embedded side portions 20 and 22, at least a portion of which is embedded in the expanded polymer matrix. The portion of the framing stud embedded in the expanded polymer matrix is referred to as the thermal portion of the stud. The portion of the embedded framing stud that is not embedded in the polymer matrix is referred to as the structural portion of the stud.

In some embodiments, such as the embodiment depicted in FIG. 1, the embedded side portions 20 and 22 do not extend all the way through the expanded polymer body 12 to touch the outer surface 24 of expanded polymer body 12. Embedded side portions 20 and 22 can extend from inner surface 30 any distance into the expanded polymer body 12 to the outer surface 24.

Referring now to FIG. 4, in some embodiments, the embedded side portions 20 and 22 extend all the way through the expanded polymer body 12 to be flush with the outer surface 24 of expanded polymer body 12 or, as shown in FIG. 137, emerge through the outer surface 24 to provide exposed portion 35. Exposed portion 35 of embedded side portions 20 and 22 can facilitate attachment of finish surfaces and materials thereto.

Embedded side portions may extend at least 0.39 inches (1 cm), in some cases at least 0.79 inches (2 cm), and in other cases at least 1.18 inches (3 cm) into expanded polymer body 12 away from inner surface 30. Also, embedded side portions 20 and 22 can extend up to 3.94 inches (10 cm), in some cases up to 3.15 inches (8 cm), and in other cases up to 2.36 inches (6 cm) away from inner surface 30 into expanded polymer body 12. One skilled in the art will appreciate that the embedded side portions 20 and 22 can be located within the expanded polymer body 12 at a variety of different distances from the inner surface 30 or can range between any of the distances recited above from the inner surface 30 into the polymer body 12.

For example, in still other embodiments of the present invention, embedded side portions 20 and 22 can be embedded within the polymer body 12 at distances of about from 1/10 to 9/10, in some cases 1/3 to 2/3 and in other cases 1/4 to 3/4 of the thickness of expanded polymer body 12 from the inner surface 30. However, in other embodiments, side portions 20 and 22 may be completely exposed to facilitate attachment of finish surfaces or members thereto.

Figure 41:
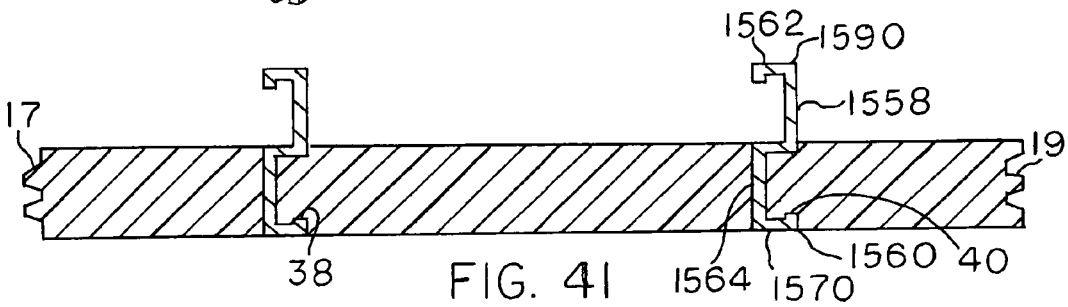
FIG. 41 is a cross-sectional view of a pre-formed building panel according to various embodiments of the present invention.
Figure 43:
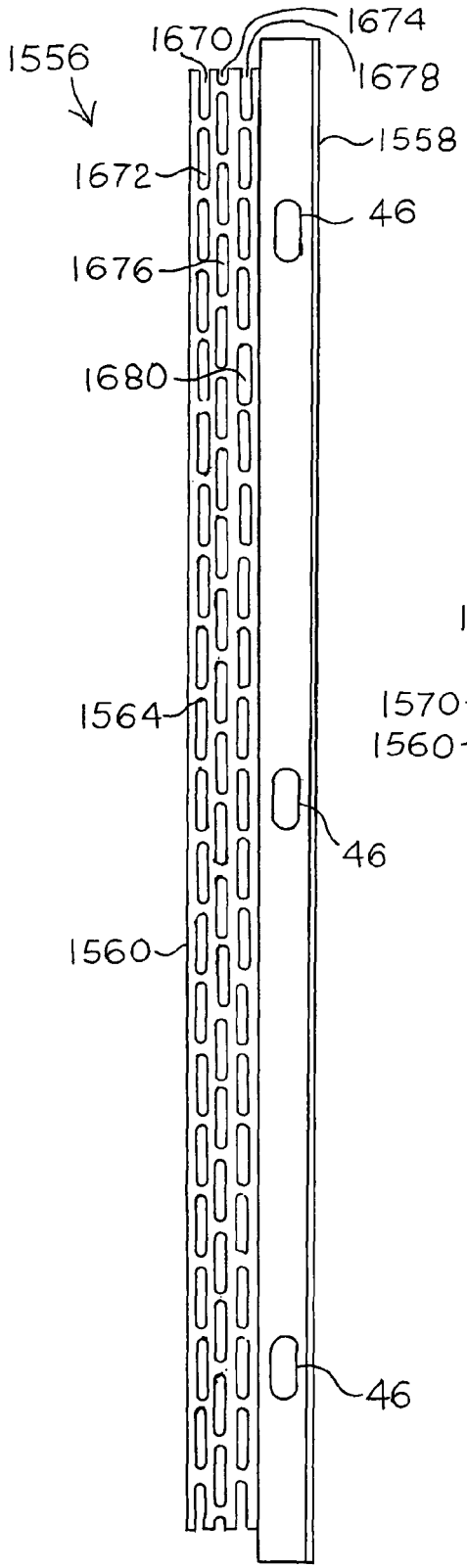
FIG. 43 is a side elevational view of a stud according to various embodiments of the present invention.

In some embodiments of the present invention, embedded metal studs 14 and 16 have a cross-sectional shape that includes embedding lengths 34 and 36, embedded side portions 20 and 22 and exposed side portions 26 and 28. The orientation of embedded metal studs 14 and 16 is referenced by the direction of open ends 38 and 40. In an embodiment of the invention shown in FIG. 1, open ends 38 and 40 are oriented away from each other. In this embodiment, wall unit 10 has greater rigidity and is easier to handle without bending. In other embodiments of the invention shown in FIG. 41, open ends 38 and 40 may also be oriented facing in the same direction.

Referring now to FIGS. 1 and 4, each exposed side portion 26, 28 comprises a web or web 1012, 1014. In some embodiments, each exposed side portion 26, 28 can further comprise a flange 1016, 1018 extending generally perpendicularly from the web 1012, 1014. In some embodiments, each exposed side portion 26, 28 can further comprise a lip portion 1020, 1022 extending generally perpendicularly from the flange 1004, 1006.

Figure 6:
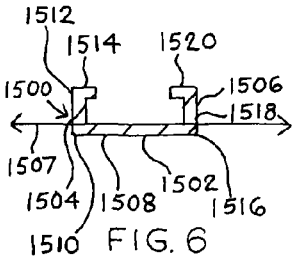
FIG. 6 is a cross-sectional view of a stud according to various embodiments of the present invention.
Figure 7:
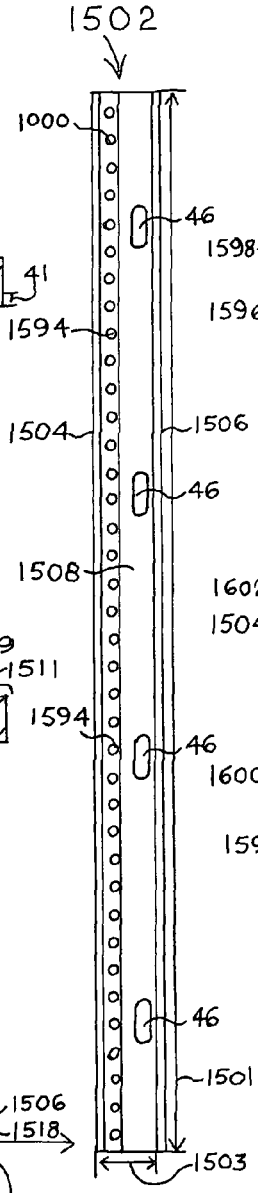
FIG. 7 is a side elevational view of a stud according to various embodiments of the present invention.

Referring to FIGS. 6 and 7, there is shown a C-type stud denoted generally as 1500. As shown in FIG. 7, the stud 1500 has a body 1502 that has a length 1501 and a width 1503. The stud 1500 also has a thickness 41 as illustrated in FIG. 6. The length 1501, width 1503, and thickness 41 may vary depending upon the application and the anticipated loading conditions that the panel must withstand. For example, in various embodiments, the length 1501 of the body 1502 may be about 3.28 feet (1 m) to 9.84 feet (3 m), for example eight feet (2.44 m). The width 1503 of body 1502 may be about 3.94 inches (10 cm) to about 7.87 inches (20 cm), for example, about 6 inches (15.24 cm). It is conceivable, however, that other lengths 1501 and widths 1503 may be employed. In various embodiments, the body 1502 comprises a first side portion 1504 and an opposed second side portion 1506. The first side portion 1504 and the second side portion 1506 are positioned along a laterally extending axis 1507 extending across the width of the body 1502. The first side portion 1504 of the body 1502 comprises a first portion 1509 of a web 1508 having an end 1510, a flange 1512 extending generally perpendicularly from the end 1510 of the web 1508 and, optionally, a return lip 1514 extending generally perpendicularly from the flange 1512 and in a direction generally away from the end 1510 of the web 1508 making up at least a part if the thermal portion of the stud.

Figure 5:
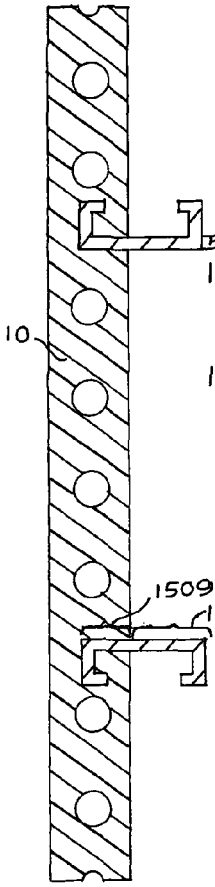
FIG. 5 is a cross-sectional view of a pre-formed building panel according to various embodiments of the present invention.

The second side portion 1506 of the body 1502 comprises a second portion 1511 (shown in FIG. 5) of the web 1508 having an end 1516 opposite end 1510, a flange 1518 extending generally perpendicularly from the end 1516 of the web 1508 and, optionally, a return lip 1520 extending generally perpendicularly from the flange 1518 and in the direction of flange 1512. The portion of the embedded framing stud that is not embedded in the polymer matrix is referred to as the structural portion of the stud.

Referring now to FIGS. 15, 16, 17, 20, 24, 28 and 32, a CT-type stud, denoted generally as 1522, comprises a body 1524 having a length 1523, a width 1525 and a thickness 41. Values of the length 1523 and width 1525 of the CT-stud 1522 may be similar to those of the C-stud 1500 discussed above or other lengths and/or thicknesses may be employed.

Figure 16:
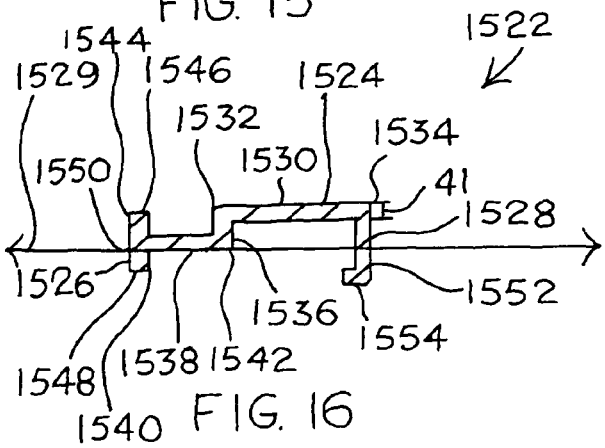
FIG. 16 is a cross-sectional view of a stud according to various embodiments of the present invention.

As shown in FIG. 16, the body 1524 comprises a first side portion 1526 and an opposed second side portion 1528. The first side portion 1526 and the second side portion 1528 are positioned along a laterally extending axis 1529 traversing the width of the body 1524. The first side portion 1526 comprises a first portion 1531 of the first web 1530 (the thermal portion) having a first end 1532, a first flange 1536 extending generally perpendicularly from the first end 1532 of the first web 1530, a second web 1538 having a first end 1540 and a second end 1542 extending generally perpendicularly from the first flange 1536 and positioned generally parallel to the first web 1530 and a second flange 1544 having a first end 1546, second end 1548 and a central portion 1550 extending therebetween. The central portion 1550 of the second flange 1544 is positioned generally perpendicularly to the first end 1540 of the second web 1538. Generally, the second flange 1544 is positioned to form a T-shape with respect to the second web portion 1538.

The second side portion 1528 of the body comprises a second portion 1533 (the structural portion-shown in FIG. 15) of the first web 1530 having a second end 1534, a third flange 1552 extending generally perpendicularly from the second end 1534 of the first web 1530, and, optionally, a return lip 1554 extending generally perpendicularly from the third flange 1552 (see FIG. 16).

Some of the differences between the different embodiments of CT-type studs 1522 are based on the position of the CT-type stud 1522 relative to the expanded polymer body 12, the length of the first web 1530 and the length of the second web 1538.

Figure 15:
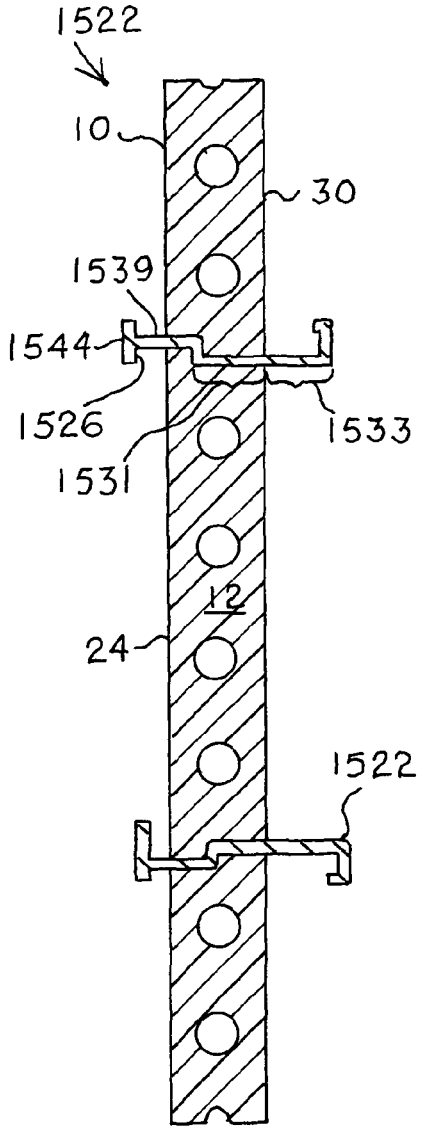
FIG. 15 is a cross-sectional view of a pre-formed building panel according to various embodiments of the present invention.

As a non-limiting example, in the embodiment illustrated in FIG. 15, the first portion 1531 of the first side portion 1526 is embedded in the expanded polymer body 12 with the second flange 1544 and a portion 1539 of the second web 1538 extending beyond the outer surface 24 of the expanded polymer body 12. The length of the first web 1530 may be about 5.12 inches (13 cm) to about 5.90 inches (15 cm), for example 5.51 inches (14 cm). Further, the length of second web 1538 may be about 1.58 inches (4 cm) to about 2.36 inches (6 cm), for example two inches (5.08 cm). However, these lengths may vary in other embodiments/applications.

Figure 19:
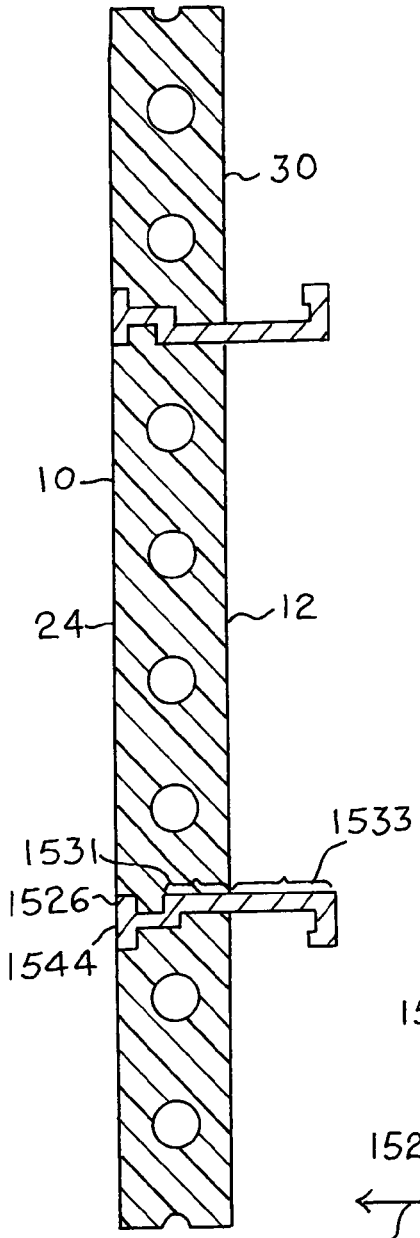
FIG. 19 is a cross-sectional view of a pre-formed building panel according to various embodiments of the present invention.
Figure 20:
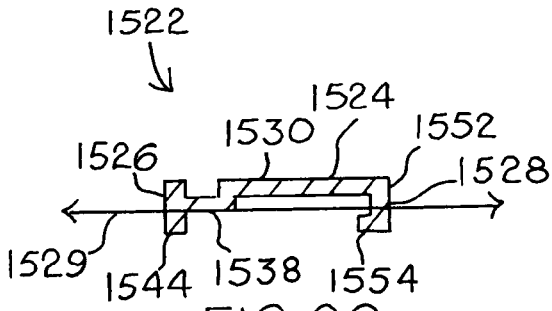
FIG. 20 is a cross-sectional view of a stud according to various embodiments of the present invention.

In the embodiment illustrated in FIG. 19, the first portion 1531 of the first side portion 1526 is embedded in expanded polymer body 12 with the second flange 1544 flush with the outer surface 24 of expanded polymer body 12. The length of the first web 1530 may be about 5.51 inches (14 cm) to about 6.30 inches (16 cm), for example six inches (15.24 cm). Further, the length of second web 1538 may be about 1.58 inches (4 cm) to about 2.36 inches (6 cm), for example 2 inches (5.08 cm). However, these lengths may vary in other embodiments/applications.

Figure 23:
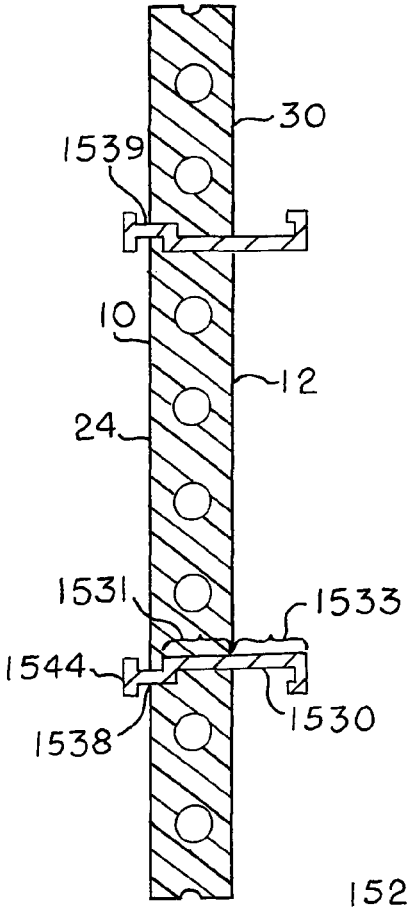
FIG. 23 is a cross-sectional view of a pre-formed building panel according to various embodiments of the present invention.
Figure 24:
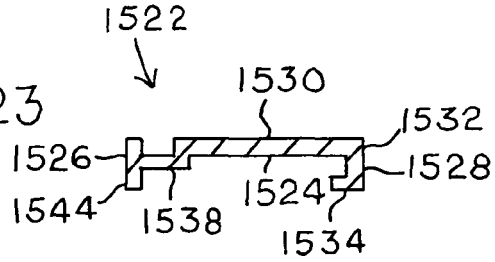
FIG. 24 is a cross-sectional view of a stud according to various embodiments of the present invention.

In the embodiment illustrated in FIG. 23, similar to the embodiment of FIG. 15, the first portion 1531 of the first side portion 1526 is embedded in the expanded polymer body 12 with the second flange 1544 and a portion of the second web 1538 extending beyond the outer surface 24 of the expanded polymer body 12. The length of the first web 1530 may be about 6.30 inches (16 cm) to about 7.09 inches (18 cm), for example seven inches (17.78 cm). Further, the length of second web 1538 may be about 1.58 inches (4 cm) to about 2.36 inches (6 cm), for example two inches (5.08 cm). However, these lengths may vary in other embodiments/applications.

Figure 27:
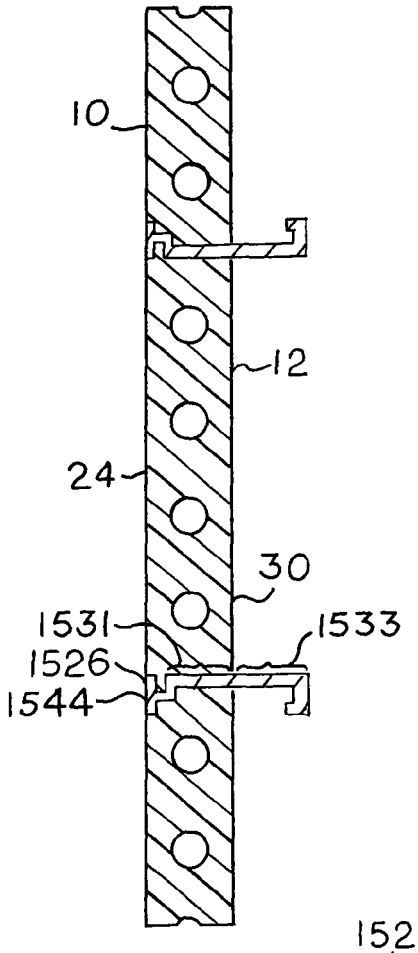
FIG. 27 is a cross-sectional view of a pre-formed building panel according to various embodiments of the present invention.
Figure 28:
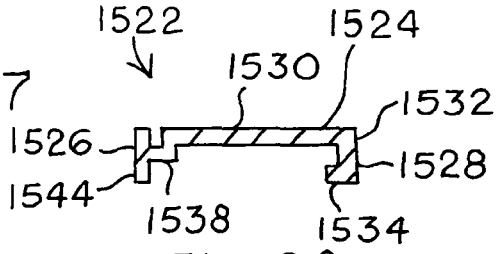
FIG. 28 is a cross-sectional view of a stud according to various embodiments of the present invention.

The embodiment illustrated in FIG. 27, similar to the embodiment of FIG. 19, the first portion 1531 of the first side portion 1526 is embedded in expanded polymer body 12 with the second flange 1544 flush with the outer surface 24 of expanded polymer body 12. The length of the first web 1530 may be about 6.30 inches (16 cm) to about 7.09 inches (18 cm), for example seven inches (17.78 cm). Further, the length of second web 1538 may be about 0.39 inches (1 cm) to about 1.18 inches (3 cm), for example 1 inch (2.54 cm). However, these lengths may vary in other embodiments/applications.

Figure 31:
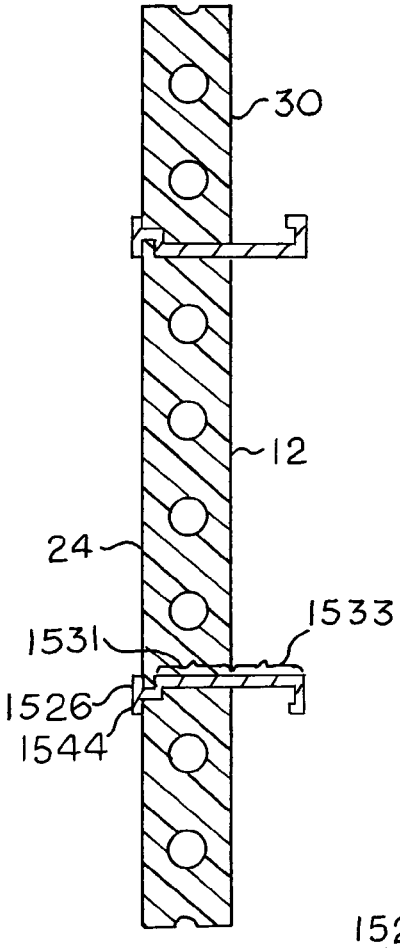
FIG. 31 is a cross-sectional view of a pre-formed building panel according to various embodiments of the present invention.
Figure 32:
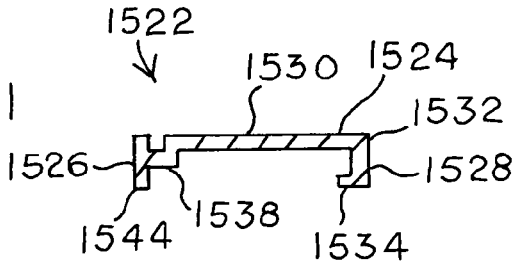
FIG. 32 is a cross-sectional view of a stud according to various embodiments of the present invention.

In the embodiment illustrated in FIG. 31 the first portion 1531 of the first side portion 1526 is embedded in expanded polymer body 12 with the second flange 1544 extending slightly beyond the outer surface 24 of expanded polymer body 12 such that a bottom surface of second flange 1544 is adjacent to outer surface 24. The length of the first web 1530 may be about 6.69 inches (17 cm) to about 7.48 inches (19 cm), for example 7.25 in (18.42 cm). Further, the length of second web 1538 may be about 0.39 inches (1 cm) to about 1.18 inches (3 cm), for example one inch (2.54 cm). However, these lengths may vary in other embodiments/applications.

Figure 36:
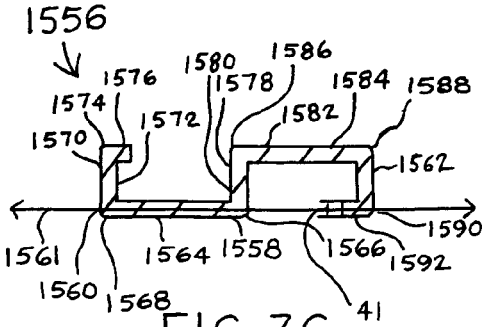
FIG. 36 is a cross-sectional view of a stud according to various embodiments of the present invention.
Figure 37:
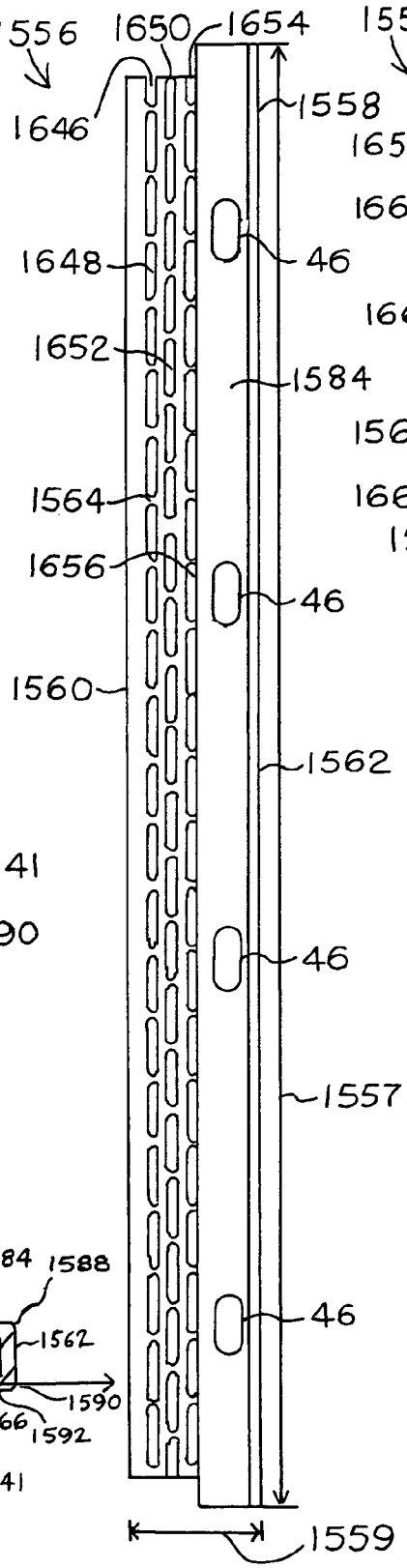
FIG. 37 is a side elevational view of a stud according to various embodiments of the present invention.

Referring now to FIGS. 36, 42, 45, 47, 49, 51, 54, 56, 59, 63, 65, 69, 71, and 74, in other embodiments of the invention, a "CC-type" stud, denoted generally as 1556, comprises a body 1558 having a length 1557, a width 1559 and a thickness 41 (see FIGS. 36 and 37). The length 1557 of the body 1558 may be about 3.28 feet (1 m) to 9.84 feet (3 m), for example eight feet (2.44 m). The width 1559 of body 1558 may be about 5.90 inches (15 cm) to about 9.84 inches (25 cm), for example eight inches (20.32 cm). However, these lengths may vary in other embodiments/applications.

In various embodiments, the body 1558 comprises a first side portion 1560 and an opposed, second side portion 1562. The first side portion 1560 and the second side portion 1562 are positioned along a laterally extending axis 1561 that traverses the width 1559 of the body 1558. The first side portion 1560 of the body 1558 comprises a first web 1564 having a first end 1566 and a second end 1568. The first flange 1570 extends generally perpendicularly from the second end 1568 of the first web 1564. The first flange 1570 with a first end 1572 adjacent to the first web 1564 and a second, opposing end 1574. The first end 1560 of the body 1558 can optionally comprise a first return lip 1576 extending generally perpendicularly from the first flange 1570 (see FIG. 36).

The second side portion 1562 of the body 1558 comprises a second flange 1578 having a first end 1580 and a second end 1582. The second flange 1578 extends generally perpendicularly from the first end 166 of the first web 1564. A second web 1584 extends generally perpendicularly from the second end 1582 of the second flange 1578. The second web 1584 having a first end 1586 and a second end 1588. The second end 1562 of the body 1558 also comprises a third flange 1590 extending generally perpendicularly from the second end 1588 of the second web 1584 and, optionally, a second return lip 1592 extending generally perpendicularly to the third flange 1590 (see FIG. 36).

Figure 42:
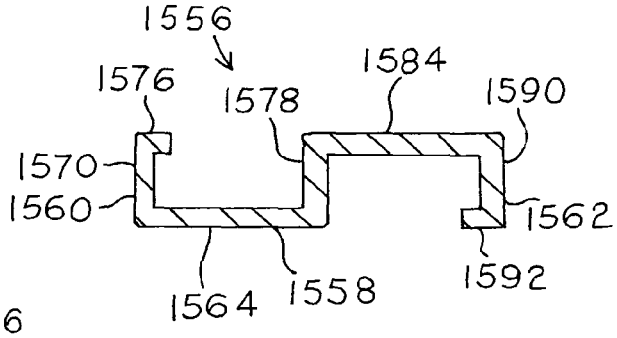
FIG. 42 is a cross-sectional view of a stud according to various embodiments of the present invention.

In an exemplary embodiment of the "CC-type" stud 1556, such as the one illustrated in FIG. 42, the first web 1564 has a length of about 3.94 inches (10 cm) to about 4.72 inches (12 cm), for example 4.375 inches (11.11 cm). The first flange 1570 has a length of about 1.18 inches (3 cm) to about 1.97 inches (5 cm), for example 1.626 in (4.13 cm). The first return lip 1576 has a length of about 0.20 inches (0.5 cm) to about 0.79 inches (2 cm), for example 0.50 inch (1.27 cm). The second flange 1578 has a length of about 1.18 inches (3 cm) to about 1.97 inches (5 cm), for example 1.626 in (4.13 cm). The second web 1584 has a length of about 3.15 inches (8 cm) to about 3.94 inches (10 cm), for example 3.626 in (9.21 cm). The third flange 1590 has a length of about 1.18 inches (3 cm) to about 1.97 inches (5 cm), for example 1.626 in (4.13 cm). The second return lip 1592 has a length of about 0.20 inches (0.5 cm) to about 0.79 inches (2 cm), for example 0.50 inch (1.27 cm). However, these lengths may vary in other embodiments/applications.

Figures 76, 77, 78:
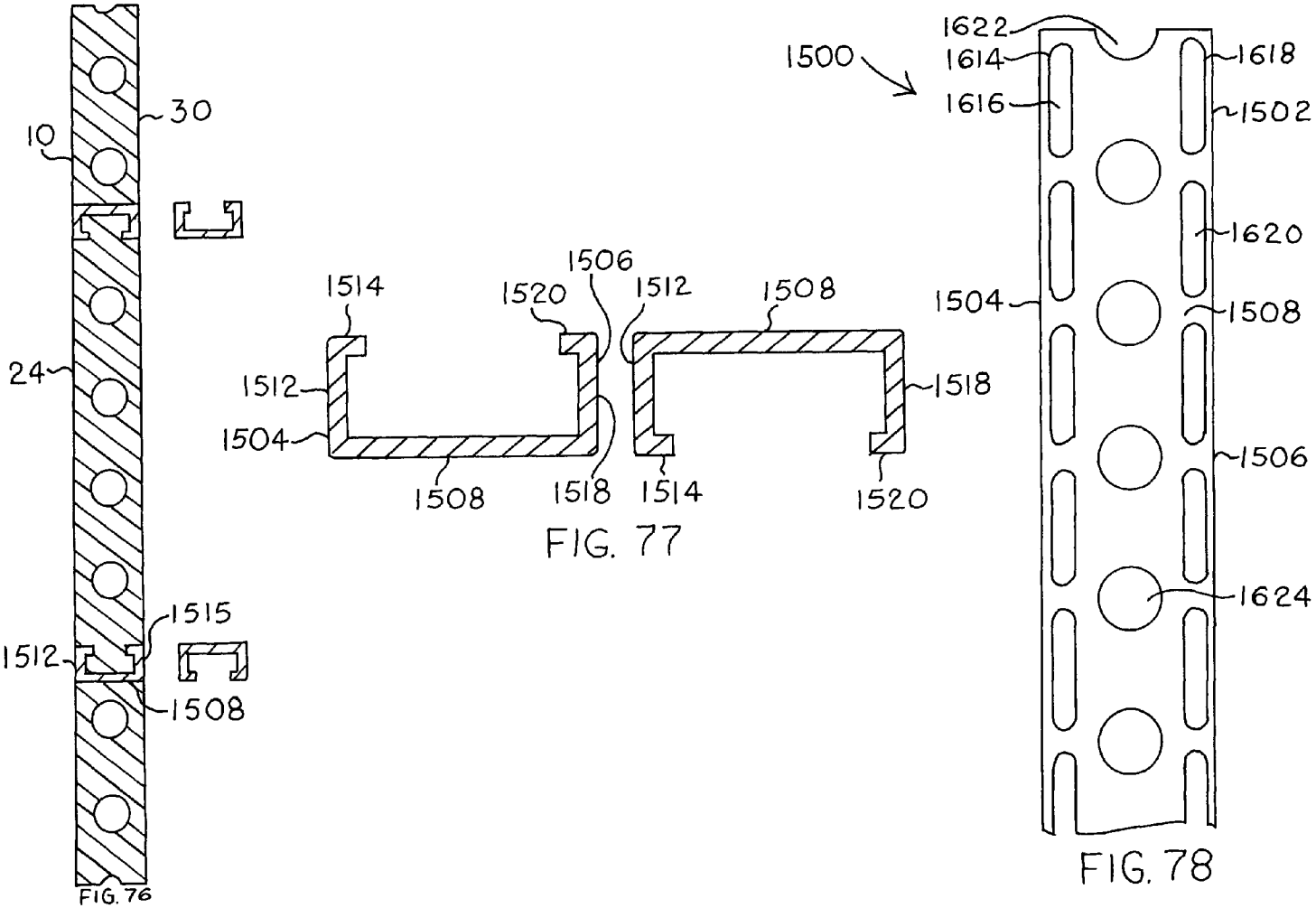
FIG. 76 is a cross-sectional view of a pre-formed building panel according to various embodiments of the present invention.
FIG. 77 is a cross-sectional view of a stud according to various embodiments of the present invention.
FIG. 78 is a side elevational view of a portion of a stud according to various embodiments of the present invention.

Referring to FIGS. 7-78, the first web 1508, 1530, and 1564 of the embedded reinforcing members which may comprise, for example, studs, joists, etc. have holes 13 or openings along its length to facilitate fusion of the expanded plastic material and to reduce any thermal bridging effects or heat transfer in the reinforcing bars, studs, joists and/or members.

Expansion holes 13 are useful in that as expanded polymer body 12 is molded, the polymer matrix expands through expansion holes 13 and the expanding polymer fuses. This allows the polymer matrix to encase and hold embedded studs 16 by way of the fusion in the expanding polymer. In an embodiment of the invention, expansion holes 13 can have a flanged and in many cases a rolled flange surface to provide added strength to the embedded metal studs.

Expansion holes 13 may be configured in a variety of different manners, sizes and shapes including, but not limited to, the following configurations.

Figure 8:
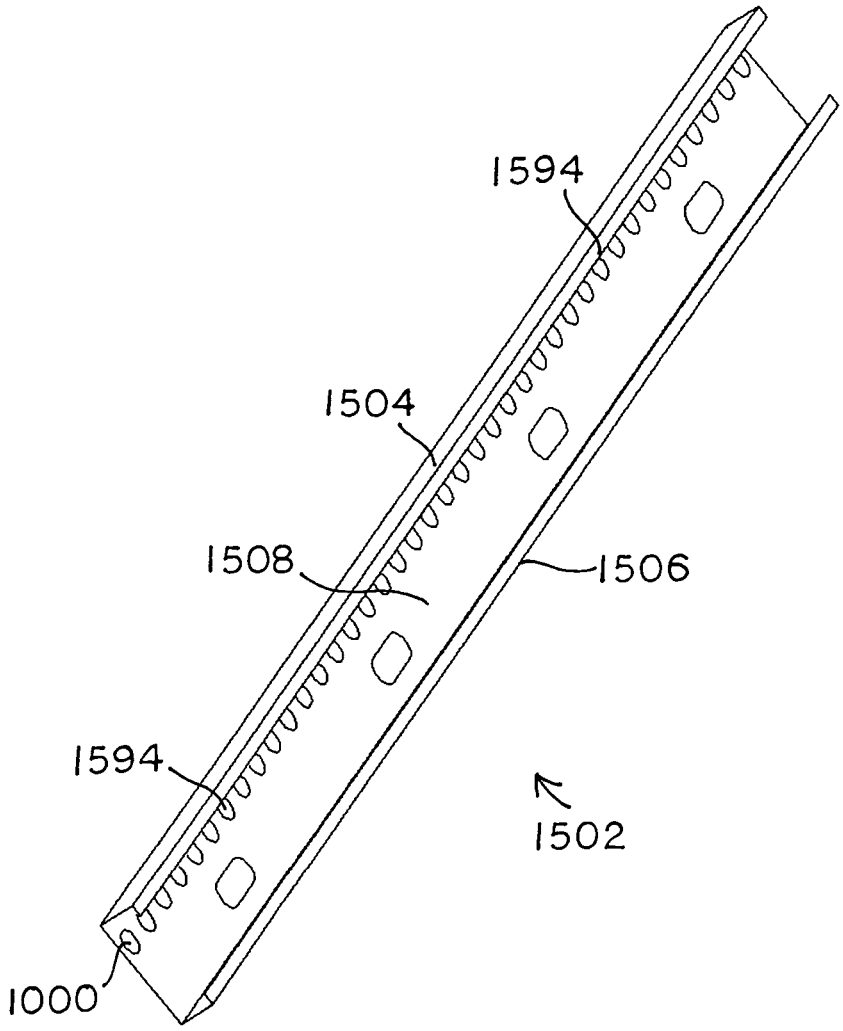
FIG. 8 is a perspective view of a stud according to various embodiments of the present invention.

Referring now to FIGS. 7 and 8, the first side portion 1504 of body 1502 comprises a web 1508 with a plurality of generally circular holes 1594 extending along the length of the body 1502. The plurality of holes 1594 may be generally evenly spaced along the length of the body 1502. Each hole of the plurality of holes 1594 may have a diameter of about 0.79 inches (2 cm) to about 1.58 inches (4 cm), for example 1.20 inches (3.05 cm). However, the sizes, shapes, numbers and spacing arrangement of holes 1594 may vary without departing from the spirit and scope of the present invention. The second end 1506 of the body 1502 comprises web 1508 with four elongated, generally oval shaped, utility holes 46. The utility holes 46 will be discussed in greater detail hereinafter. Likewise, the sizes, shapes, numbers and spacing arrangement of these holes may vary without departing from the spirit and scope of the present invention.

Figure 9:
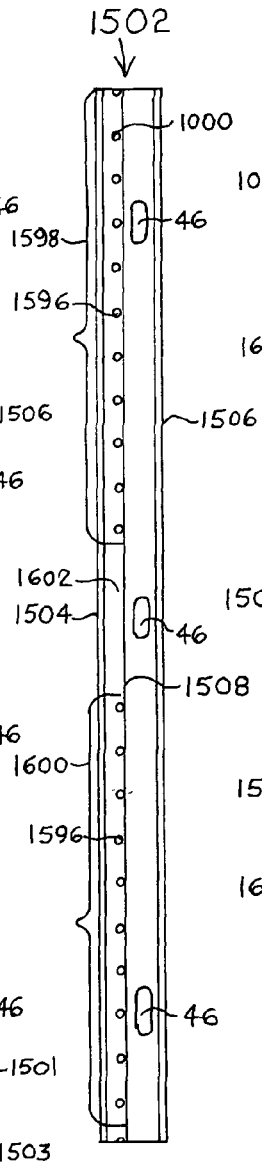
FIG. 9 is a side elevational view of a stud according to various embodiments of the present invention.
Figure 10:
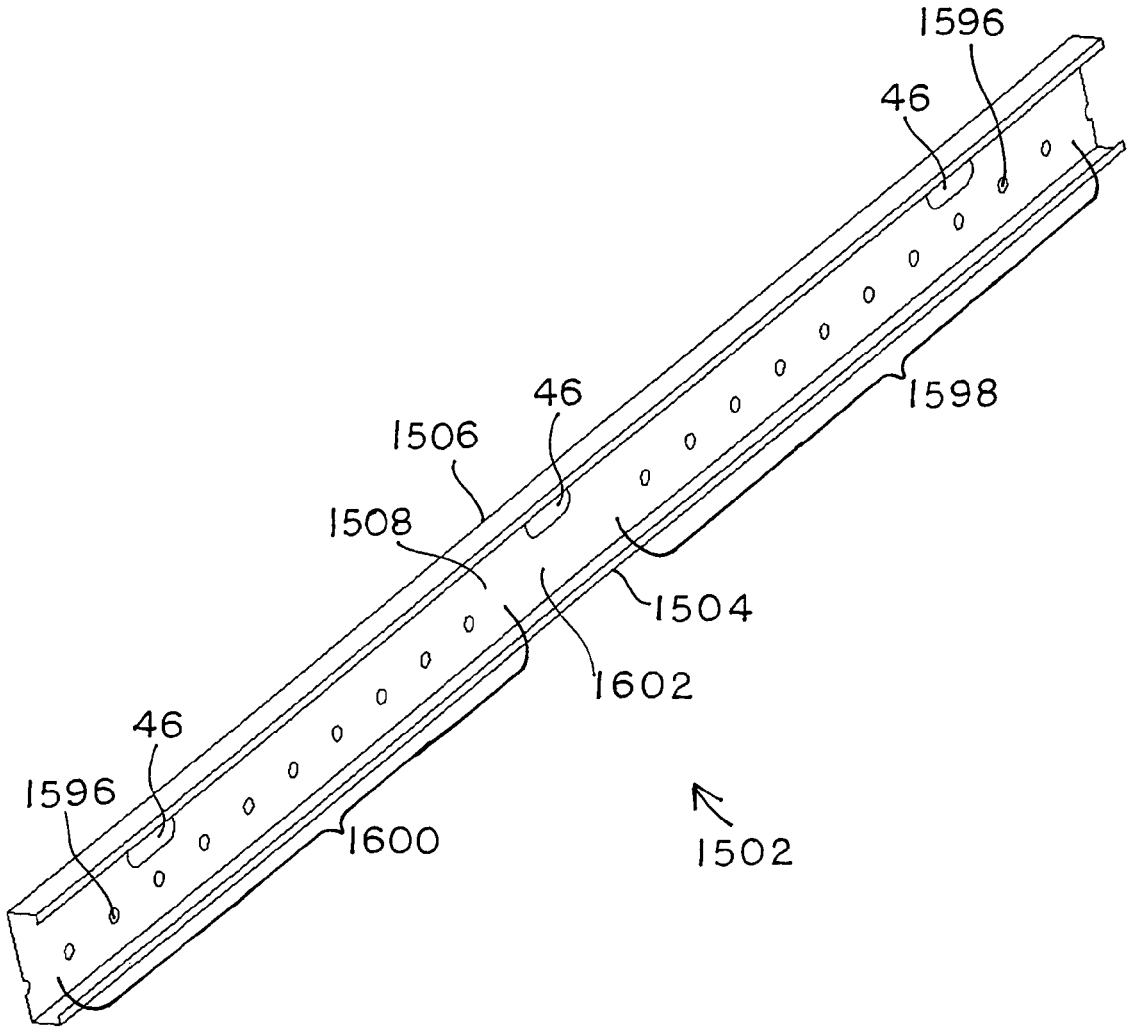
FIG. 10 is a perspective view of a stud according to various embodiments of the present invention.

Referring now to FIGS. 9 and 10, the first side portion 1504 of the body 1502 comprises a web 1508 with a plurality of holes 1596 along the length of the body 1502. The holes 1596 may have a generally circular shape and comprise a first series of holes 1598 generally evenly spaced along the length of the body 1502 and a second series of holes 1600 that may be generally evenly spaced along the length of the body 1502. The first series of holes 1598 may be spaced from the second series of holes 1600 by a central portion 1602 of the body 1502 that is free of holes. Each of the holes of the first series of holes 1598 and the second series of holes 1600 may have a diameter of about 0.79 inches (2 cm) to about 1.58 inches (4 cm), for example 1.20 inches (3.05 cm). However, the sizes, shapes, numbers and spacing arrangement of these holes may vary without departing from the spirit and scope of the present invention.

The length of the central portion 1602 can vary as desired, for example, the central portion 1602 can be 1/10 to 1/5 of the overall length of the stud. In one embodiment, the central portion 1602 is about 1/7 of the total length of the stud. The second side portion 1506 of the body comprises web 1508 that may have three, generally oval shaped utility holes 46. Likewise, the sizes, shapes, numbers and spacing arrangement of these holes may vary without departing from the spirit and scope of the present invention.

Figure 11:
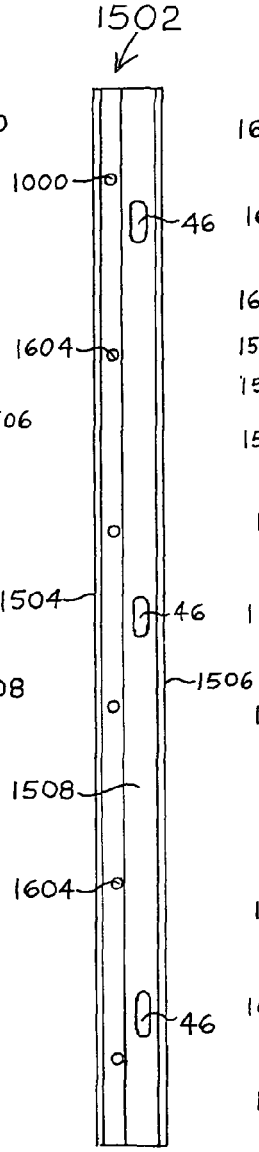
FIG. 11 is a side elevational view of a stud according to various embodiments of the present invention.
Figure 12:
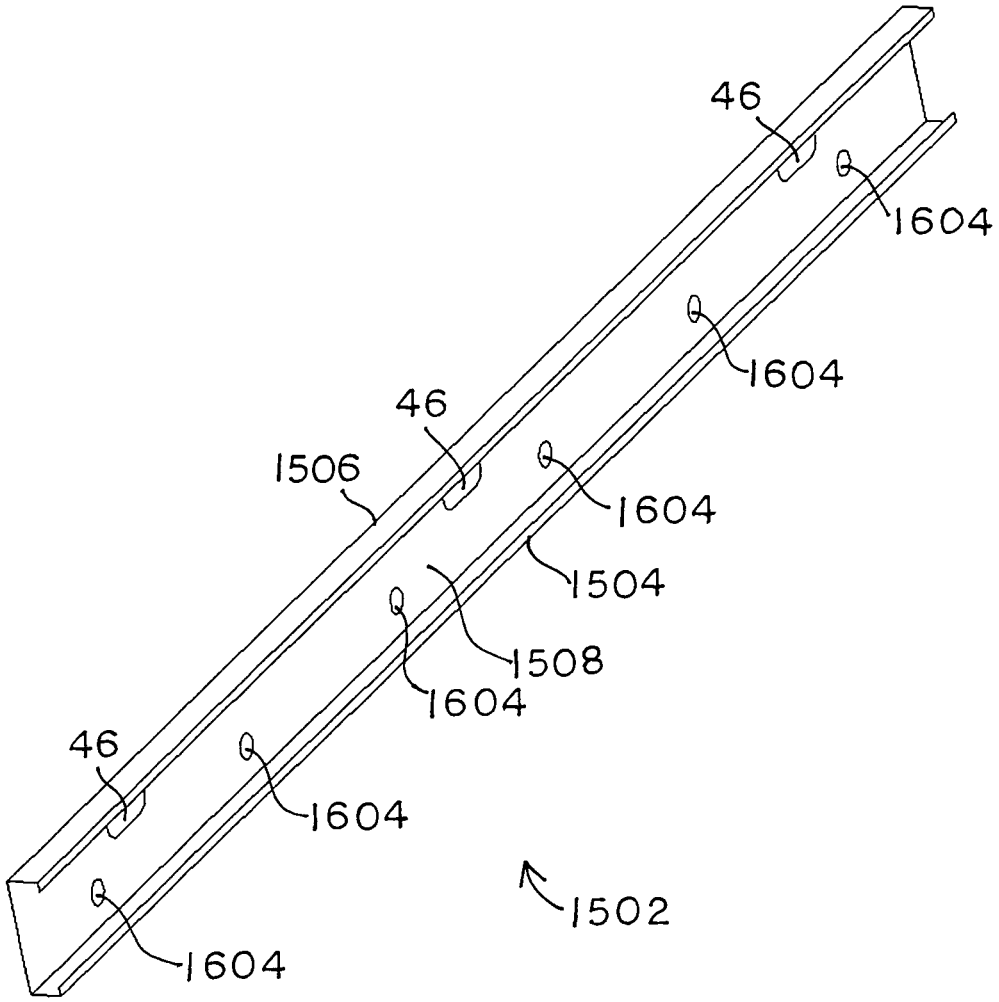
FIG. 12 is a perspective view of a stud according to various embodiments of the present invention.

Referring now to FIGS. 11 and 12, the side portion end 1504 of body 1502 comprises a web 1508 that may have six generally circular holes 1604 extending along the length of the body 1502. The six holes 1604 may be generally evenly spaced along the length of the body 1502. Each of the six holes 1604 may have a diameter of about 0.79 inches (2 cm) to about 1.58 inches (4 cm), for example 1.20 inches (3.05 cm). However, the sizes, shapes, numbers and spacing arrangement of these holes may vary without departing from the spirit and scope of the present invention. The second side portion 1506 of the body 1502 comprises web 1508 that may have three, generally oval shaped utility holes 46. Likewise, the sizes, shapes, numbers and spacing arrangement of these holes may vary without departing from the spirit and scope of the present invention.

Figure 13:
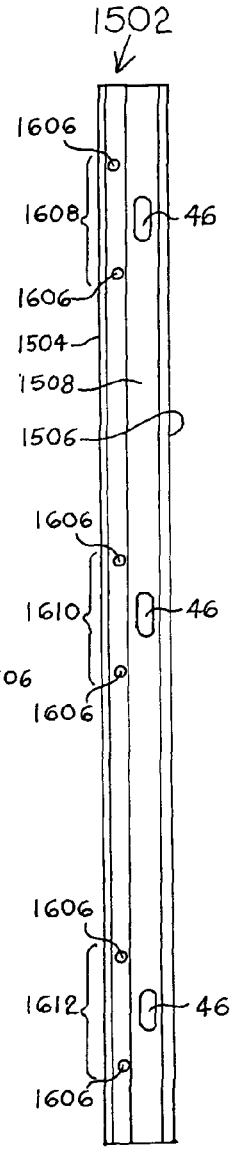
FIG. 13 is a side elevational view of a stud according to various embodiments of the present invention.
Figure 14:
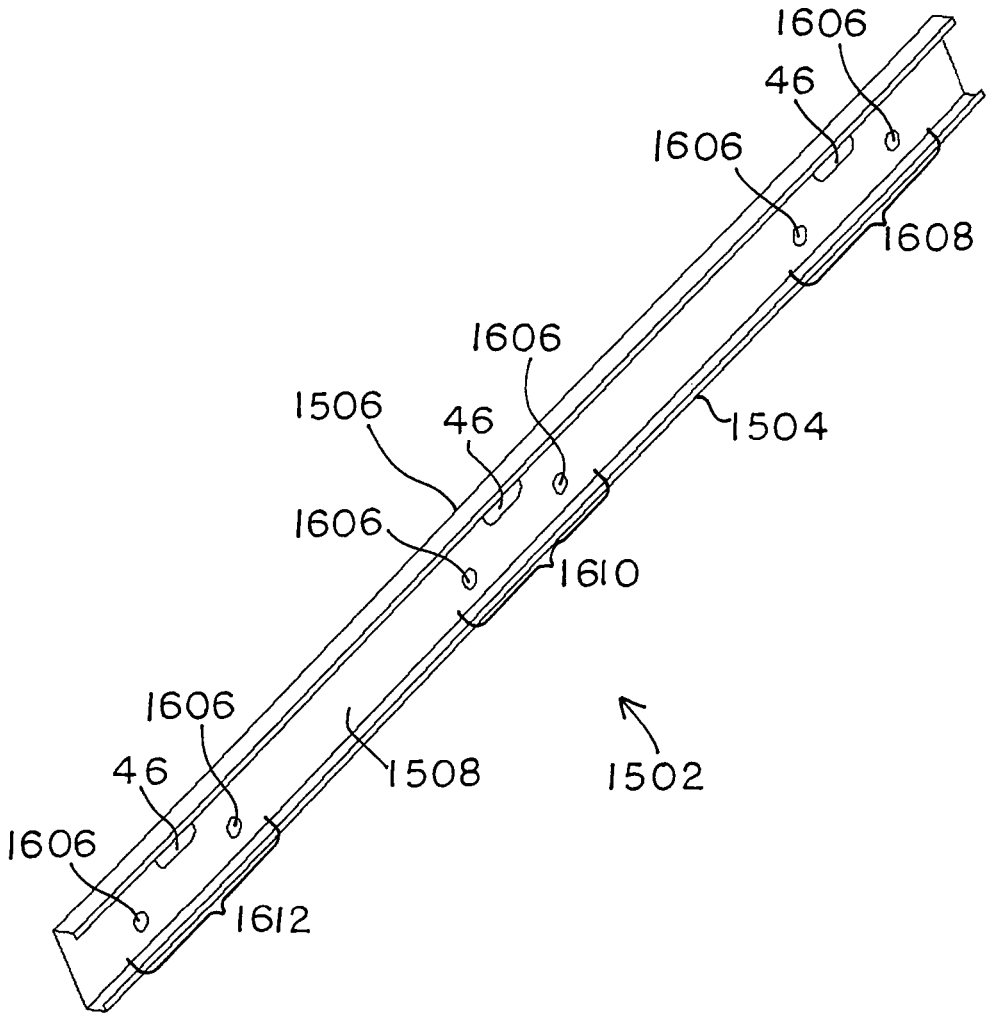
FIG. 14 is a perspective view of a stud according to various embodiments of the present invention.

Referring now to FIGS. 13 and 14, the first side portion 1504 of body 1502 may comprise a web 1508 with six generally circular holes 1606 extending along the length of the body 1502. The six holes 1606 may be positioned along the length of the body 1502 in a first group of two evenly spaced holes 1608, a second group of two evenly spaced holes 1610 and a third group of two evenly spaced holes 1612. The distance between a second hole 1606 of the first group 1608 and a first hole 1606 of the second group 1610 may be the same as the distance from a second hole 1606 of the second group 1610 to a first hole 1606 of the third group 1612. Each of the six holes 1606 may have a diameter of about 0.79 inches (2 cm) to about 1.58 inches (4 cm), for example 1.20 inches (3.05 cm). However, the sizes, shapes, numbers and spacing arrangement of these holes may vary without departing from the spirit and scope of the present invention.

Referring now to FIG. 78, the first side portion 1504 of body 1502 comprises a web 1508 that may have a first row 1614 of evenly spaced elongated or oval holes 1616, a second row 1618 of evenly spaced elongated or oval holes 1620 and a row 1622 of evenly spaced circular holes 1624 positioned between the first row 1614 of elongated or oval holes 1616 and the second row 1618 of elongated or oval holes 1620. Each hole of the row 1622 of circular holes 1624 may have a diameter of about 0.79 inches (2 cm) to about 1.58 inches (4 cm), for example 1.20 inches (3.05 cm). Each hole 1620 of the second row 1618 of elongated or oval holes 1620 may have a length that is equal to the length of each hole 1616 of the first row 1614 of elongated or oval holes 1616, although the relative lengths of the respective holes may vary. For instance, each hole 1620 of the second row 1618 of elongated or oval holes 1620 and each hole 1616 of the first row 1614 of elongated or oval holes 1616 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). However, the sizes, shapes, numbers and spacing arrangement of these holes may vary without departing from the spirit and scope of the present invention.

Figure 17:
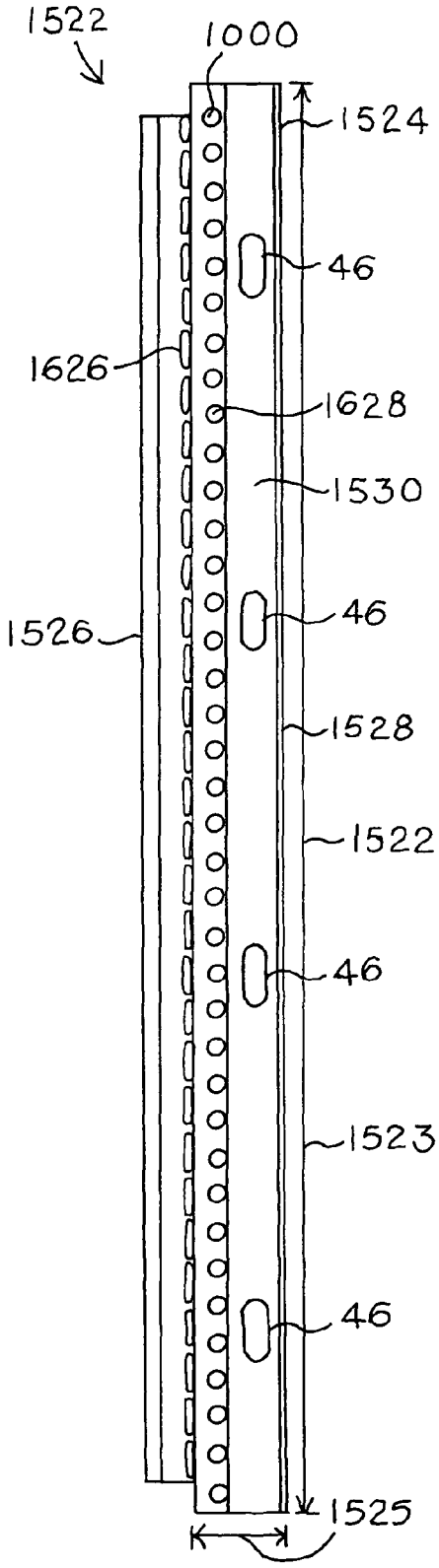
FIG. 17 is a side elevational view of a stud according to various embodiments of the present invention.
Figure 18:
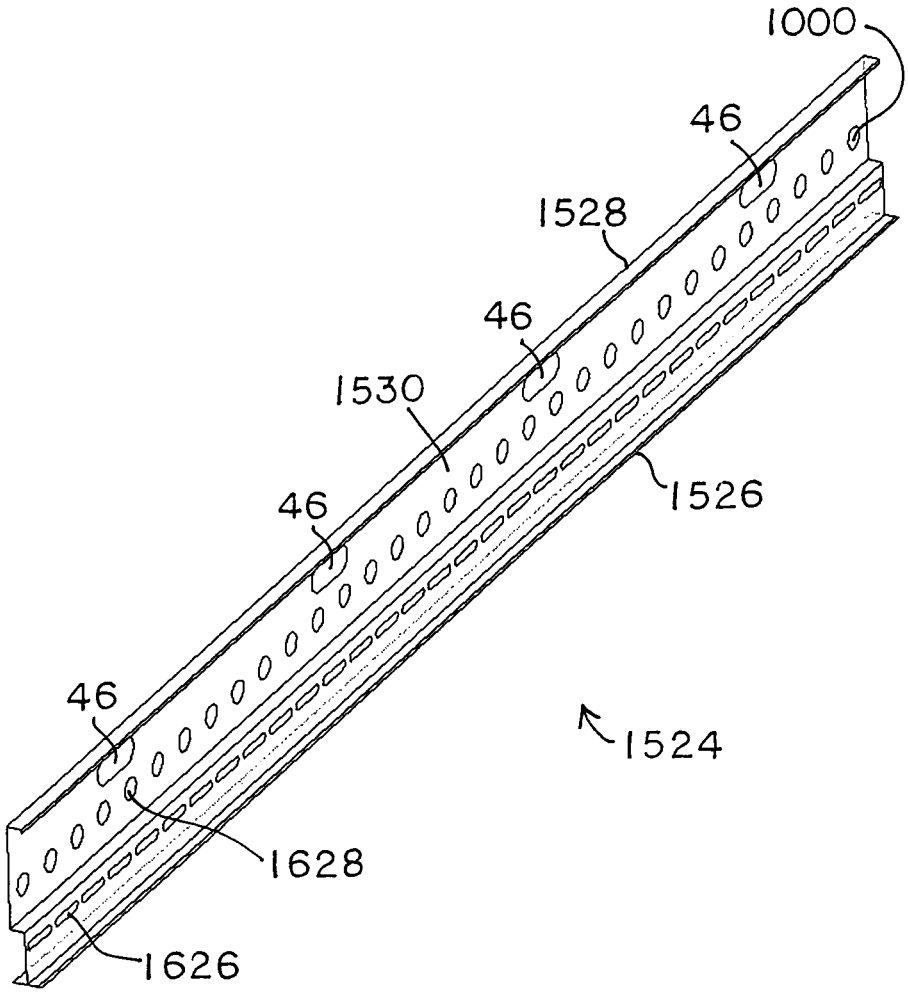
FIG. 18 is a perspective view of a stud according to various embodiments of the present invention.

Referring now to FIGS. 17 and 18, the first side portion 1526 of body 1524 comprises a plurality of equally spaced, elongated or oval holes 1626 extending along a length of the second web 1538 and positioned adjacent to the first flange 1536, and a plurality of equally spaced, generally circular holes 1628 extending along a length of the first web 1530 on the other side of the first flange 1536. Each hole of the plurality of elongated or oval holes 1626 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). Each hole of the plurality of circular holes 1628 may have a diameter of about 0.79 inches (2 cm) to about 1.58 inches (4 cm), for example 1.20 inches (3.05 cm). However, the sizes, shapes, numbers and spacing arrangement of these holes may vary without departing from the spirit and scope of the present invention. The second side portion 1528 of the body 1524 may comprise four, generally oval shaped utility holes 46 extending along the length of the first web 1530. Likewise, the sizes, shapes, numbers and spacing arrangement of these holes may vary without departing from the spirit and scope of the present invention.

Figure 21:
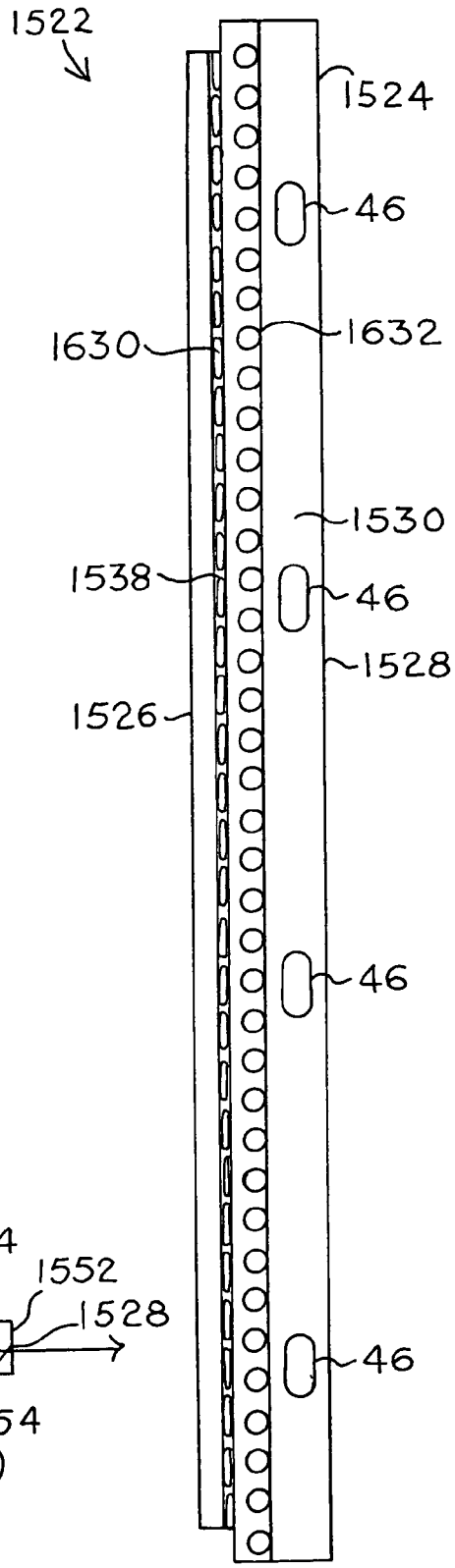
FIG. 21 is a side elevational view of a stud according to various embodiments of the present invention.
Figure 22:
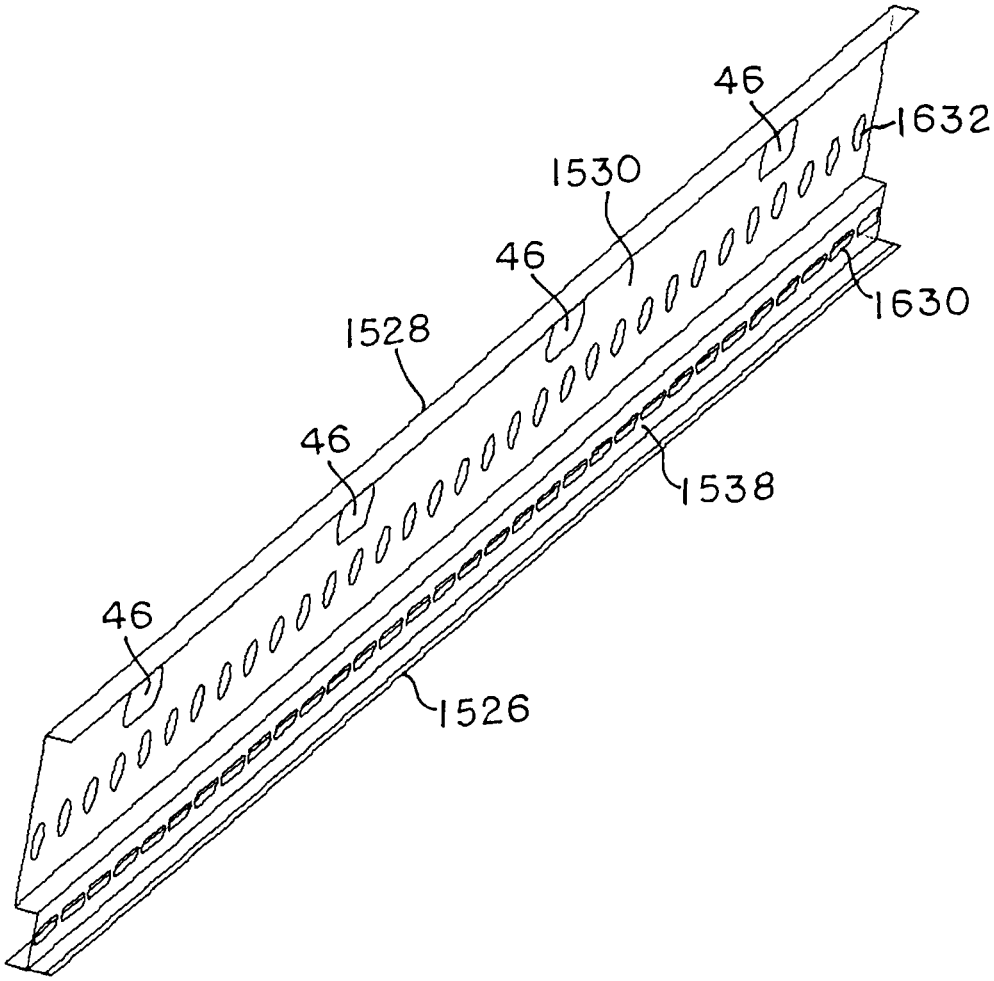
FIG. 22 is a perspective view of a stud according to various embodiments of the present invention.

Referring now to FIGS. 21 and 22, the first side portion 1526 of body 1524 may comprise a plurality of equally spaced, elongated or oval holes 1630 extending along a length of the second web 1538 and positioned in the center of the second web 1538, and a plurality of equally spaced, generally circular holes 1632 extending along a length of the first web 1530. Each hole of the plurality of elongated or oval holes 1630 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). Each hole of the plurality of circular holes 1632 may have a diameter of about 0.79 inches (2 cm) to about 1.58 inches (4 cm), for example 1.20 inches (3.05 cm). However, the sizes, shapes, numbers and spacing arrangement of these holes may vary without departing from the spirit and scope of the present invention. The second side portion 1528 of the body 1524 may comprise four, generally oval shaped utility holes 46 extending along the length of the first web 1530. Likewise, the sizes, shapes, numbers and spacing arrangement of these holes may vary without departing from the spirit and scope of the present invention.

Figure 25:
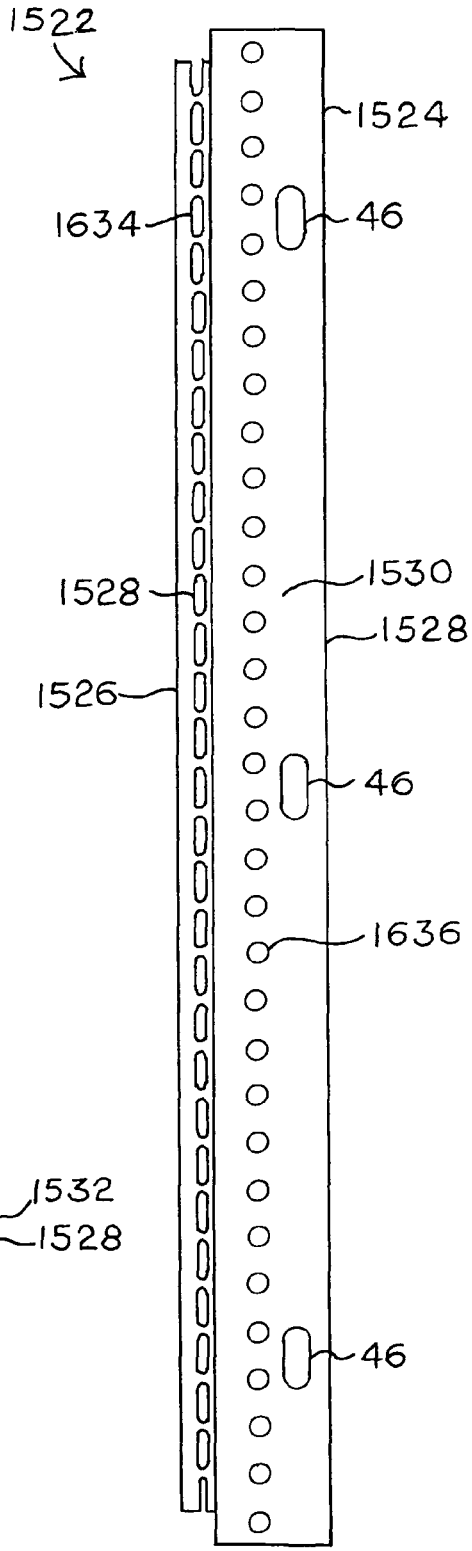
FIG. 25 is a side elevational view of a stud according to various embodiments of the present invention.
Figure 26:
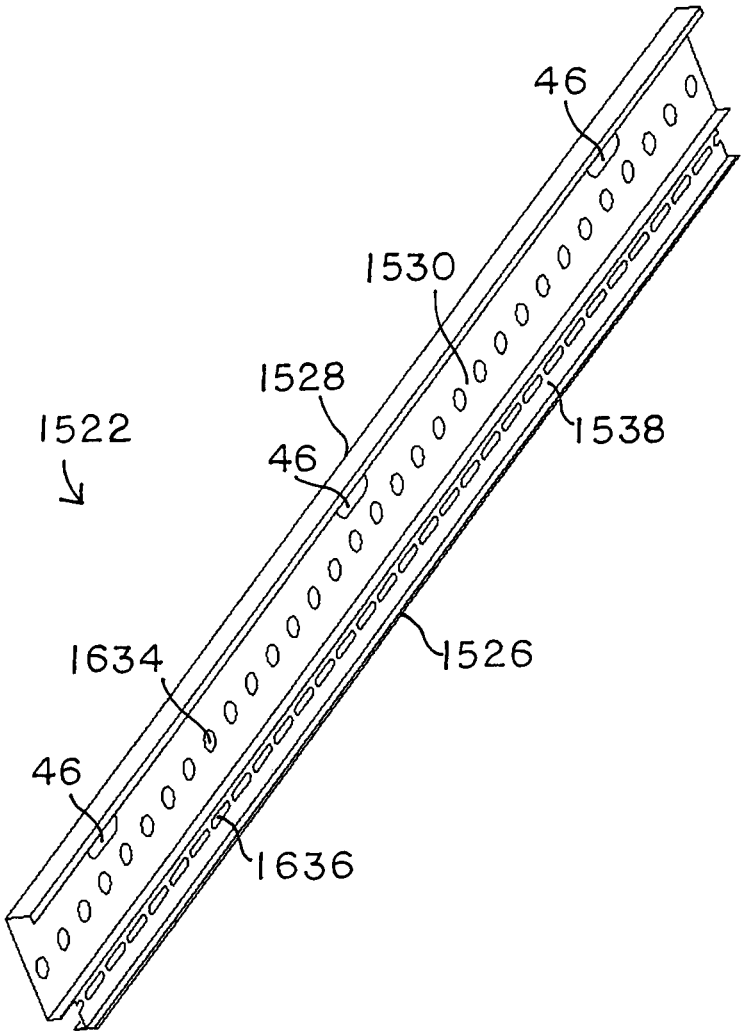
FIG. 26 is a perspective view of a stud according to various embodiments of the present invention.

Referring now to FIGS. 25 and 26, the first side portion 1526 of body 1524 may comprise a plurality of equally spaced, elongated or oval holes 1634 extending along a length of the second web 1538 and adjacent to the first flange 1536, and a plurality of equally spaced, generally circular holes 1636 extending along a length of the first web 1530. Each hole of the plurality of elongated or oval holes 1634 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). Each hole of the plurality of circular holes 1636 may have a diameter of about 0.79 inches (2 cm) to about 1.58 inches (4 cm), for example 1.20 inches (3.05 cm). However, the sizes, shapes, numbers and spacing arrangement of these holes may vary without departing from the spirit and scope of the present invention. The second side portion 1528 of the body 1524 may comprise three, generally oval shaped utility holes 46 extending along the length of the first web 1530. Likewise, the sizes, shapes, numbers and spacing arrangement of these holes may vary without departing from the spirit and scope of the present invention.

Figure 29:
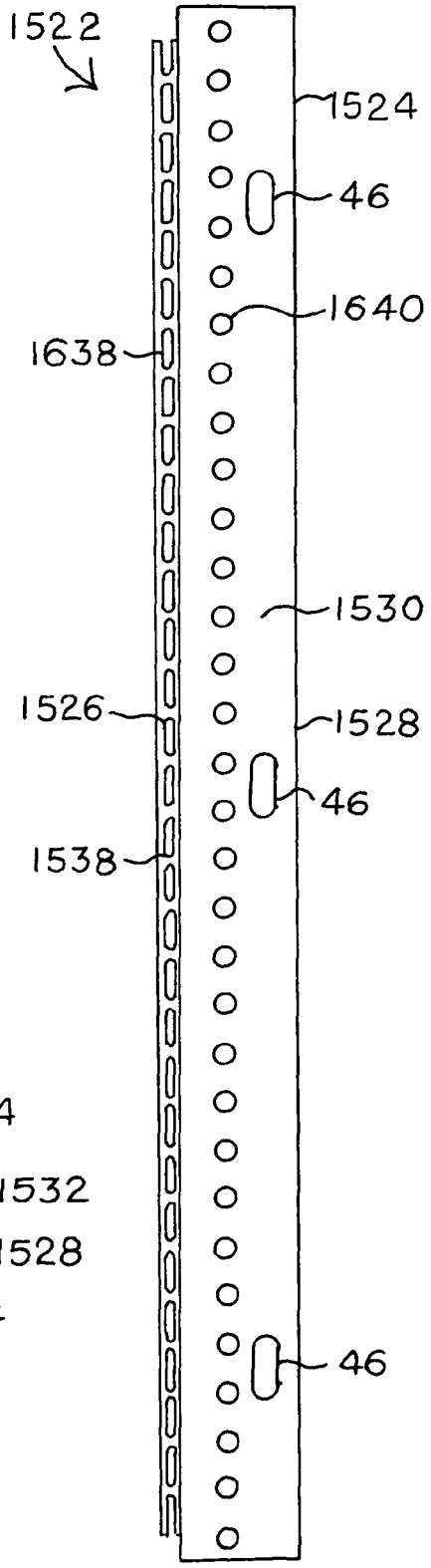
FIG. 29 is a side elevational view of a stud according to various embodiments of the present invention.
Figure 30:
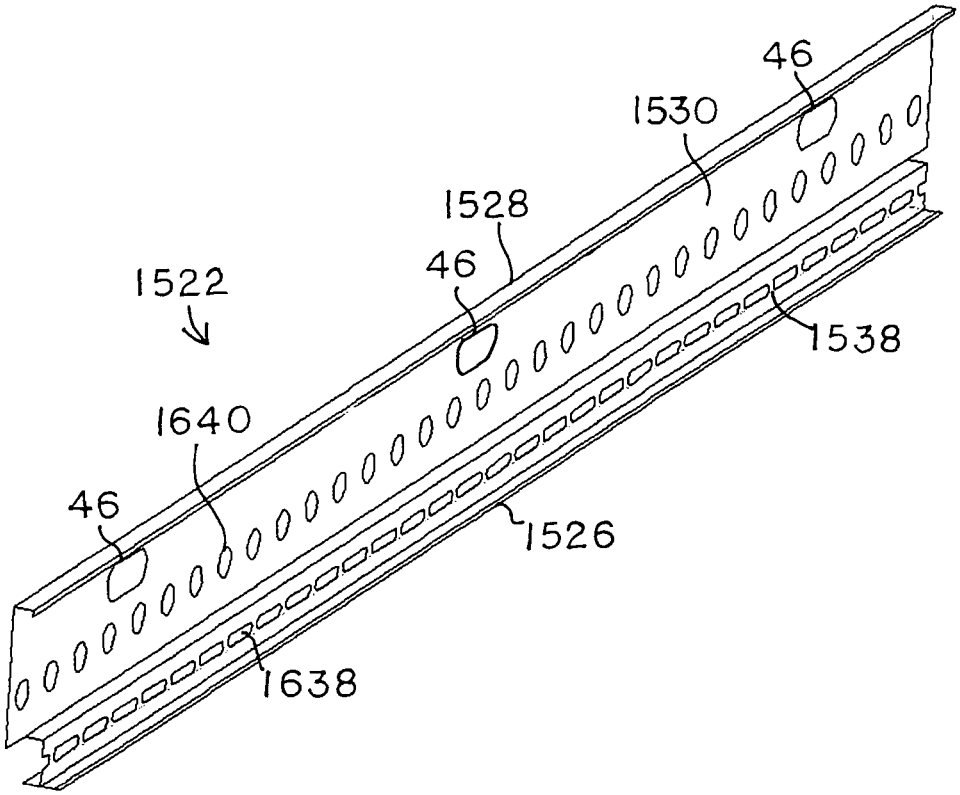
FIG. 30 is a perspective view of a stud according to various embodiments of the present invention.

Referring now to FIGS. 29 and 30, the first side portion 1526 of body 1524 may comprise a plurality of equally spaced, elongated or oval holes 1638 extending along a length of the second web 1538 and positioned in the center of the second web 1538. The first side portion 1526 may also comprise a plurality of equally spaced, generally circular holes 1640 extending along a length of the first web 1530. Each hole of the plurality of elongated or oval holes 1638 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). Each hole of the plurality of circular holes 1640 may have a diameter of about 0.79 inches (2 cm) to about 1.58 inches (4 cm), for example 1.20 inches (3.05 cm). However, the sizes, shapes, numbers and spacing arrangement of these holes may vary without departing from the spirit and scope of the present invention. The second side portion 1528 of the body 1524 may comprise three, generally oval shaped utility holes 46 extending along the length of the first web 1530. Likewise, the sizes, shapes, numbers and spacing arrangement of these holes may vary without departing from the spirit and scope of the present invention.

Figure 33:
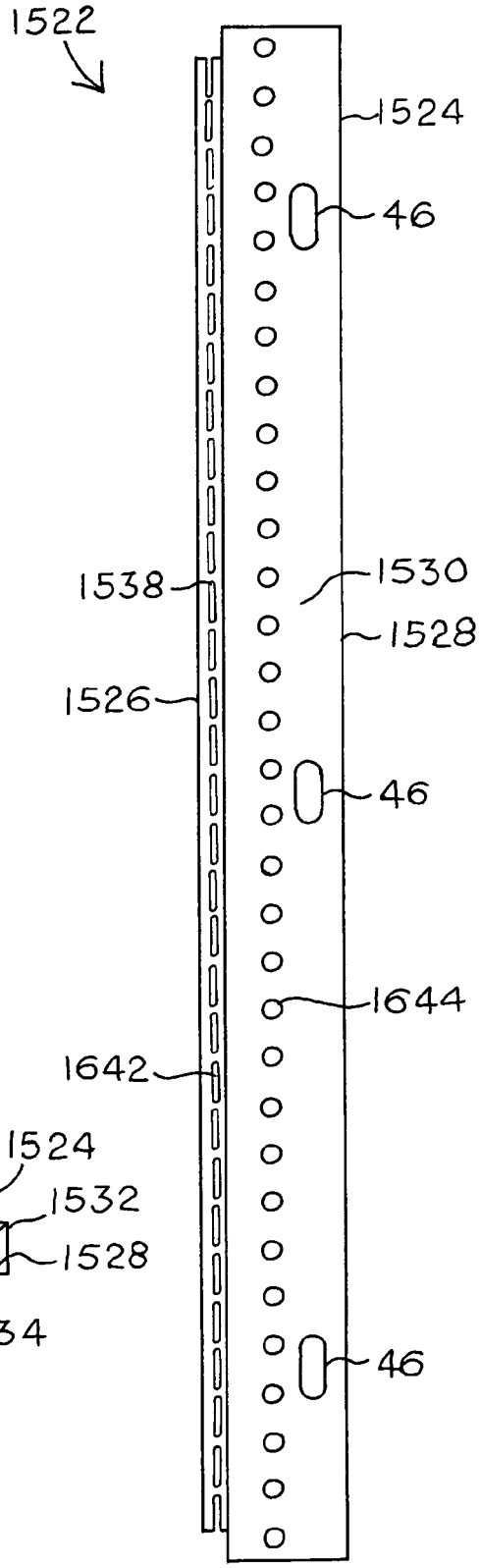
FIG. 33 is a side elevational view of a stud according to various embodiments of the present invention.
Figure 34:
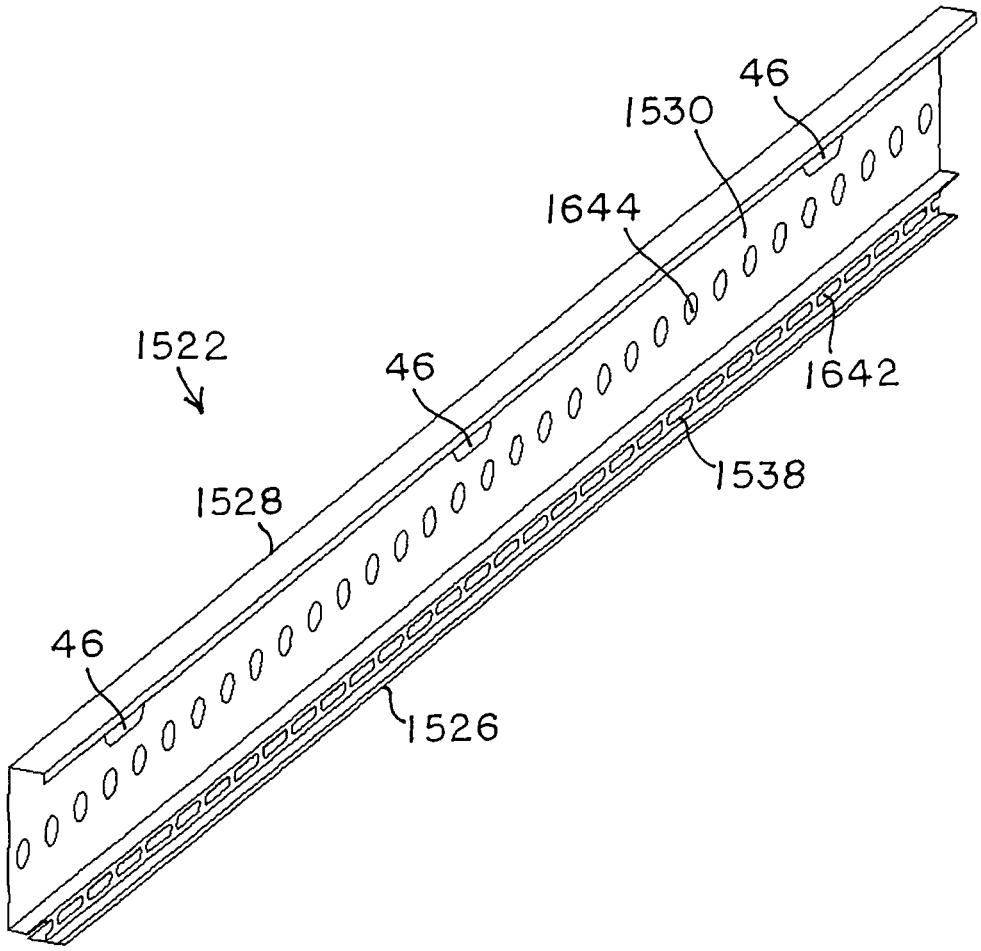
FIG. 34 is a perspective view of a stud according to various embodiments of the present invention.

Referring now to FIGS. 33 and 34, the first side portion 1526 of body 1524 may comprise a plurality of equally spaced, elongated or oval holes 1642 extending along a length of the second web 1538 and positioned in the center of the second web 1538, and a plurality of equally spaced, generally circular holes 1644 extending along a length of the first web 1530. Each hole of the plurality of elongated or oval holes 1642 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). Each hole of the plurality of circular holes 1644 may have a diameter of about 0.79 inches (2 cm) to about 1.58 inches (4 cm), for example 1.20 inches (3.05 cm). However, the sizes, shapes, numbers and spacing arrangement of these holes may vary without departing from the spirit and scope of the present invention. The second side portion 1528 of the body 1524 may comprise three, generally oval shaped utility holes 46 extending along the length of the first web 1530. Likewise, the sizes, shapes, numbers and spacing arrangement of these holes may vary without departing from the spirit and scope of the present invention.

Figure 38:
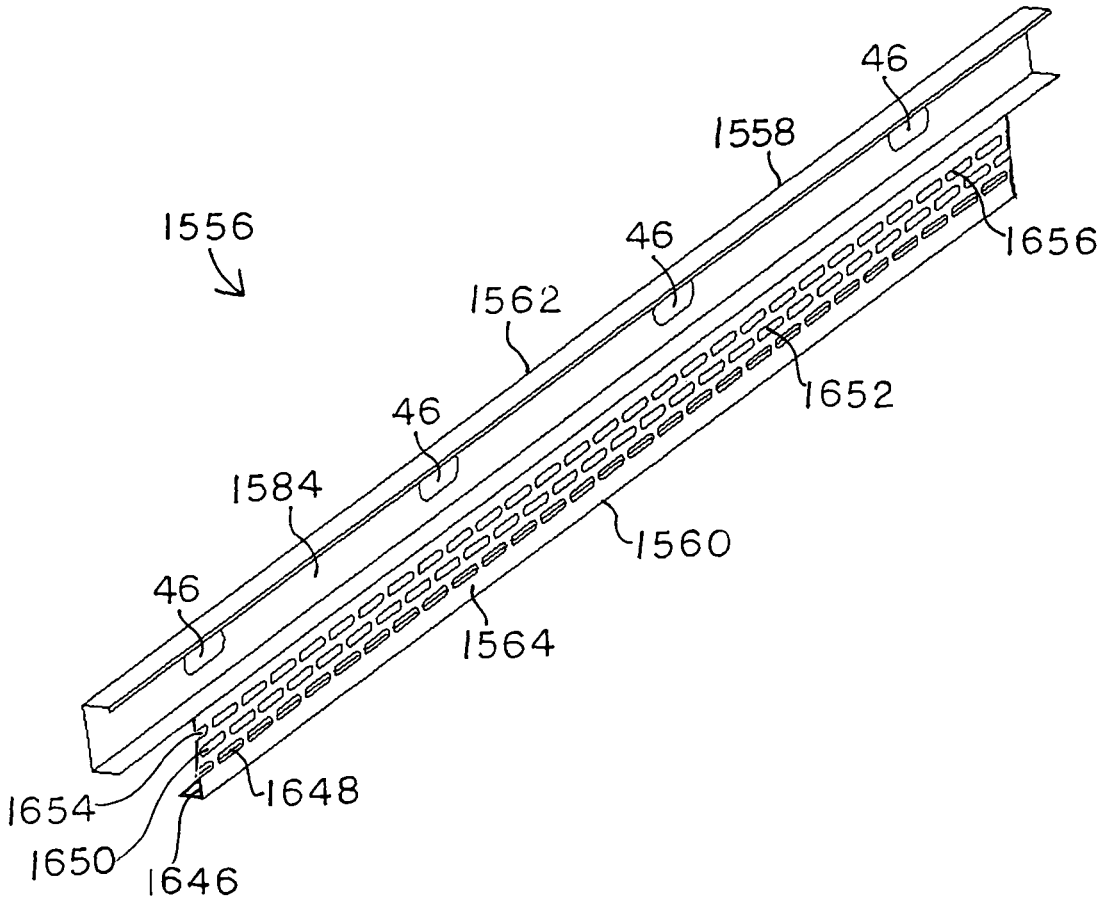
FIG. 38 is a perspective view of a stud according to various embodiments of the present invention.

Referring now to FIGS. 37 and 38, the first side portion 1560 of body 1558 may comprise a first row 1646 of equally spaced, elongated or oval holes 1648, a second row 1650 of equally spaced, elongated or oval holes 1652 and a third row 1654 of equally spaced, elongated or oval holes 1656. Each row 1646, 1650, 1654 extends along a length of the first web 1564. The second row 1650 of equally spaced, elongated or oval holes 1652 may be offset with respect to the first and third rows 1646, 1654 of equally spaced, elongated or oval holes 1648, 1656, i.e., the center of holes 1648, 1656 are aligned and the centers of holes 1652 are offset with respect thereto. Each hole of each row 1646, 1650, 1654 of elongated or oval holes 1648, 1652, 1656 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). However, the sizes, shapes, numbers and spacing arrangement of these holes may vary without departing from the spirit and scope of the present invention. The second side portion 1562 of the body 1558 may comprise four, generally oval shaped utility holes 46 extending along the length of the second web 1584. Likewise, the sizes, shapes, numbers and spacing arrangement of these holes may vary without departing from the spirit and scope of the present invention. Further, the second web portion 1584 has a length that is greater than the length of the first web portion 1564, as shown in FIG. 38, thereby creating a notch. The notch allows for secure attachment to a framing system.

Figure 39:
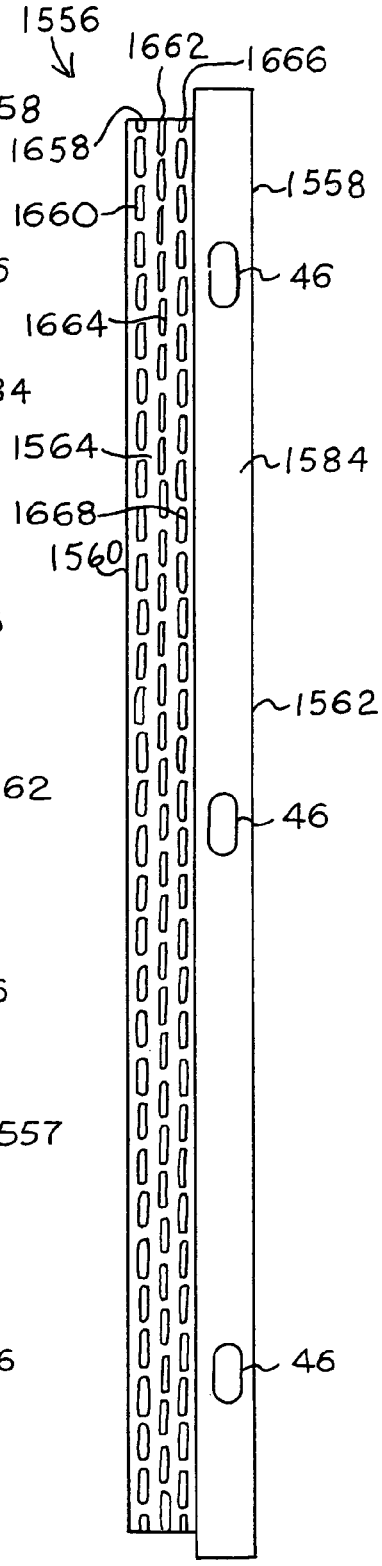
FIG. 39 is a side elevational view of a stud according to various embodiments of the present invention.
Figure 40:
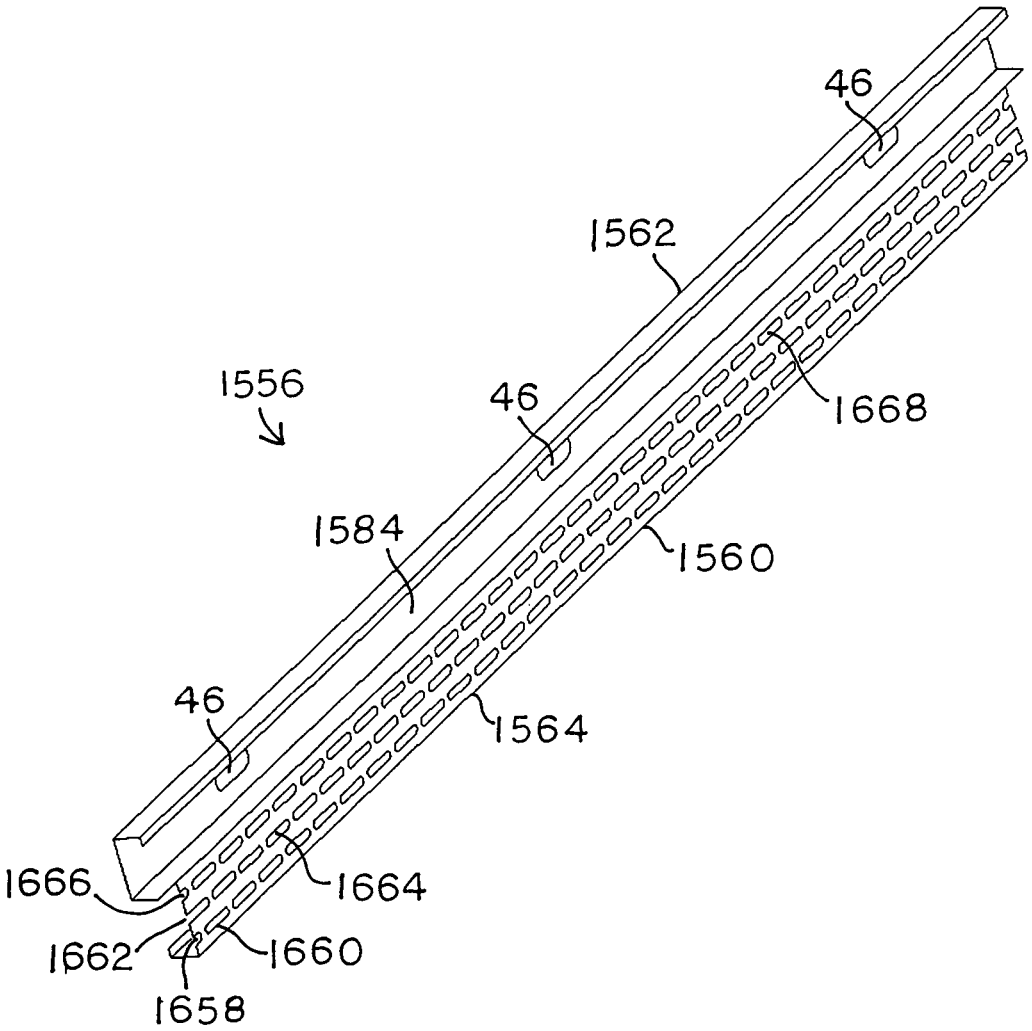
FIG. 40 is a perspective view of a stud according to various embodiments of the present invention.
Figure 44:
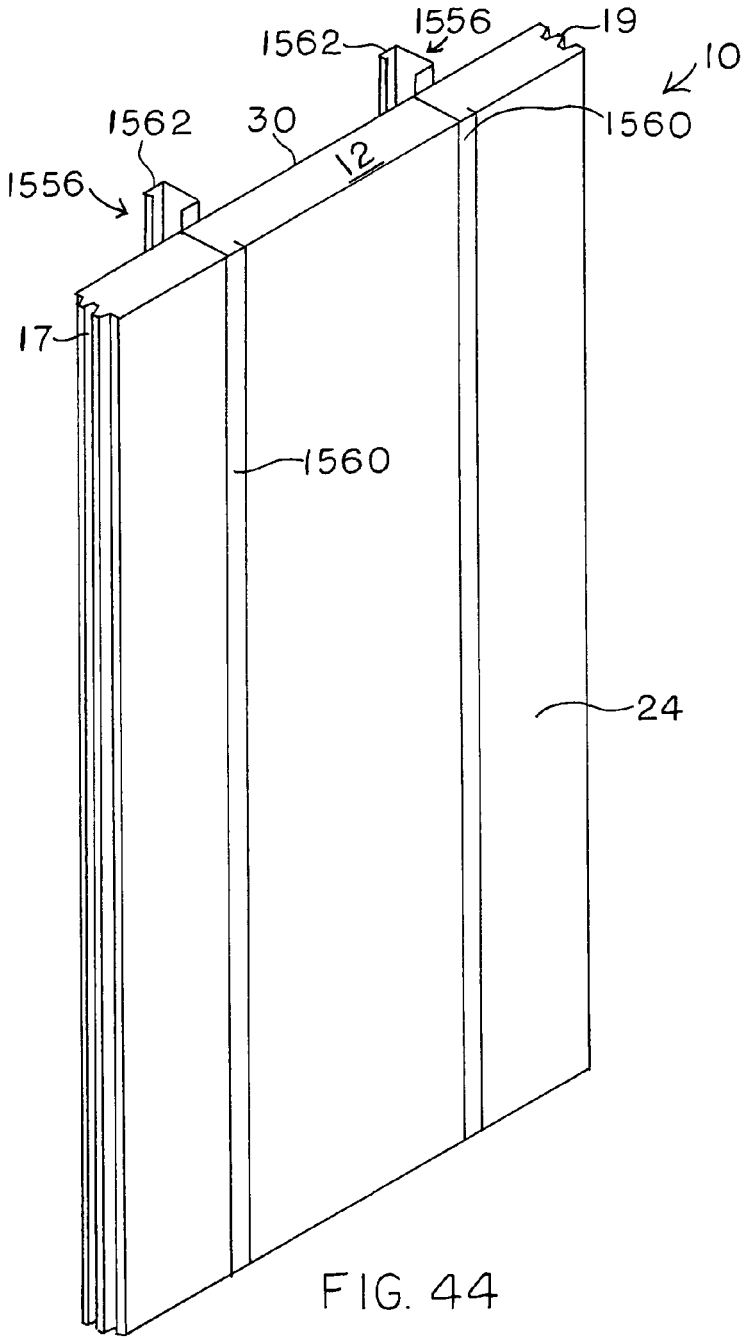
FIG. 44 is a perspective view of the building panel of FIG. 41.

Referring now to FIGS. 39 and 40, the first side portion 1560 of body 1558 may comprise a first row 1658 of equally spaced, elongated or oval holes 1660, a second row 1662 of equally spaced, elongated or oval holes 1664 and a third row 1666 of equally spaced, elongated or oval holes 1668. Each row 1658, 1662, 1666 extends along a length of the first web 1564. The second row 1662 of equally spaced, elongated or oval holes 1664 may be offset with respect to the first and third rows 1658, 1666 of equally spaced, elongated or oval holes 1660, 1668. Each hole of each row 1658, 1662, 1666 of elongated or oval holes 1660, 1664, 1668 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). However, the sizes, shapes, numbers and spacing arrangement of these holes may vary without departing from the spirit and scope of the present invention. The second side portion 1562 of the body 1558 may comprise three, generally oval shaped utility holes 46 extending along the length of the second web 1584. Likewise, the sizes, shapes, numbers and spacing arrangement of these holes may vary without departing from the spirit and scope of the present invention.

Referring now to FIGS. 41-44, the first side portion 1560 of body 1558 may comprise a first row 1670 of equally spaced, elongated or oval holes 1672, a second row 1674 of equally spaced, elongated or oval holes 1676 and a third row 1678 of equally spaced, elongated or oval holes 1680. See FIG. 43. Each row 1670, 1674, 1678 extends along a length of the first web 1564. The second row 1674 of equally spaced, elongated or oval holes 1676 may be offset with respect to the first and third rows 1670, 1678 of equally spaced, elongated or oval holes 1672, 1680. Each hole of each row 1670, 1674, 1678 of elongated or oval holes 1672, 1676, 1680 may have a length of about 1.97 inches (5 cm) to about 2.76 inches (7 cm), for example 2.36 inches (6 cm), and a width of 0.20 inches (0.5 cm) to 0.79 inches (2 cm), for example 0.591 in (1.5 cm). However, the sizes, shapes, numbers and spacing arrangement of these holes may vary without departing from the spirit and scope of the present invention. The second side portion 1562 of the body 1558 may comprise three, generally oval shaped knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 46:
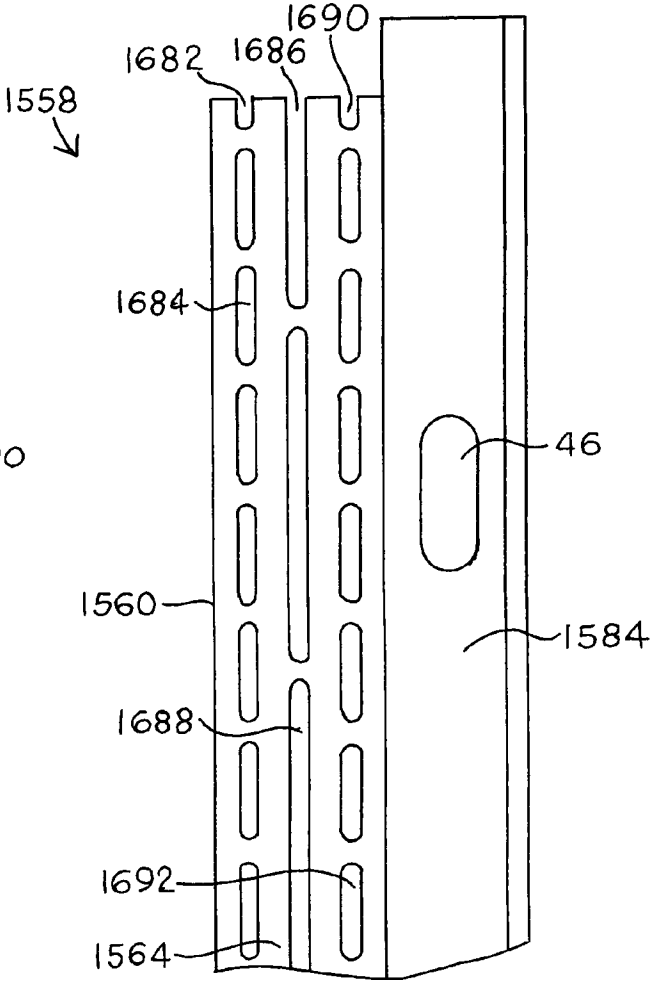
FIG. 46 is a side elevational view of a portion of a stud according to various embodiments of the present invention.
Figure 45:
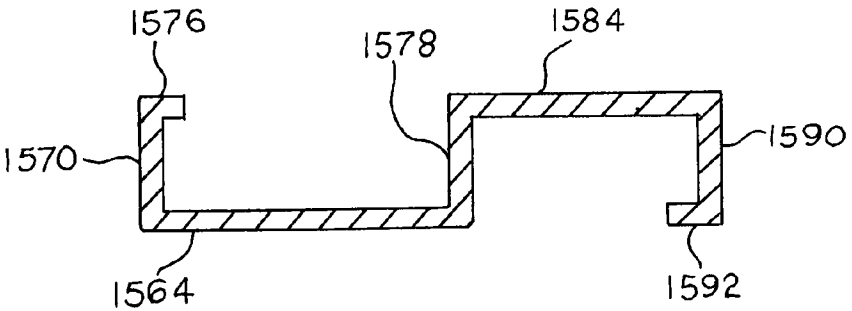
FIG. 45 is a cross-sectional view of a stud according to various embodiments of the present invention.

Referring now to FIGS. 45 and 46, the first side portion 1560 of body 1558 may comprise a first row 1682 of equally spaced, elongated or oval holes 1684, a second row 1686 of equally spaced, elongated or oval holes 1688 and a third row 1690 of equally spaced, elongated or oval holes 1692. Each row 1682, 1686, 1690 extends along a length of the first web 1564. The second row 1686 of equally spaced, elongated or oval holes 1688 may be offset with respect to the first and third rows 1682, 1690 of equally spaced, elongated or oval holes 1684, 1692. Also, each hole 1688 of the second row 1686 of elongated or oval holes 1688 may have a length that is greater than the length of each hole of the first and third rows 1682, 1690 of elongated or oval holes 1684, 1692. Each hole of each row 1682, 1690 of elongated or oval holes 1684, 1692 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). Each hole of row 1686 of elongated or oval holes 1688 may have length of about 7.87 in (20 cm) to about 9.45 in (24 cm), for example 8.50 in (21.6 cm). However, the sizes, shapes, numbers and spacing arrangement of these holes may vary without departing from the spirit and scope of the present invention. The second side portion 1562 of the body 1558 may comprise three, generally oval shaped knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 48:
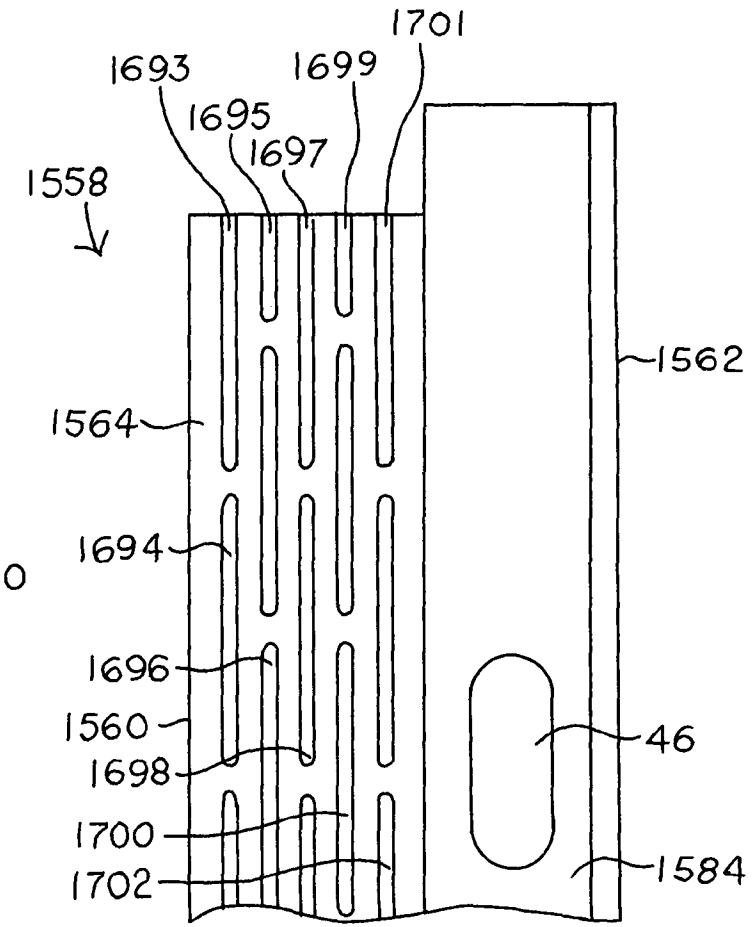
FIG. 48 is a side elevational view of a portion of a stud according to various embodiments of the present invention.
Figure 47:
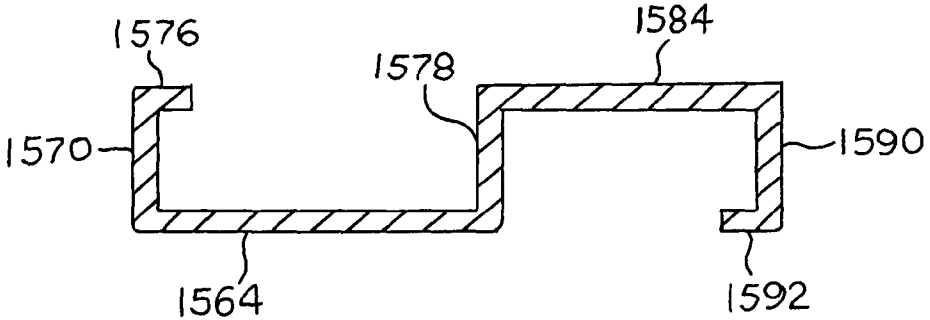
FIG. 47 is a cross-sectional view of a stud according to various embodiments of the present invention.

Referring now to FIGS. 47 and 48, the first side portion 1560 of body 1558 may comprise a first row 1693 of equally spaced, elongated or oval holes 1694, a second row 1695 of equally spaced, elongated or oval holes 1696, a third row 1697 of equally spaced, elongated or oval holes 1698, a fourth row 1699 of equally spaced, elongated or oval holes 1700 and a fifth row 1701 of equally spaced, elongated or oval holes 1702 extending along a length of the first web 1564. The second and fourth rows 1695 and 1699 may be offset with respect to the first, third and fifth rows 1693, 1697 and 1701. Each hole of each row 1693, 1695, 1697, 1699, 1701 of elongated or oval holes 1694, 1696, 1698, 1700 and 1702 may have a length of about 4.33 in (11 cm) to about 5.51 inches (14 cm), for example five inches (12.7 cm), and a width of 0.10 inches (0.25 cm) to 0.39 inches (1 cm), for example 0.25 inches (0.635 cm). However, the sizes, shapes, numbers and spacing arrangement of these holes may vary without departing from the spirit and scope of the present invention. The second side portion 1562 of the body 1558 may comprise three, generally oval shaped knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 50:
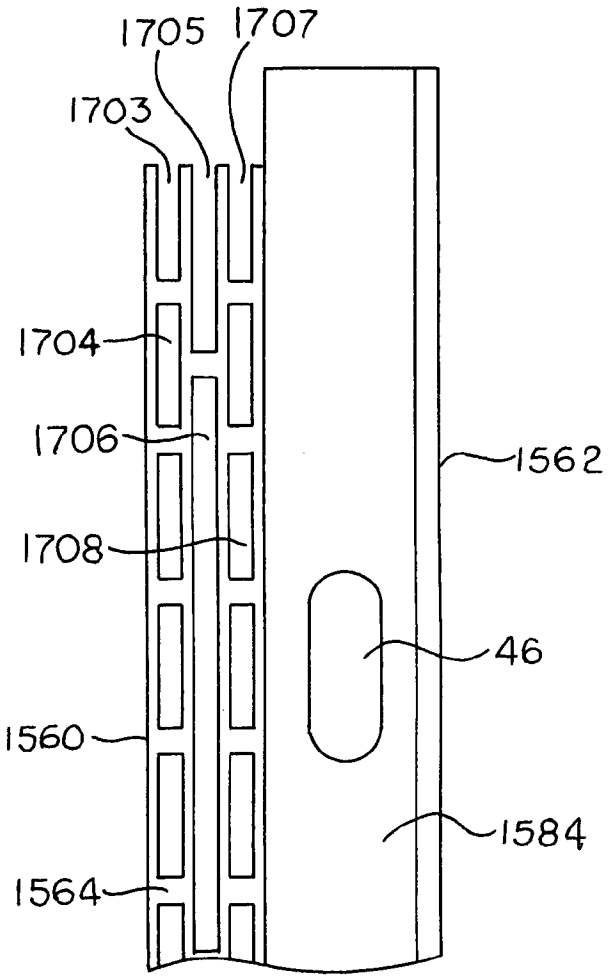
FIG. 50 is a side elevational view of a portion of a stud according to various embodiments of the present invention.
Figure 49:
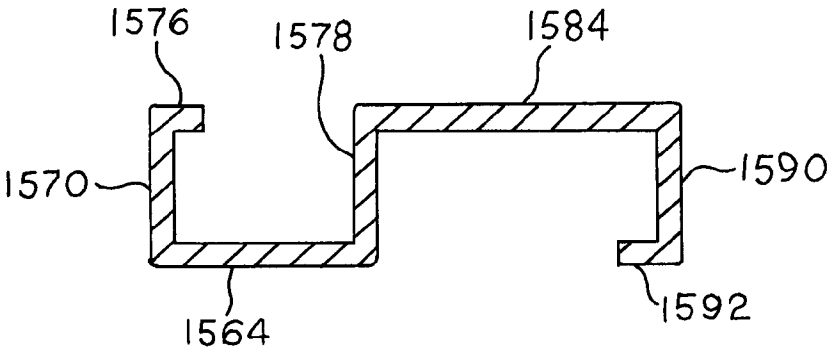
FIG. 49 is a cross-sectional view of a stud according to various embodiments of the present invention.

Referring now to FIGS. 49 and 50, the first side portion 1560 of body 1558 may comprise a first row 1703 of equally spaced, elongated or rectangular holes 1704, a second row 1705 of equally spaced, elongated or rectangular holes 1706 and a third row 1707 of equally spaced, elongated or rectangular holes 1708 extending along a length of the first web 1564. Each hole of the second row of elongated or rectangular holes 1706 may have a length that is greater than the length of each hole of the first and third rows of elongated or rectangular holes 1704 and 1706. Each hole of each row 1703, 1707 of elongated or rectangular holes 1704, 1708 may have a length of about 1.97 inches (5 cm) to about 2.76 inches (7 cm), for example 2.5 inches (6.35 cm), and a width of about 0.20 inches (0.5 cm) to about 0.79 inches (2 cm), for example 0.50 inch (1.27 cm). Each hole of row 1705 of elongated or rectangular holes 1688 may have length of about 10.63 in (27 cm) to about 15.60 in (32 cm), for example 11.5 in (29.2 cm) and a width of about 0.20 inches (0.5 cm) to about 0.79 inches (2 cm), for example 0.50 inch (1.27 cm). However, the sizes, shapes, numbers and spacing arrangement of these holes may vary without departing from the spirit and scope of the present invention. The second side portion 1562 of the body 1558 may comprise three, generally oval shaped knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 52:
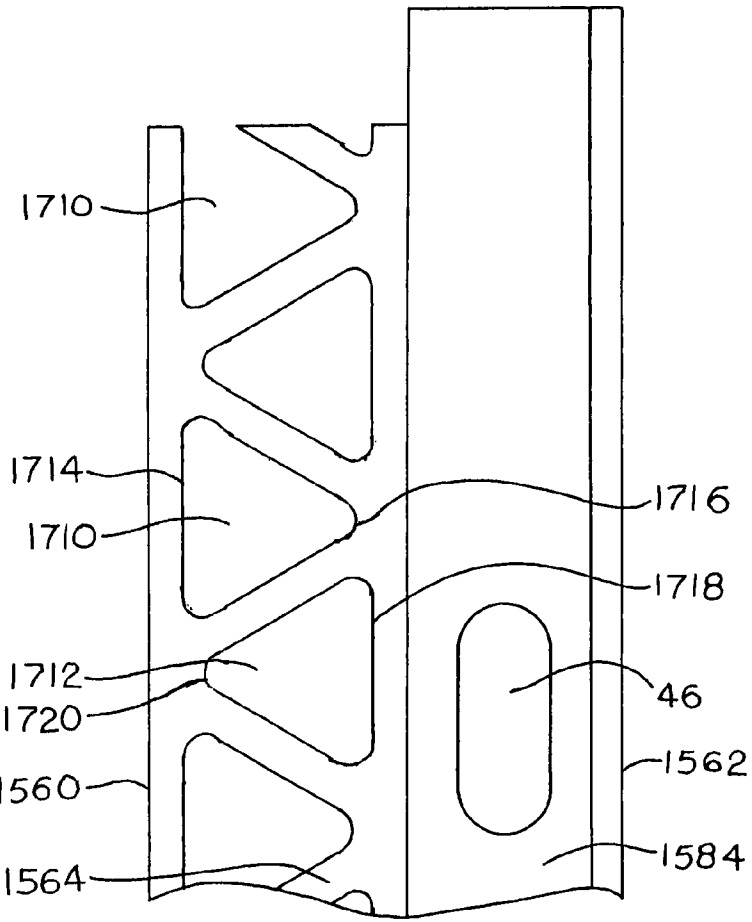
FIG. 52 is a side elevational view of a portion of a stud according to various embodiments of the present invention.
Figure 51:
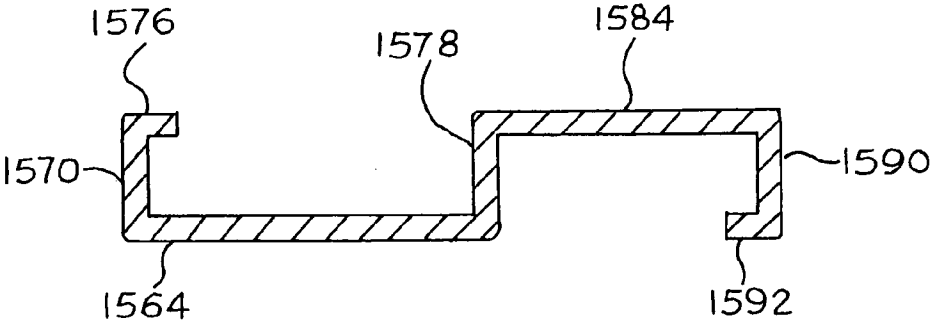
FIG. 51 is a cross-sectional view of a stud according to various embodiments of the present invention.
Figure 53:
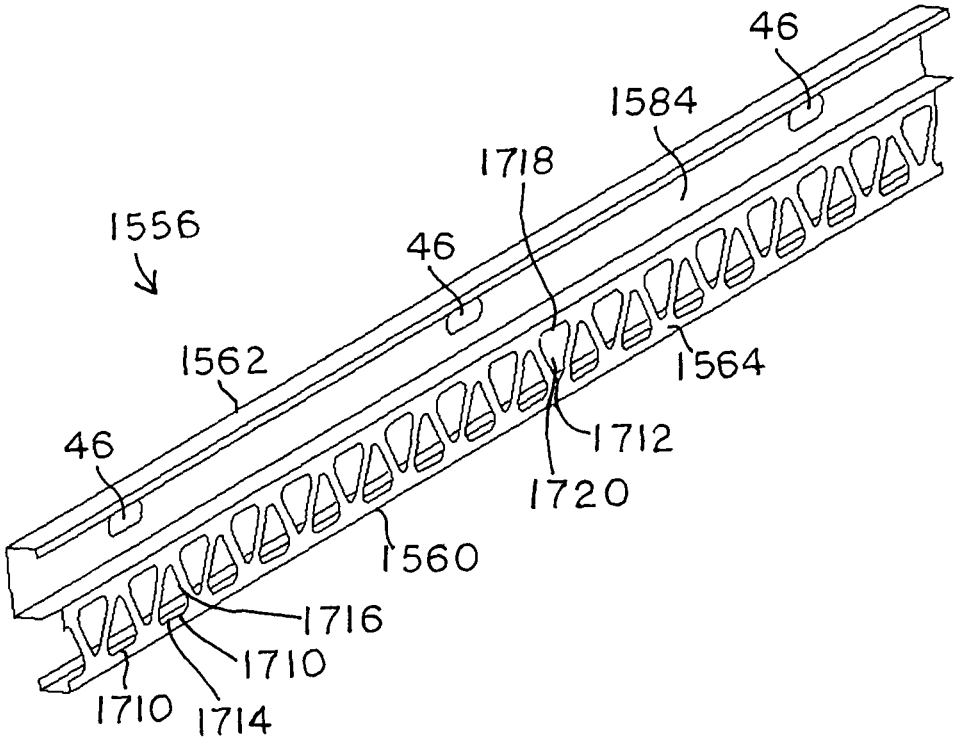
FIG. 53 is a perspective view of a stud according to various embodiments of the present invention.

Referring now to FIGS. 51-53, the first side portion 1560 of body 1558 may comprise a row of generally alternating first generally triangular slots 1710 and second generally triangular slots 1712 extending along a length of the first web 1564. The first triangular slots 1710 may comprise a base 1714 positioned generally parallel to an intersecting edge between the first web 1564 and the first flange 1570 of the first end 1560 of the body 1558 and an apex 1716 oriented toward the second flange 1578 of the second end 1562 of the body 1558. The second triangular slots 1712 may comprise a base 1718 positioned generally parallel to an intersecting edge between the first web 1564 and second flange 1578 of the second end 1562 of the body 1558 and an apex 1720 oriented toward the first flange 1570 of the first end 1560 of the body 1558. The first triangular slots 1710 and second triangular slots 1712 may generally comprise equilateral triangles with each edge of each triangular slot 1710, 1712 having a length of about 1.58 inches (4 cm) to about 2.36 inches (6 cm), for example two inches (5.13 cm). However, the sizes, shapes, numbers and spacing arrangement of these holes may vary without departing from the spirit and scope of the present invention. The second side portion 1562 of the body 1558 may comprise three, generally oval shaped knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 55:
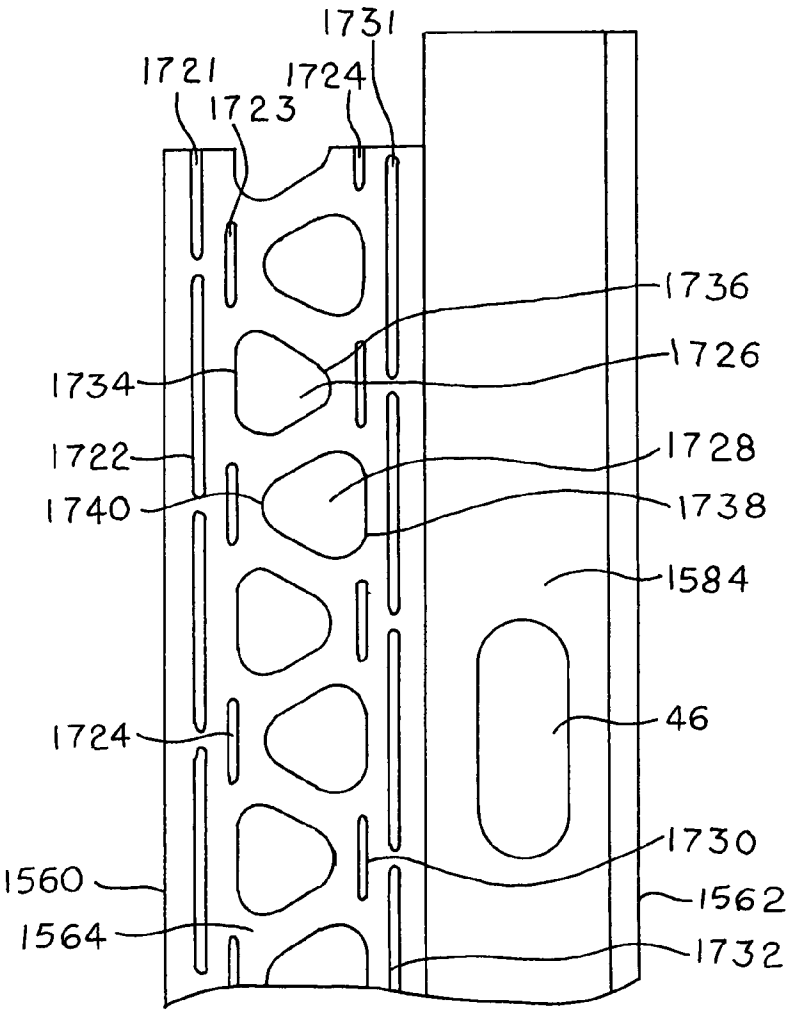
FIG. 55 is a side elevational view of a portion of a stud according to various embodiments of the present invention.
Figure 54:
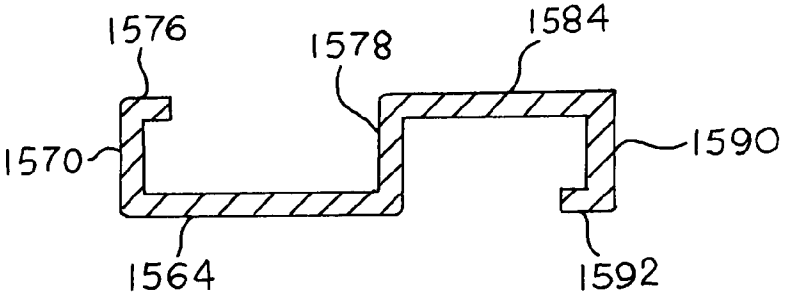
FIG. 54 is a cross-sectional view of a stud according to various embodiments of the present invention.

Referring now to FIGS. 54 and 55, the first side portion 1560 of body 1558 may comprise a first row 1721 of elongated or oval holes 1722, a second row 1723 of elongated or oval holes 1724 with each hole having a length that is less than the length of each hole of the first row of elongated or oval holes 1722, a row of generally alternating first triangular slots 1726 and second triangular slots 1728, a third row 1729 of elongated or oval holes 1730 with each hole having a length that is equal to the length of each hole of the second row 1723 of elongated or oval holes 1724, and a fourth row 1731 of elongated or oval holes 1732 with each hole having a length that is equal to the length of each hole of the first row 1721 of elongated or oval holes 1722. Each row of holes extends along a length of the first web 1564. Each hole of the first row 1721 of elongated or oval holes 1722 and the fourth row 1731 of elongated or oval holes 1732 may have a length of about 5.51 inches (14 cm) to about 6.30 inches (16 cm), for example six inches (15.24 cm), and a width of about 0.10 inches (0.25 cm) to about 0.39 inches (1 cm), for example 0.25 inches (0.635 cm). Each hole of the second row 1723 of elongated or oval holes 1724 and the third row 1729 of elongated or oval holes 1730 may have a length of about 0.591 in (1.5 cm) to about 1.378 in (3.5 cm), for example one inch (2.54 cm), and a width of about 0.10 inches (0.25 cm) to about 0.39 inches (1 cm), for example 0.25 inches (0.635 cm). However, the sizes, shapes, numbers and spacing arrangement of these holes may vary without departing from the spirit and scope of the present invention. The first triangular slots 1726 may comprise a base 1734 positioned generally parallel to an intersecting edge between the first web 1564 and the first flange 1570 of the first end 1560 of the body 1558 and an apex 1736 oriented toward the second flange 1578 of the second end 1562 of the body 1558. The second triangular slots 1728 may comprise a base 1738 positioned generally parallel to an intersecting edge between the first web 1564 and second flange 1578 of the second end 1562 of the body 1558 and an apex 1740 oriented toward the first flange 1570 of the first end 1560 of the body 1558. The first triangular slots 1710 and second triangular slots 1712 may generally comprise equilateral triangles with each edge of each triangular slot 1710, 1712 having a length of about 1.58 inches (4 cm) to about 2.36 inches (6 cm), for example two inches (5.13 cm). However, the sizes, shapes, numbers and spacing arrangement of these holes may vary without departing from the spirit and scope of the present invention. The second side portion 1562 of the body 1558 may comprise three, generally oval shaped knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 57:
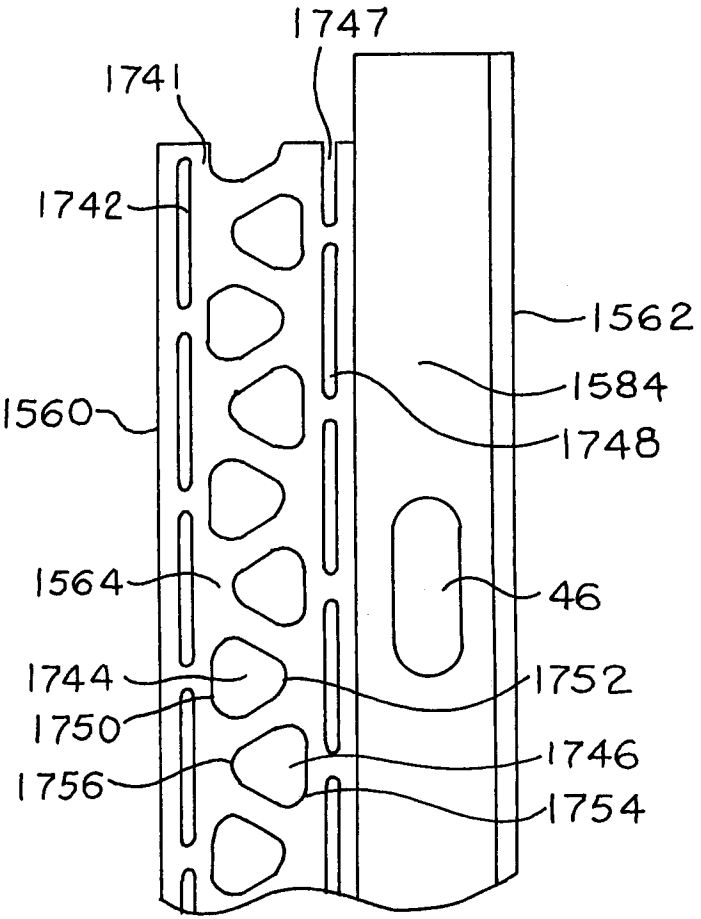
FIG. 57 is a side elevational view of a portion of a stud according to various embodiments of the present invention.
Figure 56:
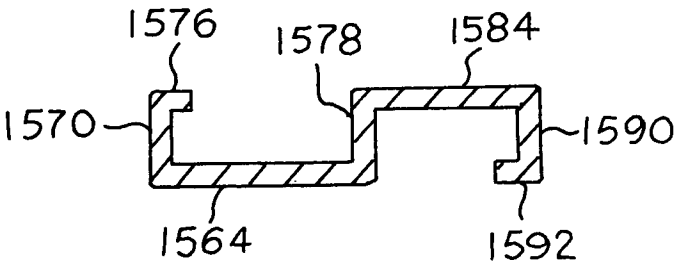
FIG. 56 is a cross-sectional view of a stud according to various embodiments of the present invention.
Figure 58:
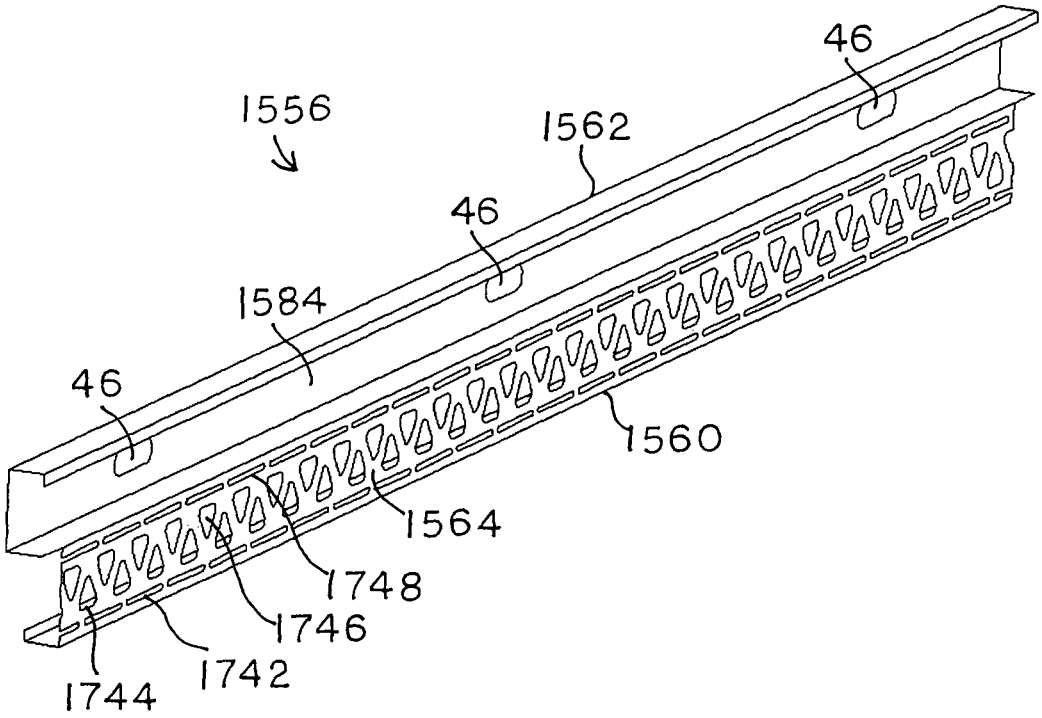
FIG. 58 is a perspective view of a stud according to various embodiments of the present invention.

Referring now to FIGS. 57 and 58, the first side portion 1560 of body 1558 may comprise a first row 1741 of elongated or oval holes 1742, a row of generally alternating first triangular slots 1744 and second triangular slots 1746, and a second row 1747 of elongated or oval holes 1748 with each hole having a length that is equal to the length of each hole of the first row of elongated or oval holes 1742. Each row of holes extends along a length of the first web 1564. Each hole of the first row 1741 of elongated or oval holes 1742 and second row 1747 of elongated or oval holes 1748 may have a length of about 3.15 inches (8 cm) to about 3.94 inches (10 cm), for example 3.54 in (9 cm), and a width of about 0.10 inches (0.25 cm) to about 0.39 inches (1 cm), for example 0.25 inches (0.635 cm). However, the sizes, shapes, numbers and spacing arrangement of these holes may vary without departing from the spirit and scope of the present invention. The first triangular slots 1744 may comprise a base 1750 positioned generally parallel to an intersecting edge between the first web 1564 and the first flange 1570 of the first end 1560 of the body 1558 and an apex 1752 oriented toward the second flange 1578 of the second end 1562 of the body 1558. The second triangular slots 1746 may comprise a base 1754 positioned generally parallel to an intersecting edge between the first web 1564 and second flange 1578 of the second end 1562 of the body 1558 and an apex 1756 oriented toward the first flange 1570 of the first end 1560 of the body 1558. The first triangular slots 1710 and second triangular slots 1712 may generally comprise equilateral triangles with each edge of each triangular slot 1710, 1712 having a length of about 1.58 inches (4 cm) to about 2.36 inches (6 cm), for example two inches (5.13 cm). However, the sizes, shapes, numbers and spacing arrangement of these holes may vary without departing from the spirit and scope of the present invention. The second side portion 1562 of the body 1558 may comprises three, generally oval shaped knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 60:
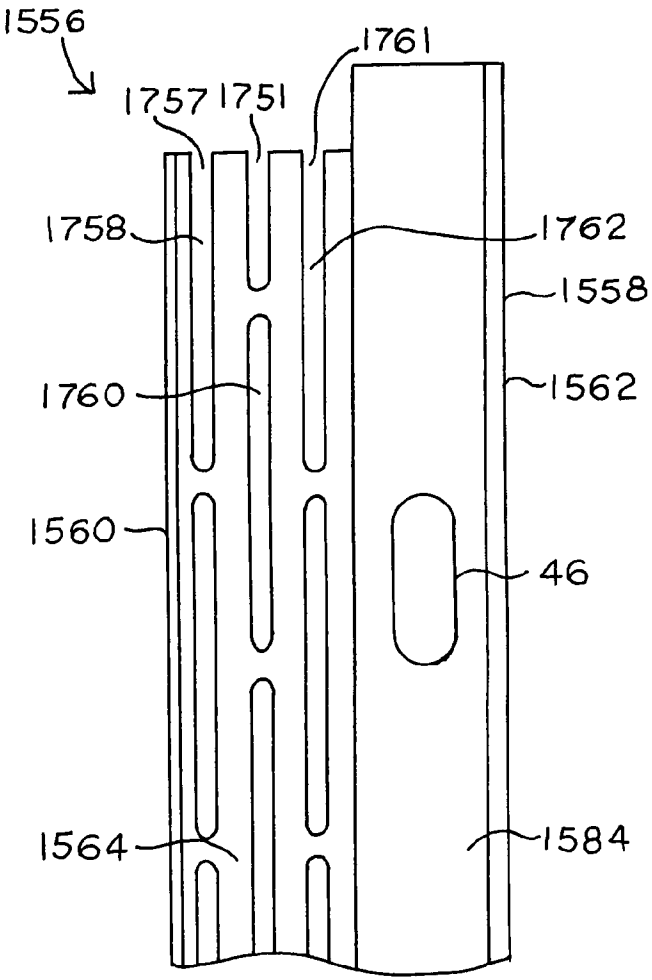
FIG. 60 is a side elevational view of a portion of a stud according to various embodiments of the present invention.
Figure 59:
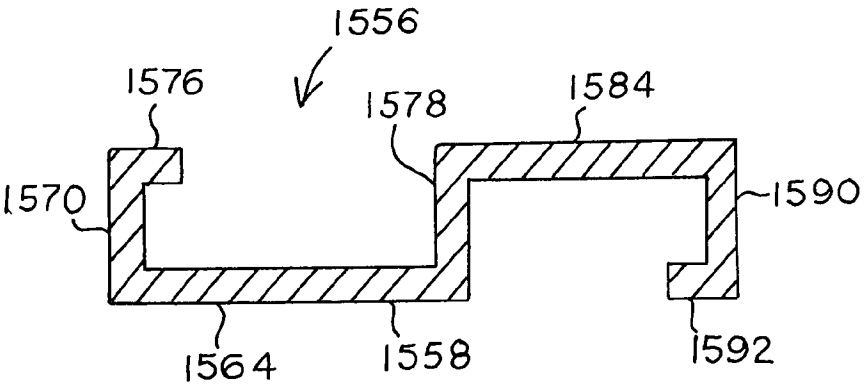
FIG. 59 is a cross-sectional view of a stud according to various embodiments of the present invention.

Referring now to FIGS. 59 and 60, the first side portion 1560 of body 1558 may comprise a first row 1757 of equally spaced, elongated or oval holes 1758, a second row 1759 of equally spaced, elongated or oval holes 1760, and a third row 1761 of equally spaced, elongated or oval holes 1762. Each row of holes extends along a length of the first web 1564. The second row of holes 1760 may be offset with respect to the first and third rows of hole 1758, 1762. Each hole of each row 1757, 1759, 1760 of elongated or oval holes 1758, 1760, 1762 may have a length of about 7.48 inches (19 cm) to about 8.27 in (21 cm), for example eight inches (20.32 cm), and a width of about 0.20 inches (0.5 cm) to about 0.79 inches (2 cm), for example 0.50 inch (1.27 cm). However, the sizes, shapes, numbers and spacing arrangement of these holes may vary without departing from the spirit and scope of the present invention. The second side portion 1562 of the body 1558 may comprise three, generally oval shaped knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 62:
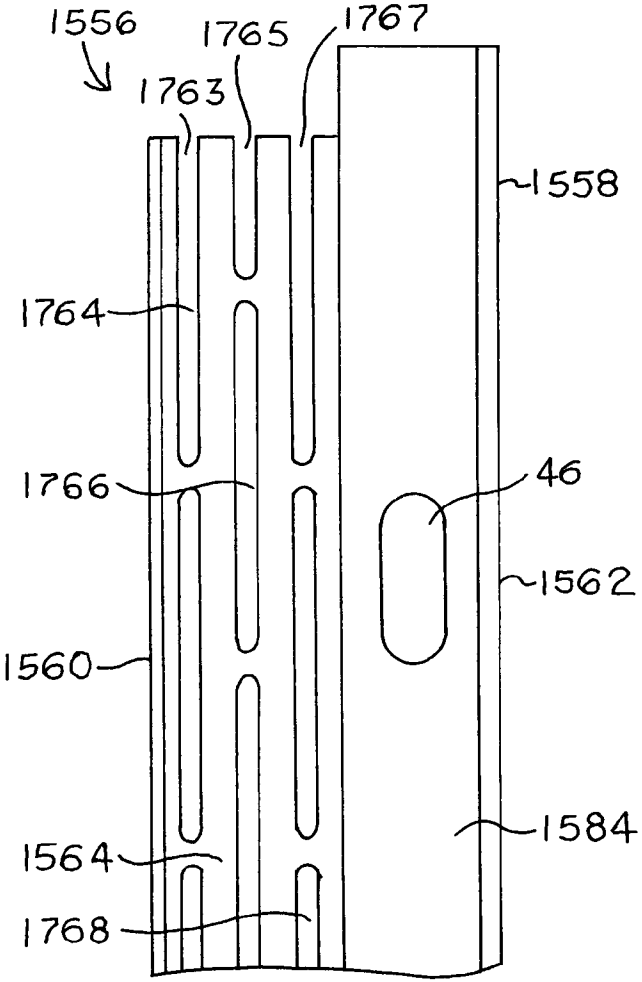
FIG. 62 is a side elevational view of a portion of a stud according to various embodiments of the present invention.
Figure 61:
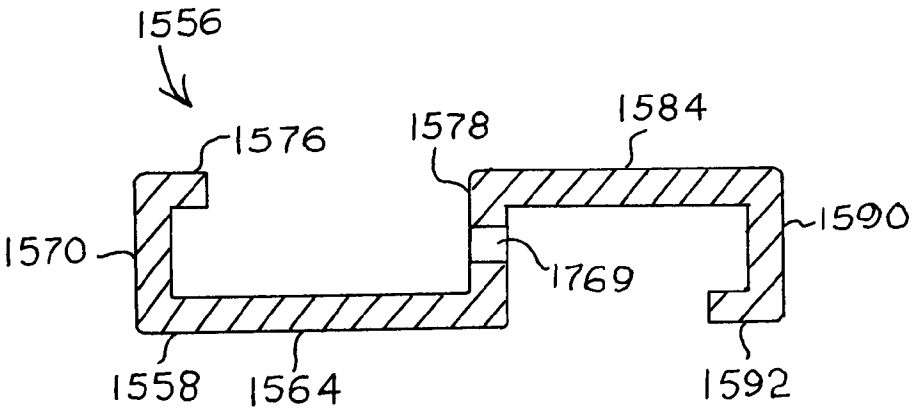
FIG. 61 is a cross-sectional view of a stud according to various embodiments of the present invention.

Referring now to FIGS. 61 and 62, the first side portion 1560 of body 1558 may comprise a first row 1763 of equally spaced, elongated or oval holes 1764, a second row 1765 of equally spaced, elongated or oval holes 1766, and a 1767 third row of equally spaced, elongated or oval holes 1768. Each row of holes extends along a length of the first web 1564. The second row of holes 1766 may be offset with respect to the first and third rows of holes 1764, 1768. Each hole of each row 1763, 1765, 1767 of elongated or oval holes 1764, 1766, 1768 may have a length of about 7.48 inches (19 cm) to about 8.27 in (21 cm), for example eight inches (20.32 cm), and a width of about 0.20 inches (0.5 cm) to about 0.79 inches (2 cm), for example 0.50 inch (1.27 cm). However, the sizes, shapes, numbers and spacing arrangement of these holes may vary without departing from the spirit and scope of the present invention. The second flange 1578 may comprise additional slots 1769 extending along a length thereof. The additional slots 1769 provide for a thermal break. The second side portion 1562 of the body 1558 may comprise three, generally oval shaped knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 64:
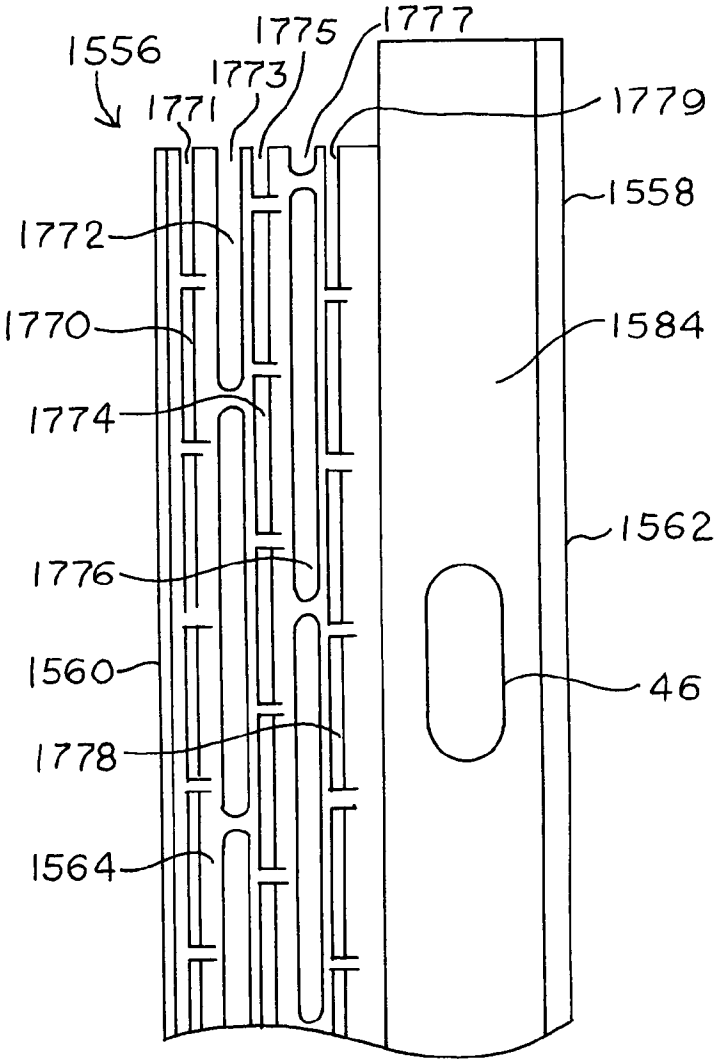
FIG. 64 is a side elevational view of a portion of a stud according to various embodiments of the present invention.
Figure 63:
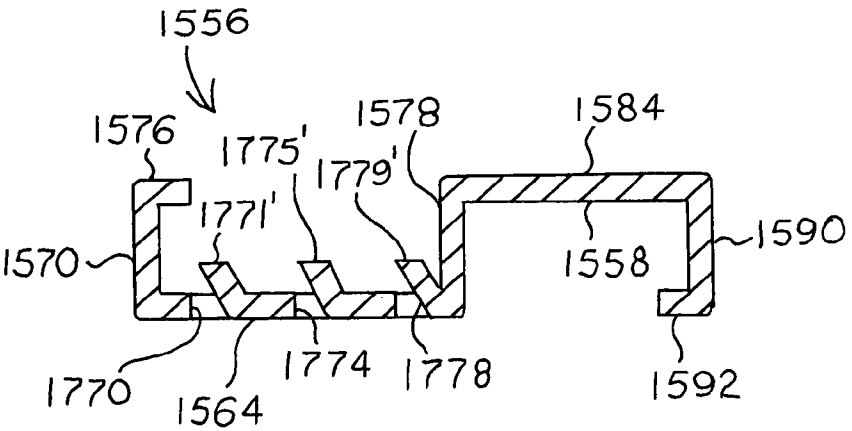
FIG. 63 is a cross-sectional view of a stud according to various embodiments of the present invention.

Referring now to FIGS. 63 and 64, the first side portion 1560 of body 1558 may comprise a first row 1771 of equally spaced, generally elongated or rectangular holes 1770, a second row 1773 of equally spaced, generally elongated or rectangular holes 1772, a third row 1775 of equally spaced, generally elongated or rectangular holes 1774, a fourth row 1777 of equally spaced, generally elongated or rectangular holes 1776, and a fifth row 1779 of equally spaced, generally elongated or rectangular holes 1778. Each row extends along a length of the first web 1564. As shown in FIG. 63, in various embodiments, the holes 1770 may be formed by punching corresponding tabs 1771' in the first web 1564. Likewise, the holes 1774 may be formed by punching, cutting, etc. corresponding tabs 1775' in the first web 1564. Holes 1778 may be formed by punching, cutting, etc. corresponding tabs 1779' in the first web 1564. One skilled in the art will appreciate that the tabs 1771', 1775' and 1779' serve to strengthen the first web 1564. Each hole of the first, third and fifth rows 1771, 1775, 1779 of elongated holes 1770, 1774, 1778 may have a smaller cross-sectional width and shorter length than the holes of the second and forth rows 1773, 1777 of elongated holes 1772, 1776. Each hole of the first, third and fifth rows 1771, 1775, 1779 of elongated holes 1770, 1774, 1778 may have a length of about 2.36 inches (6 cm) to about 3.15 inches (8 cm), for example three inches (7.62 cm), and a width of about 0.20 inches (0.5 cm) to about 0.30 in (0.75 cm), for example 0.26 in (0.65 cm) cm. Each hole of the second and fourth rows 1773, 1777 of elongated holes 1772, 1776 has a length of about 7.48 inches (19 cm) to about 8.27 in (21 cm), for example eight inches (20.32 cm), and a width of about 0.20 inches (0.5 cm) to about 0.79 inches (2 cm), for example 0.50 inch (1.27 cm). However, the sizes, shapes, numbers and spacing arrangement of these holes may vary without departing from the spirit and scope of the present invention. The second side portion 1562 of the body 1558 may comprise three, generally oval shaped or otherwise elongated knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 66:
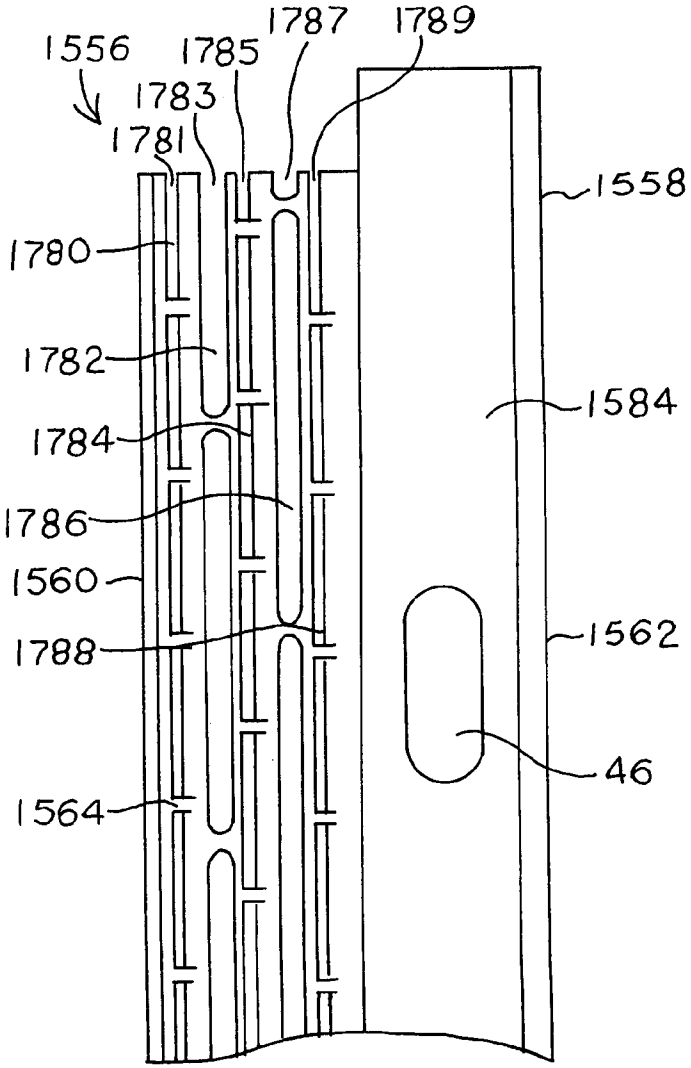
FIG. 66 is a side elevational view of a portion of a stud according to various embodiments of the present invention.
Figure 65:
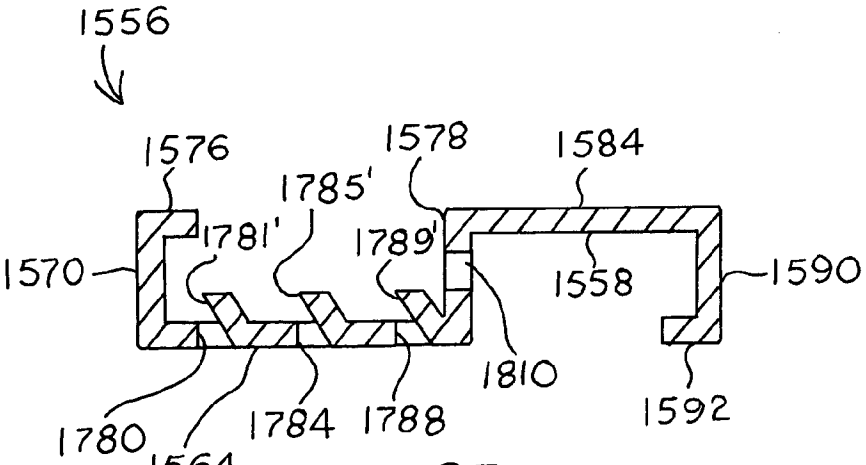
FIG. 65 is a cross-sectional view of a stud according to various embodiments of the present invention.

Referring now to FIGS. 65 and 66, the first side portion 1560 of body 1558 may comprise a first row 1781 of equally spaced, generally elongated or rectangular holes 1780, a second row 1783 of equally spaced, generally elongated or rectangular holes 1782, a third row 1785 of equally spaced, generally elongated or rectangular holes 1784, a fourth row 1787 of equally spaced, generally elongated or rectangular holes 1786, and a fifth row 1789 of equally spaced, generally elongated or rectangular holes 1788. Each row extends along a length of the first web 1564. As can be seen in FIG. 65, in various embodiments, the holes 1780 may be formed by punching, cutting, etc. corresponding tabs 1781' in the first web 1564. Likewise, the holes 1784 may be formed by punching, cutting, etc. corresponding tabs 1785' in the first web 1564. Holes 1788 may be formed by punching cutting, punching, etc. corresponding tabs 1789' in the first web 1564. One skilled in the art will appreciate that the tabs 1781', 1785', and 1789' serve to strengthen the first web 1564. Each hole of the first, third and fifth rows 1781, 1785, 1789 of elongated holes 1780, 1784, 1788 may have a smaller cross-sectional width and shorter length than the holes of the second and forth rows 1783, 1787 of elongated holes 1782, 1786. Each hole of the first, third and fifth rows 1781, 1785, 1789 of elongated holes 1780, 1784, 1788 may have a length of about 2.36 inches (6 cm) to about 3.15 inches (8 cm), for example three inches (7.62 cm), and a width of about 0.20 inches (0.5 cm) to about 0.30 in (0.75 cm), for example 0.26 in (0.65 cm) cm. Each hole of the second and fourth rows 1783, 1787 of elongated holes 1782, 1786 may have a length of about 7.48 inches (19 cm) to about 8.27 in (21 cm), for example eight inches (20.32 cm), and a width of about 0.20 inches (0.5 cm) to about 0.79 inches (2 cm), for example 0.50 inch (1.27 cm). However, the sizes, shapes, numbers and spacing arrangement of these holes may vary without departing from the spirit and scope of the present invention. The second flange 1578 may comprise additional slots 1810 extending along a length thereof. The additional slots 1810 provide for a thermal break. The second side portion 1562 of the body 1558 may comprise three, generally oval shaped or otherwise elongated knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 68:
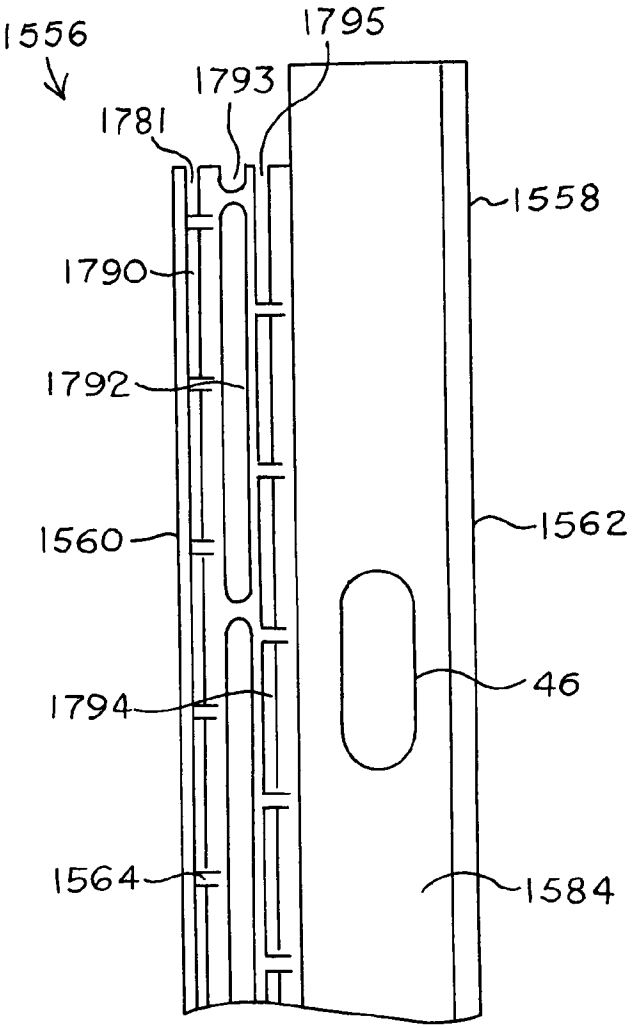
FIG. 68 is a side elevational view of a portion of a stud according to various embodiments of the present invention.
Figure 67:
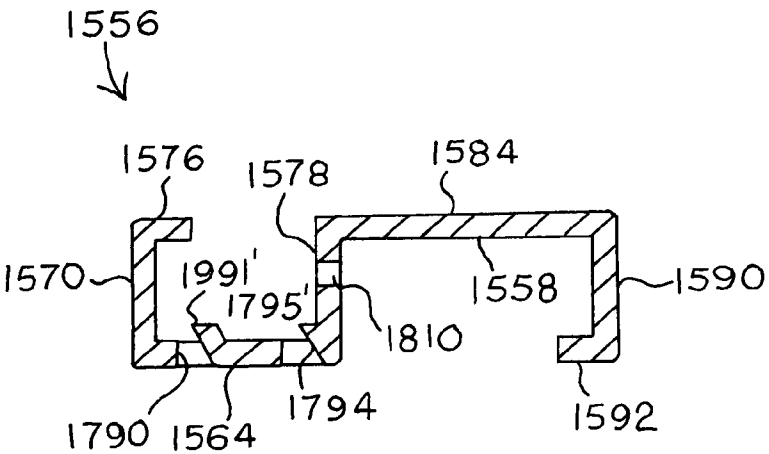
FIG. 67 is a cross-sectional view of a stud according to various embodiments of the present invention.

Referring now to FIGS. 67 and 68, the first side portion 1560 of body 1558 may comprise a first row 1791 of equally spaced, generally elongated or rectangular holes 1790, a second row 1793 of equally spaced, generally elongated or rectangular holes 1792 and a third row 1795 of equally spaced, generally elongated or rectangular holes 1794 extending along the length of the first web 1564. As shown in FIG. 67, in various embodiments, the holes 1790 may be formed by punching, cutting, etc. corresponding tabs 1791' in the first web 1564. Likewise, the holes 1794 may be formed by punching, cutting, etc. corresponding tabs 1795' in the first web 1564. One skilled in the art will appreciate that the tabs 1791' and 1795' serve to strengthen the first web 1564. Each hole of the first and third rows 1791, 1795 of elongated holes 1790, 1794 may have a smaller cross sectional width and shorter length than each hole of the second row 1793 of elongated or rectangular holes 1792. Each hole of the first and third rows 1791, 1795 of elongated or rectangular holes 1790, 1794 may have a length of about 2.36 inches (6 cm) to about 3.15 inches (8 cm), for example three inches (7.62 cm), and a width of about 0.20 inches (0.5 cm) to about 0.30 in (0.75 cm), for example 0.26 in (0.65 cm) cm. Each hole of the second row 1793 of elongated or rectangular holes 1792 may have a length of about 7.48 inches (19 cm) to about 8.27 in (21 cm), for example eight inches (20.32 cm), and a width of about 0.20 inches (0.5 cm) to about 0.79 inches (2 cm), for example 0.50 inch (1.27 cm). However, the sizes, shapes, numbers and spacing arrangement of these holes may vary without departing from the spirit and scope of the present invention. The second flange 1578 may comprise additional slots 1810 extending along a length thereof. The additional slots 1810 provide for a thermal break. The second side portion 1562 of the body 1558 may comprise three, generally oval shaped or otherwise elongated utility holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 69:
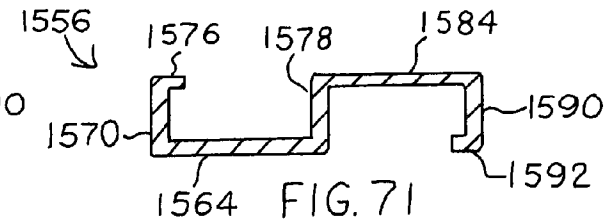
FIG. 69 is a cross-sectional view of a stud according to various embodiments of the present invention.
Figure 70:
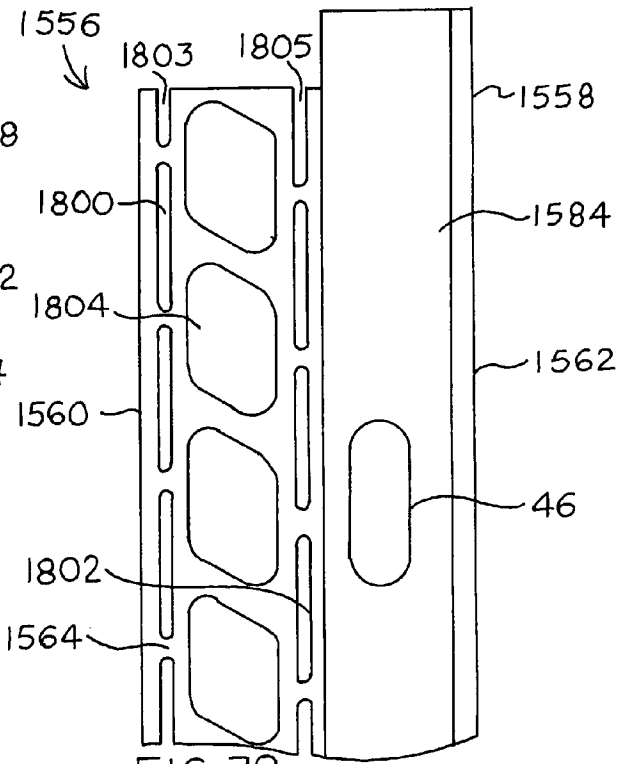
FIG. 70 is a side elevational view of a portion of a stud according to various embodiments of the present invention.

Referring now to FIGS. 69 and 70, the first side portion 1560 of body 1558 may comprise a first row 1797 of elongated or oval holes 1796, a second row 1799 of elongated or oval holes 1798 and a row of generally trapezoidally shaped holes 1801 positioned between the first row 1797 of elongated holes 1796 and the second row 1799 of elongated holes 1798. Each row extends along a length of the first web 1564. Each hole of the second row of 1799 elongated holes 1798 may have a length that is equal to the length of each hole of the first row 1797 of elongated holes 1796. Each hole of the first and second rows 1797, 1799 of elongated holes 1796, 1798 may have a length of about 3.50 in (8.89 cm) to about 7.50 in (19.05 cm), for example six inches (15.24 cm), and a width of about 0.25 inches (0.635 cm) to about 0.79 inches (2 cm), for example 0.50 inch (1.27 cm). Each of the trapezoidally shaped elongated holes 1801 may have an area of about 1.55 $in^2$ (10 $cm^2$) to about 9.30 $in^2$ (60 $cm^2$), for example 6.665 $in^2$ (43 $cm^2$). However, the sizes, shapes, numbers and spacing arrangement of these holes may vary without departing from the spirit and scope of the present invention. The second side portion 1562 of the body 1558 may comprise three, generally oval shaped or otherwise elongated utility holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 71:
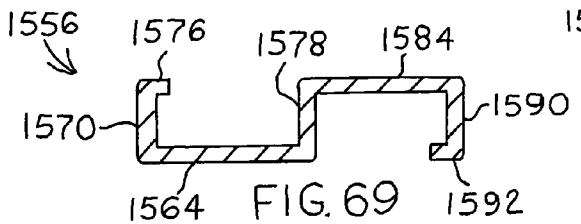
FIG. 71 is a cross-sectional view of a stud according to various embodiments of the present invention.
Figure 72:
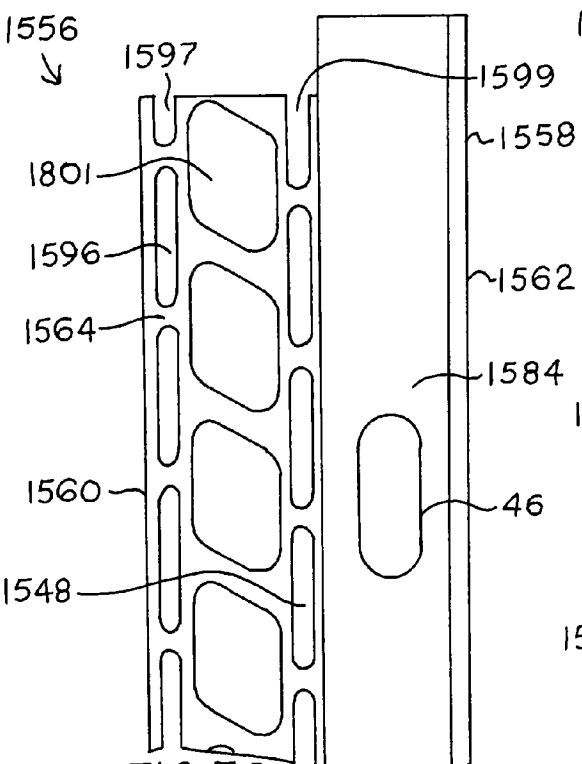
FIG. 72 is a side elevational view of a portion of a stud according to various embodiments of the present invention.

Referring now to FIGS. 71 and 72, the first side portion 1560 of body 1558 may comprise a first row 1803 of elongated or oval holes 1800, a second row 1805 of elongated or oval holes 1802 and a row of generally trapezoidally shaped holes 1804 positioned between the first row 1803 of elongated holes 1800 and the second row 1805 of elongated holes 1802. Each row extends along a length of the first web 1564. Each hole of the second row 1805 of elongated holes 1802 may have a length that is equal to the length of each hole of the first row 1803 of elongated holes 1800. Each hole of the first and second rows 1803, 1805 of elongated holes 1800, 1802 may have a length of about 3.50 in (8.89 cm) to about 7.50 in (19.05 cm), for example 5.50 in (13.97 cm), and a width of about 0.25 inches (0.635 cm) to about 0.79 inches (2 cm), for example 0.50 inch (1.27 cm). Each of the trapezoidally shaped elongated holes 1801 may have an area of about 1.55 $in^2$ (10 $cm^2$) to about 9.30 $in^2$ (60 $cm^2$), for example 6.665 $in^2$ (43 $cm^2$). However, the sizes, shapes, numbers and spacing arrangement of these holes may vary without departing from the spirit and scope of the present invention. The second side portion 1562 of the body 1558 may comprise three, generally oval shaped or otherwise elongated utility holes 46 extending along the length of the second web 1584 to be used for utilities or structural bracing/spacer members. Likewise, the sizes, shapes, numbers and spacing arrangement of these holes may vary without departing from the spirit and scope of the present invention.

Figure 75:
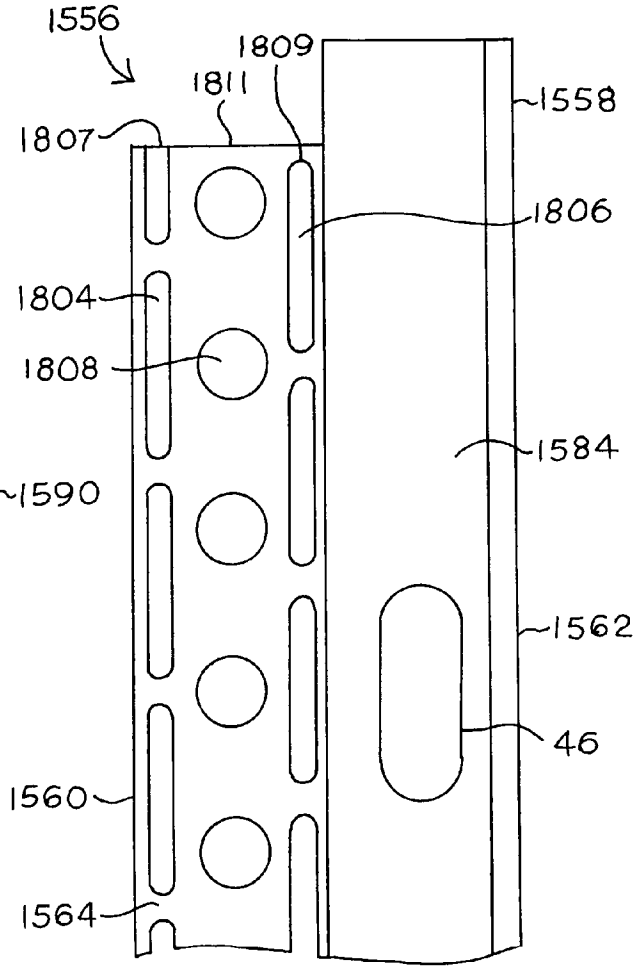
FIG. 75 is a side elevational view of a portion of a stud according to various embodiments of the present invention.
Figure 74:
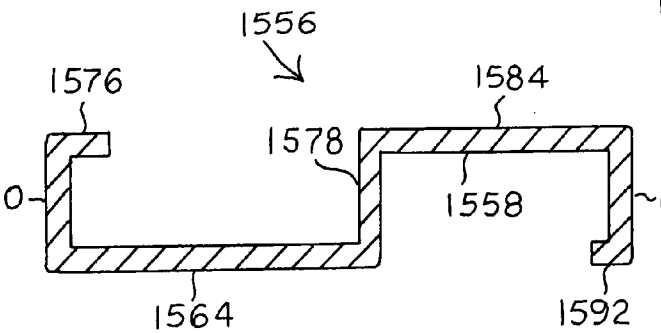
FIG. 74 is a cross-sectional view of a stud according to various embodiments of the present invention.
Figure 73:
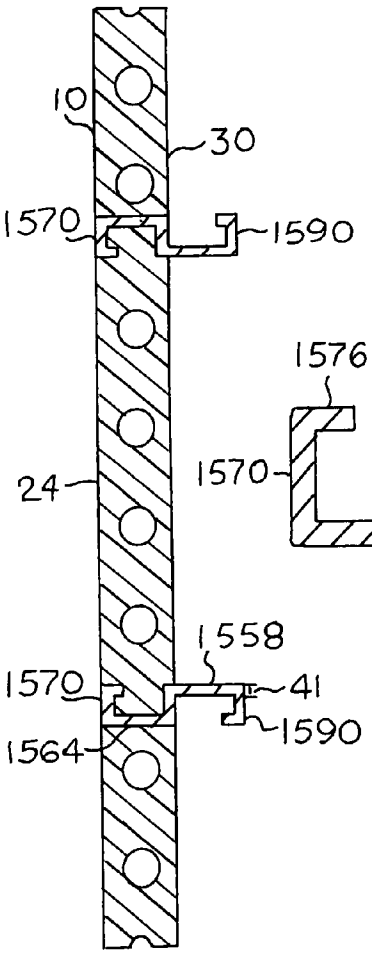
FIG. 73 is a cross-sectional view of a pre-formed building panel according to various embodiments of the present invention.

Referring now to FIGS. 74 and 75, the first side portion 1560 of body 1558 may comprise a first row 1807 of evenly spaced elongated or oval holes 1804, a second row 1809 of evenly spaced elongated or oval holes 1806, and a row 1811 of evenly spaced circular holes 1808 positioned between the first row 1807 of elongated holes 1804 and the second row 1809 of elongated holes 1806. Each row extends along a length of the first web 1564. Each hole of the second row 1809 of evenly spaced elongated holes 1806 may have a length that is equal to the length of each hole of the first row 1807 of elongated holes 1804. For instance, each hole of the second row 1809 of elongated holes 1806 and each hole of the first row 1807 of elongated holes 1804 may have a length of about 1.97 inches (5 cm) to about 2.76 inches (7 cm), for example 2.5 inches (6.35 cm), and a width of 0.20 inches (0.5 cm) to 0.79 inches (2 cm), for example 0.50 inch (1.27 cm). However, the sizes, shapes, numbers and spacing arrangement of these holes may vary without departing from the spirit and scope of the present invention. The second side portion 1562 of the body 1558 may comprise four, generally oval shaped or otherwise elongated knockout holes 46 extending along the length of the second web 1584 to be used for utilities or structural bracing/spacer members. Likewise, the sizes, shapes, numbers and spacing arrangement of these holes may vary without departing from the spirit and scope of the present invention.

The reinforcing member has a second or exposed side portion extending away from the first surface of the central body. For example, as shown in FIGS. 1 and 4, embedded metal studs 14 and 16 have exposed second side portions 26 and 28 respectively that extend from inner surface 30 of expanded polymer body 12.

Exposed side portions 26 and 28 can extend at least 0.39 inches (1 cm), in some cases at least 0.79 inches (2 cm), and in other cases at least 1.18 inches (3 cm) away from inner surface 30 of expanded polymer body 12. Also, exposed side portions 26 and 28 can extend up to 1.97 ft (60 cm), in some cases up to 15.748 in (40 cm), and in other cases up to 7.87 in (20 cm) away from inner surface 30 of expanded polymer body 12. Exposed side portions 26 and 28 can extend any of the distances or can range between any of the distances recited above from inner surface 30.

Figure 80:
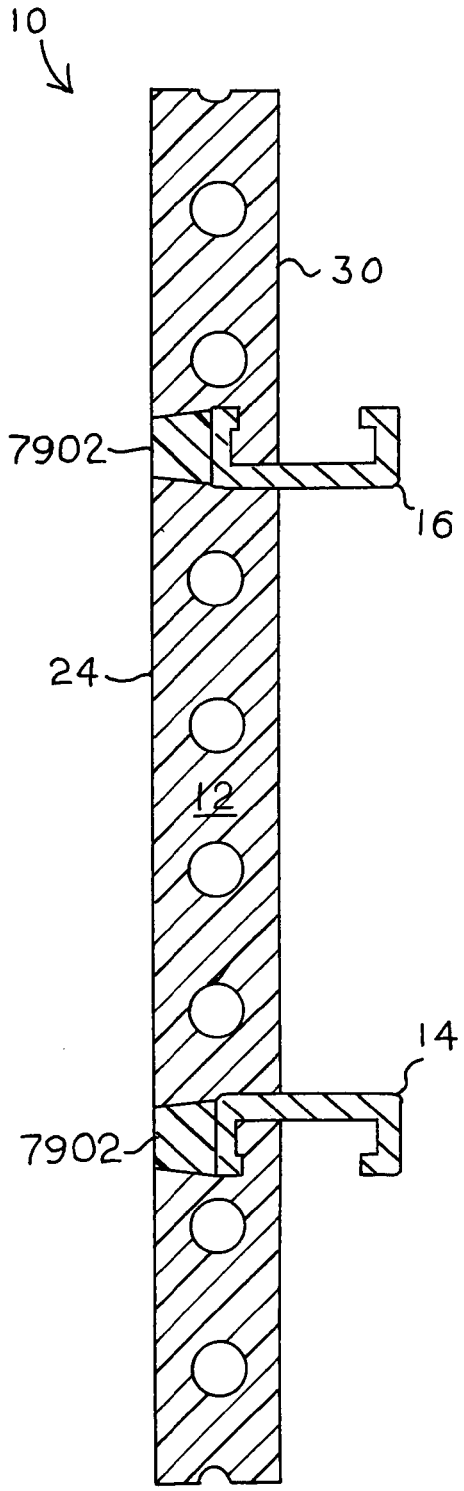
FIG. 80 is a cross-sectional view of a pre-formed building panel according to various embodiments of the present invention.
Figure 79:
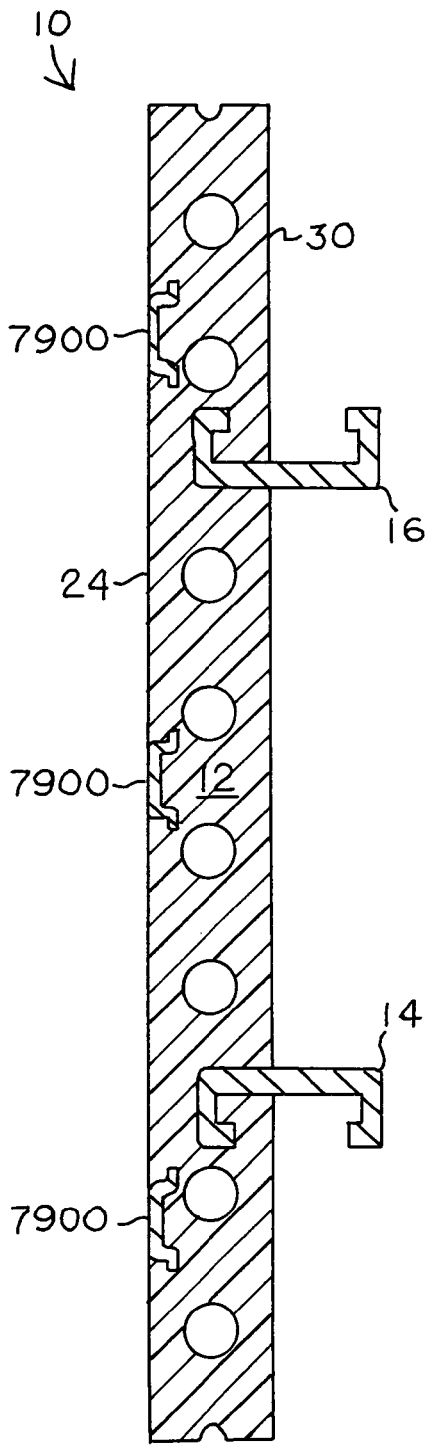
FIG. 79 is a cross-sectional view of a pre-formed building panel according to various embodiments of the present invention.

Referring now to FIGS. 79 and 80, inserts can be added to expanded polymer body 12 to allow for more secure anchoring positions. For example, with reference to FIG. 79, one or more attachment members 7900 may be embedded in expanded polymer body 12 to allow for the attachment of a finish surface 475 thereto. In various embodiments, such attachment members may comprise, for example, U-channel studs, furring strips, etc. With reference to FIG. 80, high density foam 7902 may be embedded in expanded polymer body 12 flush with outer surface 24. The foam provides for a more secure anchoring position as well as aid in locating the embedded studs 14 and 16.

Referring to FIGS. 7-14, 17, 18, 21, 22, 25, 26, 29, 30, 33, 34, 37-40, 43, 46, 48, 50, 52, 53, 55, 57, 58, 60, 62, 64, 66, 68, 70, 72, 75, 78 and 91, embedded metal studs 14 and 16 can have utility holes 46 spaced along the length of exposed side portions 26 and 28 (i.e., the structural portion of the stud). Utility holes 46 may be useful for running utilities such as wiring for electricity, telephone, cable television, speakers, and other electronic devices, gas lines and water lines. Utility holes 46 can have various cross-sectional shapes, non-limiting examples being round, oval, elliptical, square, rectangular, triangular, hexagonal or octagonal. The cross-sectional area of utility holes 46 can also vary independently one from another or they can be uniform. The cross-sectional area of utility holes 46 is limited by the dimensions of embedded metal studs 14 and 16, as utility holes 46 will fit within their dimensions and not significantly detract from their structural integrity and strength. The cross-sectional area of utility holes 46 can independently be at least 1, in some cases at least 2, and in other cases at least 0.775 $in^2$ (5 $cm^2$) and can be up to 30, in some cases up to 25, in other cases up to 3.10 $in^2$ (20 $cm^2$). The cross-sectional area of openings 18 can independently be any value or range between any of the values recited above. Typically, the number of utility holes ranges from 1 to 5, for example 3 or 4. However, other sizes, shapes, numbers and spacing arrangements could conceivable be employed in alternative embodiments.

In various embodiments of the invention, utility holes 46 can have a flanged portion around their respective perimeters and in many cases a rolled flange surface to reinforce the area around the holes. The flanged holes provide added strength to allow for the use of lighter gauge materials to achieve the same structural properties.

The spacing between each of embedded metal studs 14 and 16 is typically adapted to be consistent with local construction codes or methods, but can be modified to suit special needs. As such, the spacing between the metal studs can be at least 25 and in some cases at least 30 cm and can be up to 110, in some cases up to 100, in other cases up to 75, and in some instances up to 1.97 ft (60 cm) measured from a midpoint of exposed end 26 to a midpoint of exposed end 28. The spacing between embedded metal studs 14 and 16 can be any distance or range between any of the distances recited above.

As shown in FIG. 1, expanded polymer body 12 can extend for a distance with alternating embedded metal studs 14 and 16 placed therein. The length of wall unit 10 can be any length that allows for safe handling and minimal damage to wall unit 10 while it is being transported and installed. The length of wall unit 10 can typically be at least 1, in some cases at least 1.5, and in other cases at least 6.56 feet (2 m) and can be up to 25, in some cases up to 20, in other cases up to 15, in some instances up to 10 and in other instances up to 16.40 feet (5 m). The length of wall unit 10 can be any value or can range between any of the values recited above. In some embodiments of the invention, each end of wall unit 10 is terminated with an embedded metal stud.

The height of wall unit 10 can be any height that allows for safe handling and minimal damage to wall unit 10. The height of wall unit 10 is determined by the length of embedded metal studs 14 and 16. The height of wall unit 10 can be at least 1 and in some cases at least 4.92 feet (1.5 m) and can be up to 9.84 feet (3 m) and in some cases up to 8.20 feet (2.5 m). In some instances, in order to add stability to wall unit 10, reinforcing cross-members known as spacer bars (not shown) can be attached to embedded metal studs 14 and 16. The height of wall unit 10 can be any value or can range between any of the values recited above.

As shown in FIG. 1, expanded polymer body 12 has a finite length and can have a male terminal end 21 that includes forward edge 23 and trailing edge 25 and a receiving end 27 which includes recessed section 29 and extended section 31, which is adapted to receive forward edge 23, and trailing edge 25. Typically, lengths of wall units 10 are interconnected by inserting a forward edge 23 from a first wall unit 10 into a recessed section 29 a second wall unit 10. In this manner, a larger wall section containing any number of wall units can be assembled and/or arrayed.

Various configurations for interconnecting wall units 10 have been contemplated. Referring now to FIG. 1, the expanded polymer body 12 of wall unit 10 has a first end 17 configured to include a male "tongue" or terminal end 21 and a second end 19 configured to include a female "groove" or recessed section 29 that facilitates a "tongue and groove" union of two matching wall units 10. Typically the tongue and groove union provides a flat surface at the union to allow for easy application of sealing tape to further seal the union or joint if desired.

Referring now to FIG. 4, the first end 17 of expanded polymer body 12 may include a plurality of "tongue" portions 4000 designed to interconnect with corresponding grooves 4002 formed in the second end 19 of expanded polymer body 12. "Tongue" portions 4000 may have a generally pyramidal shape that corresponds with the shape of grooves 4002 thereby providing a smooth flat surface when two wall units 10 are interconnected.

Figure 81:
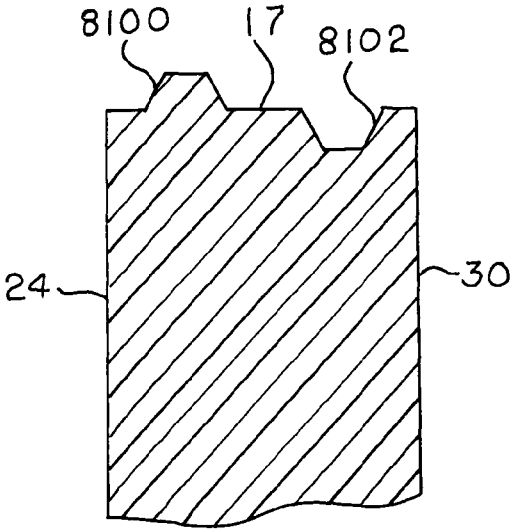
FIG. 81 is a cross-sectional view of a portion of a pre-formed building panel according to various embodiments of the present invention.

Referring now to FIG. 81, the first end 17 of expanded polymer body 12 may include a protruding portion 8100 adjacent to outer surface 24 and a recessed portion 8102 adjacent to inner surface 30 and the second end 19 includes a corresponding protruding portion (not shown) adjacent to inner surface 30 and a corresponding recessed portion (not shown) positioned adjacent to outer surface 30. Each of the protruding portions may have a generally pyramidal shape that corresponds with the shape of each of the recessed portions. The protruding portion 8100 is designed to align with a corresponding recessed portion when two wall units 10 are interconnected thereby providing a substantially smooth flat wall surface.

Figure 82:
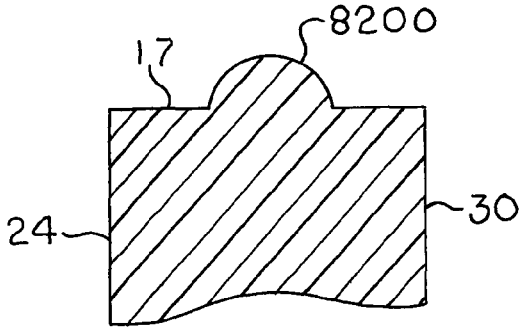
FIG. 82 is a cross-sectional view of a portion of a pre-formed building panel according to various embodiments of the present invention.

Referring now to FIG. 82, the first end 17 of expanded polymer body 12 may include a protruding portion 8200 and the second end 19 includes a corresponding recessed portion (not shown). The protruding portion may have a generally semicircular shape that corresponds with a shape of the corresponding recessed portion. The protruding portion 8200 is designed to align with a corresponding recessed portion when two wall units 10 are interconnected thereby providing a substantially smooth flat wall surface.

Figure 83B:
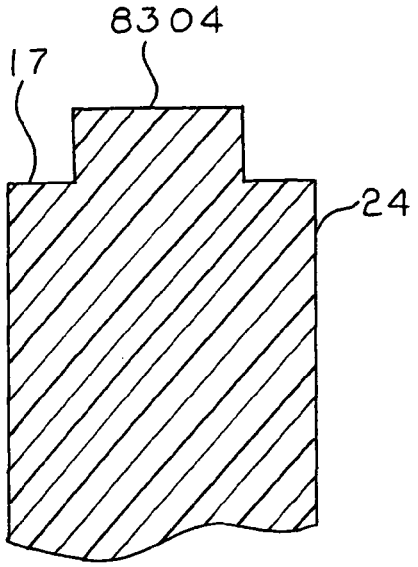
FIG. 83B is a cross-sectional view of a portion of a pre-formed building panel according to various embodiments of the present invention.
Figure 83C:
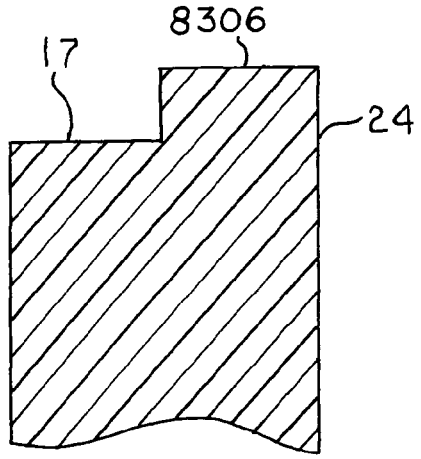
FIG. 83C is a cross-sectional view of a portion of a pre-formed building panel according to various embodiments of the present invention.
Figure 83A:
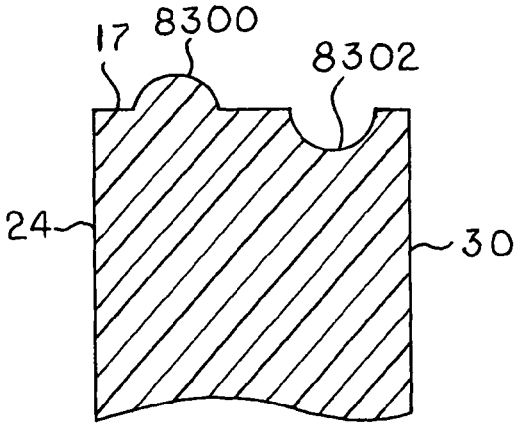
FIG. 83A is a cross-sectional view of a portion of a pre-formed building panel according to various embodiments of the present invention.
Figure 84:
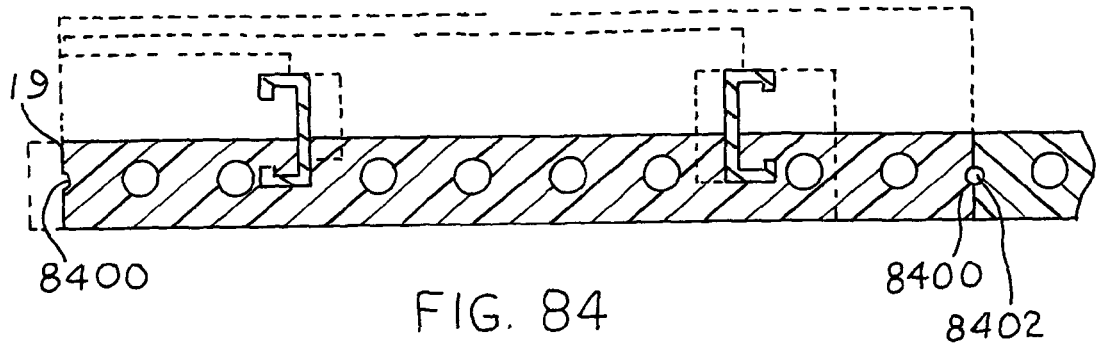
FIG. 84 is a cross-sectional view of pre-formed building panels connected using a gasket according to various embodiments of the present invention.
Figure 85:
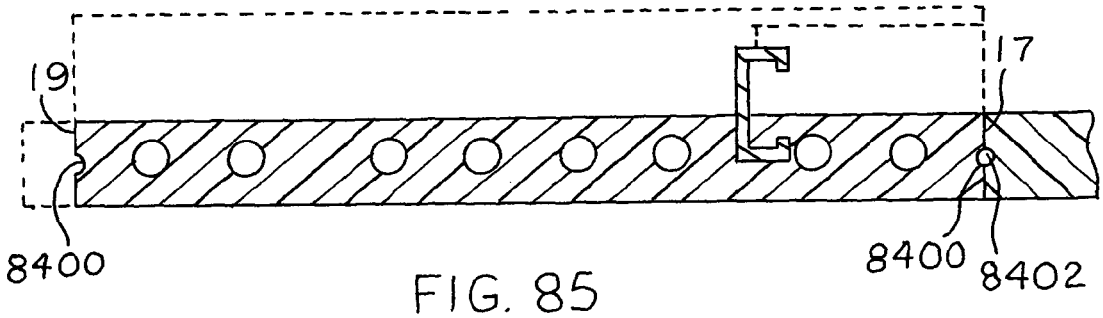
FIG. 85 is a cross-sectional view of pre-formed building panels connected using a gasket according to various embodiments of the present invention.
Figure 86:
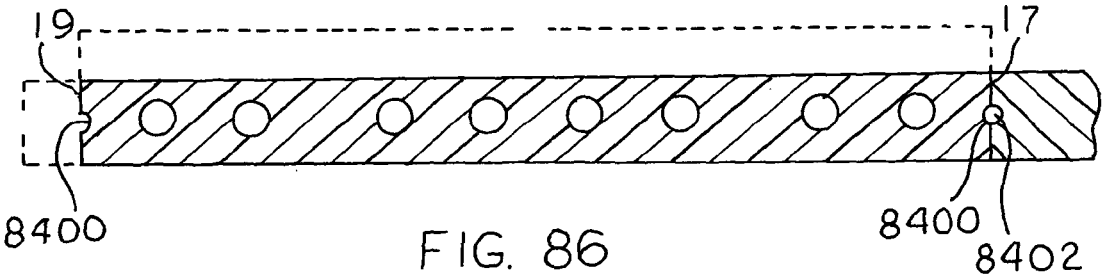
FIG. 86 is a cross-sectional view of pre-formed building panels connected using a gasket according to various embodiments of the present invention.
Figure 87:
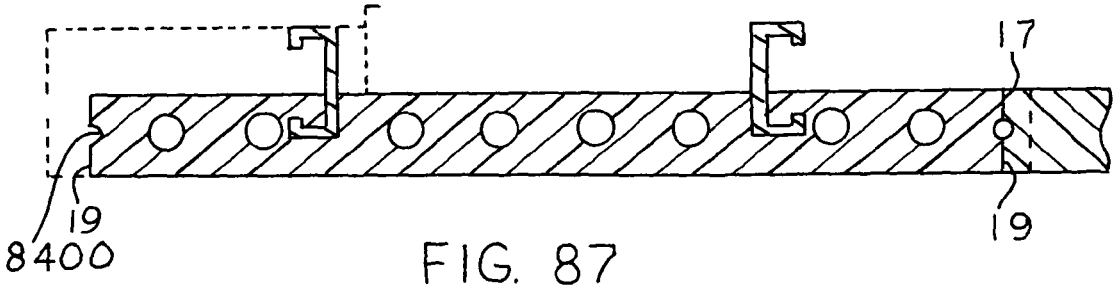
FIG. 87 is a cross-sectional view of pre-formed building panels connected using a gasket according to various embodiments of the present invention.

Referring now to FIG. 83A, the first end 17 of expanded polymer body 12 may include a protruding portion 8300 adjacent to outer surface 24 and a recessed portion 8302 adjacent to inner surface 30 and the second end 19 includes a corresponding protruding portion (not shown) adjacent to inner surface 30 and a corresponding recessed portion (not shown) positioned adjacent to outer surface 30. Each of the protruding portions may have a generally semicircular shape that corresponds with the shape of each of the recessed portions. The protruding portion 8300 is designed to align with a corresponding recessed portion when two wall units 10 are interconnected thereby providing a substantially smooth flat wall surface.

Referring now to FIG. 83B, the first end 17 of expanded polymer body 12 may include a protruding portion 8304 and the second end 19 includes a corresponding recessed portion (not shown). The protruding portion may have a generally rectangular shape that corresponds with a shape of the corresponding recessed portion. The protruding portion 8304 is designed to align with a corresponding recessed portion when two wall units 10 are interconnected thereby providing a substantially smooth flat wall surface.

Referring now to FIG. 83C, the first end 17 of expanded polymer body 12 may include a protruding portion 8306 adjacent to outer surface 24 and the second end 19 includes protruding portion (not shown) positioned adjacent to inner surface 30. Each of the protruding portions may have a generally rectangular shape. The protruding portion 8306 is designed to adjoin with the protruding portion of the second end 19 when two wall units 10 are interconnected thereby providing a substantially smooth flat wall surface.

Referring now to FIGS. 84-87, the first end 17 and the second end 19 of expanded polymer body 12 may each include a generally semicircular recess 8400. When two wall units 10 are placed adjacent to each other, the recess on the first end 17 of a first wall unit 10 and the recess on the second end 19 of a second wall unit align to form a generally circular opening between the first and second wall units. A gasket 8402 may be positioned within the circular opening to provide a secure interconnection between the first and second wall units.

Figure 88:
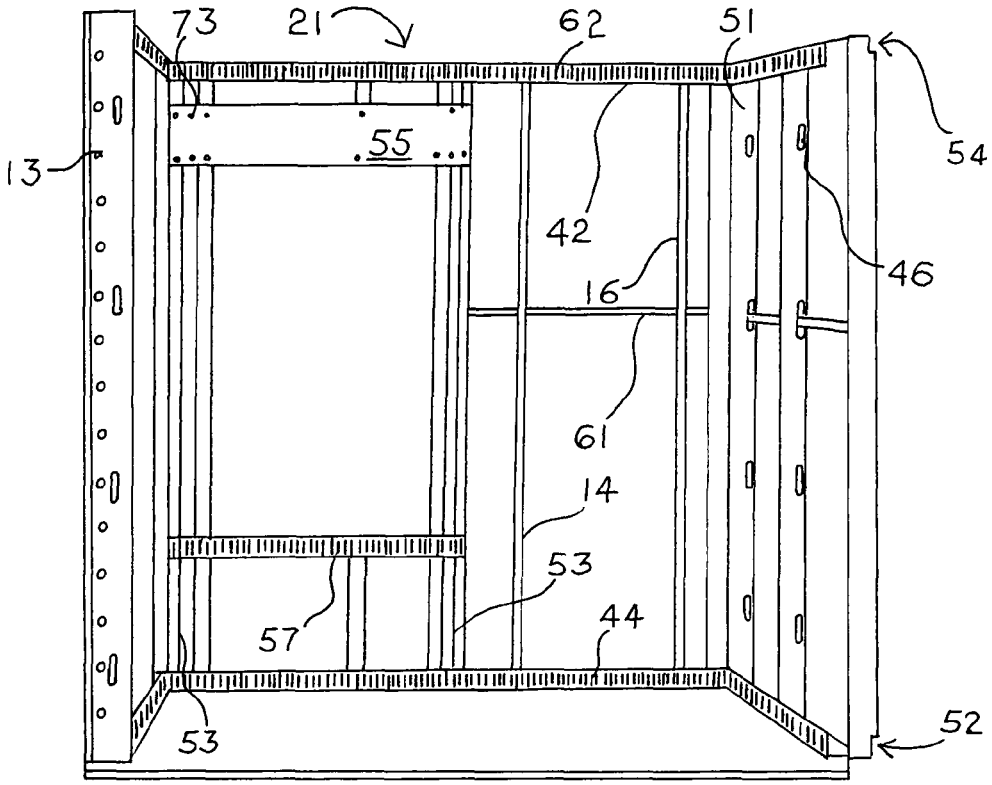
FIG. 88 is a rear elevational view of a wall system according to various embodiments of the present invention.
Figure 89:
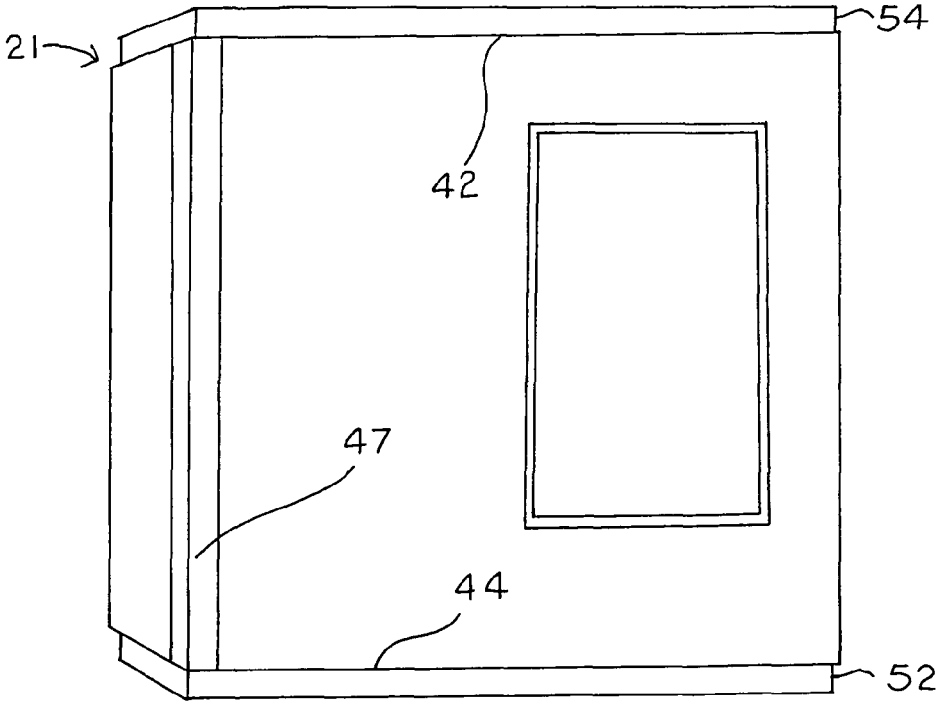
FIG. 89 is a front elevational view of a wall system according to various embodiments of the present invention.
Figure 90:
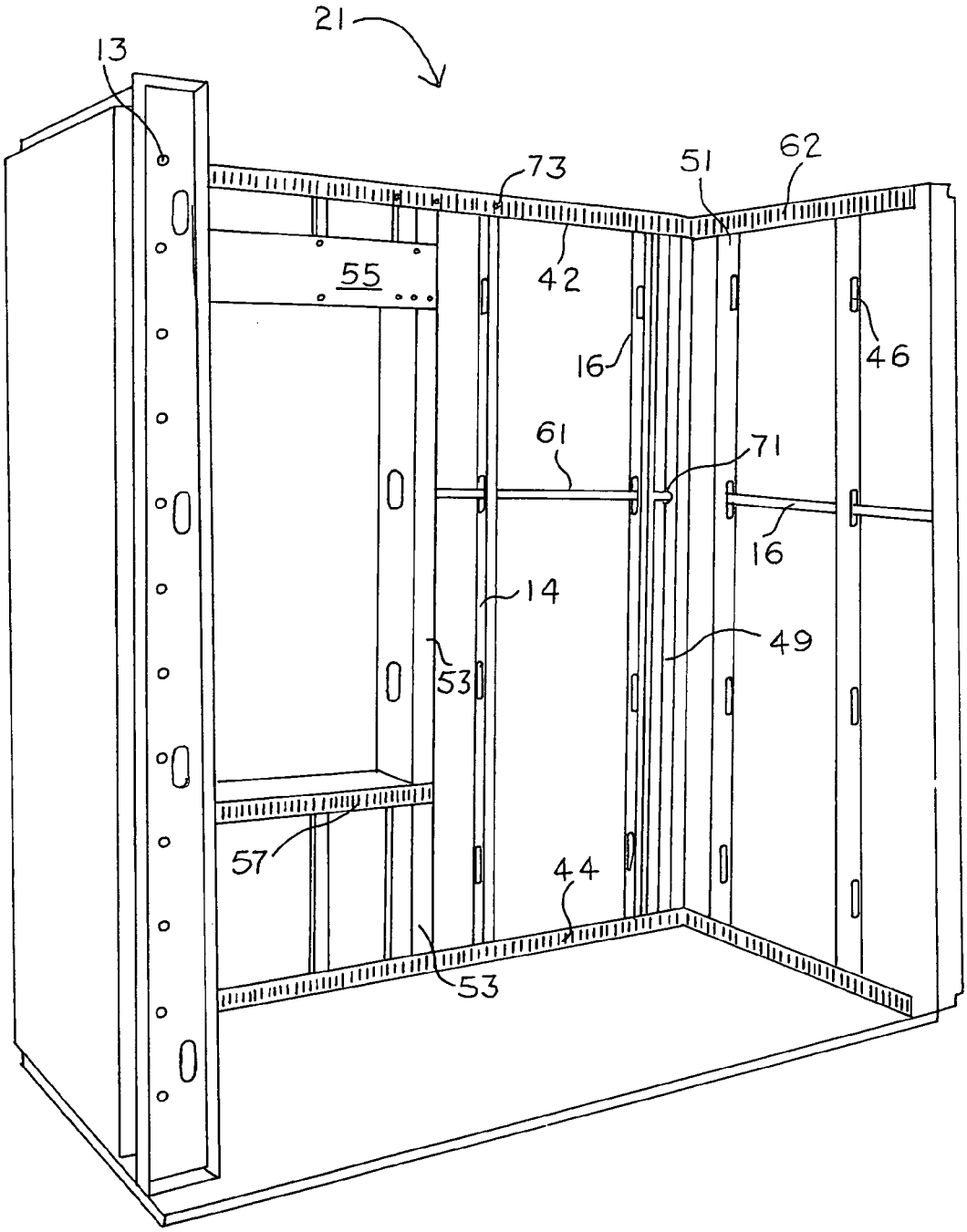
FIG. 90 is a rear perspective view of a wall system according to various embodiments of the present invention.
Figure 91:
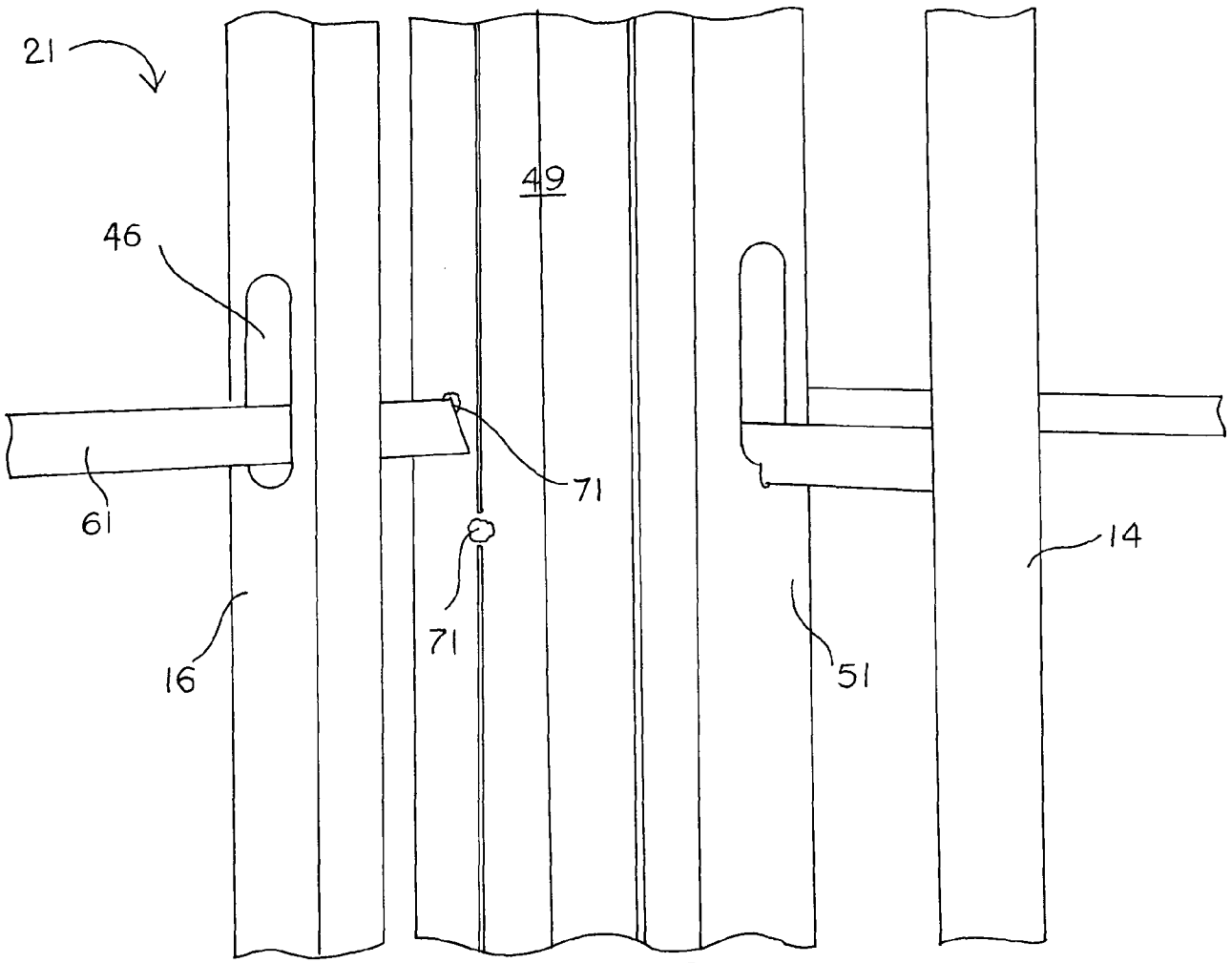
FIG. 91 is a rear view of a portion of a wall system showing spacer bars according to various embodiments of the present invention.

Wall unit 10 is typically part of an overall wall system 21 as shown in FIGS. 88-90. A bottom end of embedded metal studs 14 and 16 are seated in and attached to a bottom track 44 and a top track 42. This configuration leads to the formation of bottom channel 52 and top channel 54. Channels 52 and 54 can be filled with correspondingly shaped expanded polymer material, or alternatively with a molding shaped to fit in channels 52 or 54.

In various embodiments, the top track 42 may comprise slotted track such as that slotted track disclosed in U.S. Pat. No. 5,127,760, the disclosure of which is herein incorporated by reference in its entirety. The portions of the top track 42 and the bottom track 44 extending between the studs 14, 16 can be filled with correspondingly shaped expanded polymer material, or alternatively with a molding shaped to fit in those sections of tracks 42, 44.

Figure 92:
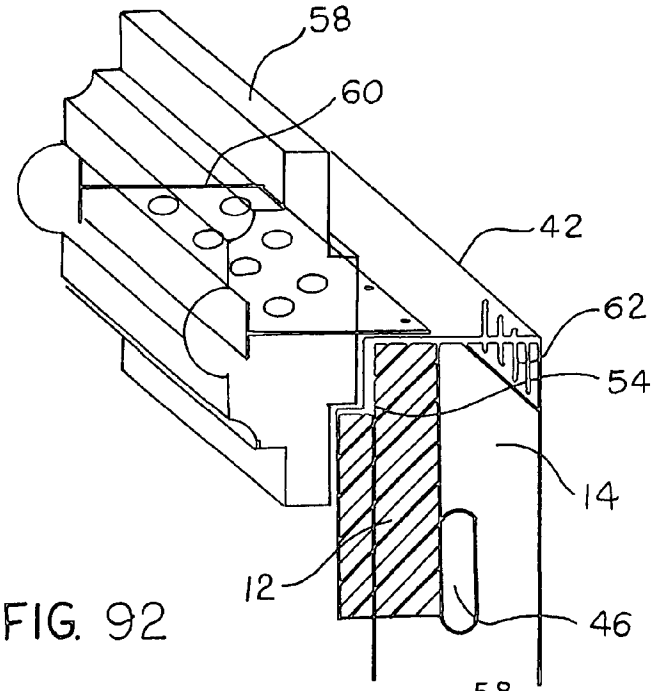
FIG. 92 is a partial top perspective view of a molding attached to a pre-formed building panel according to various embodiments of the present invention.
Figure 93:
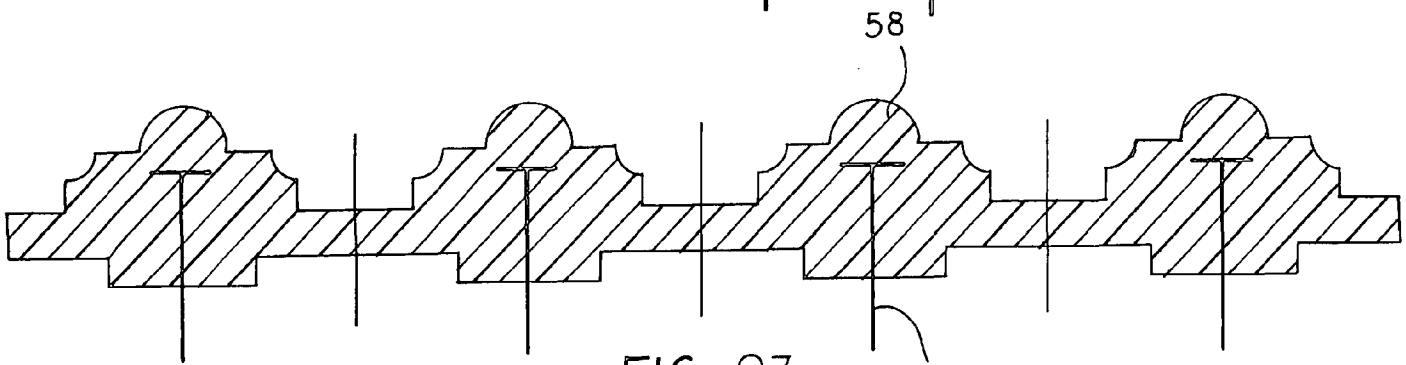
FIG. 93 is a cross-sectional view of the molding of FIG. 92.
Figure 94:
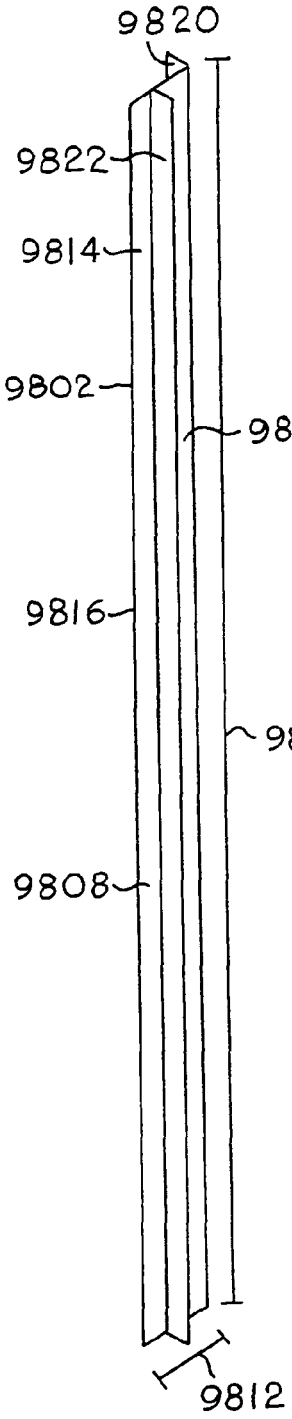
FIG. 94 is a perspective view of an interior corner post according to various embodiments of the present invention.
Figure 95:
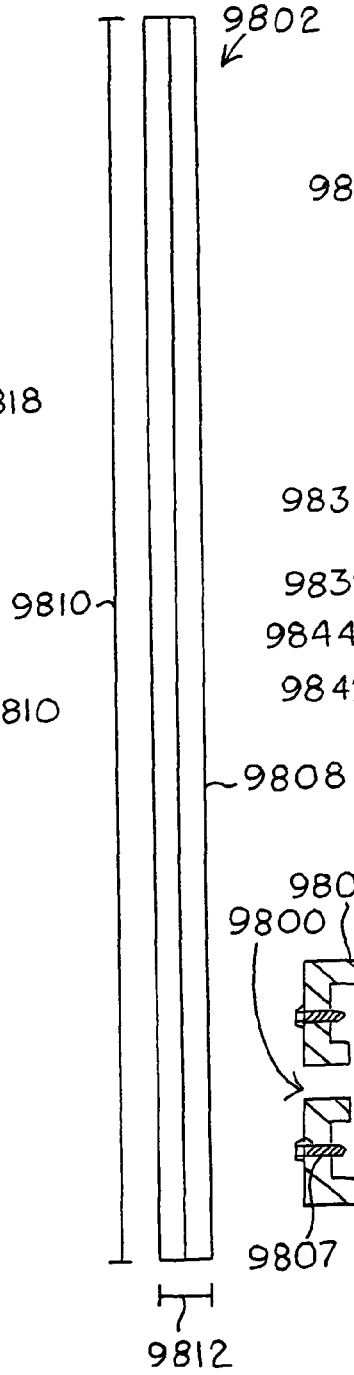
FIG. 95 is a side elevational view of an interior corner post according to various embodiments of the present invention.
Figure 96:
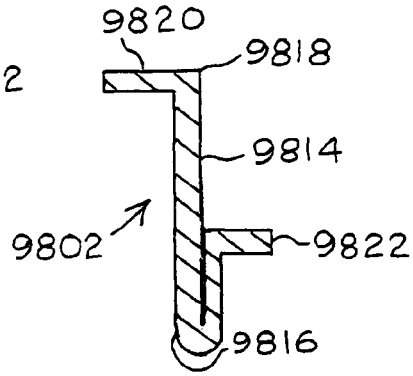
FIG. 96 is a cross-sectional view of an interior corner post according to various embodiments of the present invention.

As a non-limiting example molding 58 can be inserted into top channel 54 and attached to top track 42 by inserting fasteners 60 into holes 62 in top track 42 as shown in FIG. 92. Molding 58 provides a thermal break to the exposed metal track 42. In various embodiments, both sides of each of the embedded metal studs 14 and 16 are exposed at the ends of the panels. This feature overcomes a basic structural problem in the prior art by providing a positive mechanical connection to both sides of the embedded metal studs when top track 42 and bottom track 44 are installed. Further, when slotted top tracks are employed, the combined composite building panels can move relative to the top track 42 when the panels are attached to the top track 42 by mechanical fasteners extending through the slots therein.

Wall system 21 is shown in FIGS. 88-91, in which three wall units are connected. Where the ends of two wall units meet to form a corner, an outside corner attachment 47 secures the ends of the two wall units together. The outside corner attachment may be either an interior corner post assembly 9800 or an exterior corner post assembly 9900. Referring now to FIGS. 94-99, an interior corner post assembly 9800 includes an interior corner post 9802, a first corner stud 9804, a second corner stud 9806 and a plurality of fastening members 9807 for securing the first corner stud 9804 to the interior corner post 9802 and the second corner stud 9806.

Interior corner post 9802 comprises a body 9808 with a length 9810 and a width 9812. The body 9808 comprises a web 9814 with a first end 9816 and a second end 9818, a first flange 9820 extending generally perpendicularly from the second end 9818 of the web 9814, and a second flange 9822 extending generally perpendicularly from a central portion between the first end 9816 and the second end 9818 of the web 9814 in a direction opposite to the first flange 9820. First flange 9820 may comprise a plurality of holes 9824 extending longitudinally along a length of the body 9808. The holes 9824 allow fastening members 9807 to be inserted therethrough to secure the first corner stud 9804 to the interior corner post 9802.

Figure 97:
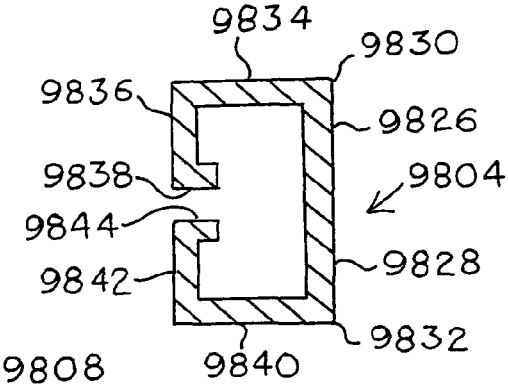
FIG. 97 is a cross-sectional view of a stud for the interior corner assembly of various embodiments of the present invention.
Figure 98:
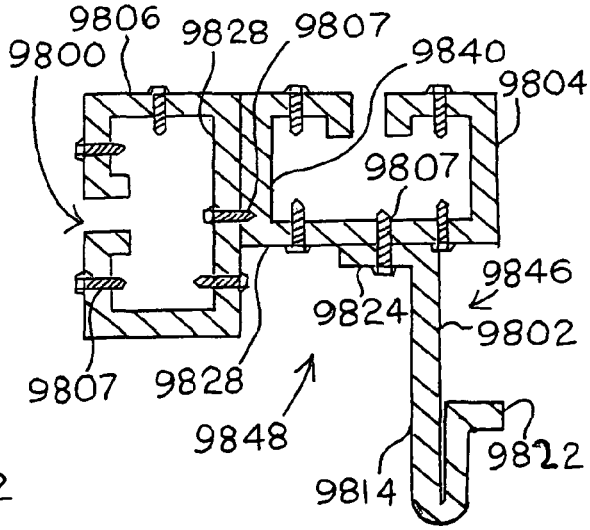
FIG. 98 is an interior corner assembly of various embodiments of the present invention.
Figure 99:
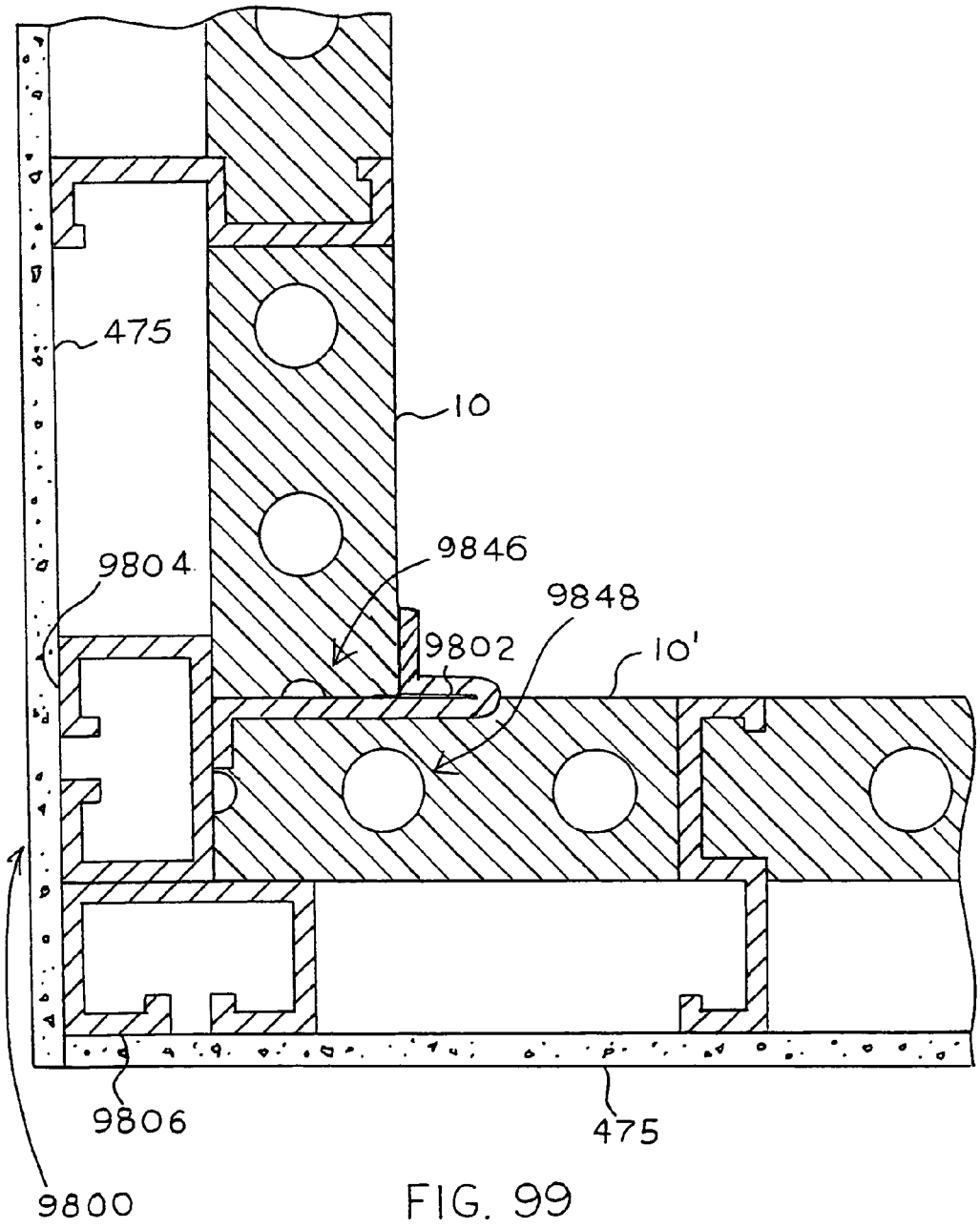
FIG. 99 is a cross-sectional view of building panels connected by an interior corner assembly according to various embodiments of the present invention.

First corner stud and second corner stud, denoted generally as 9804 and 9806, respectively, each comprises a body 9826 having a length and a width. In various embodiments, the first and second corner studs 9804, 9806 may comprise those studs manufactured by Dietrich Industries, Inc. of Pittsburgh, Pa. under the trademark HDS™. As shown in FIGS. 97 and 98, the body 9826 comprises a web 9828 having a first end 9830 and a second end 9832, a first flange 9834 extending generally perpendicularly from the first end 9830 of the web 9828, a return lip 9836 extending generally perpendicularly from the first flange 9834 and in a direction generally away from the first end 9830 of the web 9828, and a second flange 9838 extending generally perpendicularly from the return lip 9836 and towards the web 9828.

The body 9826 also comprises a third flange 9840 extending generally perpendicularly from the second end 9832 of the web 9828, a return lip 9842 extending generally perpendicularly from the third flange 9840 and in a direction generally away from the second end 9832 of the web 9828, and a fourth flange 9844 extending generally perpendicularly from the return lip 9842 and towards the web 9828.

As shown in FIG. 98, interior corner post assembly 9800 is constructed by providing an interior corner post 9802, a first corner stud 9804 and a second corner stud 9806. The web 9828 of the first corner stud 9804 is positioned adjacent to the first flange 9820 of the interior corner post 9802 and attached thereto using one or more fastening members 9807. A first channel, indicated generally as 9846, for receiving a wall unit 10 is thereby formed by a portion of the web 9828 of the first corner stud 9804, the second flange 9822 of the interior corner post 9802 and the web 9814 of the interior corner post 9802. The web 9828 of the second corner stud 9806 is positioned adjacent to the third flange 9840 of the first corner stud 9804 and secured thereto using a fastening member 9807. A second channel, indicated generally as 9848, for receiving a second wall unit 10' is thereby formed by a portion of the web 9828 of the second corner stud 9806, a portion of the web 9828 of the first corner stud 9804 and the web 9814 of the interior corner post 9802. First wall unit 10 and second wall unit 10' are positioned in first channel 9846 and second channel 9848, respectively, such that the exposed end of embedded studs are positioned parallel to the first corner stud 9804 and the second corner stud 9806. A finish surface 475, such as dry wall, can then be secured to the exposed ends of the embedded studs, the first corner stud 9804 and the second corner stud 9806 using a suitable fastening member.

The fastening member 9807 is any suitable fastener including, but not limited to, screws, nails, pins or the like.

In an embodiment of the invention, corner attachment 47 can be a corner post assembly as shown in FIGS. 100-106, where an exterior corner post assembly, indicated generally as 9900, includes an exterior corner post 9902, a first corner stud 9904, a second corner stud 9906 and a plurality of fastening members 9907 for securing the first corner stud 9904 to the exterior corner post 9902 and the second corner stud 9906. In various embodiments, the first and second corner studs 9904, 9906 may comprise those studs manufactured by Dietrich Industries, Inc. of Pittsburgh, Pa. under the trademark HDS™.

Figure 100:
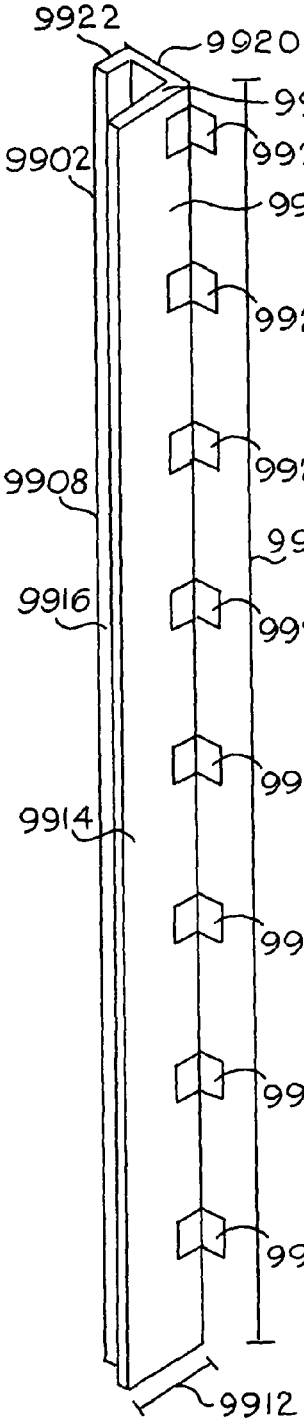
FIG. 100 is a perspective view of an exterior corner post according to various embodiments of the present invention.
Figure 101:
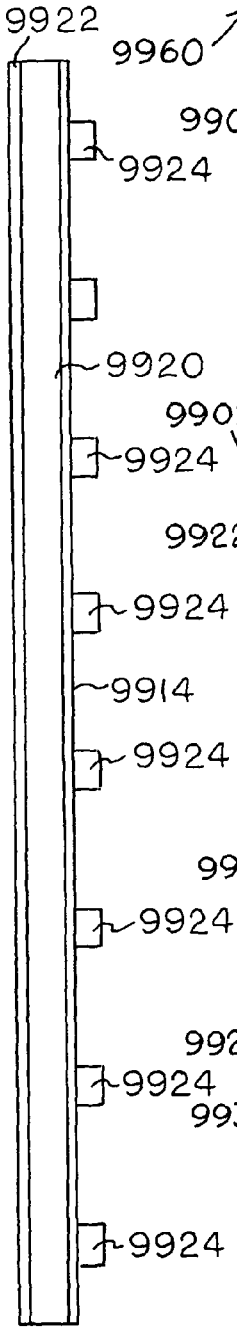
FIG. 101 is a side elevational view of an exterior corner post according to various embodiments of the present invention.
Figure 105:
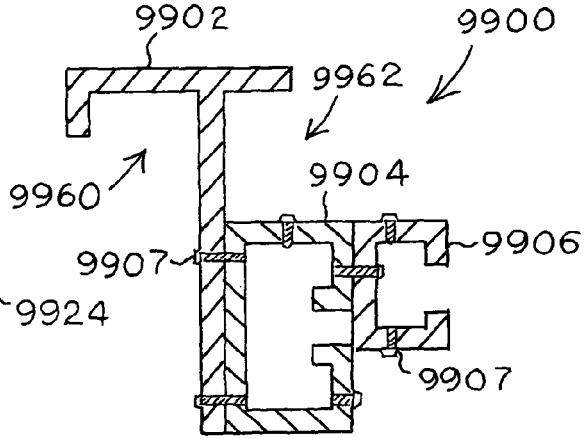
FIG. 105 is an exterior corner assembly of various embodiments of the present invention.
Figure 102:
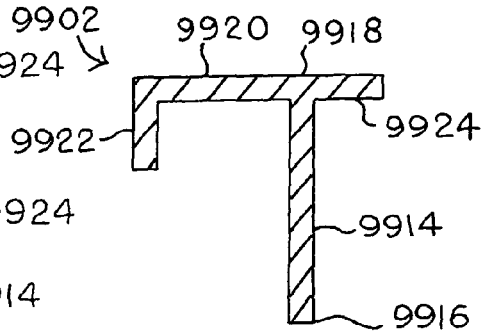
FIG. 102 is a cross-sectional view of an exterior corner post according to various embodiments of the present invention.
Figure 103:
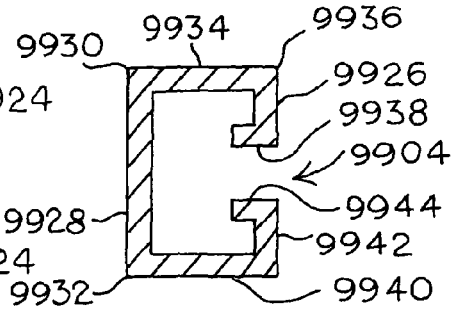
FIG. 103 is a cross-sectional view of a stud for an outer corner assembly of various embodiments of the present invention.
Figure 104:
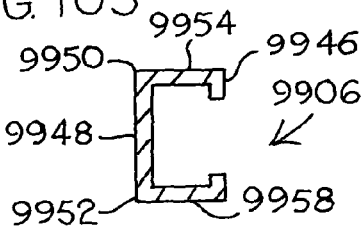
FIG. 104 is a cross-sectional view of a stud for an exterior corner assembly of various embodiments of the present invention.
Figure 106:
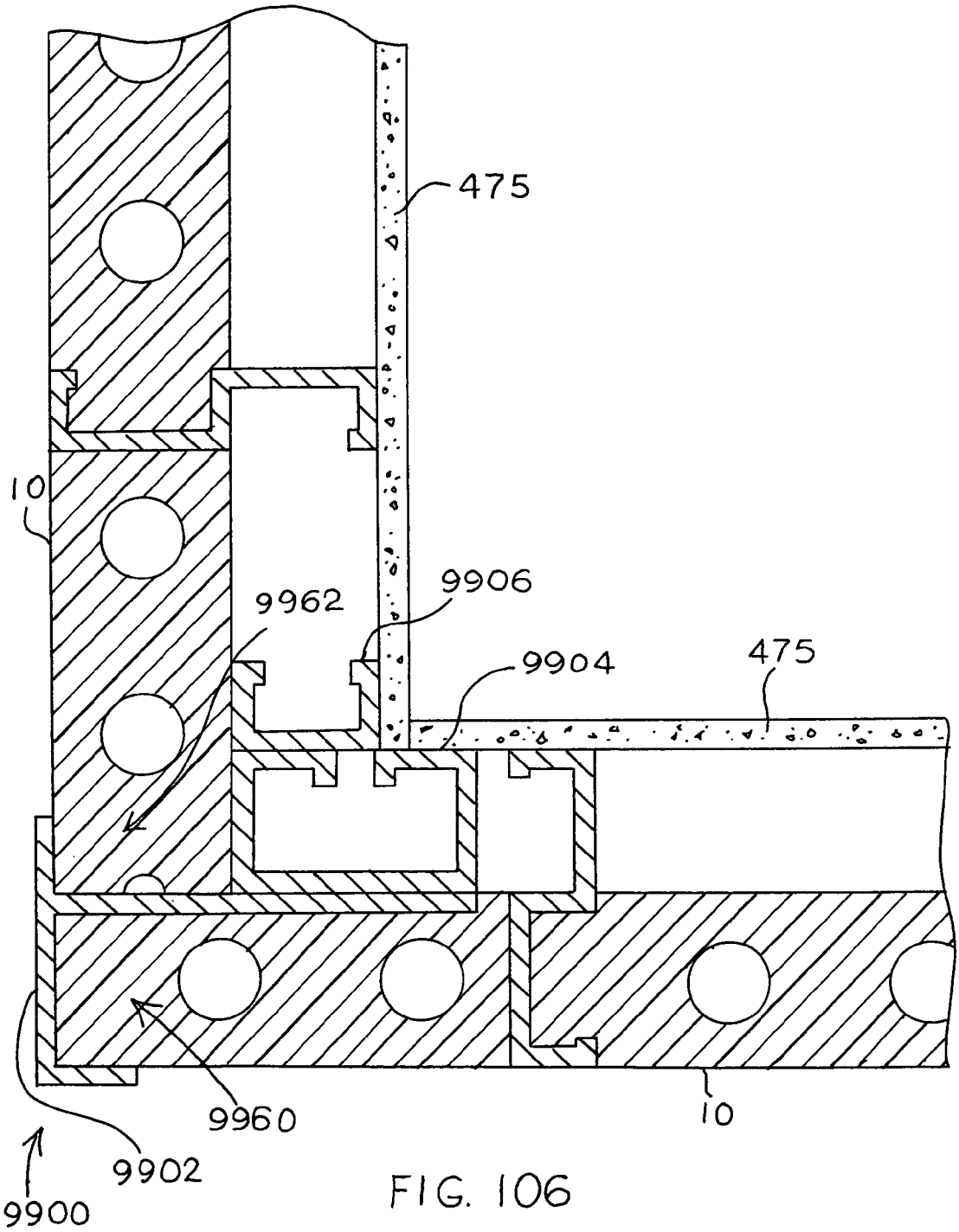
FIG. 106 is a cross-sectional view of building panels connected by an exterior corner assembly according to various embodiments of the present invention.

The exterior corner post 9902 comprises a body 9908 with a length 9910 and a width 9912. The body 9908 comprises a web 9914 with a first end 9916 and a second end 9918, a first flange 9920 extending generally perpendicularly from the second end 9918 of the web 9914, and a lip portion 9922 extending generally perpendicularly from the first flange 9920. The body 9908 also includes right-angled tabs 9924 positioned along the length 9910 of the body 9908. The number of tabs 9924 can vary as needed provide structural integrity. For example, as shown in FIG. 100, eight tabs 9924 can be used. However, it will be understood that other quantities, sizes and shaped tabs 9924 may be employed.

First corner stud, denoted generally as 9904, comprises a body 9926 having a length and a width. The body 9926 comprises a web 9928 having a first end 9930 and a second end 9932, a first flange 9934 extending generally perpendicularly from the first end 9930 of the web 9928, a return lip 9936 extending generally perpendicularly from the first flange 9934 and in a direction generally away from the first end 9930 of the web 9928, and a second flange 9938 extending generally perpendicularly from the return lip 9836 and towards the web 9928.

The body 9926 also comprises a third flange 9940 extending generally perpendicularly from the second end 9932 of the web 9928, a return lip 9942 extending generally perpendicularly from the third flange 9940 and in a direction generally away from the second end 9932 of the web 9928, and a fourth flange 9944 extending generally perpendicularly from the return lip 9942 and towards the web 9928.

The second corner stud, denoted generally as 9906, comprises a body 9946 having a length and a width. The body 9946 comprises a web 9948 having a first end 9950 and a second end 9952, a first flange 9954 extending generally perpendicularly from the first end 9950 of the web 9948, a first return lip 9956 extending generally perpendicularly from the first flange 9954 and in a direction generally away from the first end 9950 of the web 9948.

The body 9946 also comprises a second flange 9958 extending generally perpendicularly from the second end 9952 of the web 9948 and a second return lip 9960 extending generally perpendicularly from the second flange 9958 and in a direction generally away from the second end 9952 of the web 9948.

The exterior corner post assembly 9900 may be constructed by providing an exterior corner post 9902, a first corner stud 9904 and a second corner stud 9906. The web 9928 of the first corner stud 9904 is then positioned adjacent to the web 9914 of the exterior corner post 9902 and attached thereto using a fastening member 9907. The web 9948 of the second corner stud 9906 is positioned adjacent to the return lip 9936 of the first corner stud 9904 and secured thereto using a fastening member 9907. A first channel 9960 for receiving a wall unit 10 is formed by the lip portion 9922, the first flange 9820 and the web 9914 of the exterior corner post 9902. A second channel 9862 for receiving a second wall unit 10' is formed by a portion of the web 9914 of the exterior corner post 9902, the tab 9924 of the exterior corner post 9902, the first flange 9954 of the second corner stud 9906 and the first flange 9934 of the first corner stud 9904. First wall unit 10 and second wall unit 10' are positioned in first channel 9960 and second channel 9962, respectively, such that the exposed end of embedded studs are positioned parallel to the first corner stud 9904 and the second corner stud 9906. A finish surface 475, such as dry wall, can then be secured to the exposed ends of the embedded studs, the first corner stud 9904 and the second corner stud 9906 using a suitable fastening member to form an inside wall.

The fastening member 9807 is any suitable fastener including, but not limited to, screws, nails, pins or the like.

Also, additional metal studs 49 can be included to add strength to the formed corners. Thus the wall system includes interconnecting bottom 44 and top 42 tracks that may be of the type and construction described above and embedded metal studs 51 secured together at corner attachment units that extend along the height of each wall unit.

Openings for windows and doors are provided by framing the ends of the opening with two or more embedded metal studs placed adjacent to each other (shown as 53). Upper member 55 and lower member 57 are connected to the embedded metal studs to form a framed opening. The openings can be adapted to readily accept pre-manufactured windows and doors.

Figure 107:
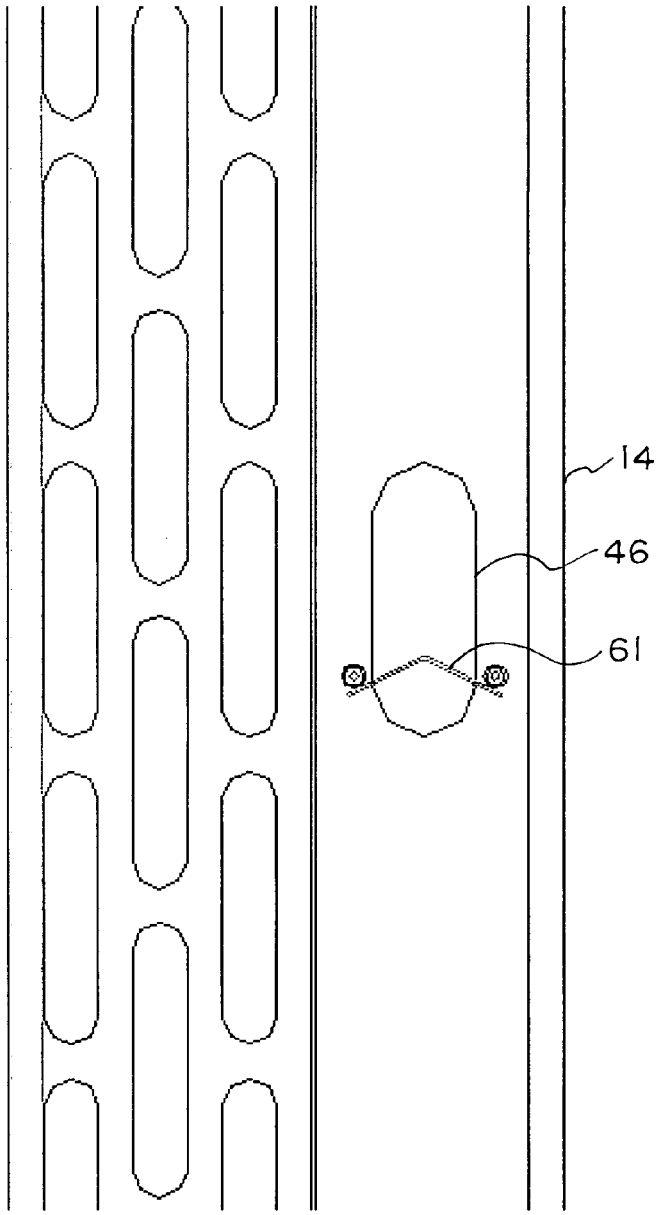
FIG. 107 is a side elevational view of a portion of a stud and spacer bar assembly according to various embodiments of the present invention.
Figure 108:
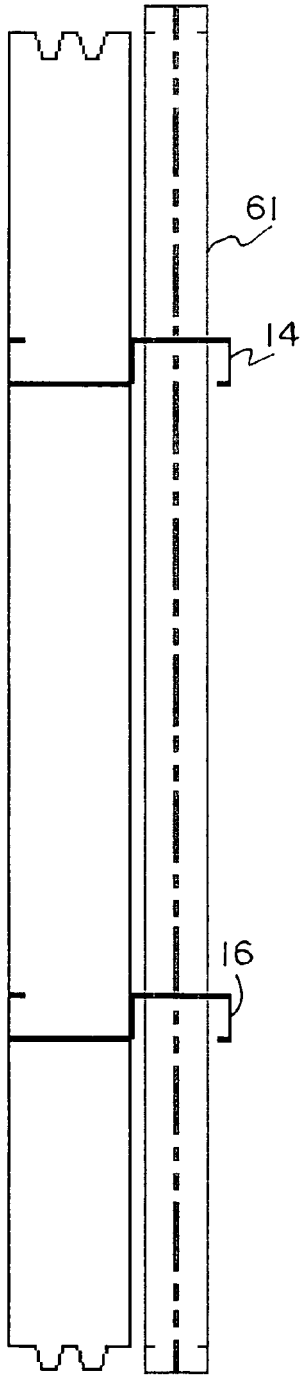
FIG. 108 is a cross-sectional view of a stud and spacer bar assembly according to various embodiments of the present invention.

The strength and integrity of wall system 21 can be enhanced by including spacer bars 61 that are arranged to pass through openings, such as utility holes 46 in embedded metal studs 14 and 16. Referring now to FIGS. 107 and 108, spacer bars 61 are attached to embedded metal studs 14 and 16 and are arranged, as shown, in a generally perpendicular relationship to metal studs 14 and 16, although spacer bars 61 can be arranged to form any suitable angle with embedded metal studs 14 and 16 that enhances the strength and integrity or wall system 21. Spacer bars and metal studs that can be incorporated in the invention include those available under the trademarks TRADE READY® SPAZZER® available from Dietrich Industries, Inc., Pittsburgh, Pa. as well as those disclosed in U.S. Pat. Nos. 5,784,850, 6,021,618 and 6,708,460, the relevant portions of which are herein incorporated by reference. In one embodiment, SPAZZER® bar Model No. 5400 is used. Retainer clips such as SPAZZER® BAR GUARD™ retainer clips, also available from Dietrich Industries, Inc., can be used for load bearing applications, if desired.

The various metal structural parts in wall system 21 can be secured or attached to one another by way of welds 71 and/or screws 73. It is conceivable, however, that other forms of mechanical fasteners may also be employed without departing form the spirit and scope of the present invention.

Some advantages of the present wall units and wall systems include the ability to easily run utilities prior to attaching a finish surface to the exposed ends of the embedded metal studs. The exposed metal studs facilitate field structural framing changes and additions and leave the structural portions of the assembly exposed for local building officials to inspect the framing.

Figure 109:
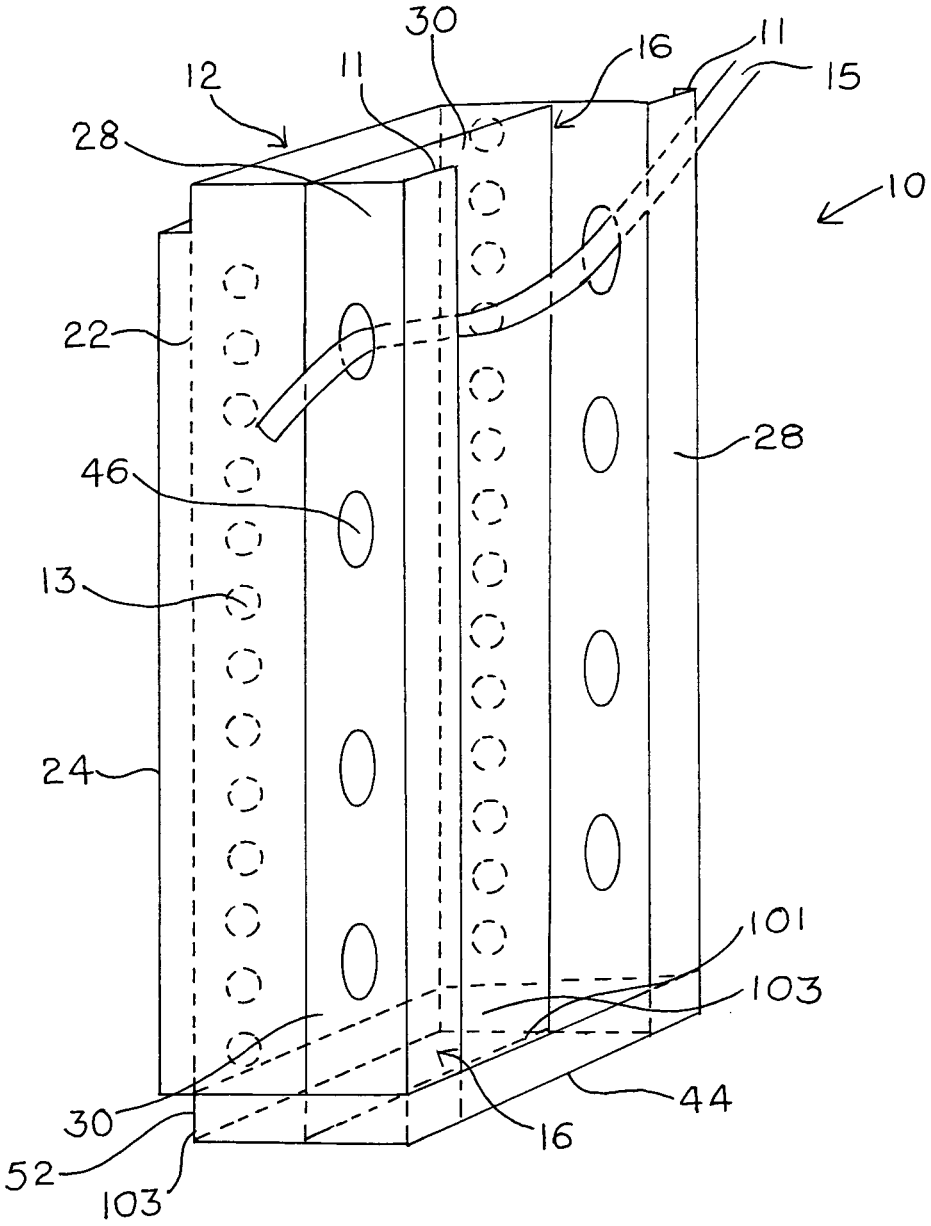
FIG. 109 is a perspective view of a wall system according to various embodiments of the present invention.

Referring to FIG. 109, in an embodiment of the invention, wall unit 10 includes expanded polymer body 12 (central body), right facing embedded metal studs 16, which include flanges 11 and have utility holes 46 located in an exposed portion of embedded studs 16, expansion holes 13 in an embedded portion (thermal portion) of embedded studs 16 and embedded end 22, which does not touch outer surface 24 of expanded polymer body 12. The embedded metal studs 16 also have exposed end 28 (structural portion) respectively that extends from inner surface 30 of expanded polymer body 12. While C-type embedded studs are illustrated in FIG. 109, this is not to be construed as limiting the present invention as the use of other types of studs, such as CC-type embedded studs and CT-type embedded studs, may be successfully employed in similar manners.

A utility space defined by inner surface 30 of expanded polymer body 12 and flanges 11 adapted for running utilities is provided. Flanges 11 may have a finish surface or material attached to them, a side of which further defines the utility space.

In an embodiment of the invention, the utility space may be adapted and dimensioned to receive a variety of commercially available standard and/or pre-manufactured components, such as windows, doors and medicine cabinets as well as customized cabinets, shelving, etc.

In an embodiment of the invention, utility holes 46 may be adapted to allow utilities (as shown, electrical line 15) to be installed in a transverse direction through embedded studs 16.

The utilities can be one or more selected from water lines (either potable, or as a non-limiting example hot water lines for radiant heating), waste lines, chases, telephone lines, cable television lines, computer lines, fiber optic cables, satellite dish communication lines, antenna lines, electrical lines, ductwork, gas lines, etc.

In a particular embodiment of the invention, wall unit 10 is attached to bottom track 44. In this embodiment, bottom track 44 is adapted to hold a volume at least equivalent to the volume of the expanded polymer matrix in expanded polymer body 12, in liquid or molten form. In some instances, this volume can be defined by bottom 101 and sides 103 of bottom track 44 and the portions of embedded bars 16 within the space defined by bottom track 44.

Non-limiting examples of suitable finish surfaces include wood, rigid plastics, wood paneling, concrete panels, cement panels, drywall, sheetrock, particle board, rigid plastic panels, a metal lath, or any other suitable material having decorating and/or structural functions.

Further, the air space between the inner surface of the expanded polymer body and the finish surface allows for improved air circulation, which can minimize or prevent mildew. Additionally, because the metal studs are not in direct contact with the outer surface, thermal bridging via the highly conductive embedded metal studs is avoided and insulation properties are improved.

Figure 110:
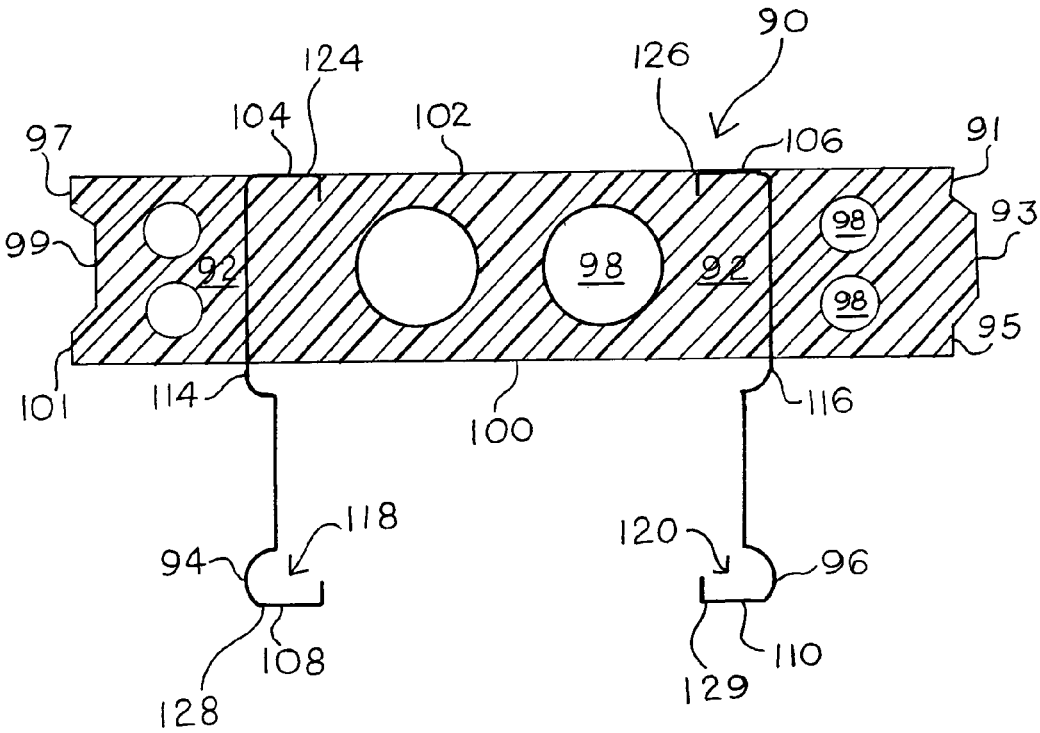
FIG. 110 is a cross-sectional view of a pre-formed building panel according to various embodiments of the present invention.

The present invention also provides composite building panels useful for floor units and floor systems. As shown in FIG. 110, floor unit 90 includes expandable polymer panel 92 (central body) and embedded metal joists 94 and 96 (embedded framing studs). Expandable polymer panel 92 includes openings 98 that traverse all or part of the length of expanded polymer panel 92 (as described regarding openings 18 in expanded polymer body 12). The embedded metal joists 94 and 96 have embedded ends 104 and 106, respectively, that are in contact with top surface 102 of expanded polymer panel 92. The embedded metal joists 94 and 96 also have exposed ends 108 and 110, respectively, that extend from bottom surface 100 of expanded polymer panel 92.

Embedded metal joists 94 and 96 include first transverse members 124 and 126, respectively, extending from embedded ends 104 and 106, respectively, which are generally in contact with top surface 102 and exposed ends 108 and 110 include second transverse members 128 and 129, respectively, which extending from exposed ends 108 and 110, respectively. The space defined by bottom surface 100 of expanded polymer panel 92 and the exposed ends 108 and 110 and second transverse members 128 and 129 of embedded metal joists 94 and 96 can be oriented to accept ductwork or other members placed between embedded metal joists 94 and 96 adjacent bottom surface 100.

Expanded polymer panel 92 can have a thickness, measured as the distance from top surface 102 to bottom surface 100 similar in dimensions to that described above regarding expanded polymer body 12. See FIG. 110.

Exposed ends 108 and 110 extend at least 1, in some cases at least 2, and in other cases at least 1.18 inches (3 cm) away from bottom surface 100 of expanded polymer panel 92. Also, exposed ends 108 and 110 can extend up to 60, in some cases up to 40, and in other cases up to 7.87 in (20 cm) away from bottom surface 100 of expanded polymer panel 92. Exposed ends 108 and 110 can extend any of the distances or can range between any of the distances recited above from bottom surface 100.

In an embodiment of the invention, embedded metal joists 94 and 96 have a cross-sectional shape that includes embedding lengths 114 and 116, embedded ends 104 and 106, and exposed ends 108 and 110. The orientation of embedded metal joists 94 and 96 is referenced by the direction of open ends 118 and 120. In an embodiment of the invention, open ends 118 and 120 are oriented toward each other. In this embodiment, floor unit 90 is adapted to accept ductwork. As a non-limiting example, a HVAC duct can be installed along the length of embedded metal joists 94 and 96.

As used herein, the term "ductwork" refers to any tube, pipe, channel or other enclosure through which air can flow from a source to a receiving space; non-limiting examples being air flowing from heating and/or air-conditioning equipment to a room, make-up air flowing from a room to heating and/or air-conditioning equipment, fresh air flowing to an enclosed space, and/or waste air flowing from an enclosed space to a location outside of the enclosed space. In some embodiments, ductwork includes generally rectangular metal tubes that are located below and extend generally adjacent to a floor.

The spacing between each of embedded metal joists 94 and 96 can be as described regarding embedded metal studs 14 and 16 in wall unit 10.

Openings 98 can have various cross-sectional shapes and similar spacing and cross-sectional area as described regarding openings 18 in expanded polymer body 12.

As shown in FIG. 110, expanded polymer panel 92 can extend for a distance with alternating embedded metal joists 94 and 96 placed therein. The length of floor unit 90 can be any length that allows for safe handling and minimal damage to floor unit 90 as described regarding the length of wall unit 10. In some embodiments, an end of floor unit 90 can be terminated with an embedded metal joist.

As shown in FIG. 110, expanded polymer panel 12 has a finite length and has a male terminal end 91 that includes forward edge 93 and trailing edge 95 and a receiving end 97 which includes recessed section 99 and extended section 101, which is adapted to receive forward edge 93, and trailing edge 95. Typically, lengths of floor units 90 are interconnected by inserting a forward edge 93 from a first floor unit 90 into a recessed section 99 from a second floor unit 90. In this manner, a larger floor section containing any number of floor units can be assembled and/or arrayed.

The width of floor unit 90 can be any width that allows for safe handling and minimal damage to floor unit 90. The width of floor unit 90 may be determined by the length of embedded metal joists 94 and 96. The width of floor unit 90 can be at least 1 and in some cases at least 4.92 feet (1.5 m) and can be up to 9.84 feet (3 m) and in some cases up to 8.20 feet (2.5 m). In some instances, in order to add stability to floor unit 90, reinforcing cross-members (not shown) can be attached to embedded metal joists 94 and 96. The width of floor unit 90 can be any value or can range between any of the values recited above.

Floor unit 90 may comprise a typically part of an overall floor system, which may include, for example, a plurality of composite floor panels as described herein, ductwork attached to the reinforcing members of at least one floor panel, and a flooring material attached to one or more of the first transverse members of the composite floor panels.

The floor panels interconnect with the male ends, which include a forward edge or tongue edge, and the female ends, which include a groove or recessed section, arrayed such that the tongue (male) and/or groove (female) of each panel is in sufficient contact with a corresponding tongue and/or groove of another panel to form a structure having a planar surface.

In the present floor system, ductwork can be attached to the reinforcing members of at least one composite floor panel.

Additionally, a flooring material can be attached to one or more of the first transverse members of the composite floor panels. Any suitable flooring material can be used in the invention. Suitable flooring materials are materials that can be attached to the transverse members and cover at least a portion of the expanded polymer panel. Suitable flooring materials may include, but are not limited to, plywood, wood planks, tongue and grooved wood floor sections, sheet metal, sheets of structural plastics, stone, ceramic, cement, concrete, and combinations thereof.

Generally, the floor system forms a plane that extends laterally from a foundation and/or a structural wall.

Figure 126A:
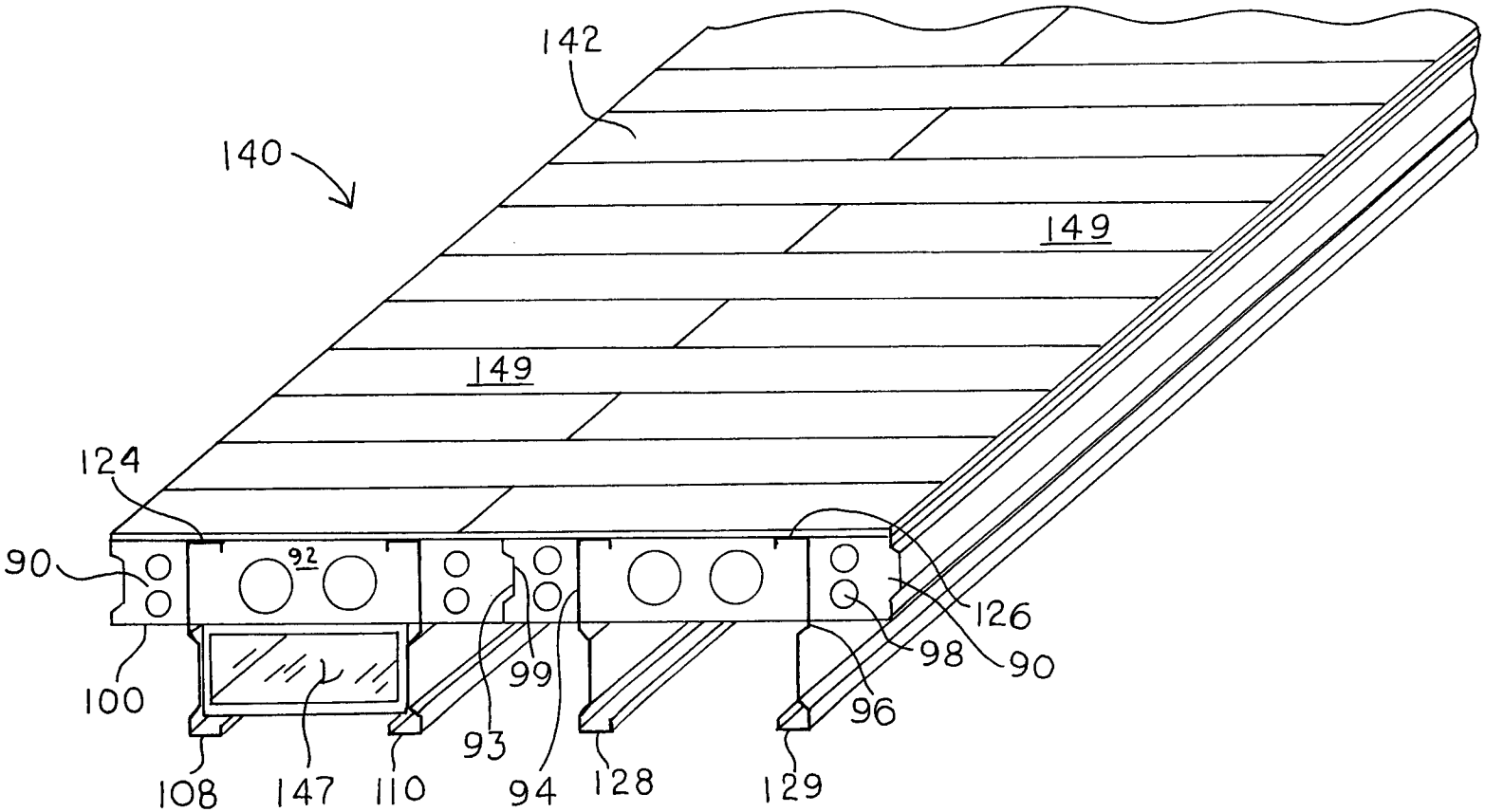
Figure 126B:
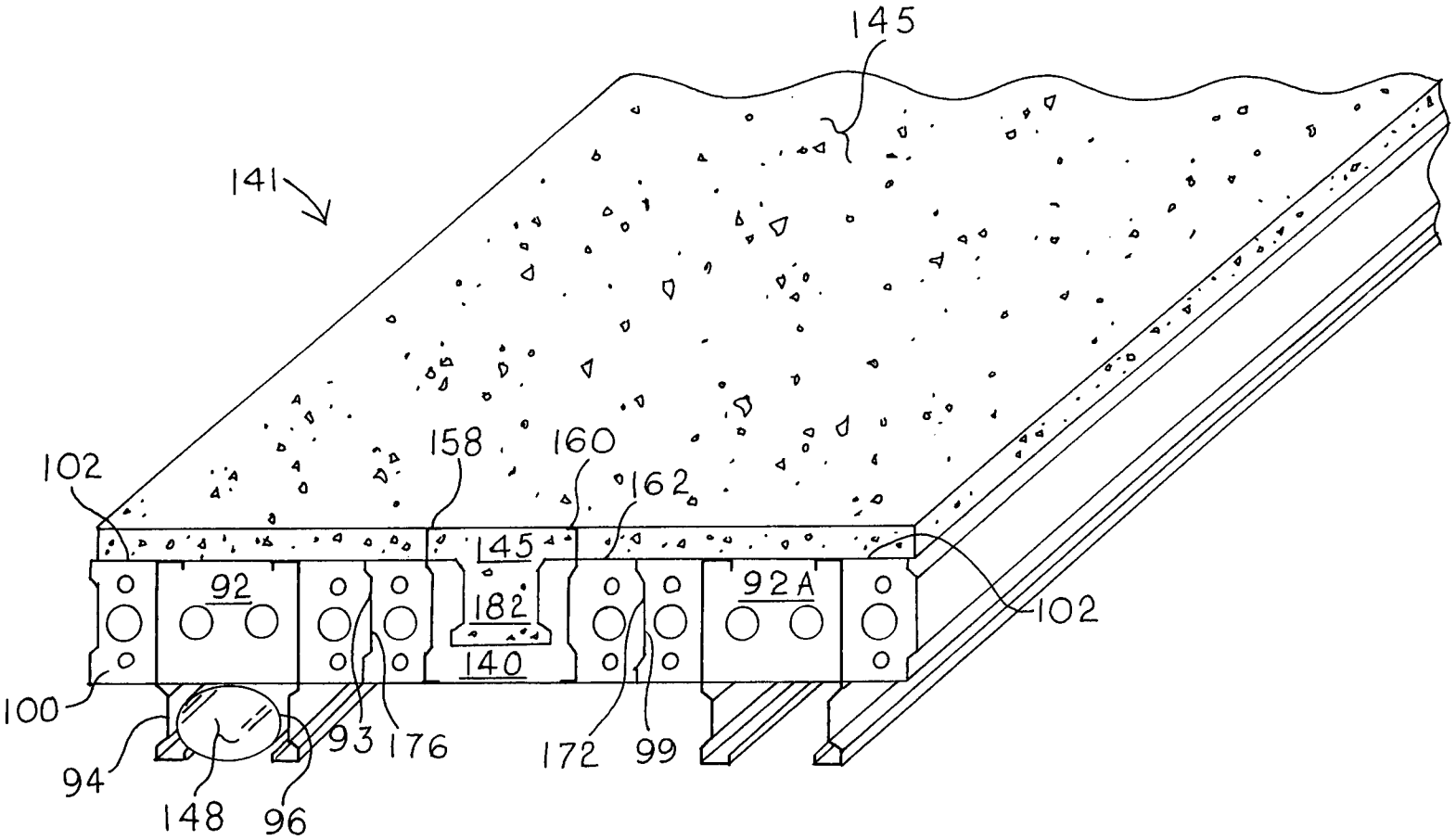

FIGS. 126A and 126B show floor system components 140 and 141 respectively. As shown in FIGS. 126A and 126B, the floor system is established by contacting forward edge 93 with recessed section 99 to form a continuous floor 142. Like features of the individual floor panels are labeled as indicated above. As described above, various shaped types of ductwork can be secured in the space defined by bottom surface 100 of expanded polymer panel 92 and the exposed ends 108 and 110 and second transverse members 128 and 129 of embedded metal joists 94 and 96. As non-limiting examples, rectangular ventilation duct 147 is shown in FIG. 126A and oval air duct 148 is shown in FIG. 126B.

The composite building panels, wall units, floor units, tilt up insulated panels and I-beam panels described herein contain variations that are not meant as limitations. Any of the variations discussed in one embodiment can be used in another embodiment without limitation.

The embodiments of the invention shown in FIGS. 126A and 126B show a non-limiting example of combinations of the composite panels described herein combining features of the various panels. This embodiment combines I-beam panel 140 and floor panel 90 (shown as 92 and 92A). In this embodiment, receiving end 176 of I-beam panel 140 accepts forward edge 93 of floor panel 92 and recessed section 99 of floor panel 92A accepts forward edge 172 of I-beam panel 140 to provide tongue and groove connections to establish continuous floor system 141. In this embodiment, circular ductwork 148 is installed along bottom surface 100 of floor panel 92 between embedded metal joists 94 and 96. In this embodiment, the flooring material is concrete layer 145, which covers top surface 102 of floor panels 92 and 92A and outer face 162 of I-beam panel 140. I-beam channel 182 extends from and is open to outer face 162 and is filled with concrete and the thickness of concrete layer 145 is sufficient to encase exposed ends 158 and 160 of I-beam panel 140. The combination shown in this embodiment provides an insulated concrete floor system where utilities can be run under an insulation layer.

Figure 112:
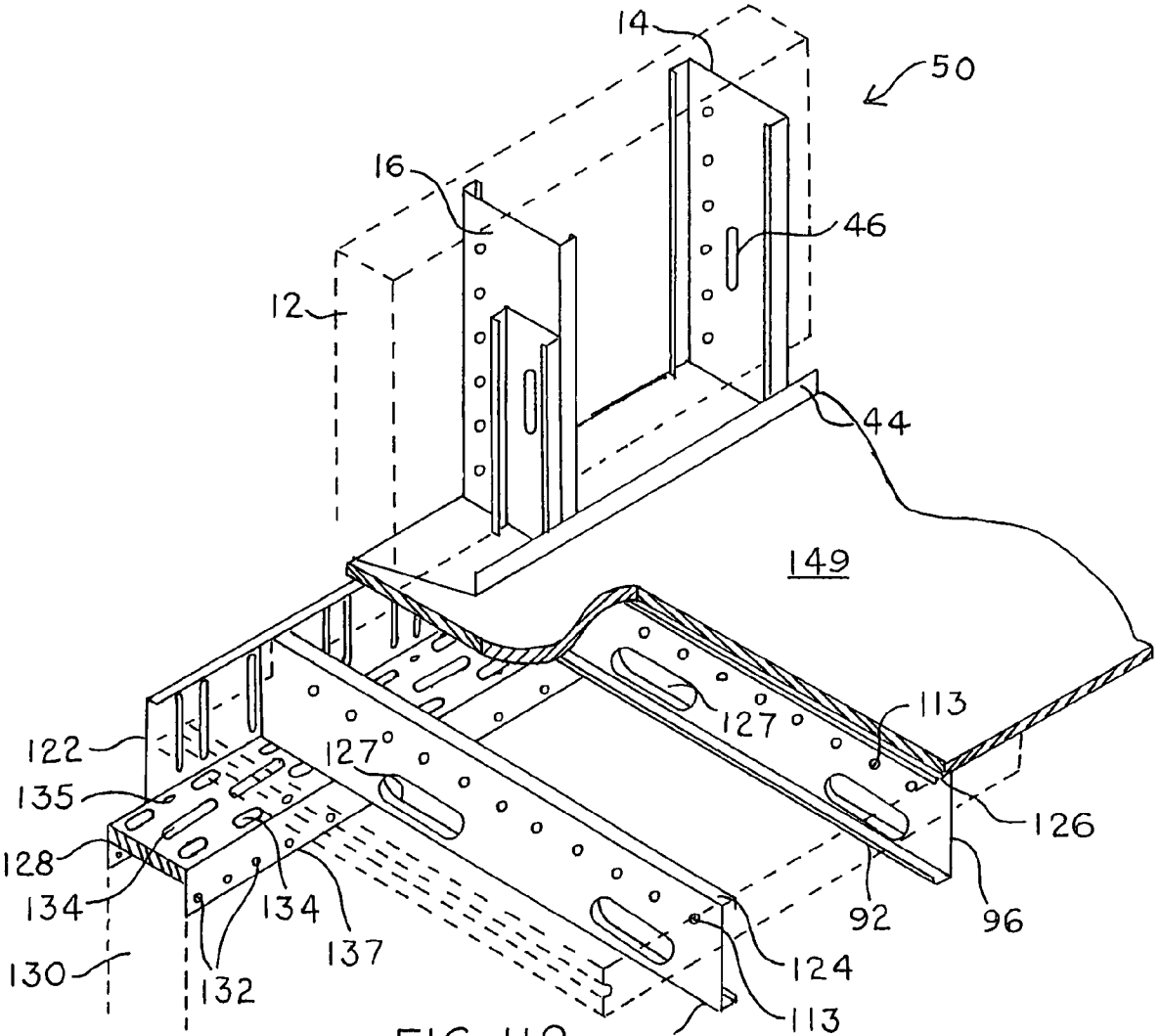
FIG. 112 is a perspective view of a construction method according to various embodiments of the present invention.

As shown in FIG. 112, an end of embedded metal joists 94 and 96 are seated in and attached to a joist rim 122 and a second joist rim is attached to the other end of embedded metal joists 94 and 96. A floor base 149, typically plywood, particle board or other supporting surface or flooring material, can be attached to the exposed ends 108 and 110. Alternatively, floor base 149 can be attached to embedded ends 104 and 106.

Figure 114:
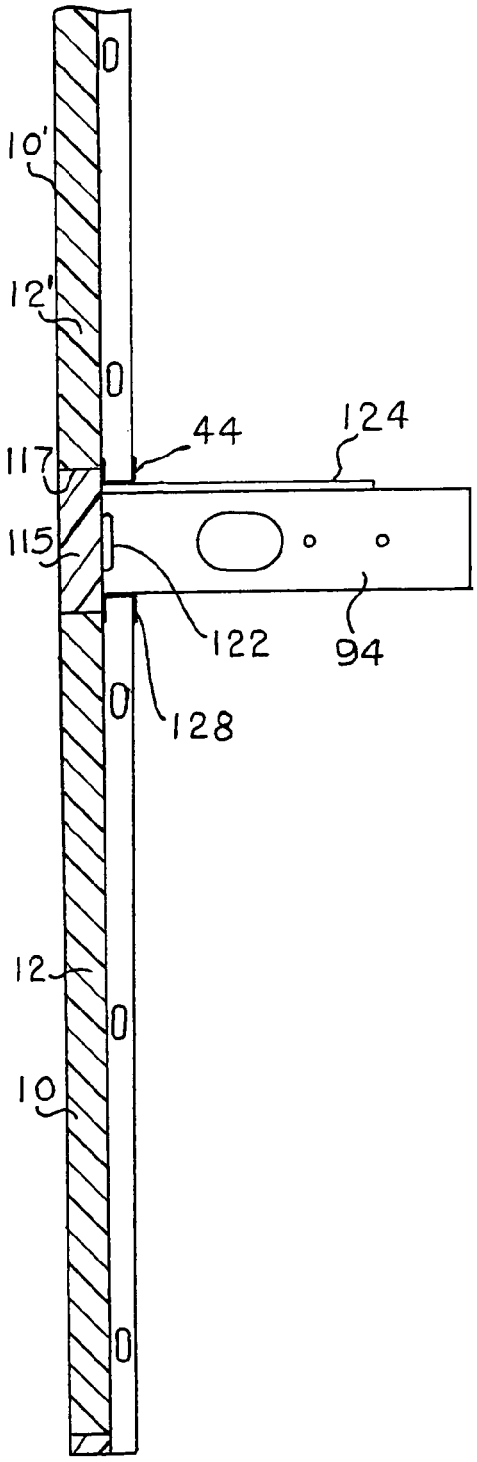
FIG. 114 is a side elevational view of a pre-formed building panel and floor connector system according to various embodiments of the present invention.
Figure 115:
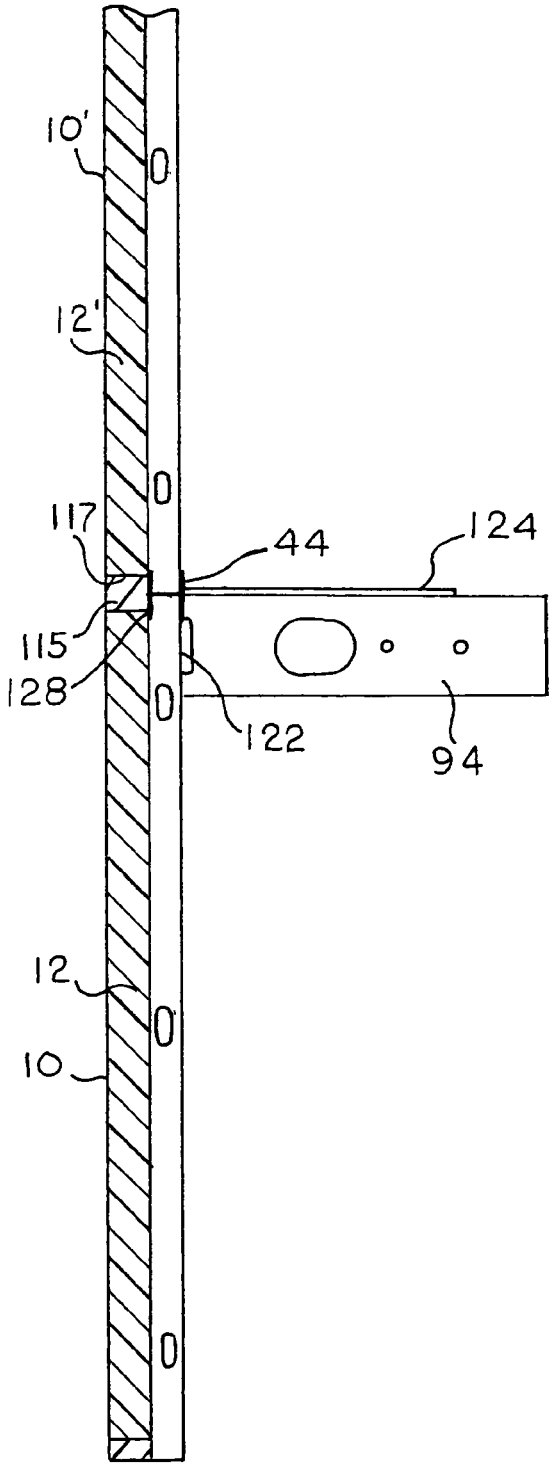
FIG. 115 is a side elevational view of a pre-formed building panel and floor connector system according to various embodiments of the present invention.

Referring now to FIGS. 114 and 115, a first wall unit 10 with a first end and a second end is positioned with the first end adjacent to a surface and the second end positioned in a level track 128. A joist rim 122 of a floor system is fixedly connected to the level track 128. In various embodiments, the joist rims manufactured by Dietrich Industries of Pittsburgh, Pa. under the trademark TRADE READY® may be employed. A plurality of metal joists 94 are attached to the joist rim 122 and support a floor base 149. A bottom track 44 is also provided in connection with joist rim 122 opposite to level track 128. A second wall unit 10' with a first end and a second is positioned with the first end in the bottom track 44. When the first and second wall units 10, 10' are constructed in this manner, a gap 117 between the expanded polymer body 12 of the first wall unit 10 and the expanded polymer body 12' of the second wall unit is created. This gap 117 can be filled with any suitable material 115, such as insulation. The material 115 may be secured to the structure using an adhesive, nails, screws or any other suitable securing method.

In this manner, a multi-story structure can be constructed using the building panels of the present invention.

Referring back to FIG. 112, embedded metal joists 94 and 96 have utility holes 127 spaced along their length. Utility holes 127 are useful for running wiring for electricity, telephone, cable television, speakers, and other electronic devices. Utility holes 127 can have various cross-sectional shapes, non-limiting examples being round, oval, elliptical, square, rectangular, triangular, hexagonal or octagonal. The cross-sectional area of Utility holes 127 can also vary independently one from another or they can be uniform. The cross-sectional area of utility holes 127 is limited by the dimensions of embedded metal joists 94 and 96, as utility holes 127 will fit within their dimensions and not significantly detract from their structural integrity and strength.

Expansion holes 13, as mentioned above are useful in that as expanded polymer body 92 is molded, the polymer matrix expands through expansion holes 113 and the expanding polymer fuses. This allows the polymer matrix to encase and hold embedded studs 94 and 96 by way of the fusion in the expanding polymer. In an embodiment of the invention, expansion holes 13 can have a flanged and in many cases a rolled flange surface to provided added strength to the embedded metal studs.

Figure 113:
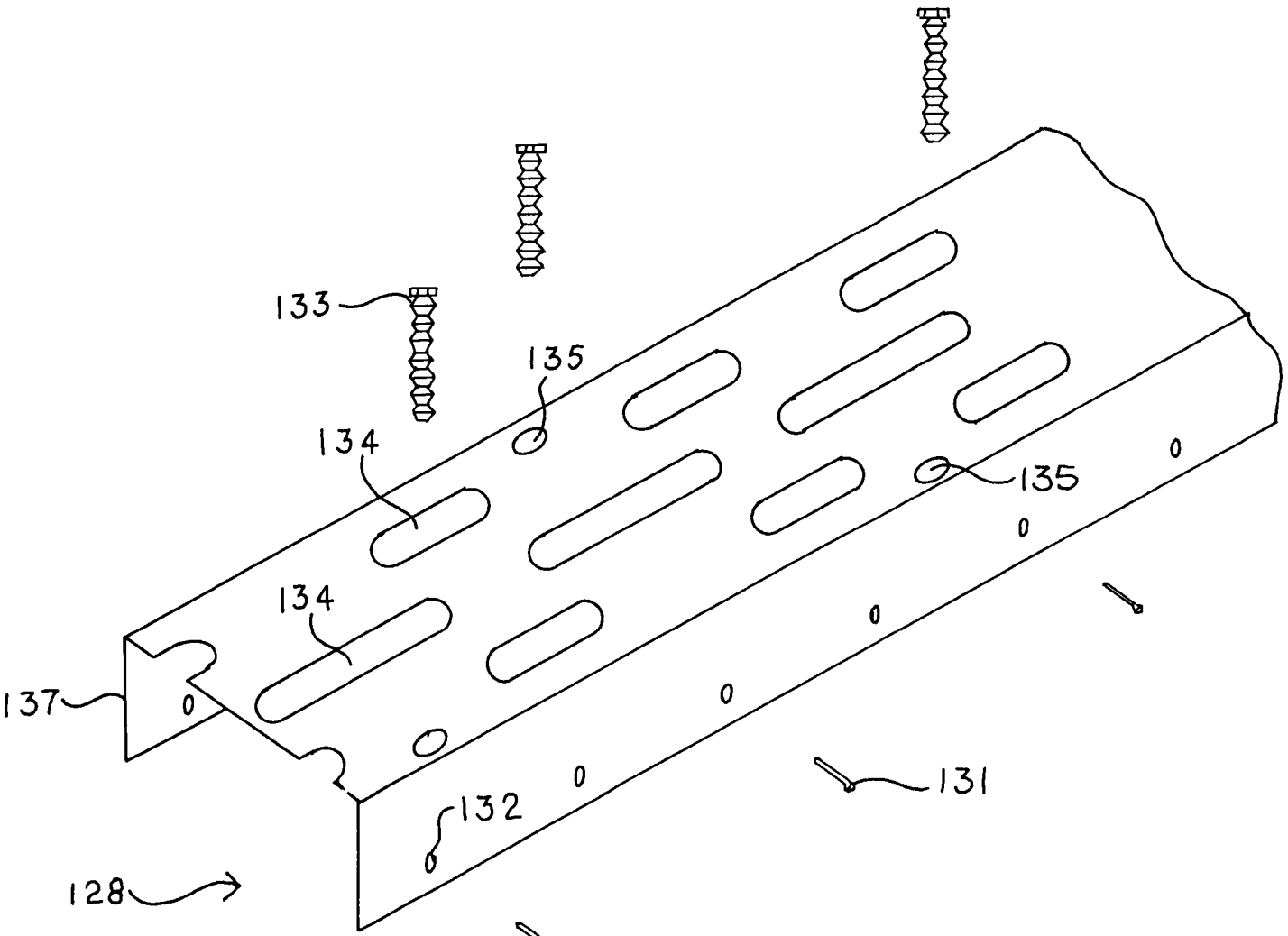
FIG. 113 is a partial perspective view of a level track according to various embodiments of the present invention.

In an embodiment of the invention, the floor system can be placed on a foundation. However, because foundations are rarely perfectly level, a level track 128 can be attached to foundation 130 prior to placement of the floor system (see FIGS. 112 and 113). Level track 128 can be placed on foundation 128 and leveled utilizing conventional techniques. The level is made permanent by fastening level track 128 to foundation 130 by using fasteners 131 (nails shown, although screws or other suitable devices can be used) via fastening holes 132. Screws 133 can also be used to attach level track 128 to foundation 130 via screw holes 135. Screws 133 can also maintain the level position of level track 128 until a more permanent positioning is achieved. Alternatively or additionally mortar can be applied via mortar holes 134 to fill the space between level track 128 and the top of foundation 130.

After level track 128 has been attached and/or the mortar has sufficiently set, the flooring system can be fastened to the foundation.

In various embodiments, level track 128 includes side rails 137, which are adapted to extend over a portion of foundation 130. The width of level track 128 is the transverse distance of a top portion of level track 128 from one side rail 137 to the other. The width of level track 128 is typically slightly larger than the width of foundation 130. The width of level track 128 can be at least 3.94 inches (10 cm), in some cases at least 5.90 inches (15 cm), in other cases at least 7.87 in (20 cm) and in some instances at least 8.27 in (21 cm). Also, the width of level track 128 can be up to 15.748 in (40 cm), in some cases up to 13.78 in (35 cm), and in other cases up to 11.81 in (30 cm). The width of level track 128 can be any value or range between any of the values recited above.

The length of side rail 137 is the distance it extends from the top portion of level track 128 and is sufficient in length to allow for proper leveling of level track 128 and attachment to foundation 130 via fasteners 131 and fastening holes 132. The length of side rail 137 can be at least 1.58 inches (4 cm), in some cases at least 1.97 inches (5 cm), and in other cases at least 2.76 inches (7 cm). Also, the length of side rail 137 can be up to 7.87 in (20 cm), in some cases up to 5.90 inches (15 cm), and in other cases up to 4.72 inches (12 cm). The length of side rail 137 can be any value or range between any of the values recited above.

Figure 111:
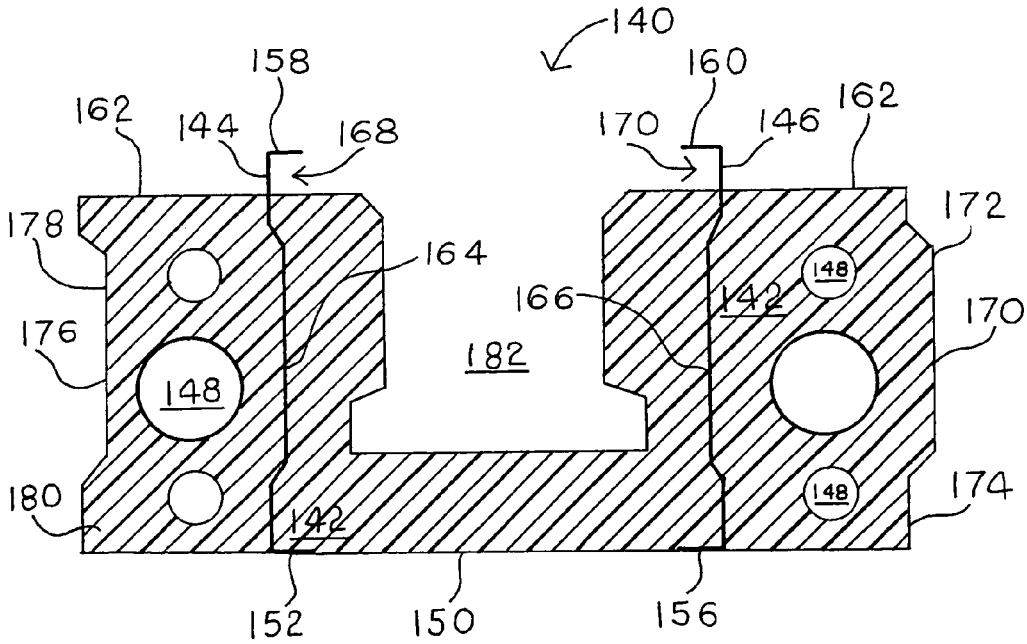
FIG. 111 is a cross-sectional view of a pre-formed building panel according to various embodiments of the present invention.

An embodiment of the invention relates to a floor or tilt up insulated panel that is adapted to act as a concrete I-beam form. As shown in FIG. 111, I-beam panel 140 includes expanded polymer form 142 (central body) and embedded metal members 144 and 146 (embedded reinforcing bars). Expanded polymer form 142 includes openings 148 that traverse all or part of the length of expanded polymer form 142. The embedded metal members 144 and 146 have embedded ends 152 and 156 respectively that are in contact with inner face 150 of expanded polymer form 142. The embedded metal members 144 and 146 also have exposed ends 158 and 160, respectively, that extend from outer face 162 of expanded polymer form 142.

Expanded polymer form 142 can have a thickness, measured as the distance from inner face 150 to outer face 162 of at least 8, in some cases at least 10, and in other cases at least 4.72 inches (12 cm) and can be up to 100, in some cases up to 75, and in other cases up to 1.97 ft (60 cm). The thickness of expanded polymer form 142 can be any distance or can range between any of the distances recited above.

Exposed ends 158 and 160 extend at least 1, in some cases at least 2, and in other cases at least 1.18 inches (3 cm) away from outer face 162 of expanded polymer form 142. Also, exposed ends 158 and 160 can extend up to 60, in some cases up to 40, and in other cases up to 7.87 in (20 cm) away from outer face 162 of expanded polymer form 142. Exposed ends 158 and 160 can extend any of the distances or can range between any of the distances recited above from outer face 100.

In an embodiment of the invention, embedded metal members 144 and 146 have a cross-sectional shape that includes embedding lengths 164 and 166, embedded ends 152 and 156, and exposed ends 158 and 160. The orientation of embedded metal members 144 and 146 is referenced by the direction of open ends 168 and 170. In an embodiment of the invention, open ends 168 and 170 are oriented toward each other. In this embodiment, I-beam panel 140 is adapted to be embedded in the concrete that is applied to outer face 162.

The spacing between each of embedded metal members 144 and 146 can be as described regarding embedded metal studs 14 and 16 in wall unit 10.

Openings 148 can have various cross-sectional shapes and similar spacing and cross-sectional area as described regarding openings 18 in expanded polymer body 12.

As shown in FIG. 111, expanded polymer panel 140 has a finite length and has a male terminal end 170 that includes forward edge 172 and trailing edge 174 and a receiving end 176 which includes recessed section 178, which is adapted to receive forward edge 172, and protruding edge 180. Typically, lengths of I-beam panels 140 are interconnected by inserting a forward edge 172 from a first I-beam panel 140 into a recessed section 178 of a second I-beam panel. In this manner, a larger roof or wall section containing any number of I-beam panels can be assembled and/or arrayed. The width of I-beam panel 140, measured as the distance from protruding edge 180 to trailing edge 174 can typically be at least 20, in some cases at least 30, and in other cases at least 13.78 in (35 cm) and can be up to 150, in some cases up to 135, and in other cases up to 4.10 ft (125 cm). The width of I-beam panel 140 can be any value or can range between any of the values recited above.

As can also be seen in FIG. 111, I-beam panel 140 includes I-beam channel 182. Various forms of the present I-beam panel are advantageous when compared to prior art systems in that the connection between adjacent panels in the prior art is provided along the thin section of expanded polymer below I-beam channel 182. The resulting thin edge of those prior panels is prone to damage and/or breakage during shipment and handling. The I-beam panel of the present invention eliminates this problem by providing a connection between adjacent panels at ends 170 and 176. Therefore, when the I-beam channel 182 is molded with concrete or the like, damage resulting from the concrete seeping through a gap created by the connection is eliminated.

In an embodiment of the invention, rebar or other concrete reinforcing rods can be placed in I-beam channel 182 in order to strengthen and reinforce a concrete I-beam formed within I-beam channel 182.

Figure 116:
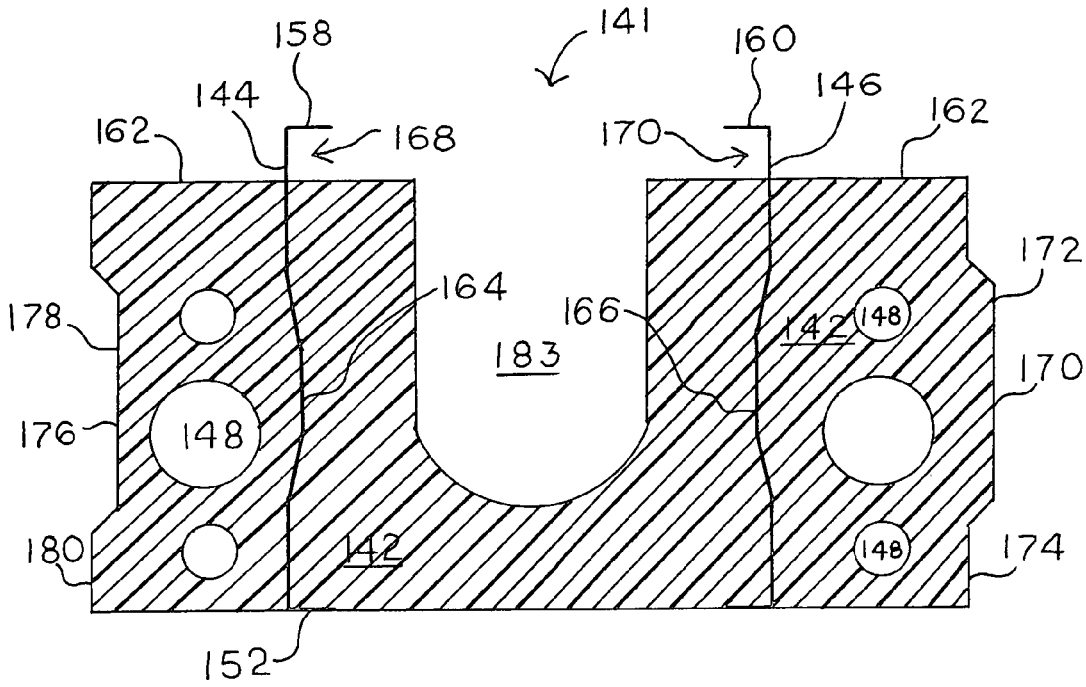
FIG. 116 is a cross-sectional view of a concrete composite pre-formed building panel system according to various embodiments of the present invention.

In another embodiment of the invention shown in FIG. 116, instead of I-beam channel 182, I-beam panel 141 includes channel 183. Channel 183 is adapted to accept ductwork or other mechanical and utility parts, devices and members.

Figure 117:
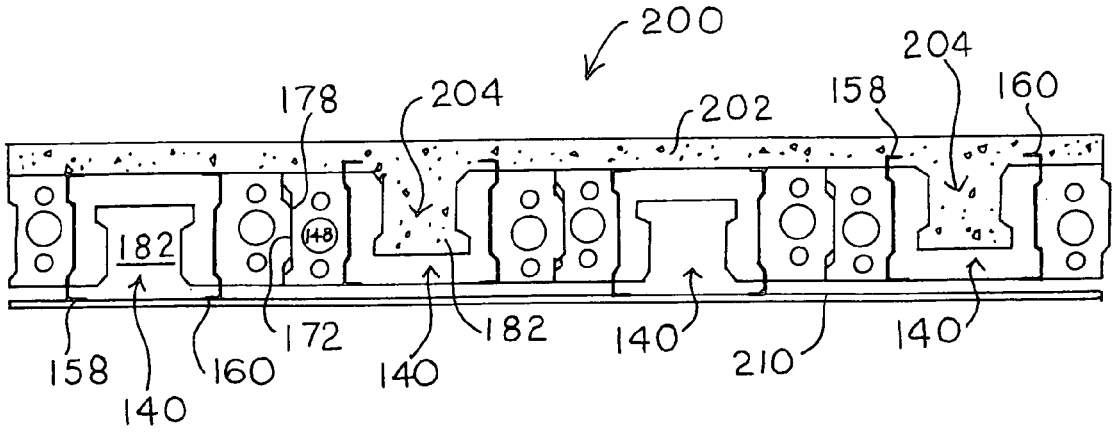
FIG. 117 is a cross-sectional view of a concrete composite pre-formed building panel system according to various embodiments of the present invention.

An example of an I-beam system 200 according to various embodiments of the present invention is shown in FIG. 117, where four I-beam panels 140 are connected by inserting a forward edge 172 from a first I-beam panel 140 into a recessed section 178 of a second I-beam panel. Concrete is poured, finished and set to form a concrete layer 202 that includes concrete I-beams 204, which are formed in I-beam channels 182. The embodiment shown in FIG. 117 is an alternating embodiment, where the direction of I-beam channel 182 of each I-beam panel 140 alternately faces toward concrete layer 202 and includes concrete I-beam 204 or faces away from concrete layer 202 and I-beam channel 182 does not contain concrete. In an embodiment of the invention, the facing away I-beam panel can be I-beam panel 141. Alternatively, every I-beam panel 140 could face concrete layer 202 and include concrete I-beam 204.

In the embodiment shown in FIG. 117, exposed ends 158 and 160 are either embedded in concrete layer 202 or are exposed. The exposed ends 158 and 160 are available as attachment points for a finish surface such as wood, rigid plastics, wood paneling, concrete panels, cement panels, drywall, sheetrock, particle board, rigid plastic panels, or any other suitable material having decorating and/or structural functions or other construction substrates 210. The attachment is typically accomplished through the use of screws or other suitable fastener arrangements.

In various embodiments of the invention, I-beam system 200 is assembled on a flat surface and a first end is lifted while a second end remains stationary resulting in orienting I-beam system 200 generally perpendicular to the flat surface. This is often referred to as "tilting a wall" in the art and in this embodiment of the invention, I-beam system 200 is referred to as a "tilt-wall."

In another embodiment of the invention, I-beam system 200 can be used as a roof on a structure.

An embodiment of the invention relates to a tilt up insulated panel that is adapted for use as a wall or ceiling panel. As shown in FIGS. 118-121, one-sided wall panel 340 includes a reinforced body 341 that includes expanded polymer form 342 (central body) and embedded metal members 344 and 346 (embedded reinforcing bars). Expanded polymer form 342 can include openings 348 and utility chases 349, which traverse all or part of the length of expanded polymer form 342. The embedded metal members 344 and 346 have embedded ends 352 and 356, respectively, that are not in contact with inner face 350 of expanded polymer form 342. The embedded metal members 344 and 346 also have exposed ends 358 and 360, respectively, that extend from outer face 362 of expanded polymer form 342.

Expanded polymer form 342 can have a thickness similar to that described regarding expanded polymer form 142. Exposed ends 358 and 360 extend at least 0.39 in (1 cm), in some cases at least 0.79 inches (2 cm), and in other cases at least 1.18 inches (3 cm) away from outer face 362 of expanded polymer form 342. Also, Exposed ends 358 and 360 can extend up to 2.36 in (60 cm), in some cases up to 15.748 in (40 cm), and in other cases up to 7.87 in (20 cm) away from outer face 362 of expanded polymer form 342. Exposed ends 358 and 360 can extend any of the distances or can range between any of the distances recited above from outer face 362.

In an embodiment of the invention, embedded metal members 344 and 346 have a cross-sectional shape that includes embedding lengths 364 and 366, embedded ends 352 and 356, and exposed ends 358 and 360. The orientation of embedded metal members 344 and 346 is referenced by the direction of embedded ends 352 and 356. In a particular embodiment of the invention, embedded ends 352 and 356 are oriented away from each other. In this embodiment, one-sided wall panel 340 is adapted so that exposed ends 358 and 360 of embedded metal members 344 and 346 are embedded in concrete 370 that is applied to outer face 362.

The spacing between each of embedded metal members 344 and 346 can be as described regarding embedded metal studs 14 and 16 in wall unit 10.

Figure 118:
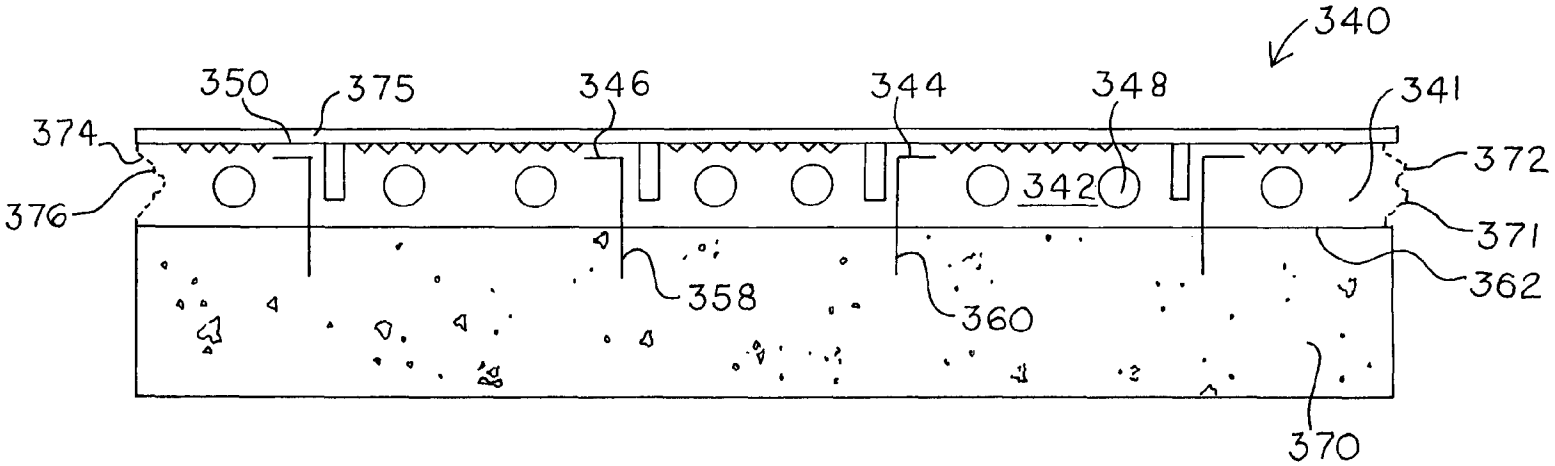
Figure 120:
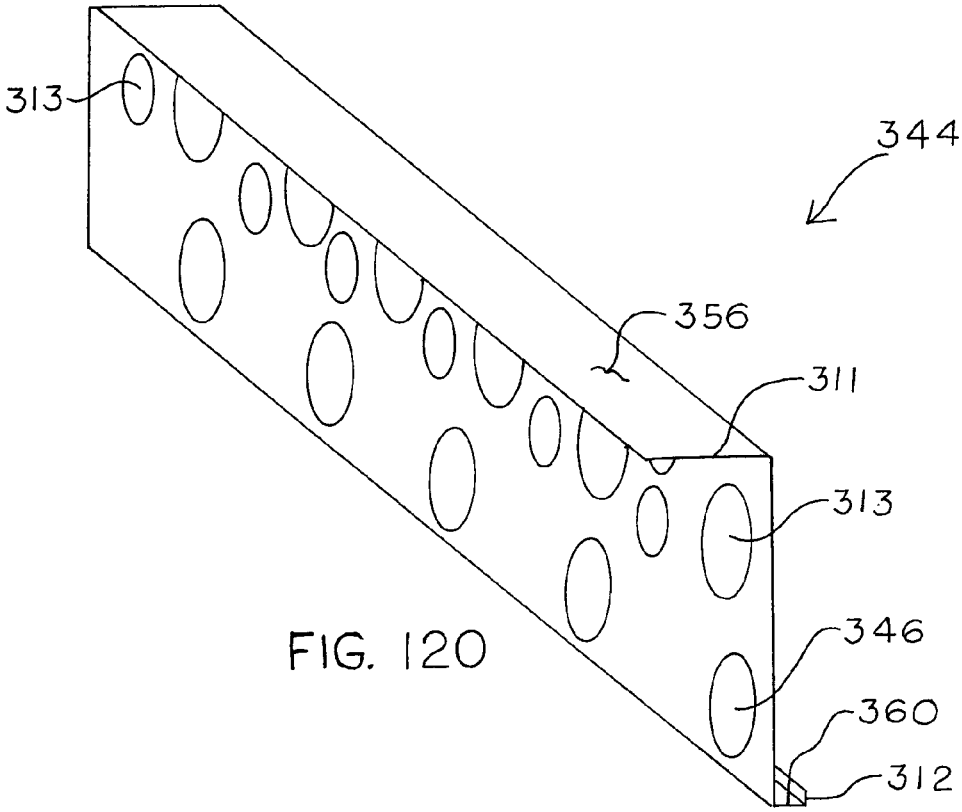
Figure 124:
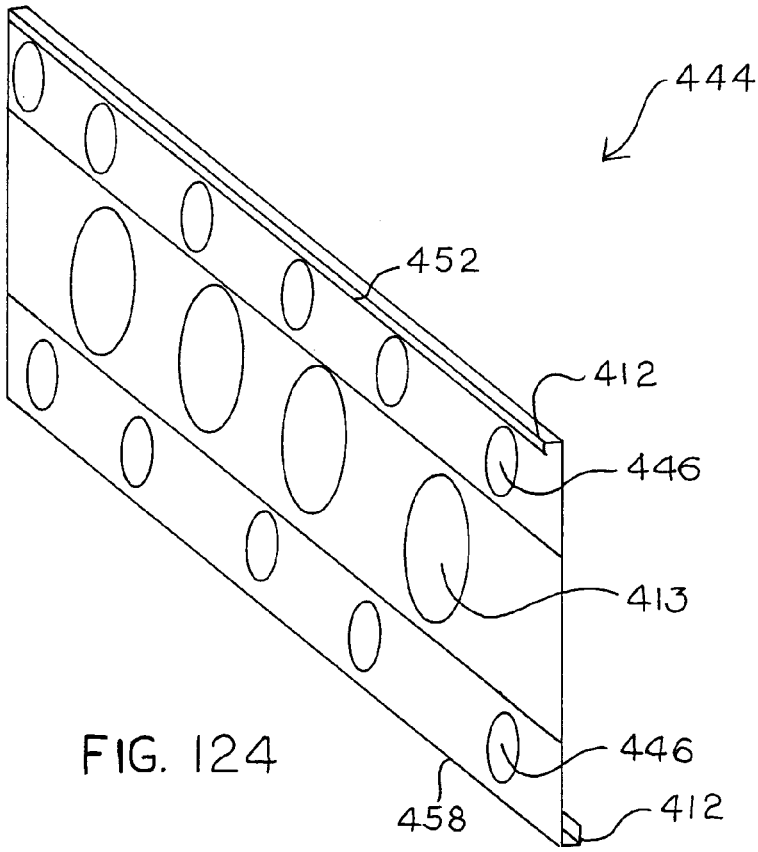

Referring now to FIGS. 118 and 120, in an embodiment of the invention, one-sided wall panel 340 includes expanded polymer body 342 (central body), embedded metal members 344 and 346 (embedded framing studs), which include flanges 311, cornered ends 312, utility holes 346 located in an exposed portion of embedded metal members 344 and 346, expansion holes 313 in an embedded portion of embedded metal members 344 and 346, and embedded ends 344 and 346, which do not touch inner face 350.

In an embodiment of the invention, inner face 350 can have a corrugated surface, which can be molded in or cut in, which enhances air flow between inner face 350 and any surface attached thereto.

With continuing reference to FIGS. 118 and 120, expansion holes 313 are useful in that as expanded polymer body 342 is molded, the polymer matrix expands through expansion holes 313 and the expanding polymer fuses. This allows the polymer matrix to encase and hold embedded metal members 344 and 346 by way of fusion in the expanding polymer. In an embodiment of the invention, expansion holes 313 can have a flanged and in many cases a rolled flange surface to provided added strength to the embedded metal members.

Openings 348 can have various cross-sectional shapes and similar spacing and cross-sectional area as described regarding openings 18 in expanded polymer body 12.

Figure 119:
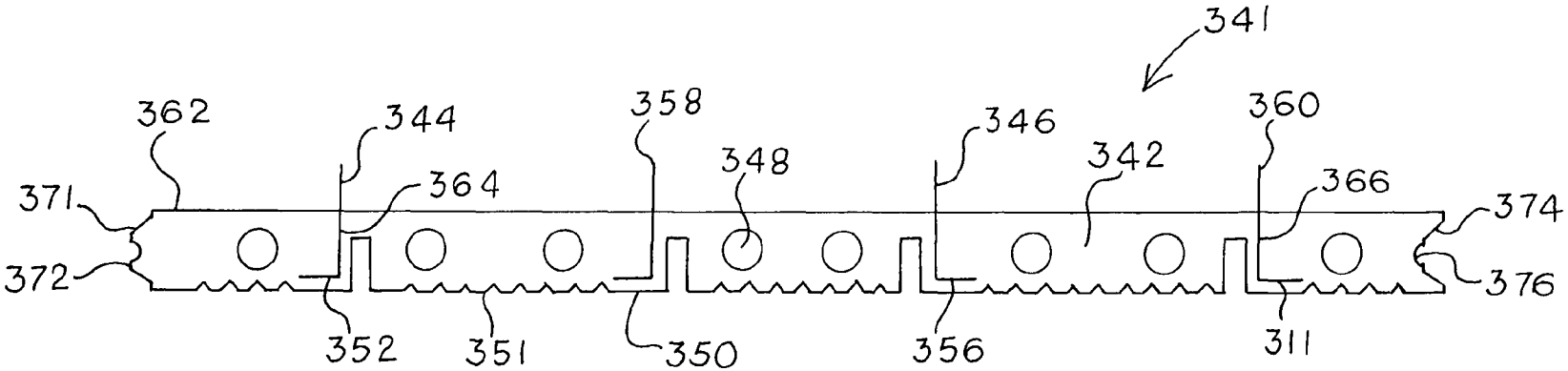
Figure 123:
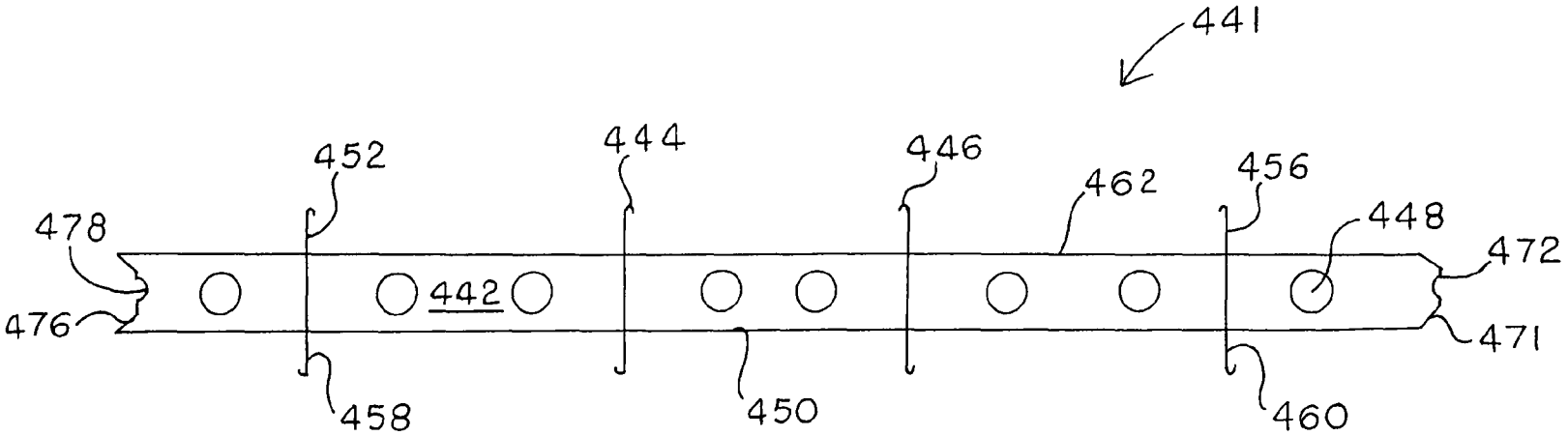

Referring now to FIGS. 118 and 119, reinforced body 341 has a finite length and has a male terminal end 371 that includes forward edge 372 and a receiving end 376 which includes recessed section 376, which is adapted to receive forward edge 372. Typically, lengths of one-sided wall panel 340 are interconnected by inserting a forward edge 372 from a first one-sided wall panel 340 into a recessed section 378 of a second one-sided wall panel. In this manner, a larger wall or ceiling section containing any number of one-sided wall panels can be assembled and/or arrayed. The width of one-sided wall panel 340, measured as the distance from protruding edge 380 to trailing edge 374 can typically be at least 20, in some cases at least 30, and in other cases at least 13.78 in (35 cm) and can be up to 150, in some cases up to 135, and in other cases up to 4.10 ft (125 cm). The width of one-sided wall panel 340 can be any value or can range between any of the values recited above.

An example of a one-sided wall panel 340 according to various embodiments of the present invention is shown in FIG. 118, where four embedded metal members 344 and 346 are used. Concrete is poured, finished and set to form a concrete layer 370 that encases exposed ends 358 and 360 of embedded metal members 344 and 346.

The embedded ends 350 and 356 of embedded metal members 344 and 346 are available as attachment points for a finish surface such as wood, rigid plastics, wood paneling, concrete panels, cement panels, drywall, sheetrock, particle board, rigid plastic panels, or any other suitable material having decorating and/or structural functions or other construction substrates sheetrock 375 as shown in FIG. 118. The attachment is typically accomplished through the use of screws or other suitable fastener arrangements.

Figure 121:
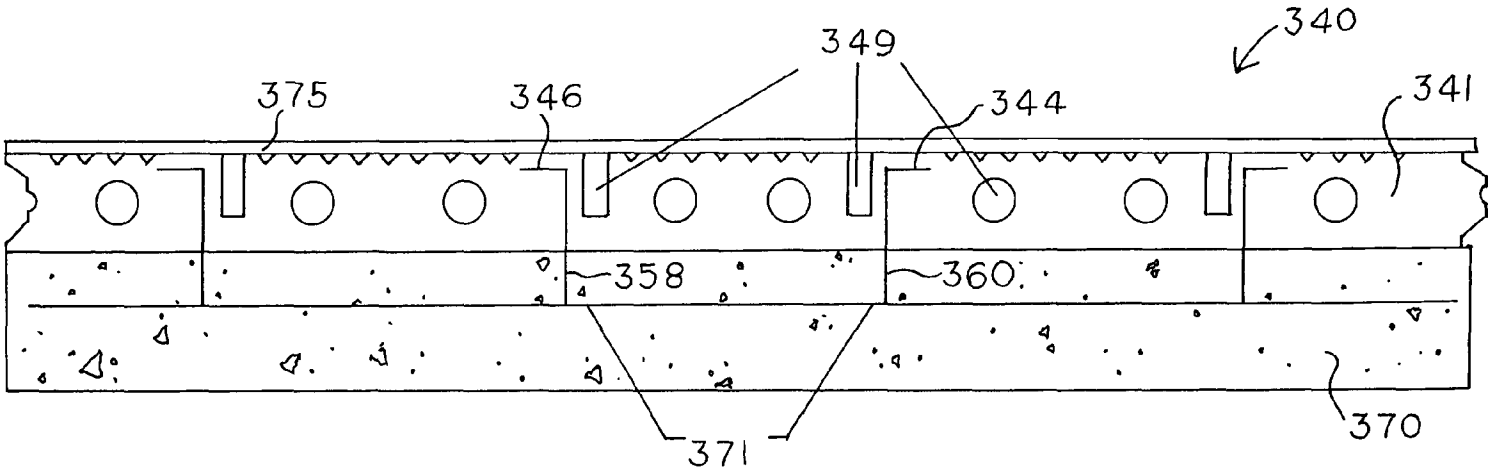

Another embodiment of the invention is shown in FIG. 121. In this embodiment, reinforcement mesh 371 is attached to exposed ends 358 and 360 of embedded metal members 344 and 346. Reinforcement mesh 371 can be made of any suitable material, non-limiting examples being fiberglass, metals such as steel, stainless steel and aluminum, plastics, synthetic fibers and combinations thereof. Desirably, after reinforcement mesh 371 is attached to exposed ends 358 and 360, concrete layer 370 is poured, finished and set so as to encase reinforcement mesh 371 and exposed ends 358 and 360. In this embodiment, reinforcement mesh 371 increases the strength of concrete layer 370 as well as increasing the strength of the attachment of concrete layer 370 to reinforced body 341.

In an embodiment of the invention, one-sided wall panel 340 is assembled on a flat surface and a first end is lifted while a second end remains stationary resulting in orienting one-sided wall panel 340 generally perpendicular to the flat surface. This is often referred to as "tilting a wall" in the art and in this embodiment of the invention, one-sided wall panel 340 is referred to as a "tilt-up wall."

An embodiment of the invention relates to another tilt up insulated panel that is adapted for use as a wall or ceiling panel. As shown in FIGS. 122-125, two-sided wall panel 440 includes a reinforced body 441 that includes expanded polymer form 442 (central body) and embedded metal members 444 and 446 (embedded reinforcing bars). Expanded polymer form 442 can include openings 448 that traverse all or part of the length of expanded polymer form 442. The embedded metal members 444 and 446 have a first exposed end 452 and second exposed end 456 respectively that extend from first face 462 of expanded polymer form 442. The embedded metal members 444 and 446 also have second exposed ends 458 and 460 respectively that extend from second face 450 of expanded polymer form 442.

Expanded polymer form 442 can have a thickness, measured as the distance from second face 450 to first face 462 similar to that described regarding expanded polymer form 142.

The exposed ends can extend at least 1, in some cases at least 2, and in other cases at least 1.18 inches (3 cm) away either face 450 or face 462 of expanded polymer form 442. Also, the exposed ends can extend up to 60, in some cases up to 40, and in other cases up to 7.87 in (20 cm) away from either face of expanded polymer form 442. The exposed ends can extend any of the distances or can range between any of the distances recited above from either face of expanded polymer form 442.

In an embodiment of the invention, exposed ends 452, 456, 458, and 460 are embedded in first concrete layer 469 and second concrete layer 470 that are applied to faces 450 and 462.

The spacing between each of embedded metal members 444 and 446 can be as described regarding embedded metal studs 14 and 16 in wall unit 10.

In an embodiment of the invention, two-sided wall panel 440 includes expanded polymer body 442 (central body), embedded metal members 444 and 446 (embedded framing studs), which cornered ends 412, utility holes 446 located in an exposed portion of embedded metal members 444 and 446, and expansion holes 413 in an embedded portion of embedded metal members 444 and 446.

Expansion holes 413 are useful in that, as expanded polymer body 442 is molded, the polymer matrix expands through expansion holes 413 and the expanding polymer fuses. This allows the polymer matrix to encase and hold embedded metal members 444 and 446 by way of fusion in the expanding polymer. In an embodiment of the invention, expansion holes 413 can have a flanged portion around their respective perimeters and in many cases a rolled flange surface to reinforce the area around the holes.

Openings 448 can have various cross-sectional shapes and similar spacing and cross-sectional area as described regarding openings 18 in expanded polymer body 12.

Reinforced body 441 has a finite length and has a male terminal end 471 that includes forward edge 472 and a receiving end 476 which includes recessed section 478, which is adapted to receive forward edge 472. Typically, lengths of two-sided wall panel 440 are interconnected by inserting a forward edge 472 from a first two-sided wall panel 440 into a recessed section 478 of a second two-sided wall panel. In this manner, a larger wall or ceiling section containing any number of two-sided wall panels can be assembled and/or arrayed. The width of one-sided wall panel 440, measured as the distance from forward edge 472 to recessed section 478 can typically be at least 20, in some cases at least 30, and in other cases at least 13.78 in (35 cm) and can be up to 150, in some cases up to 135, and in other cases up to 4.10 ft (125 cm). The width of two-sided wall panel 440 can be any value or can range between any of the values recited above.

Figure 122:
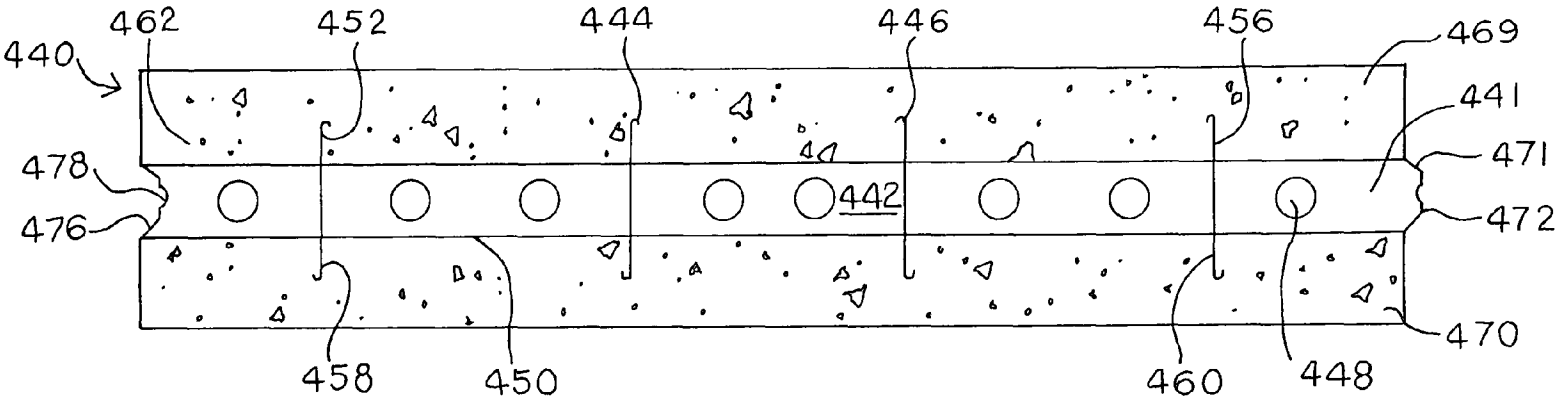

An example of a two-sided wall panel 440 according to various embodiments of the present invention is shown in FIG. 122, where four embedded metal members 444 and 446 are used. Concrete is poured, finished and set to form concrete layers 469 and 470 that encases exposed ends 452, 456, 458, and 460 of the embedded metal members.

Figure 125:
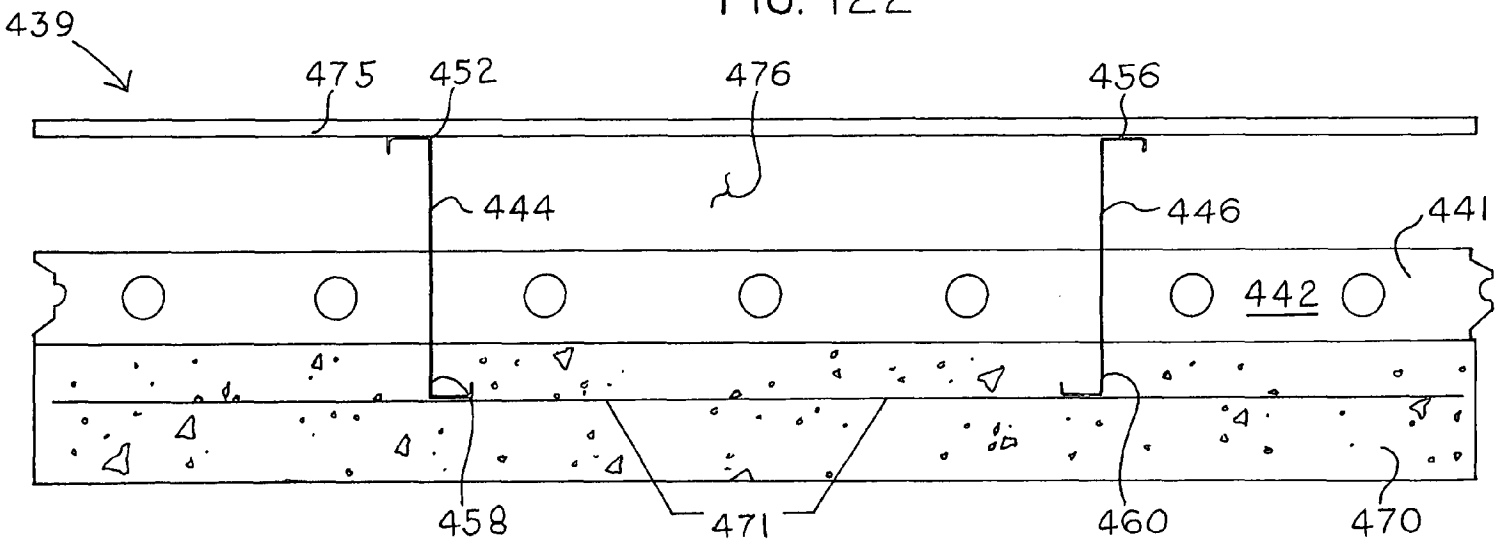

Alternatively, as shown in FIG. 125, a two-sided wall panel 439 includes variations of two-sided wall panel 440. In two-sided wall panel 439 one (or alternatively both, which is not shown) of exposed ends 452 and 456 (and alternatively also 458 and 460) are available as attachment points for a finish surface 475 such as wood, rigid plastics, wood paneling, concrete panels, cement panels, drywall, sheetrock, particle board, rigid plastic panels, or any other suitable material having decorating and/or structural functions or other construction substrates. The attachment is typically accomplished through the use of screws. However, other suitable fastener arrangements may be employed. In this embodiment, the space 476 defined by the finished surface, the exposed ends 444 and 446 and the expanded polymer body 442 can be used to run utilities, insulation and anchors for interior finishes as described above.

In this alternative embodiment, reinforcement mesh 471 is attached to exposed ends 458 and 460 of embedded metal members 444 and 446. Reinforcement mesh 471 can be made of any suitable material, non-limiting examples being fiberglass, metals such as steel, stainless steel and aluminum, plastics, synthetic fibers and combinations thereof. Desirably, after reinforcement mesh 471 is attached to exposed ends 458 and 460, concrete layer 470 is poured, finished and set so as to encase reinforcement mesh 471 and exposed ends 458 and 460. In this embodiment, reinforcement mesh 471 increases the strength of concrete layer 470 as well as increasing the strength of the attachment of concrete layer 470 to reinforced body 441.

In another embodiment of the invention, two-sided wall panel 440 is assembled on a flat surface and a first end is lifted while a second end remains stationary resulting in orienting two-sided wall panel 440 generally perpendicular to the flat surface. This is often referred to as "tilting a wall" in the art and in this embodiment of the invention, two-sided wall panel 440 is referred to as a "tilt-up wall."

In embodiments of the tilt-up walls described herein, the exposed ends of the embedded metal members can act as a chair for the proper placement of reinforcing wire mesh and/or rebar or other reinforcing rods to the center of a concrete layer, poured, finished and set to encase the exposed ends.

As used herein, the term "concrete" refers to a hard strong building material made by mixing a cementitous mixture with sufficient water to cause the cementitous mixture to set and bind the entire mass as is known in the art.

In an embodiment of the invention, the concrete can be a so called "light weight concrete" in which light weight aggregate is included with the cementitous mixture. Exemplary light weight concrete compositions that can be used in the present invention are disclosed in U.S. Pat. Nos. 3,021,291, 3,214,393, 3,257,338, 3,272,765, 5,622,556, 5,725,652, 5,580,378, and 6,851,235, JP 9 071 449, WO 98 02 397, WO 00/61519, and WO 01/66485 the relevant portions of which are incorporated herein by reference.

In an embodiment of the invention, when the exposed ends of the one-sided wall panel and the two sided wall panel are encased in concrete as described above, utility holes 346 and 446 act as sites where the set and hardened concrete fuses through the holes and thereby holds and attaches to the embedded metal members. Additionally, reinforcing rods can be placed through utility holes 346 and 446 connecting embedded metal members, thus further strengthening the formed wall panel.

The wall units, floor units, tilt up insulated panels and I-beam panels described herein contain variations that are not meant as limitations. Any of the variations discussed in one embodiment can be used in another embodiment without limitation.

In an embodiment of the invention, a lath can be attached to the exposed ends of the metal studs, metal joists or metal members of the wall units, floor units, and expanded polymer panels; i.e. construction elements, of the invention. The lath is capable of supporting a covering layer constituted by a suitable construction material. The lath can include one or more portions extending flush on opposite lateral sides of the construction element, which can be embedded in and anchored also to the concrete used for incorporating and/or joining together one or more adjacent construction elements.

The lath can support one or more covering layers and is typically a stretched metallic lath including a rhomb-shaped mesh having a length-to-height rhomb ratio of about 2:1. The rhomb length can vary between 0.79 and 2.36 in (20 and 60 mm), while the rhomb width can vary between 0.39 and 1.18 in (10 and 30 mm). The stretched metallic lath can have a thickness of from 0.0157 and 0.0591 in (0.4 and 1.5 mm) and, in some cases of from 0.0157 and 0.0394 in (0.4 and 1.0 mm). However, other configurations and sizes may be employed.

The covering layers can, for example, include one or more coating layers of plaster, stucco, cement, etc. as it is or, optionally, reinforced with fibers of a suitable material.

A particular advantage of the construction panels, wall units, floor units, and expanded polymer panels according to various embodiments of the present invention is directed to fire protection and safety. As described above, a portion of the reinforcing members in the form of embedded framing studs are exposed and can include a web of holes formed along their length. By exposing a section of the web of holes in the embedded framing studs, air flow is encouraged and in a fire situation, cooling of the web section of the embedded framing studs takes place. This can be very important to prolonging the failure time of a loaded wall section. Typically, in a fire test, an insulated metal stud will fail before a non-insulated stud in the center web area.

Locating spacer bars, as described above, in the exposed web section, the embedded framing studs act as a heat sink, helping to dissipate heat from the center web section of the embedded framing studs as well as adding to the structural properties of the wall.

The melting properties of the polymer matrix in a fire situation further facilitates the cooling of the embedded framing studs web section by melting away from the web as the temperature exceeds 200° F. (93.33° C.), allowing further air circulation and cooling of the web.

The bottom track of the wall panel, as described above, can be designed to act as a drip and containment pan in a fire event. The bottom track area is designed to contain the solids that melt when the polymer matrix burns. The bottom track is adapted to hold a volume at least equivalent to the volume of the expanded polymer matrix in the expanded polymer body in liquid or molten form. Each track section can be designed to have a holding capacity of from at least 0.2 $ft^3$ (5.66 L), in some instances at least 0.25 $ft^3$ (7.08 L), in some cases at least 0.3 $ft^3$ (8.5 L) and in other cases at least 0.4 $ft^3$ (11.33 L) and the holding capacity can be up to 0.75 $ft^3$ (21.24 L), in some cases up to 0.65 $ft^3$ (18.41 L) and in other cases up to 0.1 $ft^3$ (2.83 L) of liquid or molten material. The containment volume in the bottom track can be any value or range between any of the values recited above. The holding capacity of the bottom track is typically designed to contain the solids contained in a typical 48"×96" (1.22 m×2.44 m) construction panel.

In larger construction panels, for example those of greater height, the exterior portion of the bottom track can be slotted, allowing for the evacuation of melt materials to the exterior of the building. This design greatly diminishes the interior fire spread and improves the safety of the interior environment of the structure during initial fire spread and rescue operations.

The wall units, floor units, and expanded polymer panels of the present invention can be made using batch shape molding techniques. However, this approach can lead to inconsistencies and can be very time intensive and expensive.

In an embodiment of the invention, the wall units, floor units, and expanded polymer panels of the present invention can be made using an apparatus for molding a semi-continuous or continuous foamed plastic element that includes a) a mold including:
   i) a bottom wall, a pair of opposite side walls and a cover, and
   ii) a molding seat, having a shape mating that of the element, defined in the mold between the side walls, the bottom wall and the cover;
b) means for displacing the cover and the side walls of the mold towards and away from the bottom wall to longitudinally close and respectively open the mold; and
c) first means for positioning in an adjustable manner said cover away from and towards said bottom wall of the mold to control in an adjustable and substantially continuous manner the height of the molding seat.

The apparatus is configured to include reinforcing members which may comprise, for example, embedded framing studs, metal bars, embedded metal joists and other metal profiles which may be configured as discussed above. As a non-limiting example, the methods and apparatus disclosed in U.S. Pat. No. 5,792,481 can be adapted to make the wall units, floor units, and expanded polymer panels of the present invention. The relevant parts of U.S. Pat. No. 5,792,481 are incorporated herein by reference.

Figure 128:
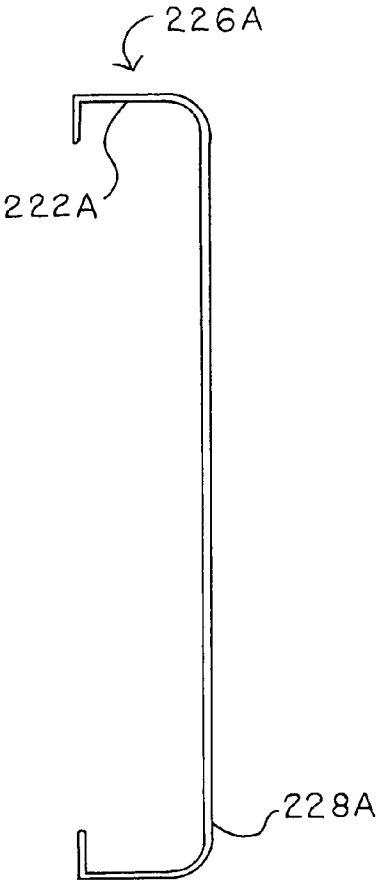
Figure 127:
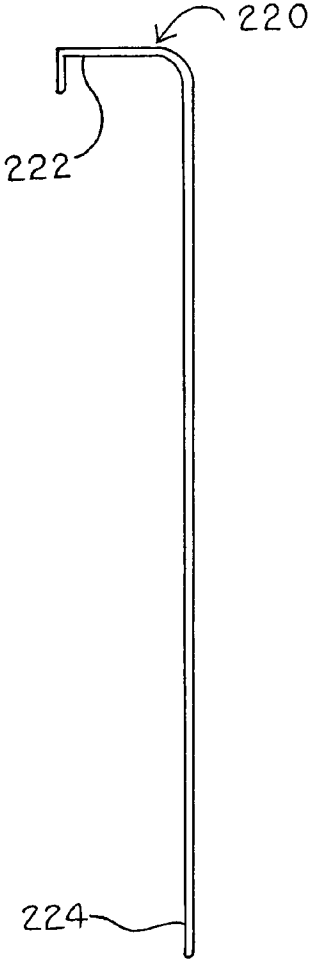

In an embodiment of the invention, the reinforcing members 220 can be molded into the wall units, floor units, and expanded polymer panels having a formed embedded end 222 and a straight exposed end 224 as shown in FIG. 127. Subsequently, the straight exposed end can be formed, worked and/or modified to provide a shaped end 228A as shown in shaped member 226A in FIG. 128 or a shaped end 228B as shown in shaped member 226B FIG. 129. Embedded ends 226A and 226B can remain unchanged from embedded end 222. Equipment and machinery for subsequently bending, working, forming or modifying the exposed end are well known in the art.

In an embodiment of the invention, the inner surface, bottom surface, or inner face of the wall units, floor units, and expanded polymer panels described above can have a grooved surface, either molded in or applied mechanically, to improve air flow through the annular space between the expanded plastic and any materials attached to the exposed ends of the metal studs, metal joists or metal members of the wall units, floor units and expanded polymer panels described above.

One aspect of various embodiments of the present invention is directed to a method of constructing a building in a first embodiment including:

providing a foundation having a series of walls having top surfaces;

positioning and securing any of the floor units or systems described above, such that the floor unit spans at least some of the top surfaces of the foundation walls to the walls;

positioning and securing any of the wall systems described above to the floor unit or system; and positioning and securing a roof system as described above to a top surface of the wall system.

Another aspect of various embodiments of the present invention provides a method of constructing a building that includes:

providing a foundation having a series of foundation walls having top surfaces;

positioning and securing the composite building panels described above, adapted for use as a floor unit, to at least some of the top surfaces of the foundation walls;

positioning and securing two or more of the composite building panels described above, adapted for use as a wall unit, to at least part of a top surface of the floor unit, wherein a bottom track and a top slip track are attached to a bottom end and a top end respectively of the composite building panels; and positioning and securing the composite building panels described above, adapted for use as a roof unit, to at least some of the top slip track of the wall units.

Still another aspect of various embodiments of the present invention is directed to a method of constructing a multi-story building that further includes:

positioning and securing the composite building panels described above, adapted for use as a second floor unit, to at least some of the top slip track of the wall units; and positioning and securing two or more of the composite building panels described above, adapted for use as a second wall unit, to at least part of a top surface of the second floor unit, wherein a bottom track and a top slip track are attached to a bottom end and a top end respectively of the composite building panels;

where the roof unit is secured to at least some of the top slip track of the second wall units.

Thus, various forms of the present invention also provide a building that contains one or more of the floor units, wall systems and roof systems described above.

The wall units, floor units and expanded polymer panels of the present invention provide a number of advantages. For example, they can eliminate the need for house wrap. The expanded polymers used in the present invention may also have at least an equivalent rating as required by local building codes for house wraps.

Also, no insulation subcontractors may be required during construction as the wall units, floor units and expanded polymer panels of the invention already include adequate insulation. The materials of construction may also effectively block low frequency sound waves resulting from exterior noise.

The acoustical properties of the construction panels, wall units, floor units and expanded polymer panels are particularly advantageous. Typically, metal studded structures have major acoustical or sound transmission problems. The metal studs will generally amplify sound through their ability to vibrate. When the metal studs are encapsulated in the polymer matrix, vibration is reduced, which results in reduced vibration and desirable acoustical and sound transmission properties. A non-limiting example of a suitable test method for determining acoustic sound insulative properties of various panels according to the present invention is ASTM E 413-04.

The panels of the present invention can have good fire resistance properties. Fire resistance of various wall assemblies according to the present invention may be evaluated according to ASTM E 119-00a.

Also, various panel embodiments of the present invention can have good strength and resistance to shear forces, such as wind resistance. Shear stiffness, shear strength and ductility of various wall assemblies according to the present invention can be evaluated according to ASTM E 2126-05. Horizontal and vertical transverse load, horizontal concentrated/point load and vertical compressive/axial load for various wall or floor assemblies of the present invention can be evaluated according to ASTM E 72-05.

The wind load resistance at the joint between two panel assemblies of various embodiments of the present invention (foam adhesion strength at the wall panel joint) can be determined according to the following method. The nominal size of each test panel is 4 ft wide by 8 ft long and consists of EPS foam with 2 embedded steel studs at 2 ft on center.

Suitable testing equipment is shown in FIGS. 131-135. Two wooden panel supports, each with the 3⅝" track and ½" dia. bolts at 16" on centers, are arranged as shown in FIGS. 131-135.

Marked concrete slabs with known weights are used to simulate uniformly distributed load on the foam. The approximate size of each slab is 1 ft by 1 ft by 3.5" thick at 110 lb/ft$^3$, a total weight of 32 lb/slab. A ¾" thick plywood panel, 1 ft wide by 7 ft long is used to support the slabs on top of the test panels, as discussed below. Pieces of 2×4 lumber are used for bracing as shown in FIGS. 131-135. A rotary laser is used for leveling.

Data on Applied Loads versus Foam deflection is determined for two testing scenarios. The two testing scenarios are scenario #1 in which the test panels have the foam side oriented as the top surface and scenario #2 in which the test panels have the steel stud side without foam oriented on the top.

The testing apparatus in assembled as shown in FIGS. 131-135. Two 4 ft×8 ft panels are placed inside the track side by side such that both panels have the foam side oriented on the top and the steel stud side without the foam facing downward. Weigh the 1 ft wide×7 ft long×¾" thick plywood panel and place it longitudinally over the length of the test panels, 6" off each panel edge. Using a rotary laser, establish the horizontal line for taking the measurements. Measure the distance between the horizontal to the top of plywood surface at the mid-span and note it as reading 1(or the baseline measurement), for unloaded wall panel joint. Place the known weights/slabs of approx. 32 lb/ft starting with two slabs (64 lb total) at the center on the plywood panel and move towards the edges of the panel at increment of two slabs/reading time. Record the exact total weight placed on the plywood and its mid-span deflection. Provide some room at mid-span panel joint for taking foam deflection measurements. Keep adding a load increment of 64 lb; measure the distance between the steel cable to the top of plywood and the total weight on the plywood panel. Repeat step #6 and 7 until foam failure. The estimated maximum load range is 250 lb to 560 lb. Record the total weight and the corresponding foam deflection for each load change.

Repeat the above steps for testing scenario #2 (FIG. 135) namely, having both wall panels oriented with steel studs without foam on top and the foam with embedded studs facing downward. The loads will be placed on the ¾" plywood on foam at the panel joint.

The ultimate strength of the panel joint is determined by foam separation or failure. In order to prevent the wall finishes (i.e. plaster) from cracking or spalling, the wall panel deflection is limited to L/240, where L is the height of the wall panel or the length of the panel in the orientation of the test. For example, when the wall panel height is 8 ft or 96 inches, the wall panel deflection is the height divided by 240, i.e., 8 ft×12 in/240 or 0.4 in.

Another potential advantage of various embodiments of the present invention is that less framing is required on a job site because of the prefabricated nature of the present wall units, floor units and expanded polymer panels.

The generally faster construction time resulting from using the present wall units, floor units and expanded polymer panels allows for earlier enclosure and protection from the elements leading to less water damage during construction. Additionally, the provided holes, openings, conduits, chases and spaces in the present wall units, floor units and expanded polymer panels results in faster wiring and plumbing and less job site scrap.

The present invention also relates to a method of doing business that allows an architectural design layout to be accessed by the apparatus for molding a semi-continuous or continuous foamed plastic element in order to customize the size, shape and dimensions of the various elements of the construction panels, wall units, floor units, and expanded polymer panels of the invention. The architectural design layout can be provided via software from a disk or via an Internet connection. For those customers with Internet capabilities, access to the present method is convenient and provides an efficient and time saving method to design and manufacture building and/or housing units.

In a non-limiting exemplary embodiment, a customer selects an architectural design for a building. The architectural design includes the unique features of each composite building panel to be used in the building. The architectural design is loaded into a processing unit that translates the design into instructions for the apparatus for molding a semi-continuous or continuous foamed plastic element. The instructions direct the apparatus to continuously or semi-continuously mold panels as described above and what customizing features to include in each panel.

The architectural design can include, as non-limiting examples the dimensions of and the location of openings and holes required in each reinforcing embedded bar as well as any indentations in each composite building panel needed to build the building; the dimensions of each composite building panel to include thickness, width, height, spacing between the reinforcing members in the form of, for example, embedded framing studs, dimensions and shape for each embedded framing studs, any channels that need to be cut into or formed in the central body of each composite building panel, any of the design features described above, any other unique features for each composite building panel, as well as gable ends accommodating any roof pitch or slope, bay window floor cuts and other design specified architectural features.

The processing unit can be any computer or device capable of reading instructions and translating them into instructions for the apparatus for molding a semi-continuous or continuous foamed plastic element.

The customizing features can include any of the architectural design features described above. As a non-limiting example, the customizing features can include forming a straight exposed end as shown in FIG. 127 to a shaped end as shown in either of FIGS. 128 and 129.

In another embodiment of the invention, an interactive computer program can be used to provide the architectural designs described above. In an embodiment of the invention, the architectural design can be inputted using a series of computer screen menus, where a user selects choices made available on a computer screen. When the design button is selected, a screen appears for additional choices for modifying the central body, the embedded framing studs, and/or the spatial relationship between the two. Selecting any of the menus directs to another screen where specific architectural design features as described above can be inputted as well as the number of panels required that have those features. Upon selection, additional customized panels can be inputted. The user then verifies the order by selecting an "order panels" button. The instructions are then relayed to the apparatus for molding a semi-continuous or continuous foamed plastic element and each of the requested number of panels having each of the architectural design features are molded and cut to the order specifications. In an embodiment of the invention, all panels are automatically labeled and marked for placement in their proper position.

In a further embodiment, the customer requests access to an interactive program that steps the customer through the design process. Once the design is complete, the customer can save the design for future use. The customer may also choose to submit the design for an order.

The use of a design program on an Internet site benefits the manufacturer in a variety of ways including a method of gathering customer profiles that can later be used for mailings, etc. In addition, an Internet site that includes this unique method of doing business reaches worldwide and generates name recognition for the manufacturer, particularly where the construction panel manufacturer is the is the only manufacturer to offer an accessible and convenient method of designing and ordering composite construction panels.

Various embodiments of the design program of the present invention provide an advantage for the user in his or her own business in that it raises the level of professionalism of the user by allowing prompt and on-the-spot service for his or her own customers. For example, a customer may bring a sketch or layout for an architectural design a composite construction panel shop requesting construction panels to use in the layout or design. In response, the panel shop owner, i.e., user, can utilize the design program to build a series of composite construction panels on a computer screen with the customer by his side, and explain to the customer the benefits of the custom composite construction panels. This process provides a first rate service to the customer, eliminates guessing, increases interaction between the panel shop and the end customer, and enhances business reputation in the field.

FIG. 130 illustrates a method of doing business 400 between a composite construction panel manufacturer 420 and a customer 414, 416 requiring the manufacture of custom composite construction panels. A composite construction panel design program is provided to a customer 414, 416 via a hard copy 418, e.g., a disk containing a copy of the program, or via electronic access, e.g., the Internet or e-mail. The composite construction panel design software is utilized by a customer on the customer's personal computer 414, 416. The customer designs one or more composite construction panels and delivers the completed design to the manufacturer 420. The design can be printed to provide a hard copy 418 to the manufacturer 420. In a particular embodiment of the present invention, the finished design is uploaded to a central computer 406 located at the manufacturer 420. In another particular embodiment, compatibility between the design program software and the software of the apparatus for molding a semi-continuous or continuous foamed plastic element 408 allows the finished design specifications to be entered into the apparatus 408 directly through a connection to the central computer. In another embodiment, the design specifications are entered manually by an apparatus operator. The design software stores and sorts the data based on particular panel design types, and identifies the most efficient sequence for making panels. Thus, the software is usable as a management tool to simplify the work of the apparatus operator, including specifying what order to make the panels and how to maneuver parts of the apparatus to change from one panel design to the next. The method of doing business as illustrated in FIG. 130 reduces the time and cost to design and manufacture custom construction panels.

Various embodiments of the invention will now be described by the following examples. The examples are intended to be illustrative only and are not intended to limit the scope of the invention.

EXAMPLE

Thermal Resistance

The thermal resistance or R-value for wall assemblies that include various wall panels according to the present invention was determined using three-dimensional computer modeling simulation. Each determination was based upon a simulated section of wall assembly 24 inches (61 cm) wide and 12 inches (30.5 cm) high. Each simulated wall assembly consisted of an outer layer of 0.50 inch (1.27 cm) thick OSB board in facing engagement with a foam section of a wall panel according to various embodiments of the present invention in which the stud was positioned in the center of the wall assembly area, as shown in FIGS. 136-140. The foam used in the computer modeling simulation was conventional rigid cellular polystyrene whose thermal insulation property met type 1 classification as per ASTM C578-04a. The simulated assembly also included an outer layer of 0.50 inch (1.27 cm) thick gypsum board positioned in facing engagement with the exposed, opposite end of the stud.

The thermal conductivity values for each of the wall assembly materials used for calculations in the computer thermal modeling simulation is set forth in Table 1 below. The average thermal conductivity of the above expanded polymer matrix or foam material was determined according to ASTM C-518-98 (Tmean=75° F. (25° C.) and temperature difference between test plates ΔT=40° F. (7° C.)) of a 12"×12"×1.5" (30.5 cm×30.5 cm×3.8 cm) using two samples of foam. Twenty (20) gauge steel was used for simulations of all steel profiles.

TABLE 1

| Wall Material | Thermal Conductivity (Btu-in/hr · ft$^2$ · ° F.) |
|---|---|
| Steel | 3.18e$^3$ |
| OSB Board | 0.80 |
| Gypsum board | 1.11 |
| Foam | 0.28 |

The above thermal conductivity values were used to calculate theoretical thermal resistance or R-value for each of five simulated wall assemblies A-E.

Referring now to FIG. 136, simulated Wall Assembly A included a wall panel according to the present invention having a C-shaped stud as discussed above with reference to FIGS. 5 and 13. Simulated Wall Assembly A consisted of the above-described foam 1900 having a thickness of 3.375 inches (8.6 cm), a C-shaped stud 1902 embedded such that the outer side of the flange 1904 of the first end 1906 of the stud 1902 was one inch (2.5 cm) from the top surface 1908 of the foam 1900 and gypsum board 1910 in facing engagement with the outer side 1912 of the flange 1914 of the second end 1916 of the stud 1902.

Referring now to FIG. 137, simulated Wall Assembly B included a wall panel according to the present invention having a CT-shaped stud as discussed above with reference to FIGS. 31-34. Simulated Wall Assembly B consisted of the above-described foam 1918 having a thickness of 4.441 inches (11.28 cm), a CT-shaped stud 1920 embedded such that the inner side 1922 of the flange 1924 of the first end 1926 of the stud 1920 was flush with the top surface 1928 of the foam 1918 and gypsum board 1930 in facing engagement with the outer side 1932 of the flange 1934 of the second end 1936 of the stud 1920.

Referring now to FIG. 138, simulated Wall Assembly C included a wall panel according to the present invention having a CT-shaped stud as discussed above with reference to FIGS. 31-34. Simulated Wall Assembly C consisted of the above-described foam 1938 having a thickness of 4.375 inches (11.11 cm), a CT-shaped stud 1940 embedded such that the inner side 1942 of the flange 1944 of the first end 1946 of the stud 1940 was 0.25 inch (0.635 cm) above the top surface 1948 of the foam 1938 and gypsum board 1950 in facing engagement with the outer side 1952 of the flange 1954 of the second end 1956 of the stud 1940.

Figure 35:
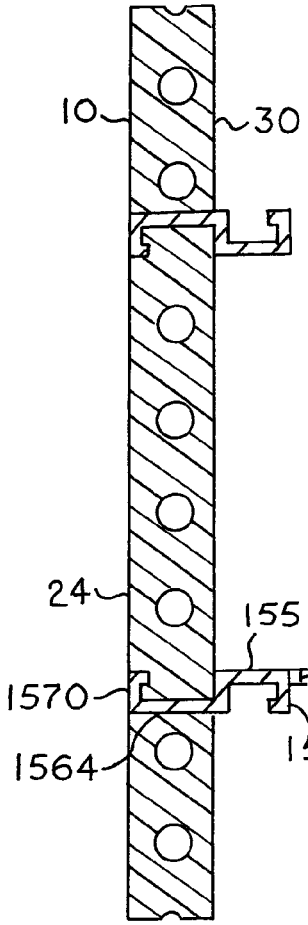
FIG. 35 is a cross-sectional view of a pre-formed building panel according to various embodiments of the present invention.

Referring now to FIG. 139, simulated Wall Assembly D included a wall panel according to the present invention having a CC-shaped stud as discussed above with reference to FIGS. 35, 39 and 40. Simulated Wall Assembly D consisted of the above-described foam 1958 having a thickness of 4.375 inches (11.11 cm), a CC-shaped stud 1960 embedded such that the outer side 1962 of the flange 1964 of the first end 1966 of the stud 1960 was flush with the top surface 1968 of the foam 1958 and gypsum board 1970 in facing engagement with the outer side 1972 of the flange 1974 of the second end 1976 of the stud 1960.

Referring now to FIG. 140, simulated Wall Assembly E included a wall panel according to the present invention having a CC-shaped stud as discussed above with reference to FIGS. 35 and 51-53. Simulated Wall Assembly D consisted of the above-described foam 1978 having a thickness of 4.375 inches (11.11 cm), a CC-shaped stud 1980 embedded such that the outer side 1982 of the flange 1984 of the first end 1986 of the stud 1980 was flush with the top surface 1988 of the foam 1978 and gypsum board 1990 in facing engagement with the outer side 1992 of the flange 1994 of the second end 1996 of the stud 1980.

Thermal modeling of the wall area directly surrounding the wall stud was performed on the above simulated wall assemblies using HEATING 7.3, a three-dimensional finite difference computer code by Oak Ridge National Laboratories. The computer modeling enabled analysis of theoretical temperature distribution in the analyzed wall systems and calculation of local heat fluxes, which were utilized to calculate face-to-face R-values for the above wall assembly configurations. The results of the computer modeling are presented in Table 2 below.

TABLE 2

| Wall Assembly | Simulated R-value (ft$^2$ · ° F. · Hr/Btu) |
|---|---|
| A | 11.97 |
| B | 13.3 |
| C | 13.56 |
| D | 14.01 |
| E | 13.97 |

As shown in Table 2, Wall Assemblies D and E had higher simulated R-values compared to Wall Assemblies A-C.

Using the above simulated R-values, the framing effect on each of simulated Wall Assemblies A-E was determined. As used herein, "framing effect" means the reduction of the nominal wall R-value caused by application of steel structural components, and is described by the following formula:

$$f_e = 1 - R_{eff}/R_{nom}$$

where: $f_e$ is framing effect;

$R_{eff}$ is effective simulated R-value of the wall assembly; and $R_{nom}$ is nominal "in-series" R-value of cavity insulation and sheathing materials.

The results of the calculations of framing effect based upon the above simulated R-values are presented in Table 3 below.

TABLE 3

| Wall Assembly | R-value of foam | $R_{nom}$ | $R_{eff}$ | Framing Effect (%) |
|---|---|---|---|---|
| A | 12.15 | 13.22 | 11.97 | 9.5 |
| B | 15.75 | 16.82 | 13.3 | 20.9 |
| C | 15.75 | 16.82 | 13.56 | 19.4 |
| D | 15.75 | 16.82 | 14.01 | 16.7 |
| E | 15.75 | 16.82 | 13.97 | 16.9 |

As shown in Table 3, Wall Assembly D had the highest simulated R-value and second lowest framing effect of Wall Assemblies A and C.

While the present invention has been described in conjunction with the specific embodiments set forth above, many alternatives, modifications and other variations thereof will be apparent to those of ordinary skill in the art. All such alternatives, modifications and variations are intended to fall within the spirit and scope of the present invention.

We claim:

1. A composite building panel comprising:

a central body, substantially parallelepipedic in shape, comprised of an expanded polymer matrix, having a first surface and an opposing second surface; and one or more reinforcing structural elements longitudinally extending across the central body having a first side portion embedded in the expanded polymer matrix, and a second side portion extending away from the first surface of the central body and one or more expansion holes located in the reinforcing structural element between the first side portion of the reinforcing structural element and the first surface of the central body;

wherein the central body comprises the polymer matrix that expands through the expansion holes; and a space defined by the first surface of the central body and the second side portion of the reinforcing structural elements is adapted for accommodating utilities through said space, and wherein the one or more reinforcing structural elements comprise a stud selected from the group consisting of: C-type stud; CT-type stud; and CC-type stud.

2. The composite building panel according to claim 1, wherein the central body has a male end and a female end.

3. The composite building panel according to claim 2, wherein the male end of the central body comprises a tongue edge and the female end of the central body comprises a female groove edge that facilitates a tongue and groove union between a first central body and a second central body to form one or more combined composite building panels.

4. The composite building panel according to claim 1, wherein the central body has a thickness measured as the distance between the first surface and the second surface of from about 0.75 inches (about 2 cm) to about 8 inches (about 20 cm).

5. The composite building panel according to claim 1, wherein the central body comprises openings extending along the length of the central body.

6. The composite building panel according to claim 5, wherein the openings have a cross-sectional shape selected from the group consisting of round, oval, elliptical, square, rectangular, triangular, hexagonal and octagonal.

7. The composite building panel according to claim 1, wherein the expanded polymer matrix comprises one or more polymers selected from the group consisting of homopolymers of vinyl aromatic monomers; copolymers of at least one vinyl aromatic monomer with one or more of divinylbenzene, conjugated dienes, alkyl methacrylates, alkyl acrylates, acrylonitrile, and/or maleic anhydride; polyolefins; polycarbonates; and combinations thereof.

8. The composite building panel according to claim 1, wherein the polymer matrix comprises carbon black, graphite or a combination thereof.

9. The composite building panel according to claim 1, wherein the reinforcing structural elements comprise a material selected from the group consisting of construction grade plastics, composite materials, ceramics, and the like.

10. The composite building panel according to claim 1, wherein the polymer matrix comprises an interpolymer of a polyolefin and in situ polymerized vinyl aromatic monomers.

11. The composite building panel according to claim 1, wherein the reinforcing structural elements comprise a metal selected from the group consisting of aluminum, steel, stainless steel, tungsten, molybdenum, iron and alloys and combinations of such metals.

12. The composite building panel according to claim 1, wherein one or more surfaces of the reinforcing structural elements have a texturized surface.

13. The composite building panel according to claim 1, wherein the embedded first side portion of the reinforcing structural elements extends through the first surface and second surface of the central body.

14. The composite building panel according to claim 1, wherein the reinforcing structural elements further comprise one or more utility holes located in the reinforcing structural element between the first surface of the central body and the second side portion of the reinforcing structural element and are adapted to receive utility lines in a transverse direction relative to the reinforcing structural elements.

15. The composite building panel according to claim 1, wherein the utilities are one or more selected from the group consisting of water lines, waste lines, chases, telephone lines, cable television lines, antenna lines, electrical lines, ductwork, and gas lines.

16. The composite building panel according to claim 1, wherein the expansion holes have a cross-sectional shape selected from the group consisting of round, oval, elliptical, square, rectangular, rounded rectangular, triangular, hexagonal, parallelogram, oblong, octagonal and combinations thereof.

17. The composite building panel according to claim 1, wherein said reinforcing structural elements comprise metal studs.

18. The composite building panel according to claim 1 further comprising a bottom track, having a bottom and sides, adapted to receive a bottom portion of the composite building panel.

19. The composite building panel according to claim 3, wherein a bottom track and a top track are attached to a bottom end and a top end respectively of the combined composite building panels.

20. The composite building panel according to claim 19, wherein said top track is configured to facilitate movement of said combined composite building panels relative thereto when said combined composite building panels are attached to said top track.

21. The composite building panel according to claim 19, wherein the bottom track has a holding capacity of from 0.2 to 1 $ft^3$.

22. The composite building panel according to claim 1 made by continuously or semi-continuously molding a foamed plastic central body with two or more reinforcing structural elements partially embedded therein.

23. A method of constructing a building comprising:

providing a foundation having a series of foundation walls having top surfaces;

supporting a plurality of composite building panels, each of the composite building panels according to claim 1, adapted for use as a floor unit, on at least some of the top surfaces of the foundation walls;

positioning and securing two or more of the plurality of composite building panels according to claim 1, adapted for use as a wall unit, to at least part of a top surface of the floor unit, wherein a bottom track and a top track are attached to a bottom end and a top end, respectively, of each of the composite building panels; and positioning and securing the composite building panels according to claim 1, adapted for use as a roof unit, to at least some of the top tracks of the wall units.

24. A building constructed according to the method of claim 23.

25. A building comprising one or more of the composite building panels according to claim 1.

* * * * *